US005425344A

United States Patent [19]

Otsuka et al.

[11] Patent Number: 5,425,344

[45] Date of Patent: Jun. 20, 1995

[54] DIAGNOSTIC APPARATUS FOR EVAPORATIVE FUEL PURGE SYSTEM

[75] Inventors: Takayuki Otsuka, Susono; Tatsumasa Sugiyama, Kariya; Katsuhiko Teraoka, Aichi, all of Japan

[73] Assignee: Toyota Jidosha Kabushiki Kaisha, Toyota, Japan

[21] Appl. No.: 6,902

[22] Filed: Jan. 21, 1993

[30] Foreign Application Priority Data

| | | | |
|---|---|---|---|
| Jan. 21, 1992 | [JP] | Japan | 4-008695 |
| Feb. 10, 1992 | [JP] | Japan | 4-023953 |
| Mar. 16, 1992 | [JP] | Japan | 4-058391 |
| May 1, 1992 | [JP] | Japan | 4-112679 |
| May 21, 1992 | [JP] | Japan | 4-129076 |
| Jun. 26, 1992 | [JP] | Japan | 4-169459 |
| Jul. 15, 1992 | [JP] | Japan | 4-188389 |
| Aug. 11, 1992 | [JP] | Japan | 4-214383 |
| Oct. 6, 1992 | [JP] | Japan | 4-267698 |
| Oct. 6, 1992 | [JP] | Japan | 4-267699 |
| Nov. 5, 1992 | [JP] | Japan | 4-296051 |
| Nov. 5, 1992 | [JP] | Japan | 4-296180 |
| Nov. 18, 1992 | [JP] | Japan | 4-308908 |

[51] Int. Cl.[6] ..... F02M 25/08

[52] U.S. Cl. ..... 123/520; 123/198 D

[58] Field of Search ..... 123/516, 518, 519, 520, 123/198 D

[56] References Cited

U.S. PATENT DOCUMENTS

| | | | |
|---|---|---|---|
| 4,949,695 | 8/1990 | Uranishi et al. | 123/520 |
| 5,085,197 | 2/1992 | Mader et al. | 123/520 |
| 5,146,902 | 9/1992 | Cook et al. | 123/520 |
| 5,158,054 | 10/1992 | Otsuka | 123/520 |
| 5,184,591 | 2/1993 | Sausner et al. | 123/520 |
| 5,191,870 | 3/1993 | Cook | 123/520 |
| 5,193,512 | 3/1993 | Steinbrenner et al. | 123/520 |
| 5,195,498 | 3/1993 | Siebler et al. | 123/520 |
| 5,205,263 | 4/1993 | Blumenstock et al. | 123/520 |
| 5,220,896 | 6/1993 | Blumenstock et al. | 123/520 |
| 5,230,319 | 7/1993 | Otsuka et al. | 123/520 |
| 5,245,973 | 9/1993 | Otsuka et al. | 123/518 |
| 5,261,379 | 11/1993 | Lipinski et al. | 123/520 |
| 5,263,462 | 11/1993 | Reddy | 123/520 |
| 5,269,277 | 12/1993 | Kuroda et al. | 123/198 D |

FOREIGN PATENT DOCUMENTS

| | | |
|---|---|---|
| 2102360 | 4/1990 | Japan . |
| 2130255 | 5/1990 | Japan . |
| 3-17169 | 2/1991 | Japan . |
| 326862 | 2/1991 | Japan . |
| 3249364 | 2/1991 | Japan . |
| 4503844 | 7/1992 | Japan . |
| WO9116216 | 10/1991 | . |
| WO9112426 | 8/1992 | . |

OTHER PUBLICATIONS

Ser. No. 895102 filed Jun. 8, 1992 (Copending application).

Ser. No. 774589 filed Oct. 10, 1991 (Copending application).

Ser. No. 777757 filed Oct. 10, 1991 (copending application).

Ser. No. 867148 filed Apr. 10, 1992 (copending application).

*Primary Examiner*—E. Rollins Cross
*Assistant Examiner*—Thomas N. Moulis
*Attorney, Agent, or Firm*—Kenyon & Kenyon

[57] ABSTRACT

In a diagnostic apparatus for an evaporative fuel purge system having a canister receiving fuel from a fuel tank via a vapor passage, the fuel being supplied to an intake air passage of an internal combustion engine via a purge passage from the canister, a pressure detecting unit detects a pressure in the evaporative fuel purge system. A decision making unit determines whether or not a failure has occurred in the evaporative fuel purge system on the basis of a relationship between the pressure detected by the pressure detecting unit and a decision value. A correction unit corrects the relationship on the basis of a value of a parameter having an influence on the pressure detected by the pressure detecting unit.

11 Claims, 103 Drawing Sheets

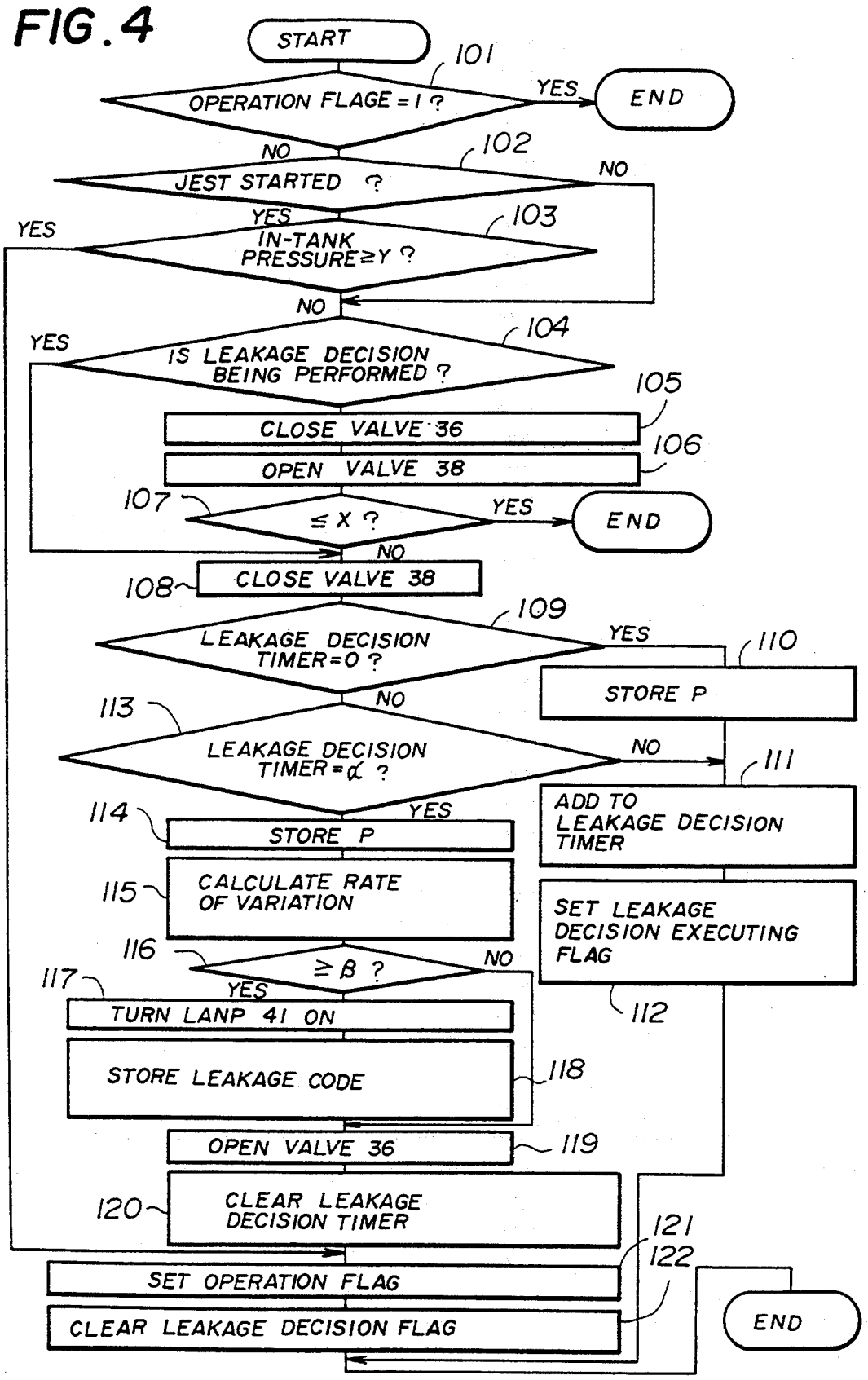
FIG. 4
START
101
OPERATION FLAGE = 1 ?
YES
END
NO
102
JEST STARTED ?
NO
YES
103
YES
IN-TANK PRESSURE ≥ Y ?
NO
104
YES
IS LEAKAGE DECISION BEING PERFORMED ?
105
CLOSE VALVE 36
106
OPEN VALVE 38
107
≤ X ?
YES
END
NO
108
CLOSE VALVE 38
109
LEAKAGE DECISION TIMER = 0 ?
YES
110
STORE P
NO
113
LEAKAGE DECISION TIMER = α ?
NO
111
ADD TO LEAKAGE DECISION TIMER
114
YES
STORE P
115
CALCULATE RATE OF VARIATION
SET LEAKAGE DECISION EXECUTING FLAG
116
≥ β ?
NO
117
YES
TURN LANP 41 ON
112
STORE LEAKAGE CODE
118
OPEN VALVE 36
119
120
CLEAR LEAKAGE DECISION TIMER
121
122
SET OPERATION FLAG
CLEAR LEAKAGE DECISION FLAG
END

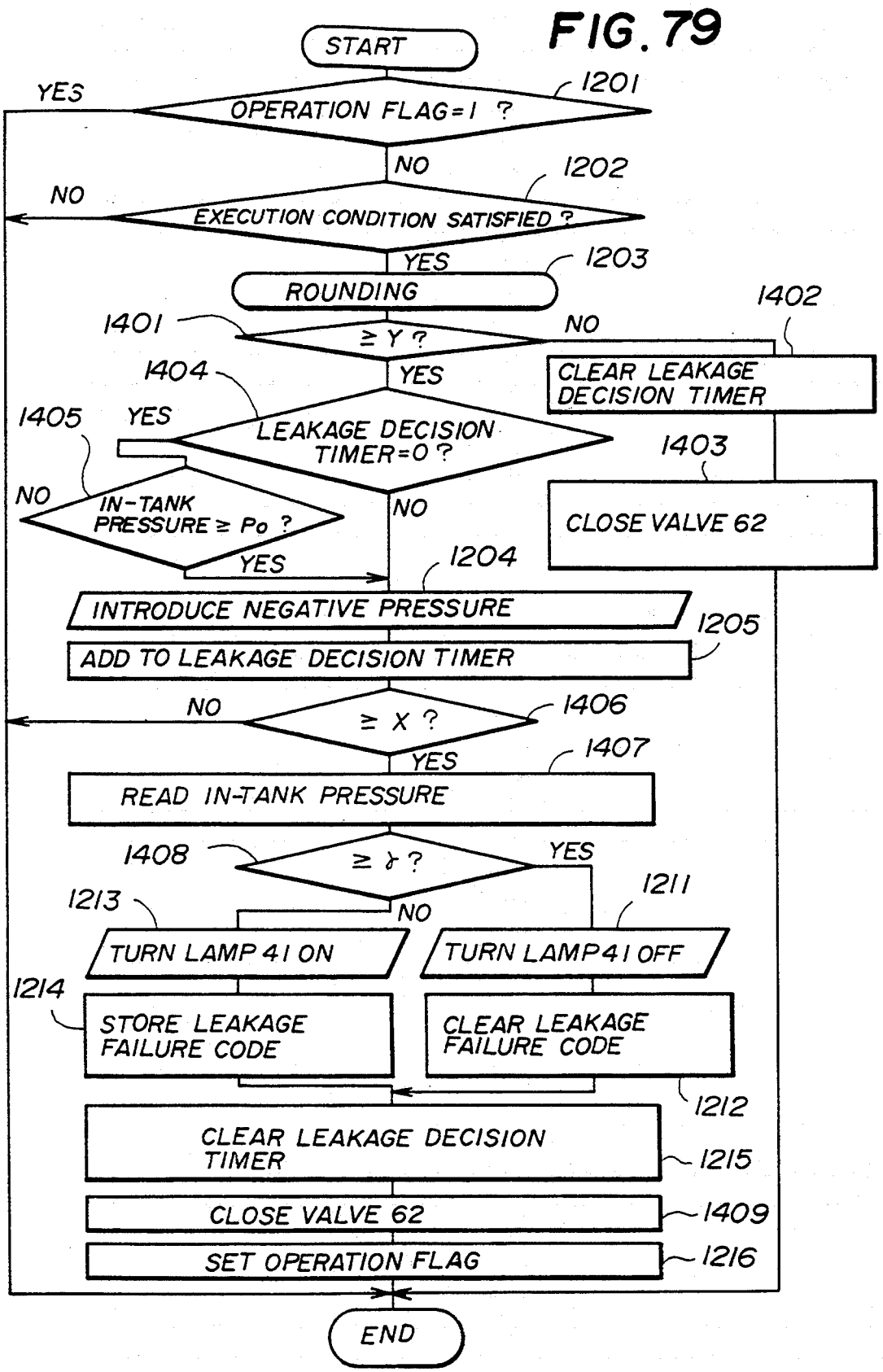
FIG. 79
START
OPERATION FLAG=1 ?
1201
YES
NO
EXECUTION CONDITION SATISFIED ?
1202
NO
YES
ROUNDING
1203
≥ Y ?
1401
NO
YES
CLEAR LEAKAGE DECISION TIMER
1402
LEAKAGE DECISION TIMER=0 ?
1404
YES
NO
IN-TANK PRESSURE ≥ Po ?
1405
YES
NO
CLOSE VALVE 62
1403
INTRODUCE NEGATIVE PRESSURE
1204
ADD TO LEAKAGE DECISION TIMER
1205
≥ X ?
1406
NO
YES
READ IN-TANK PRESSURE
1407
≥ γ ?
1408
YES
NO
TURN LAMP 41 ON
1213
TURN LAMP 41 OFF
1211
STORE LEAKAGE FAILURE CODE
1214
CLEAR LEAKAGE FAILURE CODE
1212
CLEAR LEAKAGE DECISION TIMER
1215
CLOSE VALVE 62
1409
SET OPERATION FLAG
1216
END

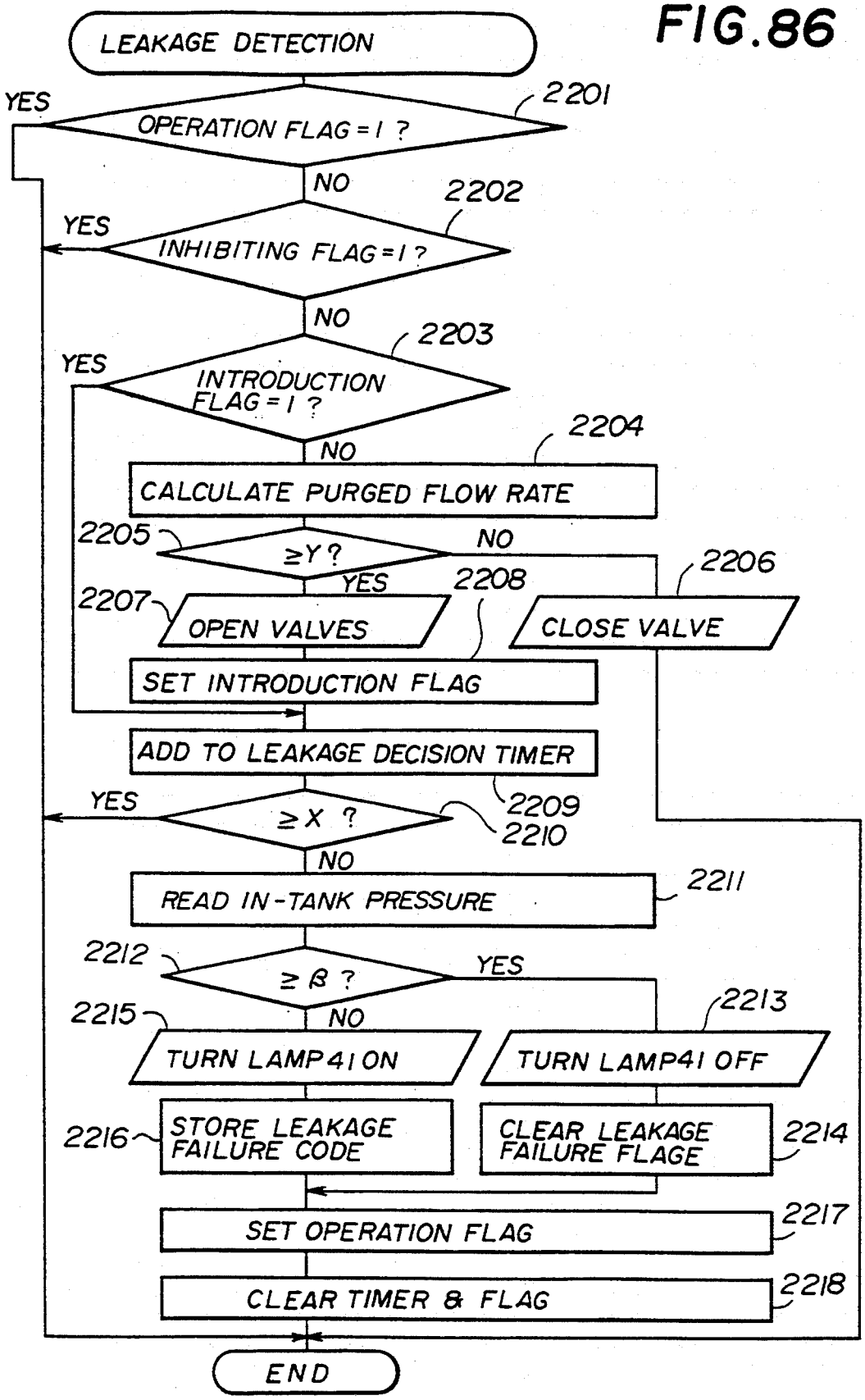
FIG.86
LEAKAGE DETECTION
OPERATION FLAG = 1 ?
2201
YES
NO
INHIBITING FLAG = 1 ?
2202
YES
NO
INTRODUCTION FLAG = 1 ?
2203
YES
NO
CALCULATE PURGED FLOW RATE
2204
≥Y ?
2205
NO
YES
OPEN VALVES
2207
2208
CLOSE VALVE
2206
SET INTRODUCTION FLAG
ADD TO LEAKAGE DECISION TIMER
≥X ?
2209
2210
YES
NO
READ IN-TANK PRESSURE
2211
≥β ?
2212
YES
NO
TURN LAMP41 ON
2215
TURN LAMP41 OFF
2213
STORE LEAKAGE FAILURE CODE
2216
CLEAR LEAKAGE FAILURE FLAGE
2214
SET OPERATION FLAG
2217
CLEAR TIMER & FLAG
2218
END

DIAGNOSTIC APPARATUS FOR EVAPORATIVE FUEL PURGE SYSTEM

BACKGROUND OF THE INVENTION

1. Field of the Invention

The present invention generally relates to a diagnostic apparatus for detecting a failure in an evaporative fuel purge system, and more particularly to a diagnostic apparatus for an evaporative fuel purge system in which an evaporative fuel from a fuel tank is made to adhere to an absorbent in a canister in an internal combustion engine and fuel is fed to an intake passage of the engine.

2. Description of the Prior Art

Normally, internal combustion engines are equipped with evaporative fuel purge systems which prevent fuel vapor evaporated in a fuel tank from being emitted into the atmosphere. Structural elements of the fuel feeding system are hermetically sealed. The fuel vapor is made to adhere to an absorbent in a canister. Then, the fuel in the canister is sucked in an intake air passage of the internal combustion engine while the engine is operating. If a failure in the evaporative fuel purge system has occurred, fuel vapor may be emitted into the atmosphere. Hence, it is necessary to detect a failure in the evaporative fuel purge systems.

U.S. patent application Ser. No. 895,102 filed on Jun. 8, 1992, assigned to the common assignee of the present application, has proposed an apparatus for detecting a failure in the evaporative fuel purge system having first and second control valves. The first control valve, which is provided in a purge passage connecting the canister and the intake passage of the internal combustion ,engine, functions to connect the canister and the intake passage to each other and disconnect them from each other. In order to determine whether or not a failure in the evaporative fuel purge system has occurred, the second control valve is closed, and then the first control valve is closed after the system reaches a predetermined negative pressure. Then, the evaporative fuel control system is maintained in the closed state for a predetermined period, and variation in the pressure in the closed system is monitored during the period. Then, it is determined whether or nor a failure in the evaporative fuel purge system has occurred on the basis of the monitored variation.

Other types of evaporative fuel purge systems have been proposed in U.S. patent application Ser. No. 777,757 filed on Oct. 10, 1991, assigned to the common assignee of the present application.

However, conventional diagnostic apparatuses for the evaporative fuel purge systems do not consider anything which has an influence on the pressure in the purge system. Hence, an erroneous diagnosis decision may be made.

SUMMARY OF THE INVENTION

An object of the present invention is to provide a diagnostic apparatus for an evaporative fuel purge system in which a diagnosis decision can be made more accurately.

A specific object of the present invention is to provide a diagnostic apparatus for an evaporative fuel purge system in which a diagnosis decision is made taking into account a parameter having an influence upon the pressure in the system in order to make a diagnosis decision more accurately.

The above objects of the present invention are achieved by a diagnostic apparatus for an evaporative fuel purge system having a canister receiving fuel from a fuel tank via a vapor passage, the fuel being supplied to an intake air passage of an internal combustion engine via a purge passage from the canister, the diagnostic apparatus comprising: pressure detecting means for detecting a pressure in the evaporative fuel purge system; decision making means, coupled to the pressure detecting means, for determining whether or not a failure has occurred in the evaporative fuel purge system on the basis of a relationship between the pressure detected by the pressure detecting means and a decision value; and correction means, coupled to the decision making means, for correcting the relationship on the basis of a value of a parameter having an influence on the pressure detected by the pressure detecting means.

The above objects of the present invention are also achieved by a diagnostic apparatus for an evaporative fuel purge system having a canister receiving fuel from a fuel tank via a vapor passage, the fuel being supplied to an intake air passage of an internal combustion engine via a purge passage from the canister, the diagnostic apparatus comprising: pressure detecting means for detecting a pressure in the evaporative fuel purge system; decision making means, coupled to the pressure detecting means, for determining whether or not a failure has occurred in the evaporative fuel purge system on the basis of a relationship between the pressure detected by the pressure detecting means and a decision value; and control means, coupled to the decision making means, for inhibiting the decision making means from performing a decision making operation when a parameter having an influence on the pressure detected by the pressure detecting means has a predetermined threshold value.

The above objects of the present invention are also achieved by a diagnostic apparatus for an evaporative fuel purge system having a canister receiving fuel from a fuel tank via a vapor passage, the fuel being supplied to an intake air passage of an internal combustion engine via a purge passage from the canister, the diagnostic apparatus comprising: pressure detecting means for detecting a pressure in the evaporative fuel purge system; decision making means, coupled to the pressure detecting means, for determining, when a predetermined diagnosing period has elapsed from a predetermined time, whether or not a failure has occurred in the evaporative fuel purge system on the basis of a relationship between the pressure detected by the pressure detecting means and a decision value; and correction means, coupled to the decision making means, for correcting the predetermined diagnosing period on the basis of a value of a parameter having an influence on the pressure detected by the pressure detecting means.

BRIEF DESCRIPTION OF THE DRAWINGS

Other objects, features and advantages of the present invention will become apparent from the following detailed description when read in conjunction with the accompanying drawings, in which:

FIG. 4 is a flowchart of the operation of the first embodiment of the present invention;

FIG. 38 is a diagram of the system structure of the fifth embodiment of the present invention;

FIG. 79 is a flowchart of a second variation of the operation shown in FIG. 75;

FIGS. 85 and 86 are flowcharts of the operation of the eighth embodiment of the present invention;

FIG. 1 shows an overview of a first embodiment of the present invention. An evaporative fuel purge system shown in FIG. 1 comprises a fuel vapor passage M1, a canister M2, and a purge passage M3. The fuel vapor passage M1 is connected between a fuel tank M10 and the canister M2, and the purge passage M3 is connected between the canister M2 and an intake passage M4 connected to an internal combustion engine M9. A diagnostic apparatus for detecting a failure in the above evaporative fuel purge system according to the first embodiment of the present invention comprises a pressure introducing unit M5, a pressure detecting unit M6, a fuel vapor quantity detecting unit M7, and a decision making unit M8.

The pressure introducing unit M5 introduces a negative pressure in the intake passage M4 into the evaporative fuel purge system between the purge passage M3 and the fuel tank M10. The pressure detecting unit M6 detects the magnitude of the pressure in the evaporative fuel purge system. The fuel vapor quantity detecting unit M7 detects the quantity of fuel vapor in the fuel tank M10. The decision making unit M8 introduces the negative pressure in the intake passage M4 into the evaporative fuel purge system when the detected quantity of fuel vapor is less than a predetermined quantity, and measures the degree of variation in the pressure in the evaporative fuel purge system on the basis of the magnitude of the negative pressure detected by the pressure detecting unit M6. Then, the decision making unit M8 compares the degree of variation and a leakage decision value, and determines, on the basis of the comparison results, whether or not a failure in the evaporative fuel purge system has occurred. Hence, the decision making is not carried out when the quantity of the fuel vapor in the tank M10 is equal to or greater than the decision making value.

If the decision making is performed in the state in which the quantity of the fuel vapor in the, tank M10 is equal to or greater than the decision making value, the pressure in the system will vary in response to introduction of the negative pressure in the intake passage M4 into the system in a manner similar to the case where the pressure in the system varies due to leakage of fuel from the system. This is due to the fact that, when the negative pressure in the intake passage M4 is introduced into the evaporative fuel purge system, the pressure in the fuel tank M10 changes toward the atmospheric pressure. Hence, the variation in the pressure in response to introduction of the negative pressure is not distinguishable from the variation therein due to leakage of fuel.

Figure 2:
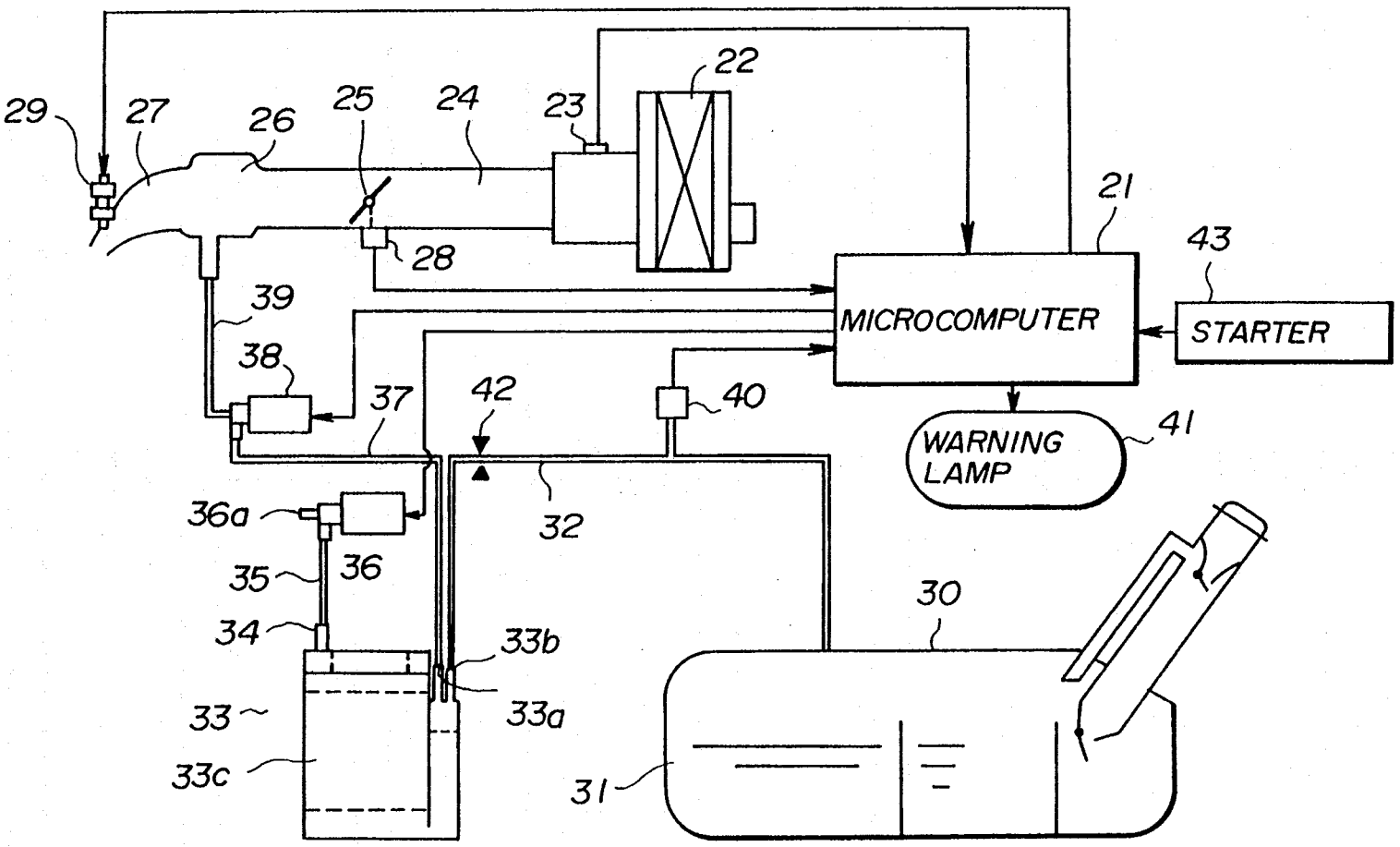
FIG. 2 is a diagram of a system structure of the first embodiment of the present invention.

FIG. 2 shows the system structure of the first embodiment of the present invention. Air is applied to an air cleaner 22, which eliminates dust or the like from the air. An air flow meter 23 measures the quantity of intake air. A throttle valve 25 provided in an intake pipe 24 controls the quantity of air flowing in the intake pipe 24. Then, the air passes through a surge tank 26 and an intake manifold 27, and enters into a combustion chamber. The intake pipe 24, the surge tank 26 and the intake manifold 27

The throttle valve 25 cooperates with an accelerator pedal (not shown), and the opening angle, of the throttle value 25 is controlled in response to the manipulation of the accelerator pedal. A fuel injection valve 29 is provided for each cylinder so that the fuel injection valve 29 partially projects inside the intake manifold 27. The fuel injection valve 29 injects fuel from a fuel tank 30 into the flow of air in the intake manifold 27 during a period of time specified by a microcomputer 21.

The fuel tank 30, which corresponds to the, fuel tank 10, accommodates fuel 31. Fuel vapor occurring in the fuel tank 30 is fed to a canister (corresponding to the canister M2 shown in FIG. 1) via a vapor input port 33*a* of a vapor passage 32 (corresponding to the vapor passage 11). The canister 33 is filled with an absorbent 33*c*, such as active carbon, and has an atmosphere aperture 34. This atmosphere aperture 34 is connected to a canister atmosphere aperture vacuum switching valve (VSV) 36 via an atmosphere passage 35. The valve 36 connects an atmosphere intake inlet 36*a* and the atmosphere passage 35 to each other and disconnects them from each other in response to a control signal generated by the microcomputer 21. The valve 36 corresponds to the second control valve 16 shown in FIG. 1.

The canister 33 is connected to a purge control value (a vacuum switching valve) 38 via a purge port 33*b* of a purge passage 37. The purge control valve 38 connects one end of a purge passage 39 having the other end connected to the surge tank 26 and the purge passage 37 to each other and disconnects them from each other in response to a control signal generated by the microcomputer 21. The purge control valve 38 corresponds to the first control valve 15.

A pressure sensor 40 is in the halfway of the vapor passage 32, and detects the pressure in the vapor passage 32. The pressure in the vapor passage 32 substantially corresponds to the pressure in the fuel tank 30. A warning lamp 41 is provided to inform the driver of the occurrence of abnormality detected by the microcomputer 21.

Fuel vapor occurring in the fuel tank 30 moves in the vapor passage 32 and adheres to the active carbon 33*c*, in the canister 33, so that emission of the fuel vapor into the atmosphere can be prevented. Normally, the vacuum switching valve 36 is kept open. While the evaporative fuel purge system is operating, the purge control valve 38 is also kept open. The atmosphere is introduced, due to the function of a negative pressure in the intake manifold 27 exerted while the engine is operating, into the canister 33 via the atmosphere introducing inlet 36*a*, the valve 36, the atmosphere passage 35 and the atmosphere aperture 34.

In response to the introduction of the atmosphere, the fuel adhering to the active carbon 33*c*, is removed therefrom, and is sucked in the surge tank 26 via the purge passage 37, the purge control valve 38 and the purge passage 39. The active carbon 33*c*, is refreshed by the removing of the fuel vapor.

The vapor passage 32 has an orifice (narrow portion) 42. The orifice 42 of the vapor passage 32 functions to keep the pressure in the vapor passage 32 equal to or higher than a predetermined pressure (corresponding to a reference level used to determine whether or not a diagnosing operation should be performed) when a large quantity of fuel vapor is present in the fuel tank 30 due to the influence of ambient temperature while the engine is OFF. A starter 43 is activated when starting the engine. At this time, the starter 43 generates a starter signal.

Figure 1:
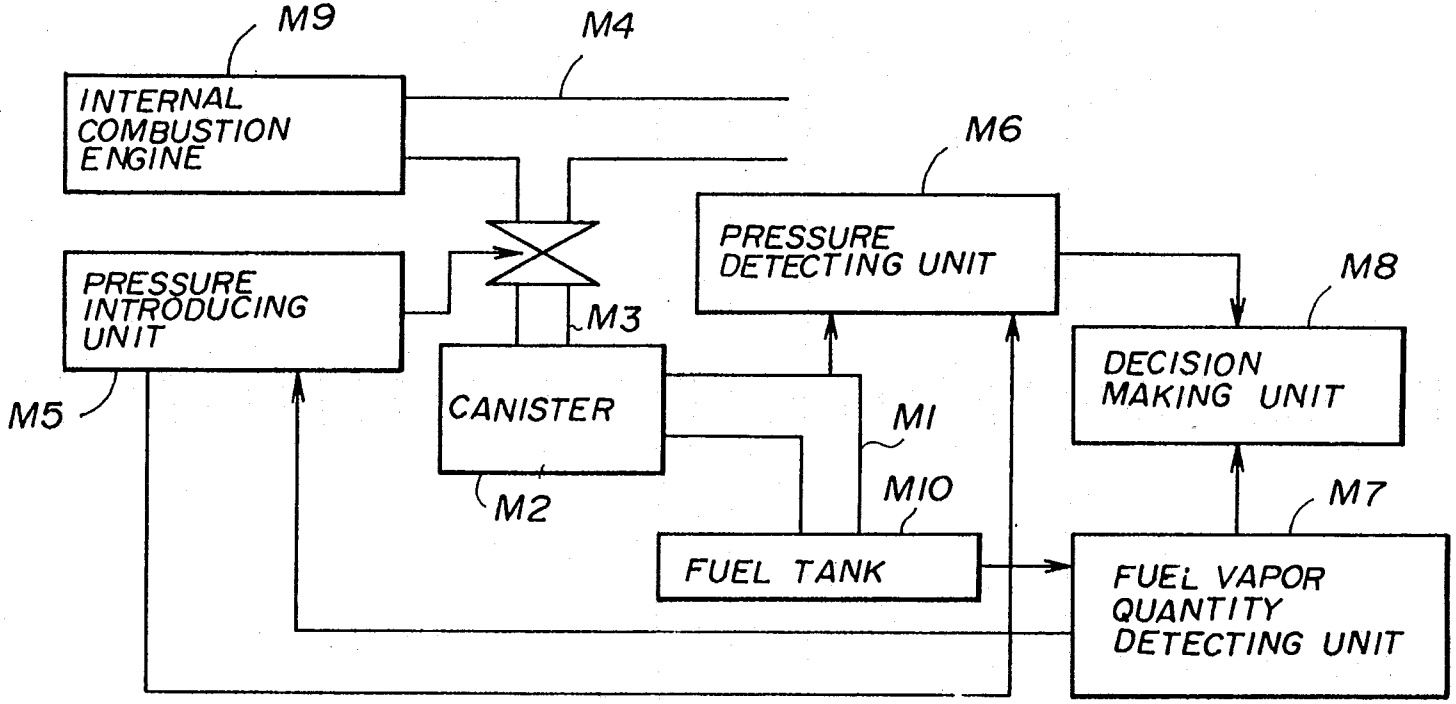
FIG. 1 is a block diagram of an overview of a first embodiment of the present invention.
Figure 3:
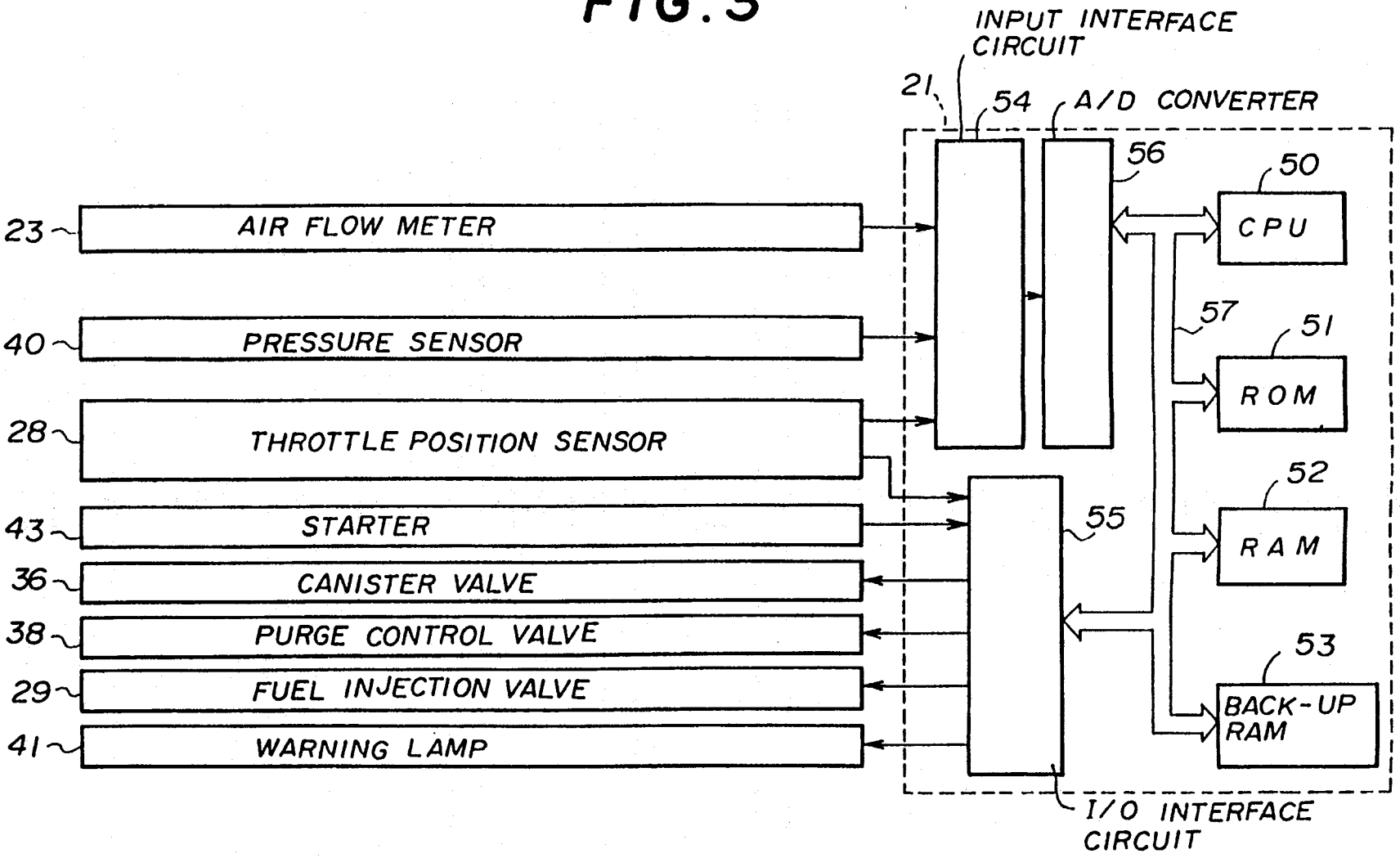
FIG. 3 is a block diagram of the hardware structure of the first embodiment of the present invention.

The microcomputer 21 corresponds to the fuel vapor quantity detecting unit M7 and the decision making unit M8 shown in FIG. 1, and has a hardware structure shown in FIG. 3, in which parts that are the same as parts shown in FIG. 2 are given the same reference numbers. The microcomputer 21 comprises a central processing unit (CPU) 50, a read only memory (ROM) 51, a random access memory (RAM) 52, a backup RAM 53, an input interface circuit 54 with a multiplexer, an analog-to-digital (A/D) converter 56, and an input/output (I/O) interface circuit 55. The above structural elements are connected to each other via a bus 57. The ROM 51 stores programs executed by the CPU 50. The RAM 52 functions as a working area of the CPU 50. The backup RAM 53 holds data after the engine is turned OFF.

The input interface circuit 54 receives an intake air quantity detecting signal from the air flow meter 23, a detection signal from a throttle position sensor 28, and a pressure detection signal from the pressure sensor 40 in such a manner that these signals are sequentially selected. The selected signal is applied to the A/D converter 56, which outputs a corresponding digital signal to the bus.57.

The I/O interface circuit 55 receives the detection signal from the throttle position sensor 28, and a starter signal from the starter 43, and outputs these signals to the CPU 50 via the bus 57. Further, the I/O interface circuit 55 selectively outputs signals via the bus to the fuel injection valve 29, the canister atmosphere aperture valve 36, the purge control valve 38, and the warning lamp 41.

The CPU 50 of the microcomputer 21 executes the following processes in accordance with the programs stored in the ROM 51. FIG. 4 is a flowchart of a failure diagnosing routine according to the first embodiment of the present invention. The routine shown in FIG. 4 is activated every 65 ms, for example. The, CPU 50 determines, in step 101, whether or not an operation flag has been set to "1". The operation flag indicates whether or not a diagnosing process is being executed. The operation flag is reset to "0" by an initial routine executed at the time of starting the engine, and hence the result of the first determination is NO. In step 102, the CPU 50 determines, by referring to the starter signal from the starter 43, whether or not the engine is operating in a state immediately after the engine is started. When the result of the step-102 determination is YES, the CPU 50 determines, in step 103, whether or not the pressure in the fuel tank 30 is equal to or higher than a positive pressure Y (Pa). When it is determined that the pressure in the fuel tank 30 is equal to or higher than the positive pressure Y (Pa), the CPU 50 infers that a large amount of fuel vapor exists in the fuel tank 30 and there is no leakage of fuel. In this case, the CPU 50 decides that the negative pressure in the intake air pipe 24 is being introduced into the purge system due to a large amount of fuel vapor and a failure in the purge system cannot be correctly carried out due to an increase in exhaust emission caused by continuously applying the negative pressure to the purge system. Hence, the CPU 50 sets the operation flag to "1" in step 121, and clears a leakage decision executing flag in step 122. Then, the routine shown in FIG. 4 ends. The decision making unit M8 executes step 103.

When it is determined, in step 102, that the engine is not in the state immediately after starting, the CPU 50 decides that the pressure in the fuel tank 30 is lower than the positive pressure Y (Pa) so that a small quantity of fuel vapor exists in the fuel tank 30 and decides that the failure detecting operation can be correctly carried out. Then, the CPU 50 executes step 104.

In step 104, the CPU 50 determines whether or not the leakage decision executing flag is ON (has been set to "1"). The leakage decision executing flag is cleared by the initial routine executed when the engine is turned ON, and is initially equal to "0". Then, the CPU 50 executes step 105, in which the CPU 50 closes the canister atmosphere aperture valve 36. In step 106, the CPU 50 opens the purge control valve 38.

Figure 5:
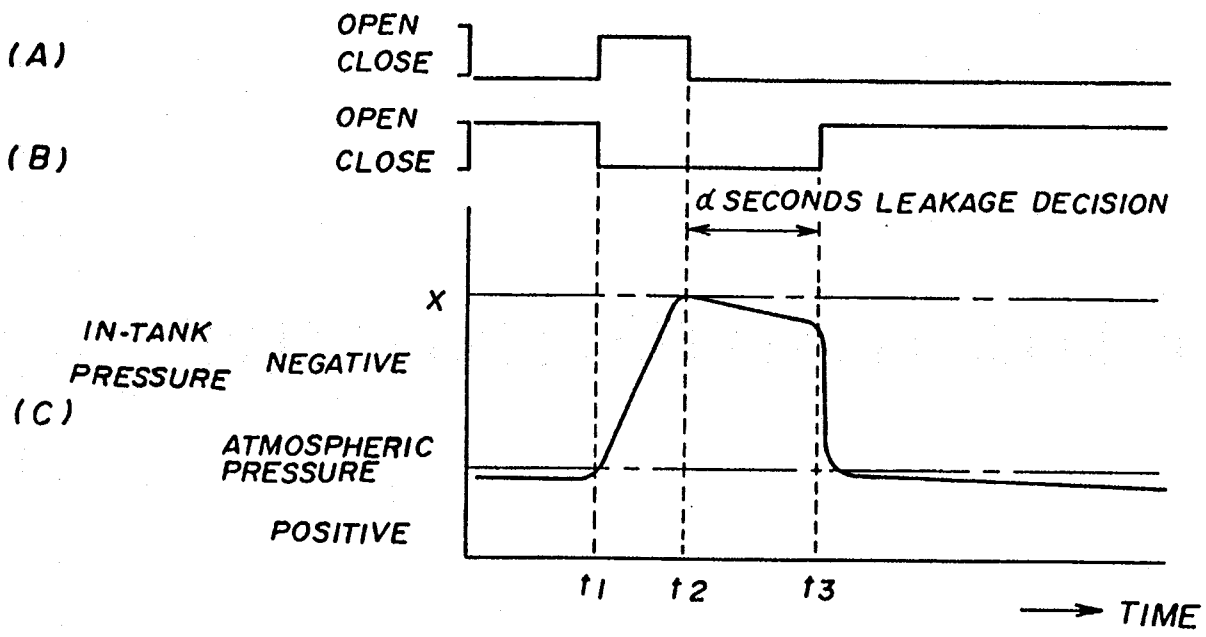
FIG. 5 is a time chart of the operation of the first embodiment of the present invention.

Referring to FIG. 5, it will now be assumed that the canister atmosphere aperture valve 36 is closed at time $t_1$ ((B) of FIG. 5), and the purge control valve 38 is opened at the time $t_1$ ((A) of FIG. 5). In this case, the negative pressure from the combustion chamber is applied to the fuel tank 30 via the purge passage 39, the purge control valve 3.8, the purge passage 37, the canister 33 and the vapor passage 32. Hence, as shown in (C) of FIG. 5, the pressure in the fuel tank 30 (in-tank pressure) quickly changes towards the negative-pressure area (the negative pressure increases) after the time $t_1$.

In step 107 shown in FIG. 4, the CPU 50 determines, on the basis of the detection signal from the pressure sensor 40, whether or not the in-tank pressure is equal to or lower than a threshold pressure X (Pa) in the negative pressure area. When the in-tank pressure is equal to or lower than the predetermined value X (Pa), the routine ends. The steps 101–107 are repeatedly carried out every 65ms until the in-tank pressure has become greater than the threshold pressure X (Pa). When it is determined, in step 107, that the in-tank pressure has become greater than the threshold pressure X (Pa), the CPU 50 closes the purge control valve 38 at time $t_2$ in step 108, as shown in (A) of FIG. 5.

At the time $t_2$, both the valves 36 and 38 are in the closed states, and the fuel purge pressure in the system between the purge control valve 38 and the fuel tank 30 is maintained if there is no failure in the system. In practice, the pressure in the fuel purge system very slowly and gradually decreases towards the atmospheric pressure. The aforementioned valve control unit 18 corresponds to the steps 105 to 108.

When the purge control valve 38 is closed in step 108, steps 109 to 116 corresponding to the decision making unit 19 are carried out.

In step 109, the CPU 50 determines whether or not a leakage decision timer is equal to "0". The leakage decision timer is cleared by the aforementioned initial routine. Hence, the result of the step-109 determination is affirmative when the step-109 determination is carried out for the first time. Then the CPU 50 executes step 110, in which the current detection value of the pressure sensor 40 is written, as a diagnosis starting pressure value $P_S$, into the RAM 52.

The CPU 50 adds a predetermined value to the value of the leakage decision timer in step 111, and sets the leakage decision executing flag to "1" in step 112. Thereafter, the routine shown in FIG. 4 ends. When the routine is activated again, it is determined, in step 104, that the leakage decision operation is being executed. Thus, the CPU 50 jumps steps 105–107, and returns to step 109 via step 108.

Since it is determined, in step 109, that the leakage decision timer does not indicate "0", the CPU 50 decides, in step 113, whether the value of the leakage decision timer has reached a value corresponding to a diagnosis time (leakage decision time) $\alpha$. When the result of the above determination is NO, the CPU 50 ends execution of the routine via the steps 111 and 112.

In the above-mentioned manner, the steps 101–104, 108, 109, 113, 111 and 112 are repeatedly performed every 65 ms. When the value of the leakage decision timer reaches the leakage decision time $\alpha$, the detection value of the pressure sensor 40 obtained at that time is written into the RAM 52, as a diagnosis end pressure value $P_E$, in step 114. In step 115, the CPU 50 calculates a rate of variation in the pressure by using the following expression:

$$(P_S - P_E)/\alpha$$

where the pressure values $P_S$ and $P_E$ are read from the RAM 52.

In step 116, the CPU 50 determines whether or not the rate of variation in the pressure calculated in step 115 is equal to or greater than a predetermined leakage decision value $\beta$. When the, result of the above determination is YES, the CPU 50 concludes that there is a large leakage due to a large variation in the pressure. Hence, the CPU 50 turns the warning lamp 41 ON in step 117 in order to inform the driver of the occurrence of a failure in the evaporative fuel purge system. At this time, the CPU 50 writes a leakage failure code into the backup RAM 53 in step 118. The leakage failure code is read from the RAM 53 during a repairing operation, and the maintenance person is informed of a failure in the evaporative fuel purge system. When it is determined, in step 116, that the rate of variation is less than the leakage decision value $\beta$, the CPU 50 executes step 119.

In step 119, the CPU 50 sends the canister atmosphere aperture valve 36 the control signal which opens the valve 36 at time $t_3$. When the valve 36 is normal, the valve 36 is opened, and the atmosphere is introduced into the evaporative fuel purge system from the atmosphere introducing inlet 36*a* via the canister atmosphere aperture 36. Hence, as shown in (C) of FIG. 5, the pressure in the fuel tank 30 rapidly changes to the positive-pressure area via the atmospheric pressure after the time $t_3$. The behavior of the above change in the in-tank pressure depends on the, situation of the occurrence of vapor.

The CPU 50 clears the leakage decision timer in step 120, and sets the operation flag to "1" in step 121. Further, the CPU 50 clears the leakage decision executing flag to "0" in step 122, and ends execution of the routine shown in FIG. 4. Thereafter, the operation flag indicates "1" when the routine shown in FIG. 4 is activated. Hence, the operation flag is maintained at "1" until the engine is started again.

Figure 6:
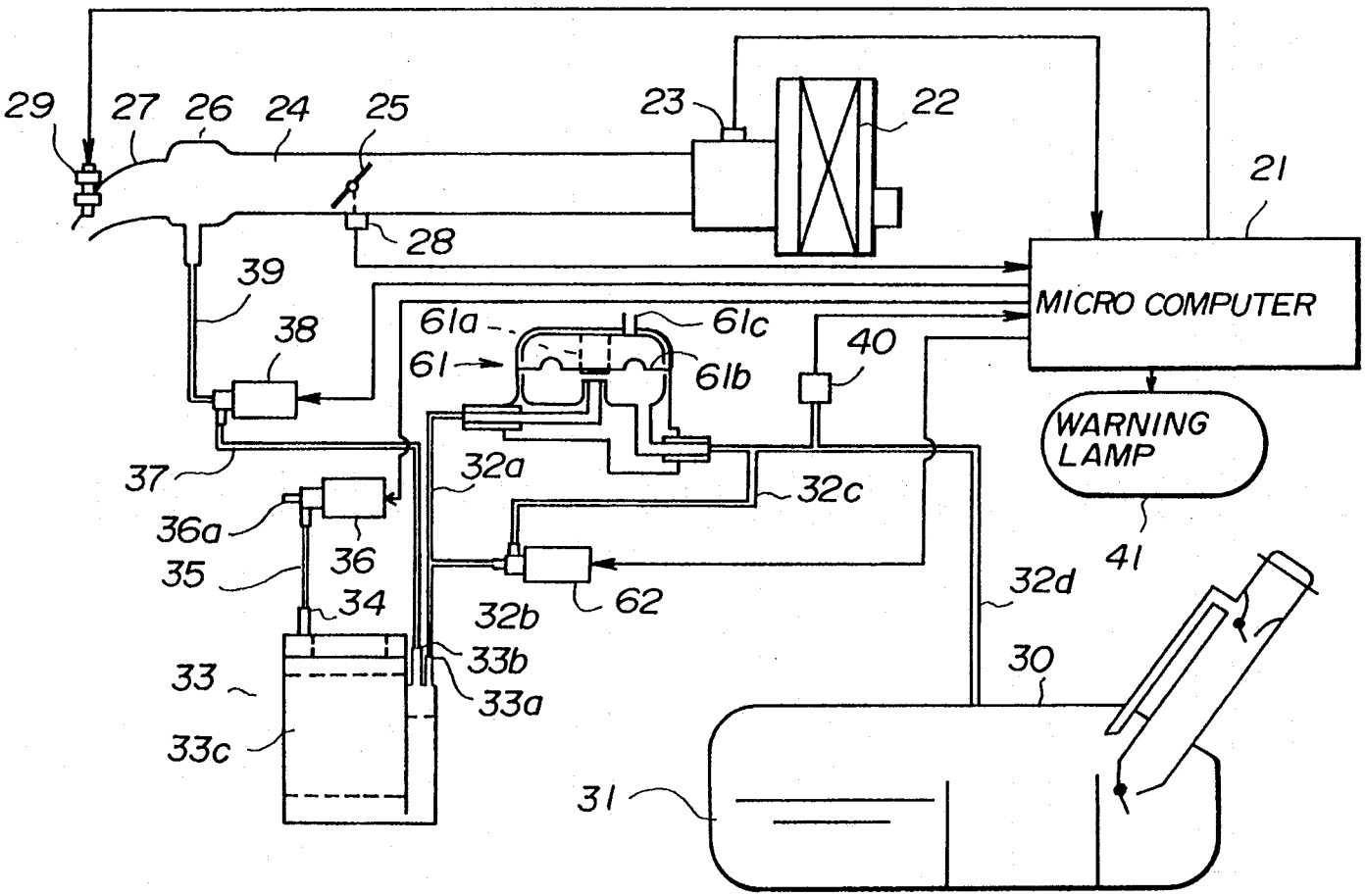
FIG. 6 is a diagram of the system structure of a first variation of the first embodiment of the present invention.

A description will now be given, with reference to FIGS. 6 through 8, of a first variation of the first embodiment of the present invention. In FIG. 6, parts that are the same as parts shown in the previously described figures are given the same reference numbers. Referring to FIG. 6, there is illustrated a valve 61 for controlling the pressure in the in-fuel tank 30. More particularly, the valve 61 is a mechanical control valve for connecting the vapor passage to the vapor passages 32*a* and 32*c* and disconnecting the vapor passage 32*a* from the vapor passages 32*c* and 32*d*. When the in-tank pressure is greater than a set pressure of a spring 61*a* provided in the valve 61, a diaphragm 61*b* provided therein is located at the position shown in FIG. 6 and the valve 61 connects the vapor passage 32*a* to the vapor passages 32*c* and 32*d*. When the in-tank pressure is lower than the set pressure of the spring 61*a*, the diaphragm 61*b* moves downwards, and the valve 61 disconnects the vapor passage 32*a* from the vapor passages 32*c* and 32*d*. With use of the valve 61, it is possible, to keep the in-tank pressure in the positive-pressure area and suppress the occurrence of fuel vapor. Reference number 61*c* indicates an atmosphere opening of the valve 61.

In order to diagnose the evaporative fuel purge system, it is necessary to monitor variation in the in-tank pressure in the state in which the negative pressure is introduced in the fuel tank 30. For this requirement, in the first variation of the first embodiment, the vapor passages 32*b* and 32*c* are provided so as to bypass the valve 61 and an in-tank pressure switching valve (VSV) (or referred to as a bypass control valve) 62 is provided which connects the vapor passages 32*b* and 32*c* to each other and disconnects these vapor passages from each other.

Figure 7:
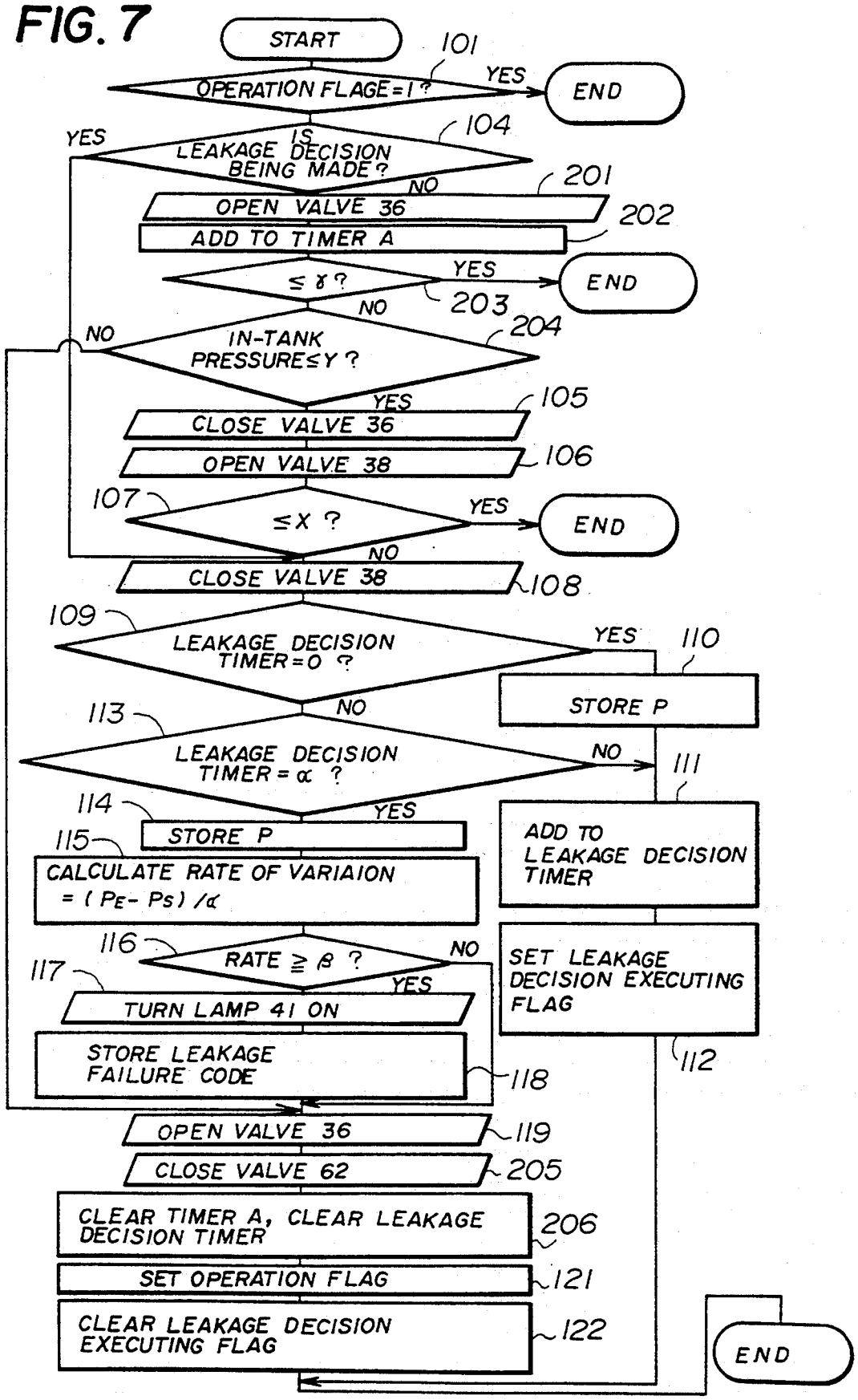
FIG. 7 is a flowchart of the operation of the first variation shown in FIG. 6.

FIG. 7 is a flowchart of a failure diagnosing routine according to the first variation. The CPU 50 of the microcomputer 21 executes the routine shown in FIG. 7 every 65 ms, for example. When the CPU 50 decides, in step 104, that the leakage decision making is not being performed, the CPU 50 opens the bypass control valve 62 in step 201, and adds a predetermined time to the value of a timer A in step 202. In step 203, the CPU 50 determines whether or not the updated value of the timer A indicates the elapse of $\tau$ minutes. When the determination result is NO, the CPU 50 terminates the routine shown in FIG. 7.

When the routine is repeatedly activated every 65 ms, and the CPU 50 determines that the value of the timer A indicates the elapse of the time $\tau$, the CPU 50 determines, in step 204, whether or not the in-tank pressure is lower than the threshold pressure Y (Pa), in the positive-pressure area. When a small quantity of vapor fuel exists in the fuel tank 30, the passage resistance is small. Hence, as schematically illustrated in (D) of FIG. 8, the in-tank pressure is close to the atmospheric pressure at time $t_1$ after the predetermined time $\tau$ from time $t_0$ when the bypass control valve 62 is opened ((C) of FIG. 8).

Figure 8:
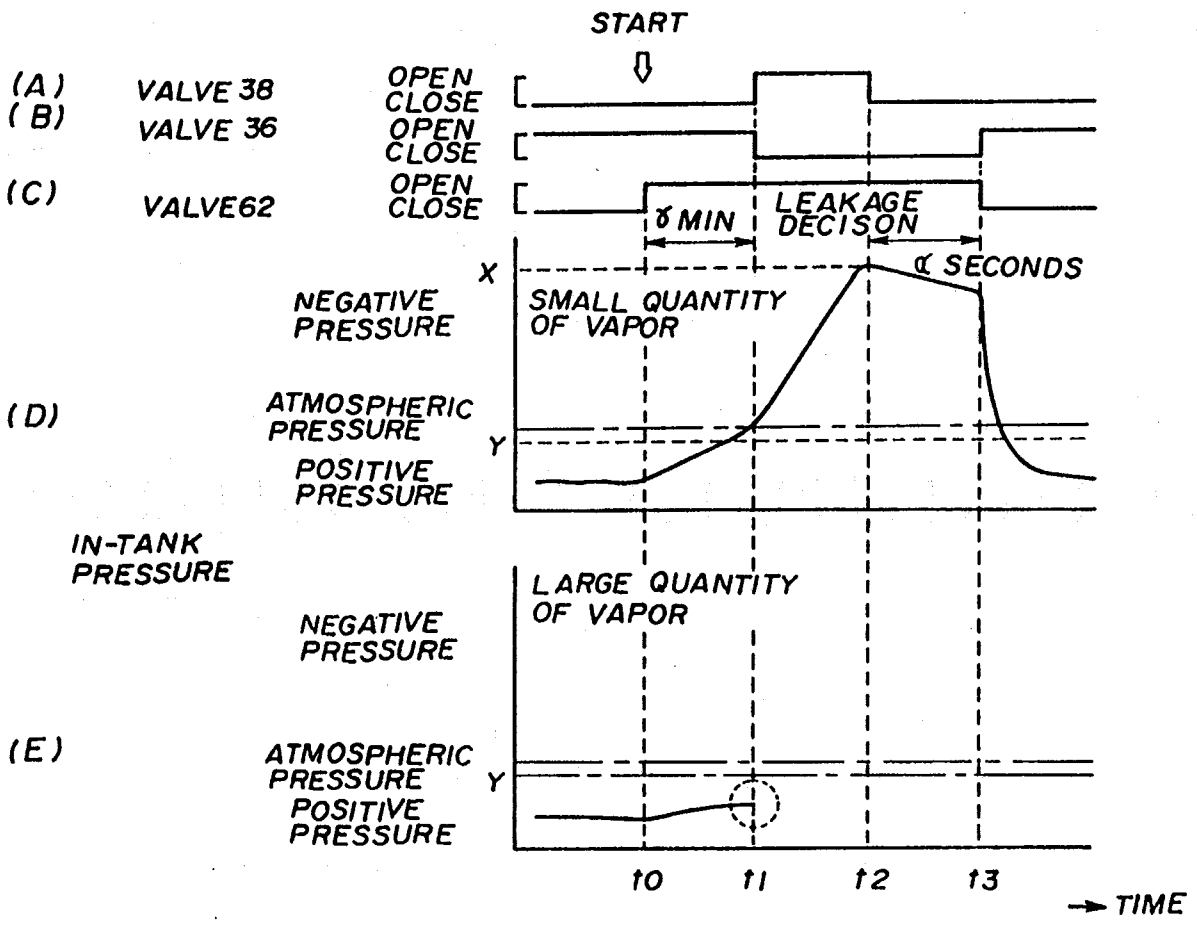
FIG. 8 is a time chart of the operation of the first variation shown in FIG. 6.

In step 105, the CPU 50 closes the valve 36 at time $t_1$ shown in (B) of FIG. 8. Further in step 106, the purge control valve 38 is opened at time $t_1$ in (A) of FIG. 8. Thereafter, the process is carried out in accordance with the same algorithm as that of the first embodiment of the present invention. When the failure diagnosing process ends, the bypass control valve 62 is closed in step 205 in order to turn ON the valve 61 in step 205, and clears the timer A and the leakage decision timer in step 206.

When a large quantity of fuel vapor exists in the fuel tank 30, as shown in (E) of FIG. 8, the pressure in the fuel tank 30 does not reach the atmospheric pressure due to the passage resistance and the like even at the time $t_1$ after the time $\tau$ from the time when the bypass control valve 62 is opened. Hence, in this case, it is determined, in step 204, that the pressure in the fuel tank 30 is greater than the threshold pressure Y (Pa). Then, the CPU 50 opens the valve 36 in step 119 without executing the leakage decision, and performs the steps 205, 206, 121 and 122. Then, the CPU 50 ends execution of the routine shown in FIG. 7, and does not performs the routine until the engine is started again.

In the above-mentioned manner, an erroneous diagnosis which may occur when a large quantity of fuel vapor exists in the fuel tank 30. The fact that the in-tank pressure is greater than the threshold value Y (Pa) in the negative-pressure area means that there is little leakage of fuel. Hence, it is also possible to make a decision that the evaporative fuel purge system is operating normally when the in-tank pressure is greater than the threshold pressure Y (Pa).

Figure 9:
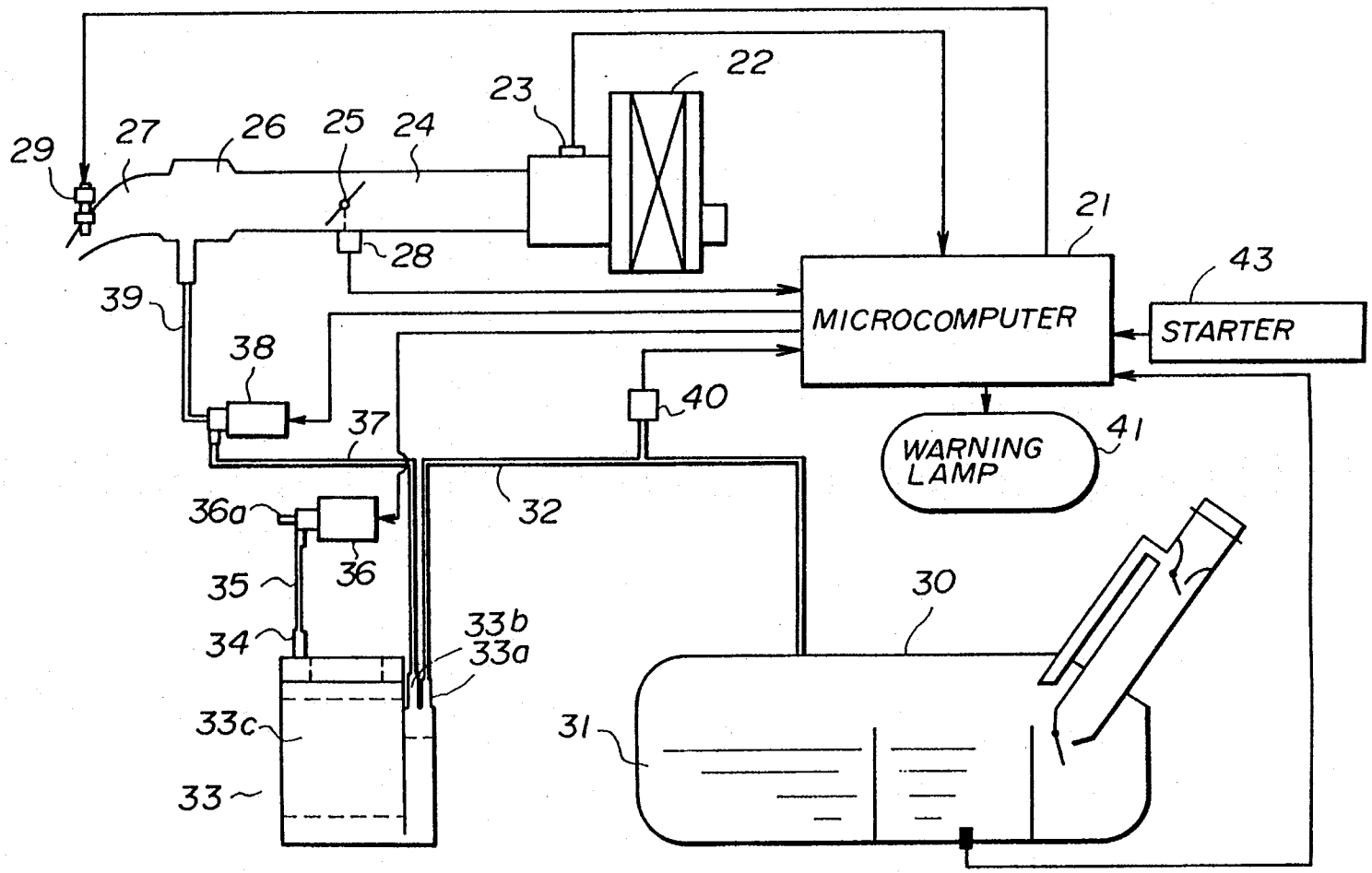
FIG. 9 is a diagram of the system structure of a second variation of the first embodiment of the present invention.

A description will now be given, with reference to FIGS. 9 through 11, of a second variation of the first embodiment of the present invention. FIG. 9 shows the system structure of the second variation. In FIG. 9, parts that are the same as parts shown in FIG. 2 are given the same reference numbers. As shown in FIG. 9, the second variation employs a fuel temperature sensor 71. The quantity of fuel vapor detected from the fuel temperature, and the predetermined leakage decision value $\beta$ is varied in accordance with the detected quantity of fuel Vapor.

Figure 10A:
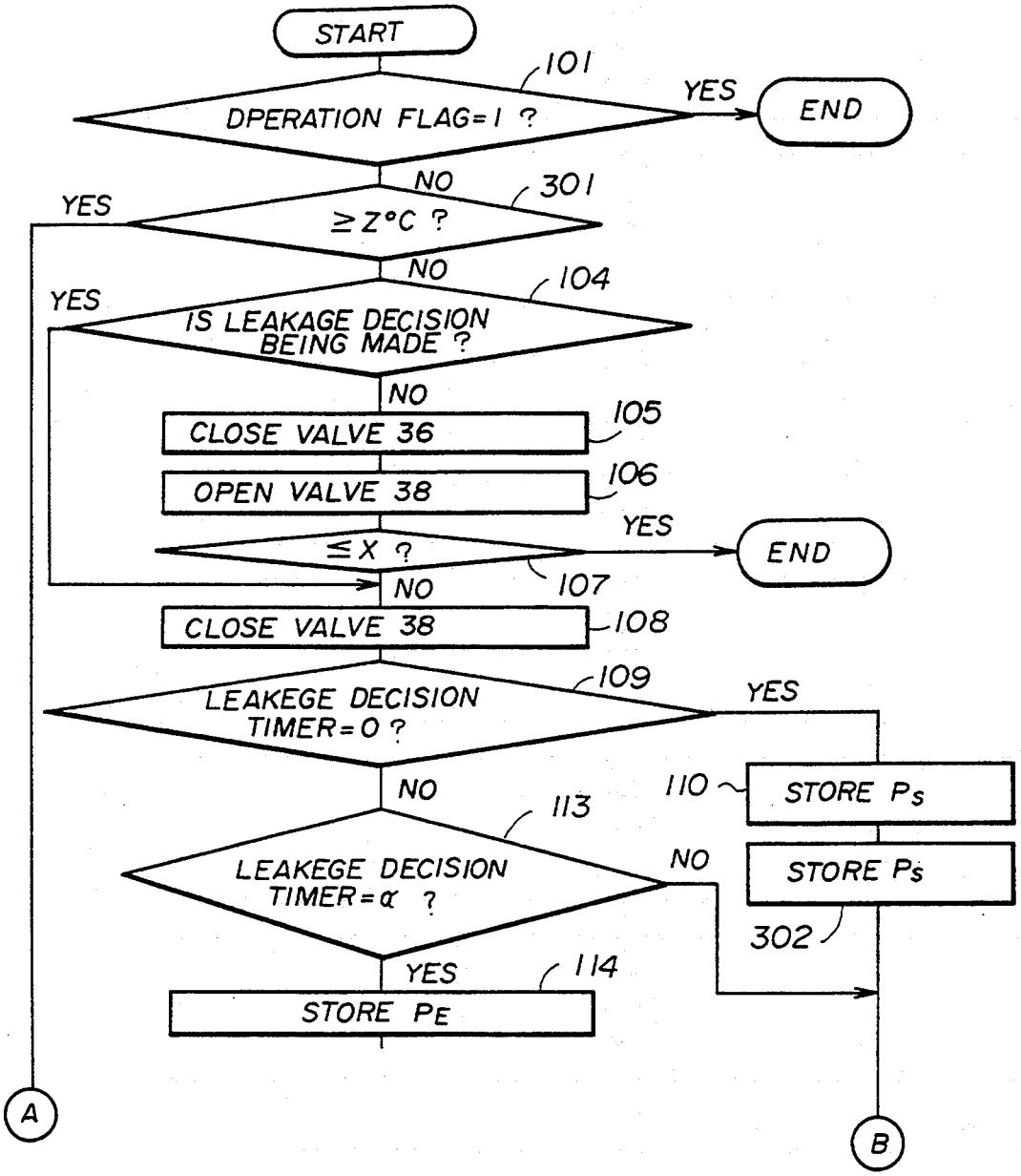
FIGS. 10A and 10B are flowcharts of the operation of the second variation shown in FIG. 9.
Figure 10B:
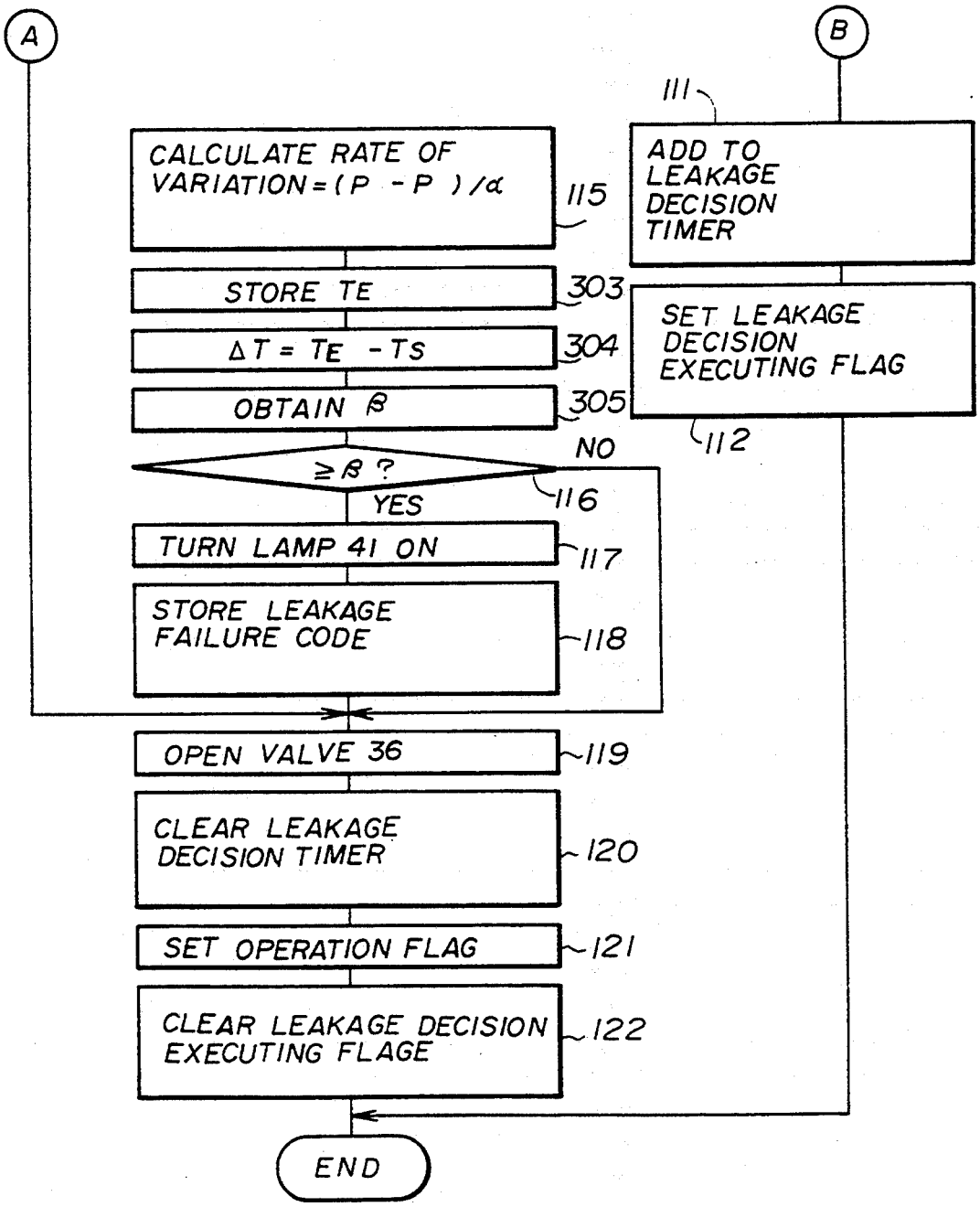

The fuel temperature sensor 71 is fastened to an appropriate position of the fuel tank 30 so that the temperature of the fuel 31 can be measured. A fuel temperature detection signal from the fuel temperature sensor 71 is applied to the microcomputer 21. FIGS. 10A and 10B are flowcharts of a failure diagnosing routine of the second variation. The routine shown in FIGS. 10A and 10B is activated every 65 ms. The CPU 50 determines, in step 101, whether or not the operation flag has been set, to "1". In step 301, the CPU 50 determines whether or not the fuel temperature is equal to or higher than a predetermined threshold temperature Z(° C.). When it is determined that the fuel temperature is equal to or higher than the predetermined threshold temperature Z(° C.), a large quantity of fuel vapor exists in the fuel tank 30 and it may be impossible to apply a negative pressure to the fuel tank 30. Hence, the CPU 510 proceeds to step 119, in which the valve 36 is opened.

Thereafter, the CPU 50 executes the steps 120, 121 and 122, and ends execution of the routine. In the above-mentioned manner, an increase in the exhaust emission arising from continuous application of the negative pressure can be prevented.

When it is determined, in step 301, that the fuel temperature is less than the threshold temperature Z(° C.), a negative pressure is applied to the fuel tank 30 in the state in which the valve is maintained in the closed state. Then, the purge control valve 38 is closed so that the negative pressure is shut in the system between the purge control valve 38 and the fuel tank 30. Then, the rate of variation in the pressure in the closed system is calculated, and the leakage decision is made by comparing the rate of variation in the pressure with the leakage decision value $\beta$. That is, the steps 104–116 are executed in the same manner as the first embodiment of the present invention.

During the above operation, the CPU 50 stores the diagnosis starting pressure value $P_S$ into the RAM 52 in step 110, and writes, as a diagnosis starting fuel temperature $T_S$, the current fuel temperature indicated by the fuel temperature sensor 71 into the RAM 52 in step 302. In step 115, the CPU 50 calculates the rate of variation in the pressure after the time a (seconds) from the start of the diagnosis. In step 303, the CPU 50 writes the fuel temperature indicated at that time into the RAM 52 as a diagnosis end fuel temperature $T_E$. In step 304, the CPU 50 calculates a fuel temperature variation delta-T corresponding to the difference between the temperatures. $T_S$ and $T_E$ ($T_E$–$T_S$). In step 305, the CPU 50 refers to a table shown in FIG. 11 and stored in the ROM 51, and calculates the leakage decision value D by accessing the table with the fuel temperature variation delta-T and the diagnosis end fuel temperature $T_E$.

Figure 11:
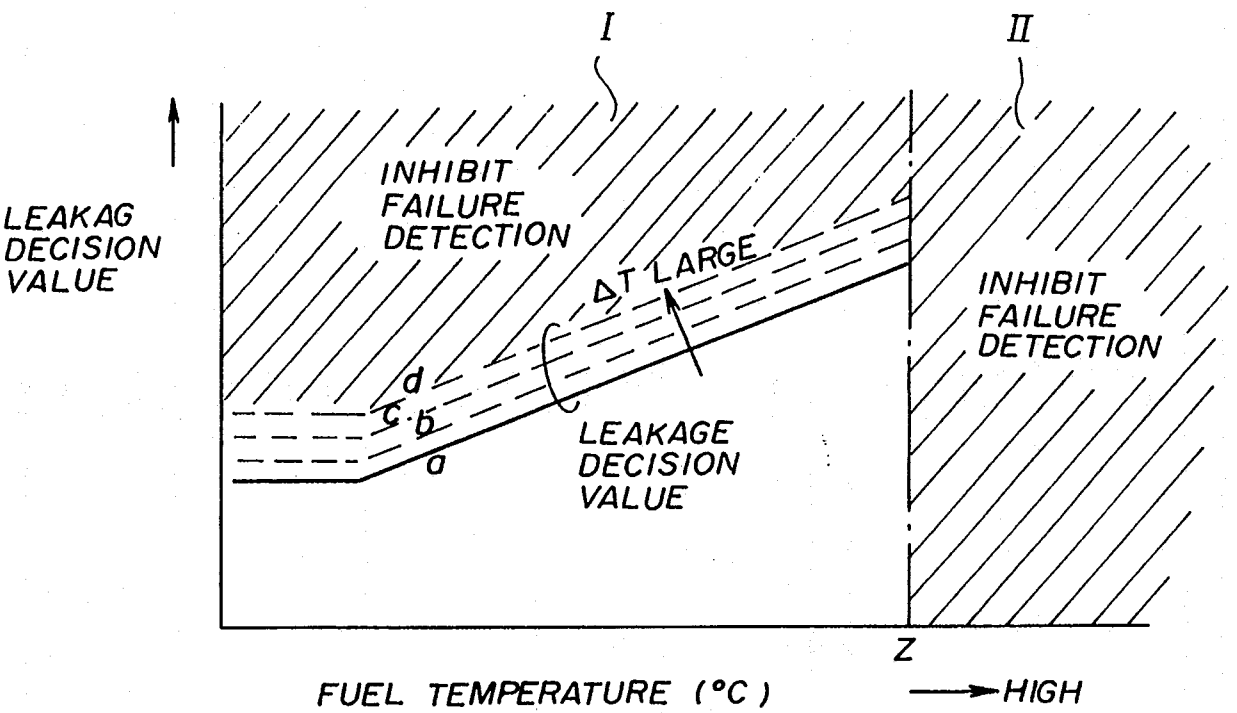
FIG. 11 is a graph showing parameters of a table used to generate a leakage decision value.

The table shown in FIG. 11 defines the relationship between the leakage decision value D and the fuel temperature (° C.). A solid line 'a' indicates a characteristic curve when there is no temperature variation delta-T (=0) in the diagnosing time $\alpha$ (seconds). As the temperature variation delta-T increases, the characteristic changes as indicated by broken lines 'b', 'c' and 'd'. This is because, when vapor has occurred in the fuel tank 30, the negative pressure shut in the closed system changes towards the atmospheric pressure, and hence it is necessary to increase the leakage decision value $\beta$. In addition, the quantity of variation in the negative pressure towards the atmospheric pressure is approximately proportional to the quantity of fuel vapor occurring in the fuel tank 30, which increases as the fuel temperature variation delta-T increases.

For an identical fuel temperature variation delta-T, the quantity of fuel vapor increases as the diagnosis end fuel temperature $T_E$ increases. Hence, the characteristics 'a'—'d' can be represented by linear curves in which the leakage decision value $\beta$ increases as the fuel temperature increases. Although not shown in FIGS. 10A and 10B, when the fuel temperature variation delta-T is greater than the leakage decision value $\beta$ on the characteristic curve 'd' (hatched area I in FIG. 11), the execution of the failure diagnosis operation is inhibited and step 119 is immediately carried out. This is because the correct decision and application of negative pressure cannot be made due to the existence of a large quantity of fuel vapor. For the same reason as above, the execution of the failure diagnosis operation is inhibited when it is determined, in step 301, that the fuel temperature is equal to or higher than the threshold temperature Z(° C.) (hatched area II in FIG. 11).

In the above-mentioned manner, the leakage decision value $\beta$ can be varied on the basis of the quantity of fuel vapor in the fuel tank 30. Then, the CPU 50 executes step 116, in which it is determined whether or not the leakage decision value $\beta$ is equal to or less than the rate of pressure variation calculated in step 115. When the result of the above determination is YES, the CPU 50 decides that the evaporative fuel purge system is normally operating. In the other case, the CPU 50 decides that a failure has occurred in the evaporative fuel purge system.

Other variations of the first embodiment of the present invention can be made. For example, the pressure sensor 40 can be fastened to the fuel tank 30, and fuel vapor can be purged in the vicinity of the throttle valve 25. The first embodiment and its variation detects a failure in the system on the basis of variation in the negative pressure shut in the closed system. The first embodiment includes all evaporative fuel purge systems in which the negative pressure is applied up to the fuel tank.

Figure 12:
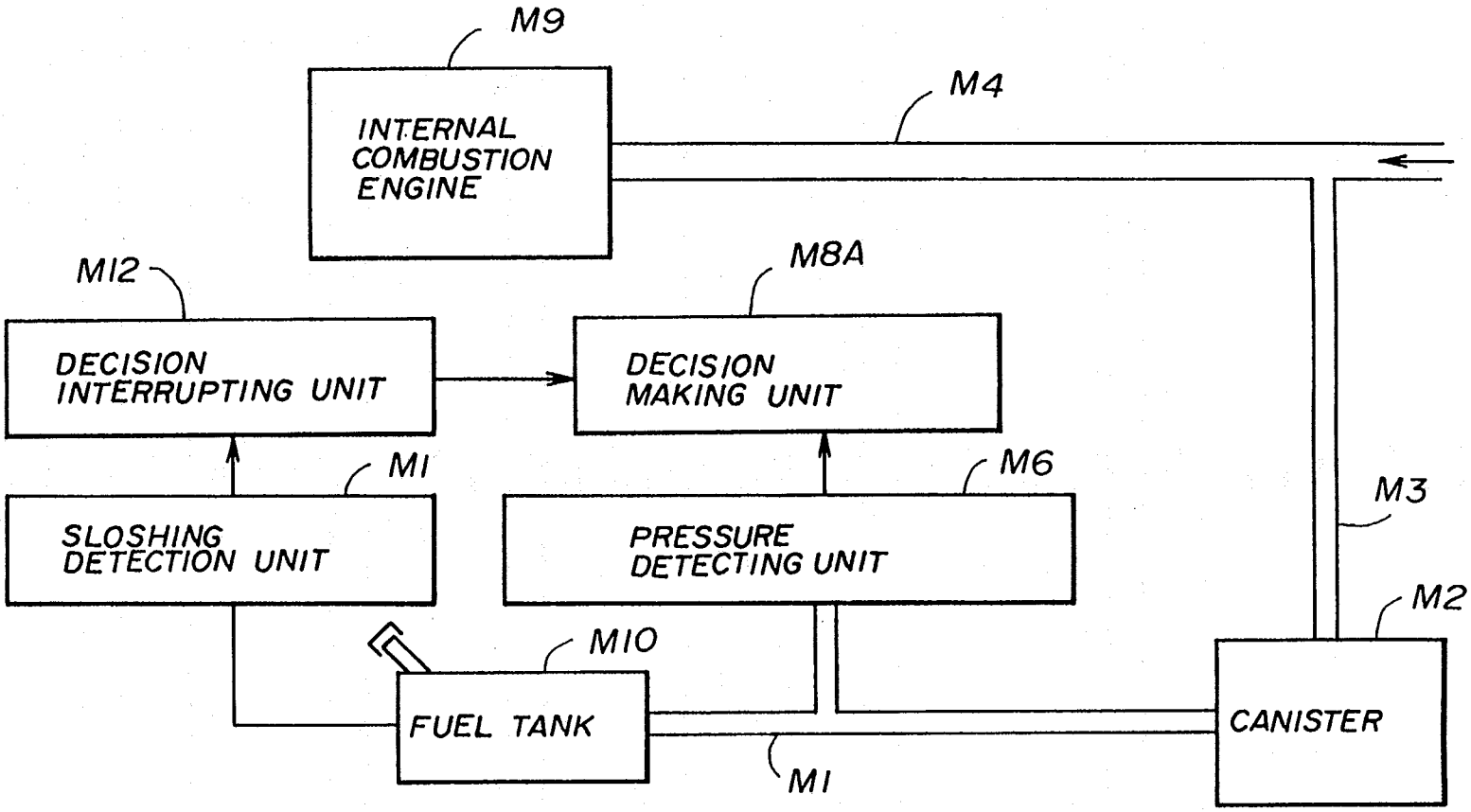
FIG. 12 is a block diagram of an overview of a second embodiment of the present invention.

A description will now be given of a second embodiment of the present invention. FIG. 12 shows an overview of the second embodiment of the present invention. In FIG. 12, parts that are the same as parts shown in FIG. 1 are given the same reference numbers. The second embodiment takes into the account the following matters. When a vehicle is slaloming, sloshing of fuel in the fuel tank takes place. The sloshing of fuel increases the quantity of fuel vapor and increases the in-tank pressure. If the sloshing of fuel occurs during the failure diagnosing process, the introduced negative pressure in the, type of systems, in which the negative pressure is introduced for diagnosis, will decrease irrespective of no leakage of fuel. In this case, it may be determined that there is leakage of fuel. In the type of systems in which variation in the pressure in the fuel tank maintained in the closed state (disconnected from the canister) are measured for diagnosis, the pressure increases towards the positive-pressure area due to the sloshing of fuel irrespective of leakage of fuel. The second embodiment of the present invention is intended to eliminate the above disadvantages.

Referring to FIG. 12, the, second embodiment comprises a sloshing detection unit M11, a decision interrupting unit M12, and a decision unit M8A. The sloshing detection unit M11 detects the occurrence of sloshing of fuel in the fuel tank M10. The decision interrupting unit M12 interrupts the decision making: operation of the decision unit M8A when the sloshing detection unit M11 detects the occurrence of sloshing of fuel in the fuel tank M10. With the use of the above structural elements, the diagnosing operation can be performed without being affected by an increase in fuel vapor due to the occurrence of sloshing of fuel.

Figure 13:
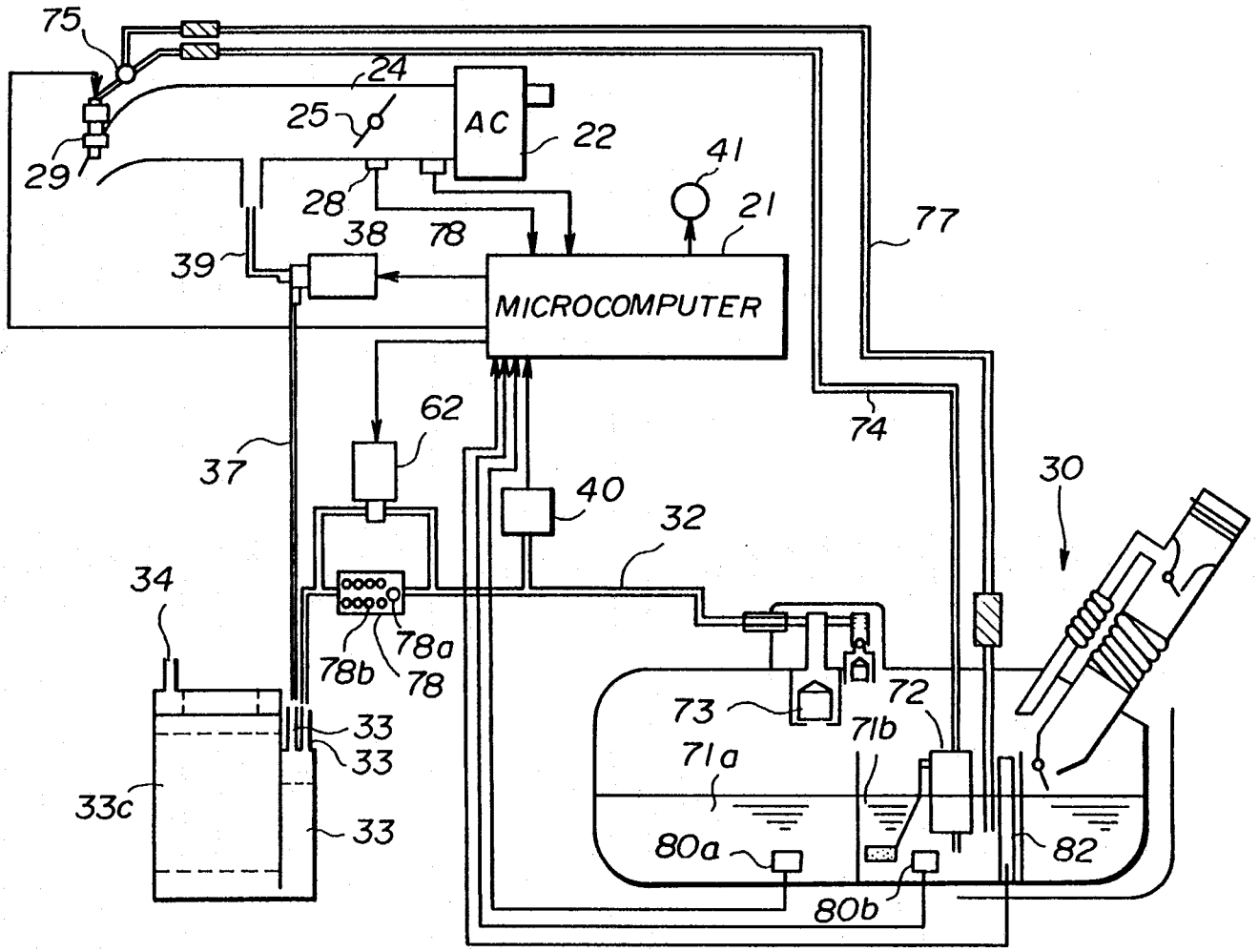
FIG. 13 is a diagram of the system structure of the second embodiment of the present invention.

FIG. 13 shows the system structure of the second embodiment of the present invention. In FIG. 13, parts that are the same as parts shown in the previously described figures are given the same reference numbers. The fuel tank 30 comprises a main tank **71*a* and a sub tank 71*b*. The sub tank 21*b* is provided inside the main tank 71*a*, and is connected to the main tank 71*a*. A fuel pump 72 is provided in the fuel tank 30. A roll-over valve 23 is fastened to an upper portion of the fuel tank 30, and functions to prevent fuel from flowing to the outside of the fuel tank when the vehicle turns over. The fuel pump 72 is coupled to the fuel injection valve 29 via a pressure regulator 75 used to regulate the fuel injection pressure at a fixed level. A pipe 74 connects the fuel pump 72 and the pressure regulator 75. Fuel which is not injected is returned to the fuel tank 30 via a fuel returning pipe 77**.

The upper portion of the fuel tank 30 is connected to the canister 30 via the vapor passage 32 in which a valve 78 having a check ball **78*a* and a spring 78*b* is provided. The spring 78*b* urges the check ball 78*a* rightwards, and maintains the pressure in the fuel tank 30** at a fixed level (equal to 250 mmAq, for example).

Fuel temperature sensors **80*a* and 80*b* are provided in the fuel tank 30. Temperature detection signals from the fuel temperature sensors 80*a* and 80*b* are sent to the microcomputer 21. An intake air temperature sensor 78 is fastened to the intake pipe 24, and generates an intake air temperature detection signal sent to the microcomputer 21. A fuel level sensor 82 detects the level of fuel in the sub tank 80*b*, and generates a fuel level detection signal sent to the microcomputer 21**.

Figure 14:
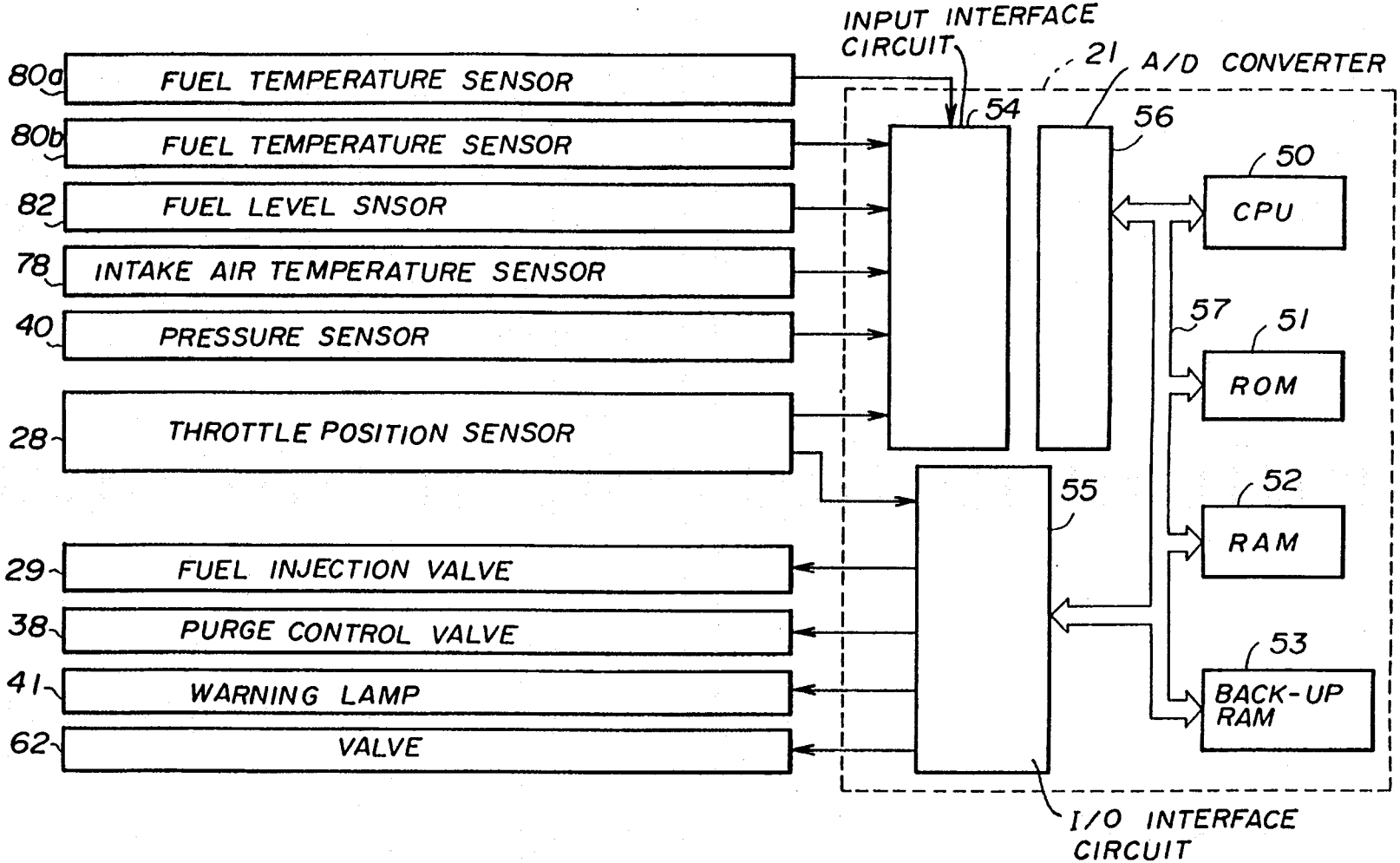
FIG. 14 is a block diagram of the hardware structure of the second embodiment of the present invention.

FIG. 14 shows the hardware structure of the microcomputer 21. In FIG. 14, parts that are the same as parts shown in the previously described figures are given the same reference numbers.

A description will be given of the operation of the second embodiment of the present invention. When the engine is started by turning the starter switch 43 ON, fuel in the sub tank **71*b* of the fuel tank 30 is fed to the pressure regulator 75 via the pipe 74. The pressure regulator 75 regulates the pressure of the fuel at a fixed level, and supplies the regulated fuel to the fuel injection valve 29, which injects the fuel into the intake pipe 24 for a fuel injection time specified by the microcomputer 21. Fuel which is not used is fed back to the sub tank 71*b* via the fuel returning pipe 77**.

Fuel vapor occurring in the fuel tank 30 passes through the vapor passage 32 and reaches the valve 78 since the bypass control valve 62 is opened. When the pressure in the fuel tank 30 is less than the set pressure (250 mmAq, for example) of the valve 78, the check ball **78*a* is located at the position shown in FIG. 13 due to the function of the spring 78*b*, so that the vapor passage 32 is disconnected from the canister 33. Hence, the fuel vapor cannot be transferred to the canister 33**.

For example, when the engine is started in the cold state thereof, the in-tank pressure is approximately equal to the atmospheric pressure, and the volume of fuel decreases due to a fuel injection carried out immediately after the engine is started. Hence, the in-tank pressure decreases and becomes a negative pressure. Thereafter, the temperature of the engine gradually increases and the quantity of fuel vapor increases. Hence, the in-tank pressure increases towards the positive-pressure area, and becomes equal to the set pressure by the valve 78.

When the in-tank pressure becomes equal to or higher than the set pressure, the check ball 78*a* in the valve 78 is moved against the spring force of the spring 78*b*. Hence, the fuel vapor from the fuel tank 30 is allowed to pass through the valve 78 and reach the canister 33. The fuel vapor adheres to the active carbon 33*c*, in the canister 33. When the fuel vapor leaves the canister 33, the in-tank pressure decreases. When the in-tank pressure becomes equal to or lower than the set pressure by the valve 78*a*, the valve 78 is closed again.

As described above, when there is no fuel leakage in the vapor passage 32 or the fuel tank 30, fuel vapor in the tank 30 passes through the valve 78 and adheres to the active carbon 33*c*, in the canister 33. Immediately after the engine is started, the purge control condition is not satisfied because the purge control valve 38 is closed. The purge control condition defines a condition that makes it possible to minimize deterioration of drivability and exhaust emission even if the air-fuel ratio deviates due to purging. For example, the purge control condition required that 1) the engine coolant temperature is equal to or higher than a predetermined temperature, 2) the quantity of intake air is equal to or greater than a predetermined quantity during a feedback control in which fuel injection is controlled so as to become equal to a target air-fuel ratio, and 3) a fuel cutting operation is not performed. The microcomputer 21 supervises the purge control condition.

When the microcomputer 21 makes a decision that the purge control condition is satisfied, the microcomputer 21 opens the purge control valve 38. Due to the negative pressure in the intake pipe 24, the atmosphere is introduced into the canister 33 via the atmosphere aperture 34 thereof, and the fuel is removed from the active carbon 33*c*. Then, the fuel vapor is sucked into the intake pipe 24 via the purge passage 37 and the purge control valve 38. The active carbon 33*c*, in the canister 33 is refreshed due to the removing of the fuel vapor. Hence, the quantity of fuel vapor from the fuel tank 30 gradually increases.

Figure 15:
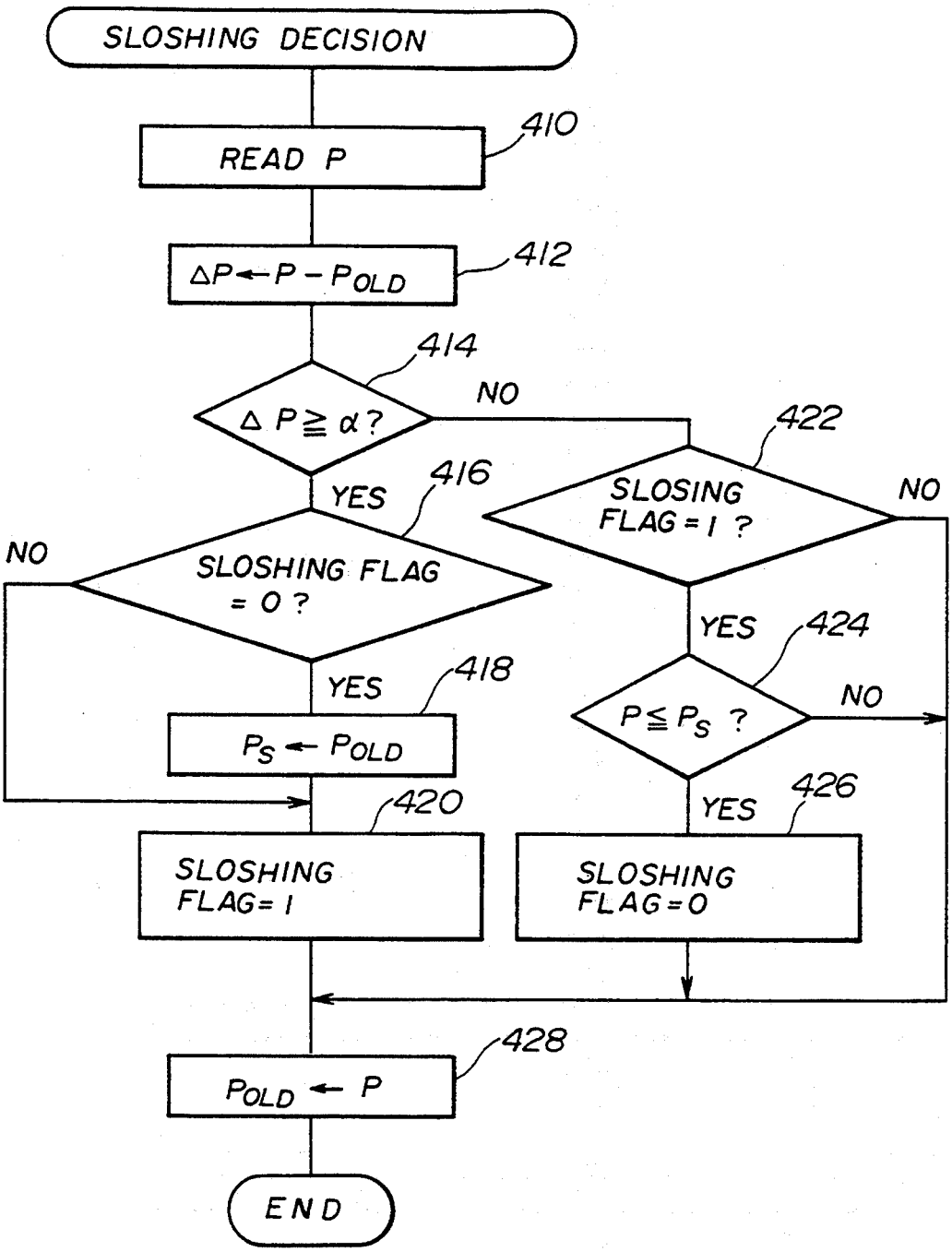
FIGS. 15 and 16 are flowcharts of the operation of the second embodiment of the present invention.

A description will now be given of a sloshing decision process and a failure diagnosing process executed under the control of the CPU 50 of the microcomputer 21. FIG. 15 is a sloshing decision routine, which is executed every 32 msec by an interrupt to the CPU 50.

The CPU 50 reads the in-tank pressure P on the basis of the detection signal of the pressure sensor 40 in step 410. In step 412, the CPU 50 calculates the difference delta-P between the in-tank pressure P read in step 410 and the previously read in-tank pressure $P_{OLD}$. In step 414, the CPU 50 determines whether or not the pressure difference delta-P is equal to or greater than a predetermined value a (equal to, for example, 1–2 mmHg), that is, determines whether or not sloshing of fuel has occurred. When the result of the step-414 determination is YES, the CPU 50 executes step 416 in which a sloshing flag is equal to "0". When it is determined that the sloshing flag is equal to "0", the CPU 50 writes the Previous in-take pressure $P_{OLD}$ into a held pressure variable $P_S$, and proceeds to step 420. When it is determined that the sloshing flag is equal to "1" the CPU 50 directly proceeds to step 420. In step 420, the CPU 50 sets the sloshing flag to "1", and writes the in-tank pressure P into the previous in-tank pressure variable $P_{OLD}$. Then, the CPU 50 ends execution of the routine shown in FIG. 15.

When it is determined, in step 414, that delta-P is less than the predetermined value a, the CPU 50 determines whether or not the sloshing flag is equal to "1". When it is determined that the sloshing flag is equal to "1" the CPU 50 determines, in step 424, that the in-tank pressure P is equal to or less than the held pressure $P_S$. When it is determined that $P \leqq P_S$, that is, when it is determined that the in-tank pressure returns to the pressure before the sloshing of fuel occurred, the CPU 50 sets the sloshing flag to "0", and executes step 428. When it is determined, in step 422, that the sloshing flag is equal to "0" or it is determined, in step 424, that $P > P_S$, the CPU 50 executes step 428 and ends execution of the routine shown in FIG. 15.

Figure 16:
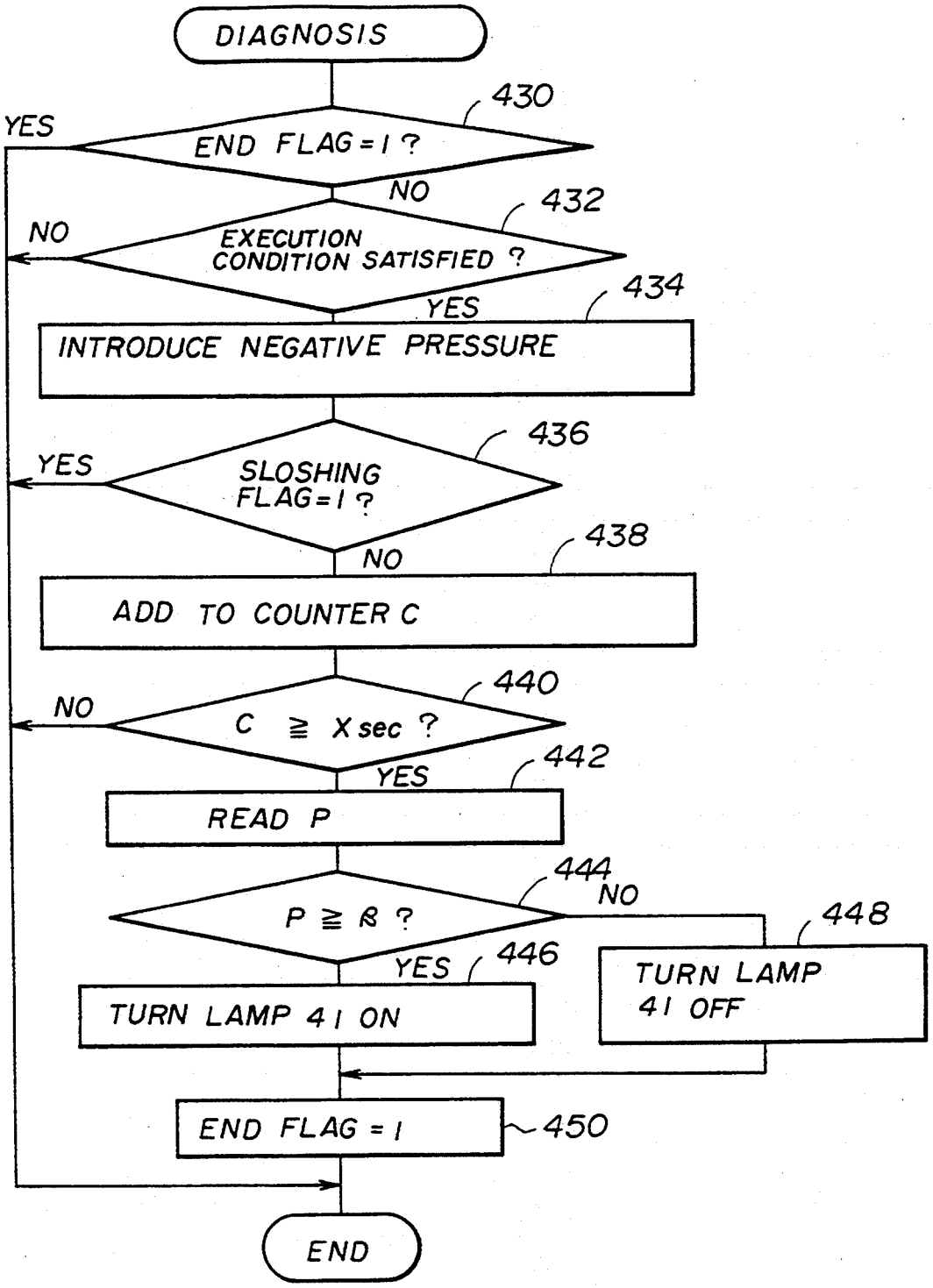

FIG. 16 is a flowchart of a failure diagnosing routine according to the second embodiment of the present invention. The routine shown in FIG. 16 is activated every 84msec, for example. In step 430, the CPU 50 determines whether or not an end flag is equal to "1". When it is determined that the end flag is equal to "1", the CPU 50 ends execution of the routine. When it is determined, in step 430, that the end flag is not equal to "1", the CPU 50 executes step 432. The end flag and a negative pressure introduction counter (which will be described later) are reset during the initial operation executed after the engine is started.

Figure 18:
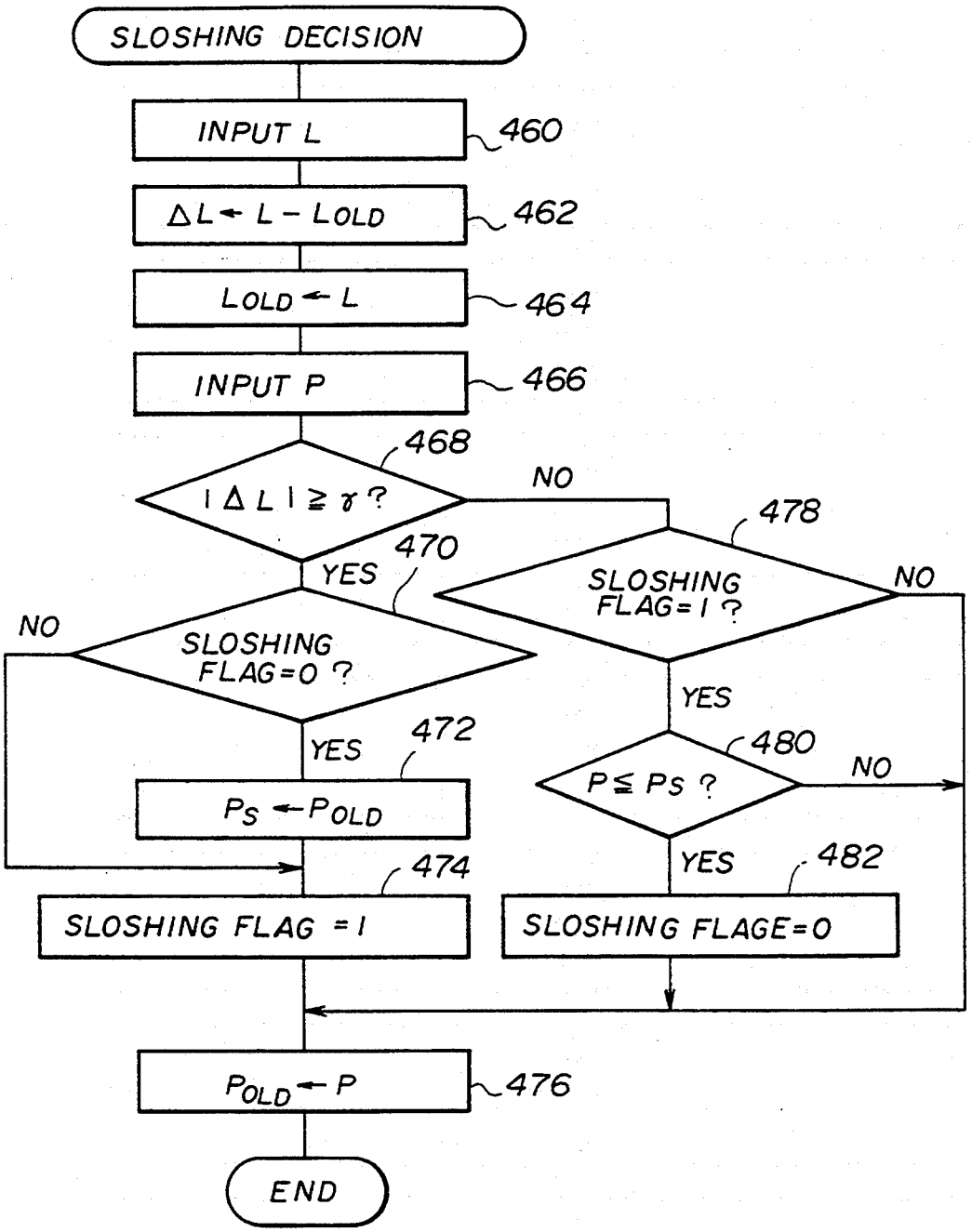
FIG. 18 is a flowchart of a first variation of the process shown in FIG. 15.

In step 432, the CPU 50 executes an air-fuel ratio feedback control, and determines whether or not a diagnosis execution condition such that the coolant temperature is equal to or higher than 80° C. is satisfied. When the result of the step-432 determination is YES, the CPU 50 executes step 434. If not, the CPU 50 terminates the routine shown in FIG. 16. In step 434, the CPU 50 opens the purge control valve 38 and the bypass control valve 82. Hence, the negative pressure in the intake pipe 24 is introduced into the fuel tank 30. In step 438, the CPU 50 determines whether or not the sloshing flag is equal to "1". When the sloshing flag is equal to "1", the CPU 50 decides that sloshing of fuel in the fuel tank 30 has occurred, and ends execution of the routine shown in FIG. 18. When the sloshing flag is equal to "0", the CPU 50 executes step 438, in which "1" is added to the counter value of the negative pressure introduction counter C1.

In step 440, the CPU 50 determines whether or not the counter value of the negative pressure introduction counter C is equal to or greater than a predetermined time X (sec). When it is determined that $C < X$, the CPU 50 ends execution of the routine shown in FIG. 18. When it is determined that $C \geqq X$, the CPU 50 executes step 442, in which the in-tank pressure P is read on the basis of the detection signal of the pressure sensor 40. In step 444, the CPU 50 determines whether or not the in-tank pressure P is equal to or higher than a leakage decision value $\beta$. When it is determined that $P \geqq D$, the CPU 50 makes a decision that there is fuel leakage in the evaporative fuel purge system, and turns the warning lamp 41 ON in step 448. When it is determined that $P < \alpha D$, the CPU 50 determines that there is no fuel leakage, and turns the warning lamp 41 OFF in step 448. In step 450, the CPU 50 sets the end flag to "1".

Figure 17:
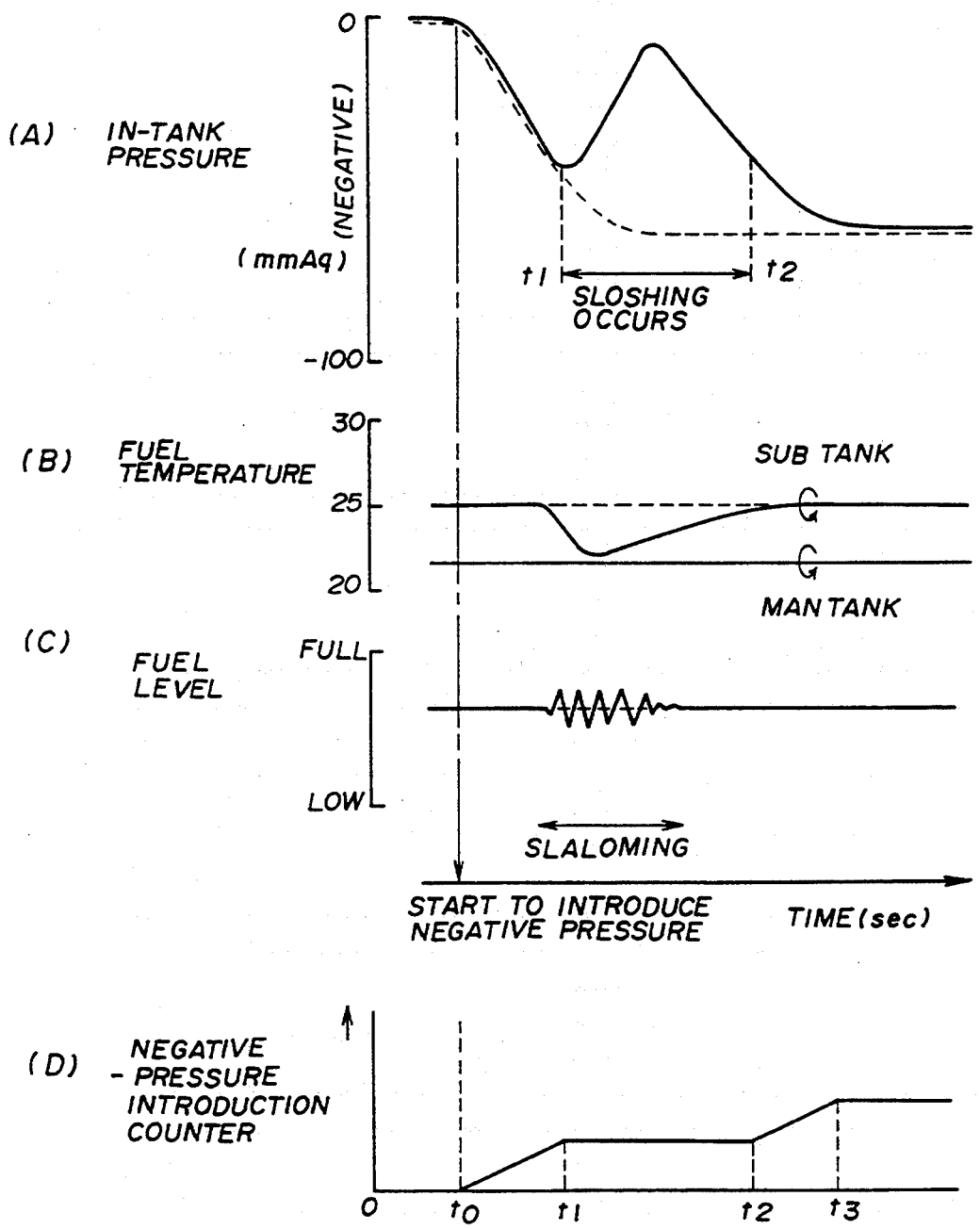
FIG. 17 is graphs illustrating the operation of the second embodiment of the present invention.

When there is no fuel leakage in the evaporative fuel purge system and there is no slashing at the time of diagnosing the system, as shown by the broken line in (A) of FIG. 17 the in-tank pressure in the fuel tank 30 starts to gradually decrease at time $t_0$ when the negative pressure is introduced into the fuel tank 30. If there is sloshing of fuel due to slaloming, as shown in the real line in (A) of FIG. 17, the in-tank pressure increases, and then decreases after the occurrence of sloshing stops. In this case, as shown in (D) of FIG. 17, the value of the negative pressure introduction counter C increases from time $t_0$ to time $t_1$, and does not change for a period between time $t_1$ and time $t_2$. At time $t_2$, the counter value the negative pressure introduction counter C starts to increase, and becomes equal to X (sec) at time $t_3$ when the failure diagnosing process is performed. That is, the execution of diagnosing is interrupted during the period between the times $t_1$ and $t_2$, and is not affected by sloshing of fuel.

When there is sloshing of fuel due to slaloming, as shown in (C) of FIG. 17, the fuel level greatly fluctuates. Hence, it is possible to make a decision as to whether or not sloshing of fuel has occurred.

FIG. 1B is a flowchart of a first variation of the sloshing decision routine according to the second embodiment of the present invention. The routine shown in FIG. 1B is executed every 32 msec by an interrupt to the CPU 50. In step 460, the CPU 50 reads the fuel level labeled L on the basis of the detection signal of the fuel level sensor 82. In step 462, the CPU 50 subtracts the previously read fuel level $L_{OLD}$ from the fuel level L obtained at step 462, so that a fuel level difference delta-L is calculated. In step 464, the CPU 50 writes the fuel level L into the previous fuel level variable $L_{OLD}$. In step 488, the CPU 50 reads the in-tank pressure P.

In step 468, the CPU 50 determines whether or not the absolute value of the fuel level difference delta-L is equal to or higher than a predetermined value $\tau$. When it is determined that $|\text{delta-L}| \geqq \tau$, the CPU 50 concludes that sloshing of fuel has occurred, and executes step 470 in which it is determined whether or not the sloshing flag is equal to "0". Only when the sloshing flag is equal to "0", the CPU 50 executes step 472 in which the previous in-tank pressure is written into the held pressure variable $P_S$. The CPU 50 sets the sloshing flag to 1 in step 474, and writes the in-tank pressure P into the previous in-tank pressure variable $P_{OLD}$ in step 476. Then, the CPU 50 ends execution of the routine shown in FIG. 18.

When it is determined, in step 468, that $|\text{delta-L}| < \tau$, the CPU 50 makes a decision that there is no slashing of fuel, and determines, in step 478, whether or not the sloshing flag is equal to "1". Only when sloshing flag is equal to "1", the CPU 50 determines whether or not the in-pressure P is equal to or lower than the held pressure $P_S$. When it is determined that $P \leqq P_S$, the CPU 50 sets the sloshing flag to "0", and writes the in-tank pressure P into the previous in-tank pressure variable $P_{OLD}$ in step 476. When it is determined, step 478, that the sloshing flag is equal to "0" or $P > P_S$, the CPU 50 executes step 476.

The temperature of the fuel in the sub tank 71*b* is higher than that of the fuel in the main tank 71*a* because there is fuel returned from the fuel injection valve 29 in the sub tank 71*b*. However, when sloshing of fuel has occurred, fuel flows from the main tank 71*a* to the sub tank 71*b*. Hence, as shown in (B) of FIG. 17, the temperature of the sub tank 71*b* decreases. It follows that a decision as to whether or not sloshing of fuel has occurred can be made by referring to the temperature of the fuel in the sub tank 71*b*.

Figure 19:
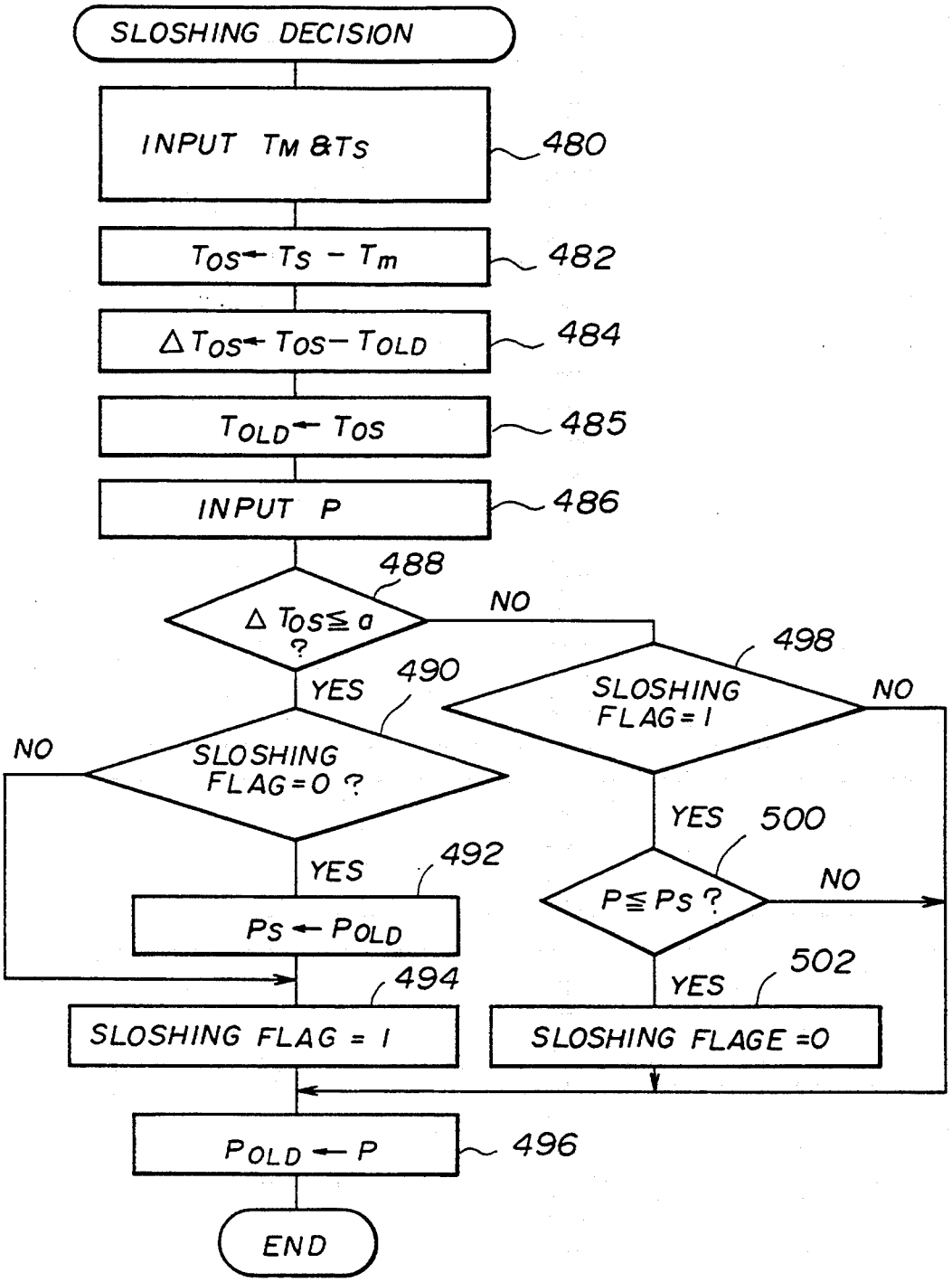
FIG. 19 is a flowchart of a second variation of the process shown in FIG. 15.

FIG. 19 is a flowchart of a second variation of the sloshing decision routine, which is executed every 32 msec, for example. In step, 480, the CPU 50 reads a main tank fuel temperature $T_M$ and a sub-tank fuel temperature $T_S$ from the detection signals of the fuel temperature sensors 80*a* and 80*b*. In step 482, the CPU 50 calculates a fuel temperature difference $T_{OS}$ by subtracting the main tank fuel temperature $T_M$ from the sub-tank fuel temperature $T_S$. In step 484, the CPU 50 calculates a variation delta-$T_{OS}$ in the fuel temperature by subtracting the previously obtained fuel temperature difference $T_{OLD}$ from the current fuel temperature difference $T_{OS}$. In step 484, the CPU 50 writes the fuel temperature difference $T_{OS}$ into the previous fuel temperature difference variable $T_{OLD}$. In step 486, the CPU 50 reads the in-tank pressure P.

In step 488, the CPU 50 determines whether or not the fuel temperature variation delta-$T_{OS}$ is equal to or lower than a leakage decision value a. When the determination result is YES, the CPU 50 determines whether or not the sloshing flag is equal to "0". When the result of the above determination is YES, the CPU 50 writes the previous in-tank pressure $P_{OLD}$ into the held pressure variable $P_S$ in step 492. In step 494, the CPU 50 sets the sloshing flag to "1", and writes the in-tank pressure P into the previous in-tank pressure variable $P_{OLD}$.

When it is determined, in step 488, that delta-$T_{OS} > a$, the CPU 50 makes a decision that no sloshing of fuel has occurred, and executes step 498 in which step it is determined whether or not the sloshing flag is equal to "1". Only when the sloshing flag is equal to "1", the CPU 50 determines, in step 500, whether or not the in-tank pressure P is equal to or lower than the held pressure $P_S$. When $P \leqq P_S$, the CPU 50 sets the sloshing flag to "0", and writes the in-tank pressure P into the previous in-tank pressure variable $P_{OLD}$ in step 496. When it is determined, in step 498, that the sloshing flag is equal to "0", or it is determined, in step 500, that $P > P_S$, the CPU 50 executes step 496, and ends execution of the routine shown in FIG. 19.

Figure 20:
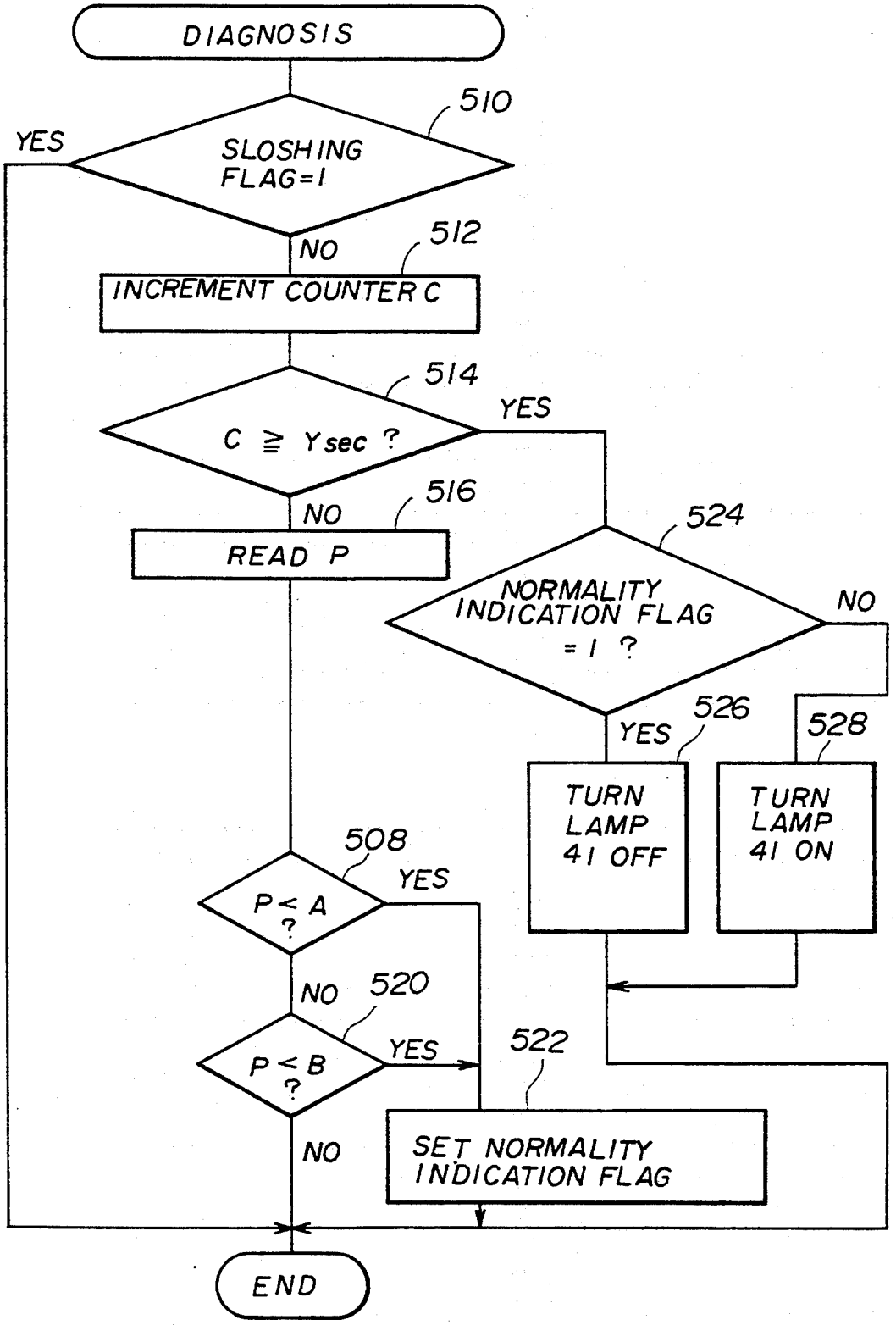
FIG. 20 is a flowchart of a third variation of the process shown in FIG. 15.

FIG. 20 is a flowchart of a third variation of the failure diagnosing routine according to the second embodiment of the present invention. The routine shown in FIG. 20 is performed every 64 msec by an interrupt to the CPU 50. In step 510, the CPU 50 determines whether or not the sloshing flag is equal to "1". When the result is affirmative, the CPU 50 concludes that sloshing of fuel has occurred and therefore ends execution of the routine shown in FIG. 20. When it is determined that the sloshing flag is not equal to "1", the CPU 50 executes step 512 in which 1 is added to the counter value of the counter C, which is reset to zero when the engine is started.

In step 514, the CPU 50 determines whether or not the counter value of the counter C is equal to or greater than a predetermined time Y (sec). When $C < Y$, the CPU 50 reads the in-tank pressure from the detection signal of the pressure sensor 40. In step 508, the CPU 50 determines whether or not the in-tank pressure P is lower than a predetermined value A (equal to, for example, −50 mmAq). When the determination result is negative, the CPU 50 determines whether or not the in-tank pressure P is lower than a leakage decision value (equal to, for example, +50 mmAq). When the result of the step-520 determination is NO, the CPU 50 decides that there is fuel leakage in the evaporative fuel purge system, and ends the procedure. When the result of the step 508 or 520 determination is YES, the CPU 50 sets a normality indication flag to "1" in step 522. The normality indication flag is reset to "0" when the engine is started.

It is determined, in step 514, that C≧Y, the CPU 50 determines, in step 524, whether or not the normality indication flag is equal to "1". When the determination result is YES, the CPU 50 turns the warning lamp 41 OFF in step 526. On the other hand, when the result of the step-524 determination is NO, the CPU 50 turns the warning lamp 41 ON.

Figure 21:
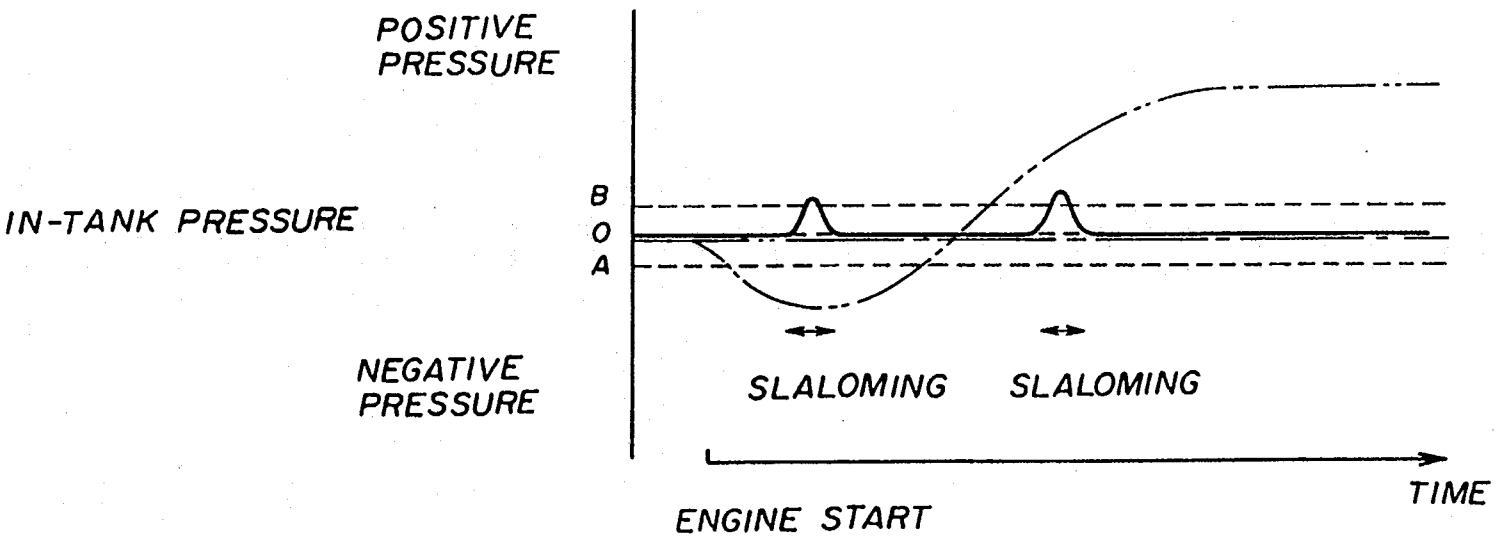
FIG. 21 is a graph showing the operation of the second embodiment of the present invention.

As shown in FIG. 21, the in-tank pressure is close to the atmospheric pressure (indicated by 0) when the engine is started in the cold state. Thereafter, the volume of fuel in the fuel tank 30 decreases due to consumption of fuel by injection decreases, as indicated by the two-dot chained line shown in FIG. 21. Then, the fuel temperature gradually increases due to the returned fuel and exhaust heat, and correspondingly the quantity of fuel vapor increases. Hence, the in-tank pressure increases towards the positive-pressure area, and reaches the set pressure by the control valve 78.

If fuel leakage has occurred in the evaporative fuel purge system, the in-tank pressure is kept close to the atmospheric pressure for the predetermined period Y, as indicated by the one-dot chained line. Hence, it is possible to determine whether or not the evaporative fuel purge system malfunctions by determining whether or not the in-tank pressure is within the range between the leakage decision values A and B. However, there is a possibility that the in-tank pressure may quickly increase and exceed the leakage decision value B if sloshing of fuel has occurred. With the above in mind, the process shown in FIG. 20 stops making the decision in order to prevent an erroneous decision.

Figure 22:
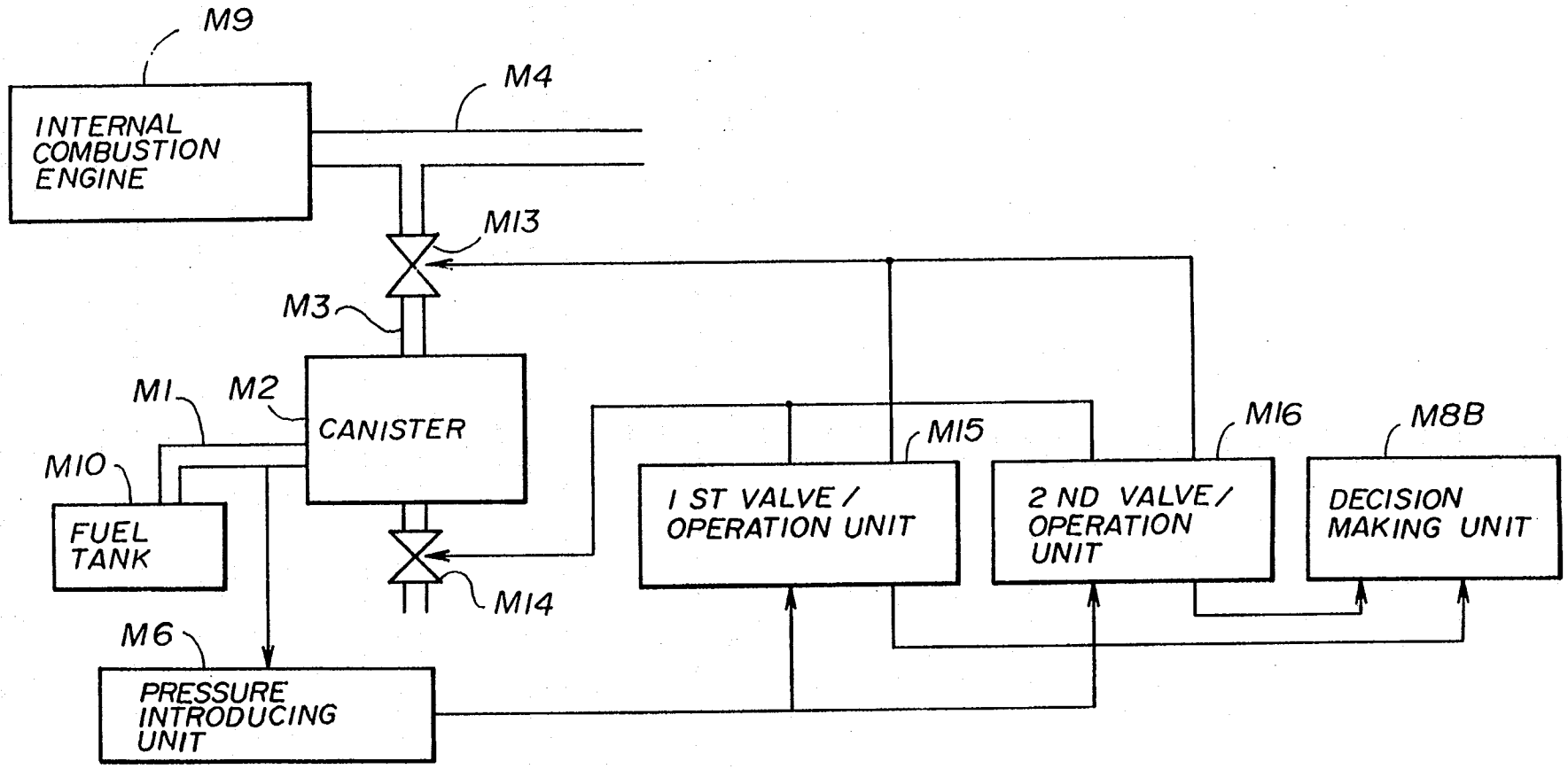
FIG. 22 is a block diagram of an overview of a third embodiment of the present invention.

A description will now be given of a third embodiment of the present invention. FIG. 22 shows an overview of the third embodiment of the present invention. In FIG. 22, parts that are the same as parts shown in the previously described figures are given the same reference numbers. A first control valve M13 is provided in the purge passage M3. A second valve M14 opens or closes an atmosphere aperture of the canister M2. A first valve control/operation unit M15 executes a first valve control operation. In the first valve control operation, the second control valve M14 is closed and the first control vale M13 is opened in order to introduce a pressure in the intake air passage M4 into the evaporative fuel purge system between the purge passage M3 and the fuel tank M10.

Thereafter, the first valve control/operation unit M15 closes the first control valve M13 and opens the second control valve M14. Then, the first valve control-/operation unit M15 calculates a first rate of variation in the pressure until the pressure in the evaporative fuel purge system changes to a positive pressure after reaching the atmospheric pressure. A second valve control-/operation unit M16 closes the first and second control valves M13 and M14 after a predetermined negative pressure is introduced in the evaporative fuel purge system, and calculates a second rate of variation in the pressure in the system which is maintained in the closed state. A decision making unit M8B makes a decision that a failure has occurred in the evaporative fuel purge system when the difference between the first rate and the second rate is equal to or greater than a leakage decision value.

When the first control valve M13 is opened, the pressure in the intake air passage M4 is applied to the canister M2 and the fuel tank M10 via the purge passage M3. When the engine is operating, a negative pressure in the intake air passage M4 is introduced into the evaporative fuel purge system. In this state, when the first control valve M13 is opened and the second control valve M14 is simultaneously closed. Thereby, the in-tank pressure becomes a negative pressure. Thereafter, the first control valve M13 is closed, and the second control valve M14 is opened. Hence, the atmosphere is introduced into the evaporative fuel purge system via the second control valve M14, and the in-tank pressure, increases towards the atmospheric pressure.

Then, the in-tank pressure increases to a positive pressure value as the quantity of fuel vapor increases. During this operation, the first valve control/operation unit M15 calculates the first rate of variation in the in-tank pressure by referring to the detection signal of the pressure detecting unit M6. The second rate of variation in the in-tank pressure in the system maintained in the closed state is reflected by fuel leakage in the system and the occurrence of fuel vapor. The decision making unit M8B subtracts the second rate of variation from the first rate of variation. The result of this subtraction does not include the influence of fuel vapor. In this manner, it becomes possible to prevent erroneous diagnosis.

The hardware structure of the third embodiment of the present invention is configured as shown in FIG. 2, and the microcomputer 21 used in the third embodiment is configured as shown in FIG. 3.

Figure 23:
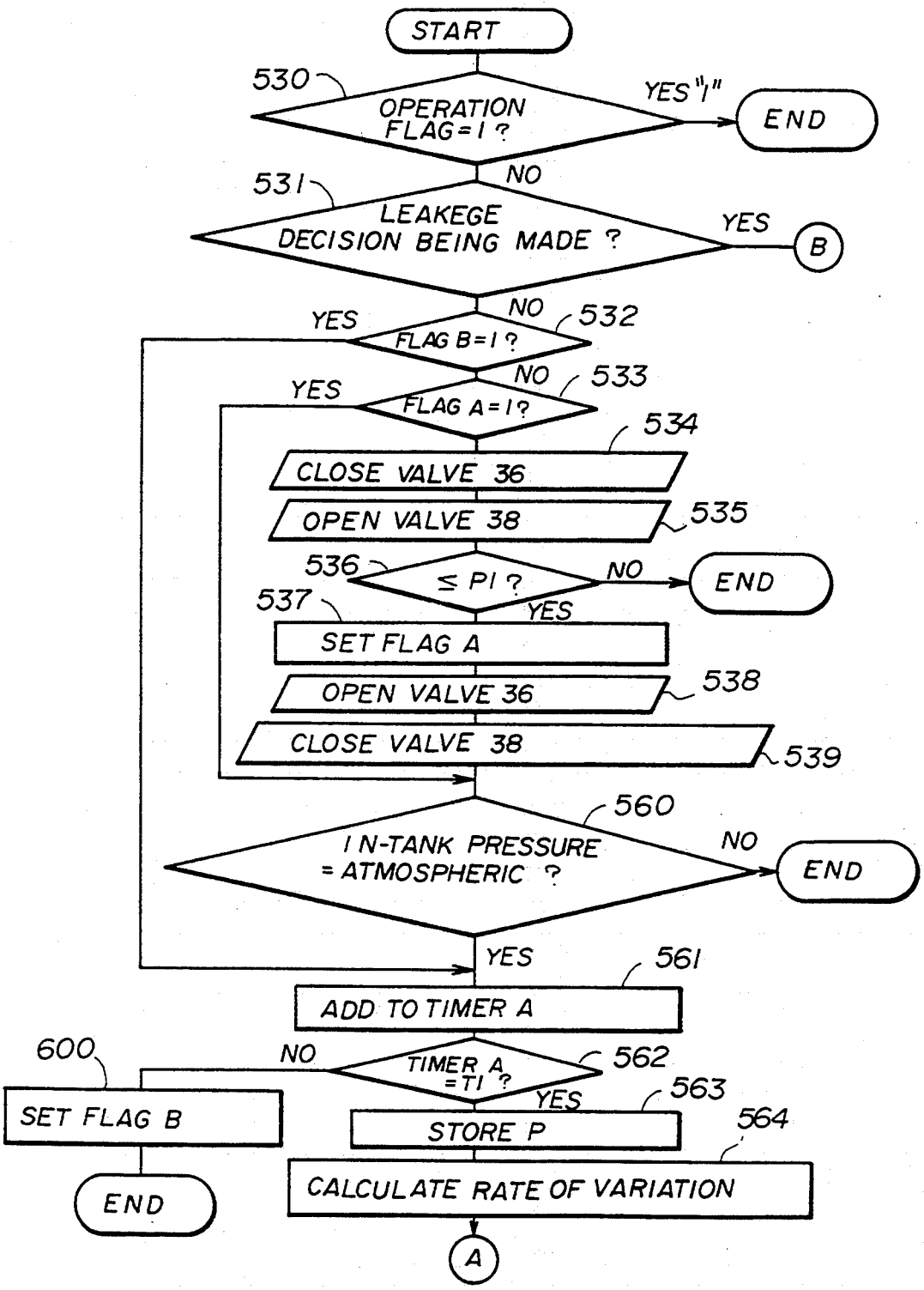
FIGS. 23 and 24 are flowcharts of the operation of the third embodiment of the present invention.
Figure 24:
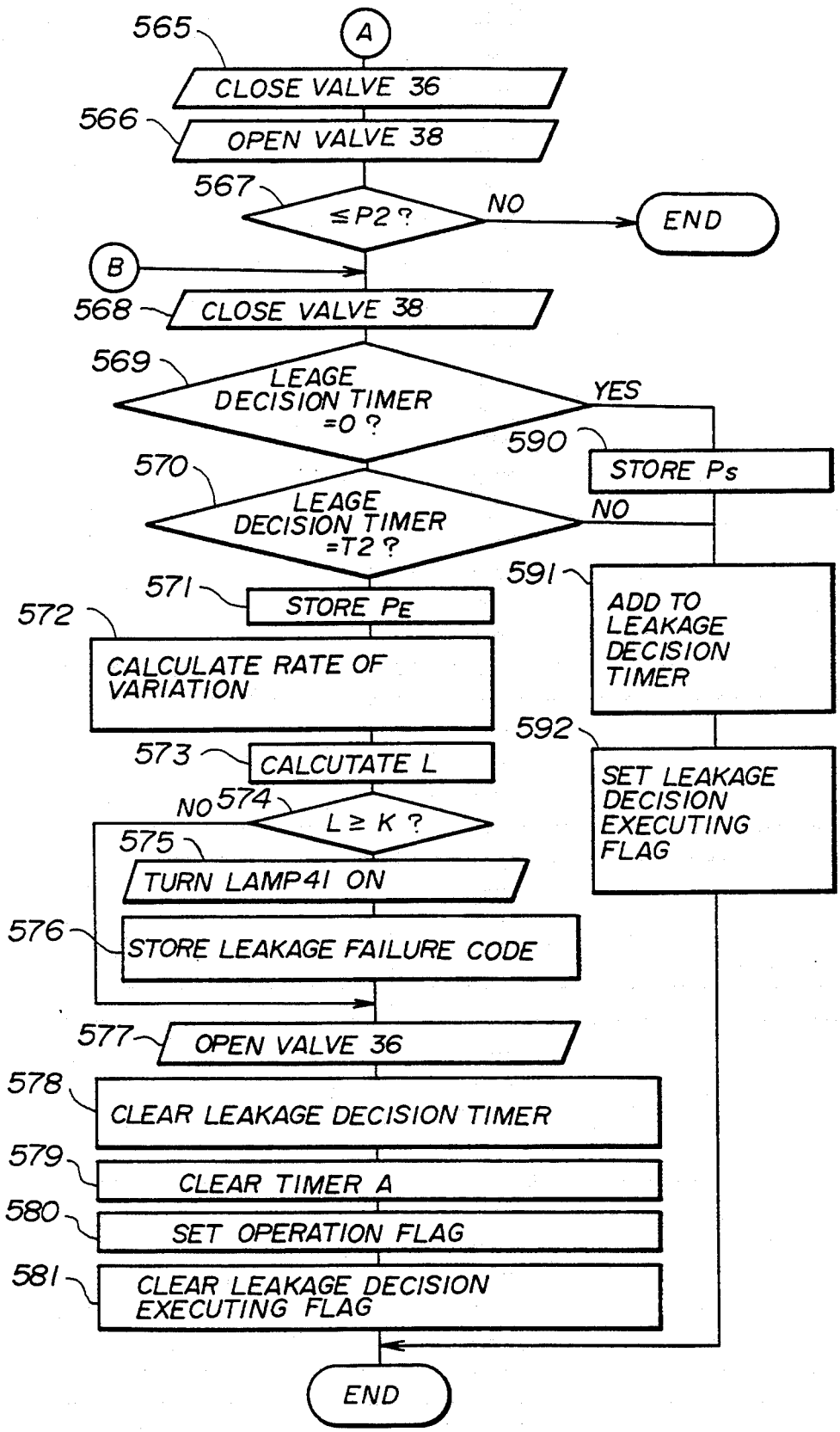

FIG. 23 is a flowchart of the operation of the third embodiment, which is executed every 65 ms, for example. In step 530, the CPU 50 determines whether or not the operation flag is equal to "1". When the determination result is YES, the CPU 50 ends execution of the routine shown in FIG. 23. When it is determined that the operation flag is not equal to "1", the CPU 50 determines whether or not the leakage decision executing flag is active in step 531. When the determination result is YES, step 568 shown in FIG. 24 is executed. In the other case, the CPU 50 determines, in step 532, whether or not a flag B (which will be described later) is equal to "1". When the determination result is NO, the CPU 50 determines, in step 533, whether or not a flag A (which will be described later) is equal to "1". The flags A and B are reset by the initial routine executed when the engine is started. When the steps 532 and 533 are successively executed for the first time after the engine is started, the results of these determinations are NO. In this case, the CPU 50 executes step 534, in which the valve 36 is closed to separate the atmosphere aperture 34 of the canister 33 from the atmosphere. In step 515, the CPU 50 opens the purge control valve 38.

Figure 25:
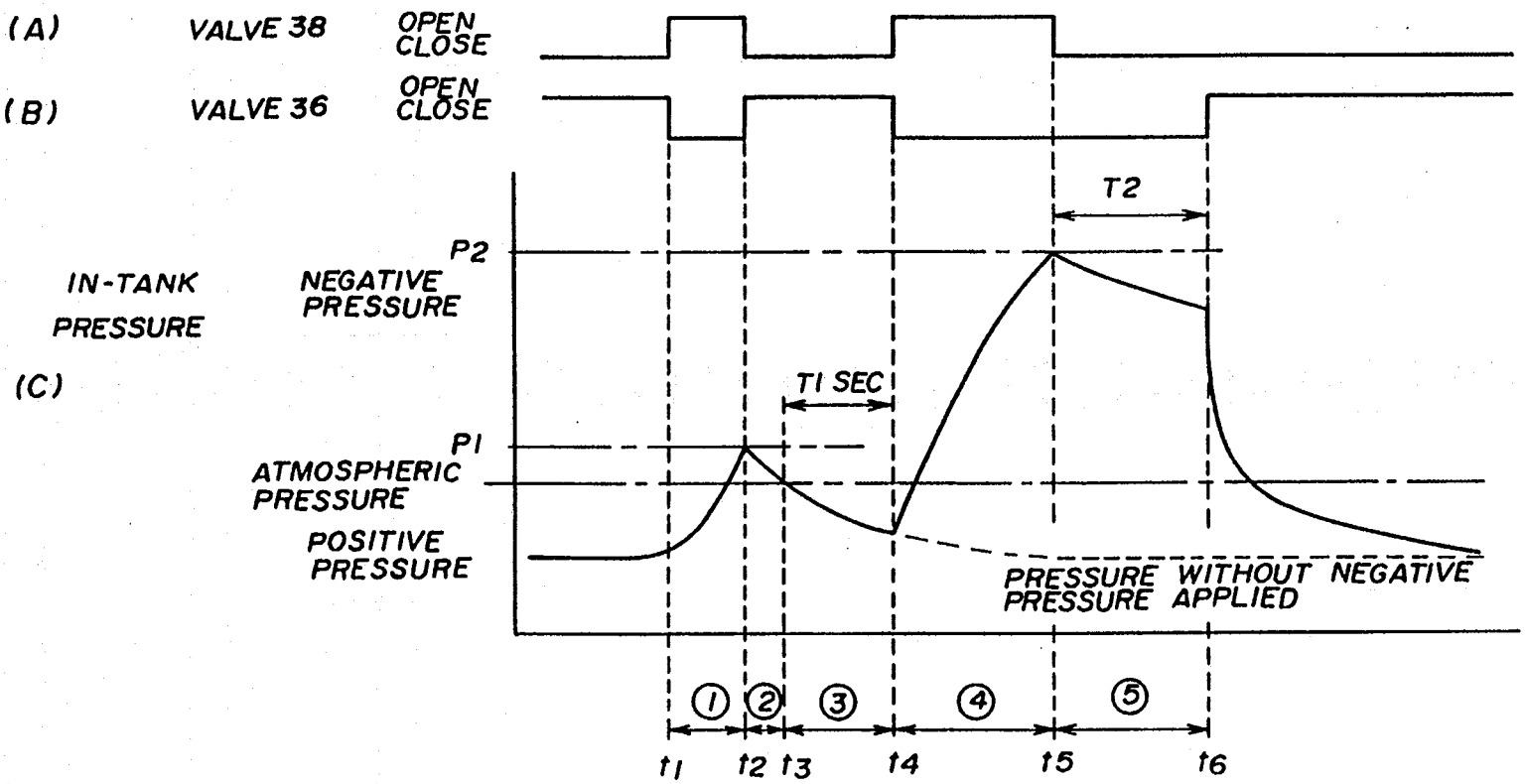
FIG. 25 is a time chart of the operation of the third embodiment of the present invention.

When the valve 38 is opened at the almost the same time (time $t_1$) as the valve 36 is closed, as shown in FIG. (A) and (B) of FIG. 25, the negative pressure in the intake air passage 24 is applied to the fuel tank 30 via the purge passage 39, the purge control valve 38, the purge passage 37, the canister 33 and the vapor passage 20. Hence, the pressure in the fuel tank 30 rapidly decreases after the time $t_1$, as shown in (C) of FIG. 25. In step 536, the CPU 50 determines whether or not the in-tank pressure is equal to lower than a predetermined negative pressure P1 (Pa) on the basis of the detection signal from the pressure sensor 40. When it is determined that the in-tank pressure is higher than the predetermined negative pressure P1, the CPU 50 decides that the setting of negative pressure continues, and ends execution of the routine shown in FIG. 23. The steps 530–536 are repeatedly carried out until the in-tank pressure becomes equal to or lower than the predetermined negative pressure. In FIG. 25, the above repetitive operation is executed for a period 1.

When it is determined, step 536, that the in-tank pressure is equal to or lower than the predetermined negative pressure P1, the CPU 50 sets the flag A to "1" in step 537 in order to indicate that the setting of negative pressure has been completed. The CPU 50 opens the valve 36 in step 538, and closes the purge control valve 38 in step 539. When the valve 36 is opened and the purge control valve 38 is closed at time $t_2$, as shown in (A) and (B) of FIG. 25, the fuel tank 30 is released to the atmosphere via the valve 36, the atmosphere passage 35, the atmosphere aperture 34, the canister 33 and the vapor passage 32. As shown in (C) of FIG. 25, the in-tank pressure increases after the time $t_3$, and becomes equal to the atmospheric pressure at time $t_3$. Fuel vapor passes through the orifice 42 of the vapor passage 32 and increases the in-tank pressure due to the passage resistance of the orifice 42. Hence, the in-tank pressure becomes a positive pressure after the time $t_3$.

In step 560, the CPU 50 determines whether or not the in-tank pressure is equal to the atmospheric pressure. When the determination result is NO, the CPU 50 decides that the fuel tank 30 is still opened to the atmosphere, and ends execution of the routine shown in FIG. 23. When the next execution of the routine, the CPU 50 decides, in step 533, that the flag A is active, and jumps to step 580. In the above manner, the steps 530–533 and 580 are repeatedly performed in the state in which the fuel tank 30 is continuously opened to the atmospheric pressure until it is determined that the in-tank pressure is equal to the atmospheric pressure. The above repetitive operation is carried out for period 2.

When it is determined, in step 560, that the in-tank pressure is equal to the atmospheric pressure, the. CPU 50 adds a predetermined value to the current timer value of the timer A in step 561, and determines, in step 562, whether or not the timer value of the timer A corresponds to a predetermined period T1 (seconds). When the result of this step is NO, the CPU 50 executes step 600 in which the flag B is activated in order to indicate that the rate of variation in the in-tank pressure due to the occurrence of fuel vapor is being measured.

When the routine shown in FIG. 23 starts again, it is determined, in step 532, that the flag B is active, and executes step 562 after executing step 561. The above operation is repeatedly carried out until it is determined that the value of the timer A corresponds to the predetermined time T1 (seconds) (period 3).

When the value of the timer A reaches the predetermined time T1 (seconds), in step 563 the CPU calculates the difference $P_F$ between the current pressure indicated by the detection signal from the pressure sensor 40 and the atmospheric pressure, and stores the pressure difference $P_F$ in the RAM 52. In step 564, the CPU 50 calculates an evaporative fuel variation rate F by using formula $F=(P_F/T1)\times C$ where C is a correction coefficient, $P_F$ is the pressure of the fuel vapor. The evaporative fuel variation rate F is a rate of variation occurring when the in-tank pressure changes from the atmospheric pressure to a positive pressure, and indicates the degree of influence of fuel vapor to the in-tank pressure. In the above formula, "C" is a correction coefficient used to convert the average rate ($P_F$/T1), of variation during the period 3 in which the in-tank pressure changes from the atmospheric pressure to a positive pressure into an average rate of variation during a period 5 in which the in-tank pressure varies under the negative-pressure condition. The correction coefficient is a value greater than 1.

In the above-mentioned manner, the evaporative fuel variation rate indicative of the influence of fuel vapor to the in-tank pressure is calculated, and the CPU 50 a fuel leakage decision process shown in FIG. 24. Steps 565 to 572 correspond to the operation of the second valve control/operation unit M16 shown in FIG. 22.

First of all, the CPU 50 closes the valve 36 in step 565, and opens the purge control valve 38 in step 566 in order to apply a negative pressure to the fuel tank 30. When the steps 565 and 566 are concurrently performed at the time $t_4$ as shown in (A) and (B) of FIG. 25, a negative pressure in the intake air passage 24 is introduced into the fuel tank 30, and the in-tank pressure quickly decreases after the time $t_4$, as shown in (C) of FIG. 25.

The CPU 50 determines, in step 567, whether or not the in-tank pressure is equal to or lower than a predetermined negative pressure P2 (Pa). The steps 530–532 (FIG. 23) and steps 565–567 are repeatedly carried out until the in-tank pressure reaches the predetermined negative pressure P2 (Pa). The above repetitive operation is executed for the period 4. When it is determined, in step 567, that the in-tank pressure becomes equal to or lower than the predetermined negative pressure P2 (Pa), the CPU 50 closes the purge control valve 38 in step 568. Hence, the evaporative fuel purge system between the purge passage 39 and the fuel tank 30 is maintained in the closed state and the negative pressure introduced therein is held.

When the purge control valve 38 is closed at the time $t_5$ as shown in (A) of FIG. 25, the in-tank pressure increases after the time $t_5$ in response to the occurrence of fuel vapor, as shown in (C) of FIG. 25. If there is leakage of fuel in the evaporative fuel purge system, an ambient air is introduced in the system. Hence, the in-tank pressure quickly changes towards the atmospheric pressure due to the function of the occurrence of fuel vapor and fuel leakage. According to the third embodiment of the present invention, a leakage decision pressure variation rate T, dependent on in-tank pressure variation arising from fuel leakage and in-tank pressure variation arising from the occurrence of fuel vapor, is calculated from the in-tank pressure obtained at the time $t_5$ (diagnosis starting pressure $P_S$) and the in-tank pressure (diagnosis end pressure $P_E$) obtained at time $t_6$ after the predetermined time T2 (seconds) from the time $t_5$. The leakage decision pressure variation rate T is used to determine whether or not a failure has occurred in the evaporative fuel purge system.

Steps 569–572 and steps 590–592 shown in FIG. 24 are intended to calculate the leakage decision pressure variation rate T. The CPU 50 closes the purge control valve 38 in step 568, and determines, in step 569, whether or not the leakage decision timer indicates "0". Since the leakage decision timer is reset to "0" by the initial process executed when the engine is started, the result of the step-569 determination executed for the first time after the engine is started is YES. In step 590, the CPU 50 reads the diagnosis starting pressure $P_S$ obtained at this time.

Then, the CPU 50 adds a predetermined value to the value of the leakage decision timer in step 591, and sets the leakage decision executing flag to "1" in step 592. When it is determined, in step 531 (FIG. 23), that the leakage decision operation is being carried out, the CPU 50 executes step 568 without executing the steps 102–117.

In step 569, the CPU 50 determines whether or not the leakage decision timer indicates "0". At this time, the determination result is NO. In step 570, the CPU 50 determines whether or not the leakage decision timer indicates the value corresponding to the predetermined period T2 (seconds). When the determination result is NO, the CPU 50 executes steps 201 and 202, and ends execution of the routine shown in FIG. 24. The above operation is repeatedly carried out until it is determined, in step 570, that the leakage indicates the value corresponding to the predetermined period T2 (period t in FIG. 25).

When it is determined, in step 570, that the leakage decision timer indicates the value corresponding to the predetermined period T2, the CPU 50 reads the diagnosis end pressure $P_E$ obtained from the pressure sensor 40 at this time, and stores it in the RAM 52 in step 571. Then, the CPU 50 calculates the leakage decision pressure variation rate T ($=P_E-P_S$) in step 572. As has been described, the leakage decision variation rate T reflects pressure variation due to the occurrence of fuel vapor and introduction of ambient air due to fuel leakage, and varies in accordance with the status of the occurrence of fuel vapor. Particularly, when the fuel in the tank 30 is highly volatile or when the temperature of the fuel is high, the leakage decision pressure variation rate T is great even if there is no leakage in the evaporative fuel purge system.

With the above in mind, steps 573 and 574 corresponding to the process of the decision unit M8B (FIG. 22) cancel the influence of occurrence of fuel vapor in order to prevent erroneous diagnosis caused by fuel leakage. More particularly, in step 573 the evaporative fuel variation rate F is subtracted from the leakage decision pressure variation rate T, so that the variation rate L due to fuel leakage is calculated. In step 574, it is determined whether or not the variation rate L due to fuel leakage is equal to or greater than a predetermined value k. The occurrence of fuel leakage can be detected on the basis of the result of the step-574 determination.

When it is determined, in step 574, that L is equal to or greater than k, the CPU 50 determines that a failure has occurred in the evaporative fuel purge system. Then, the CPU 50 turns the warning lamp 41 ON in step 575, and stores the aforementioned leakage failure code in the backup RAM 53 in step 576. When the result of the step-574 determination is NO, the CPU 50 makes a decision that the evaporative fuel purge system is normally operating, and executes step 577 without executing steps 575 and 576. In step 577, the CPU 50 opens the valve 36. When step 577 is performed at time $t_6$ as shown in (B) of FIG. 25, the in-tank pressure increases after the time $t_6$ and reaches the in-tank pressure observed before the diagnosing operation is started.

Subsequent to step 577, the CPU 50 clears the leakage decision timer in step 578, and clears the timer A in step 579. Further, the CPU 50 sets the operation flag to "1" in step 580, and clears the leakage decision executing flag in step 581. Thereafter, the CPU 50 ends execution of the routine shown in FIG. 24. Since the operation flag is kept active "1" and the diagnosing operation is not carried out until the engine is started.

In the above-described third embodiment of the present invention, the pressures $P_S$ and $P_E$ are measured after the evaporative fuel pressure $P_F$ is measured. Alternatively, it is possible to measure the evaporative fuel pressure $P_F$ at the time of opening the fuel tank 30 to the atmosphere after the pressures $P_S$ and $P_E$ are measured.

Figure 26:
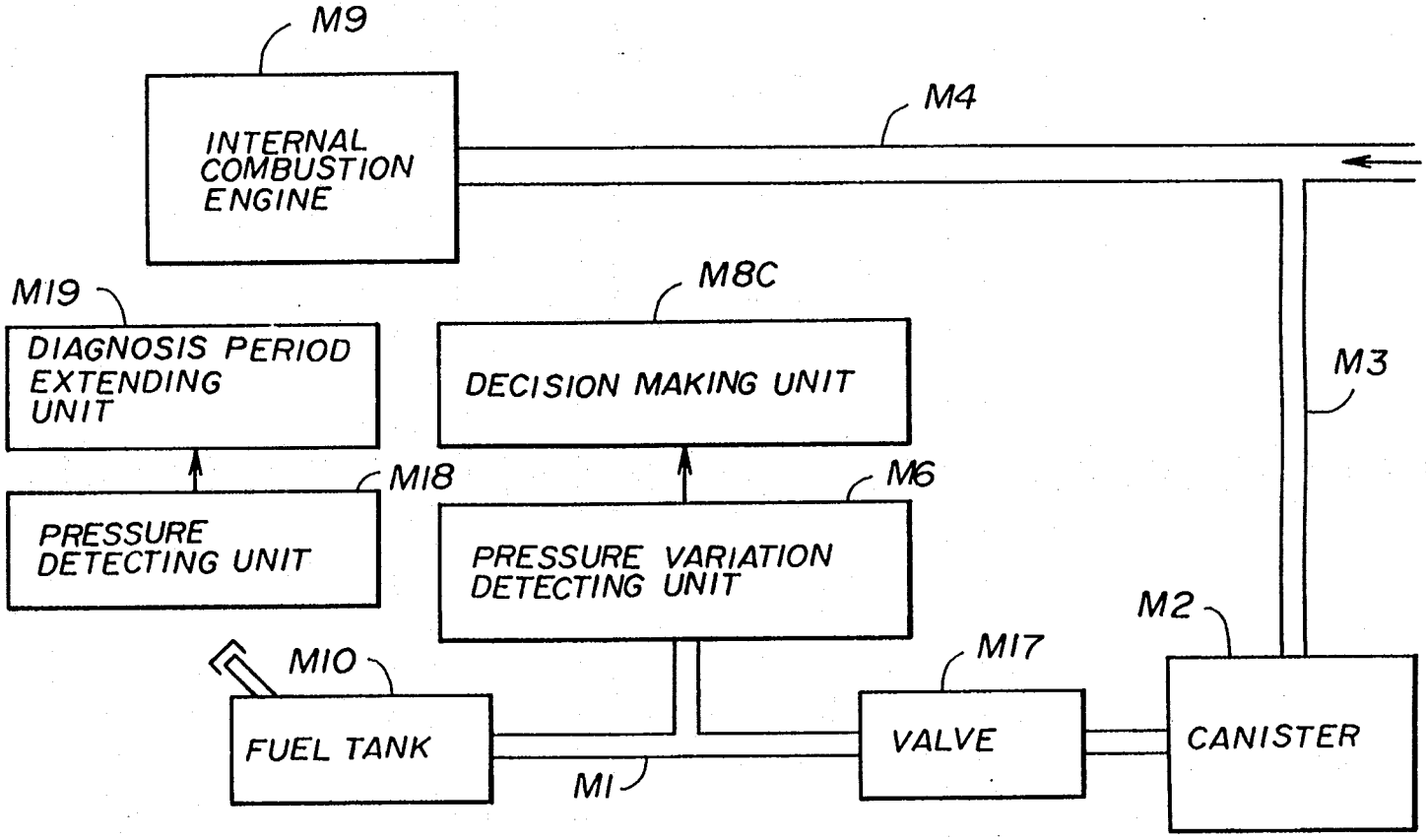
FIG. 26 is a block diagram of an overview of a fourth embodiment of the present invention.

FIG. 26 is a block diagram of an overview of a fourth embodiment of the present invention. In FIG. 26, parts that are the same as parts shown in the previously described figures are given the same reference numbers. A valve 17 keeps the pressure in the fuel tank M10 at a positive pressure or below. A decision making unit M8C decides that a failure in the evaporative fuel purge system has occurred when a variation in the pressure in a passage between the fuel tank M10 and the valve M17 obtained for a predetermined diagnosing period is equal to or less than a predetermined value. A specific condition detecting unit M18 detects a specific condition in which fuel vapor does not occur easily. A diagnosing period extension unit M19 extends the above-mentioned diagnosing period when the condition detecting unit M18 detects the specific condition.

There is a possibility that the pressure in the fuel tank M10 may not greatly change for the predetermined diagnosing period. This is because the fuel temperature does not greatly increase for the predetermined diagnosing period after the engine is started, and hence only a small amount of fuel vapor occurs. In the above case, an erroneous decision may be made. The fourth embodiment of the present invention is intended to eliminate the above problem.

Figure 27:
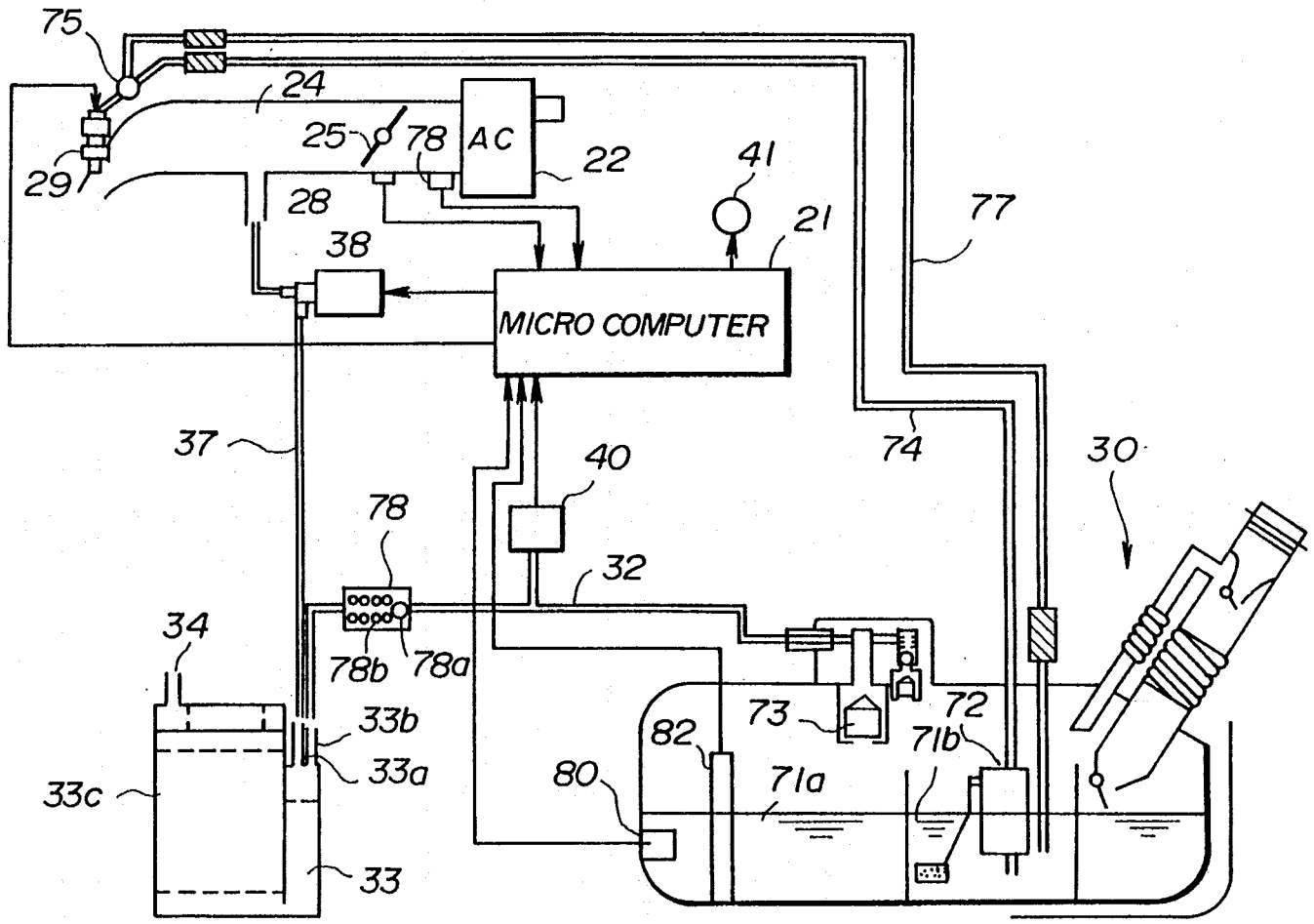
FIG. 27 is a diagram of the system structure of the fourth embodiment of the present invention.

FIG. 27 shows the system structure of the fourth embodiment of the present invention. In FIG. 27, parts that are the same as parts shown in the previously described figures are given the same reference numbers. A fuel temperature sensor 80 measures the temperature of fuel in the fuel tank 30.

Figure 28:
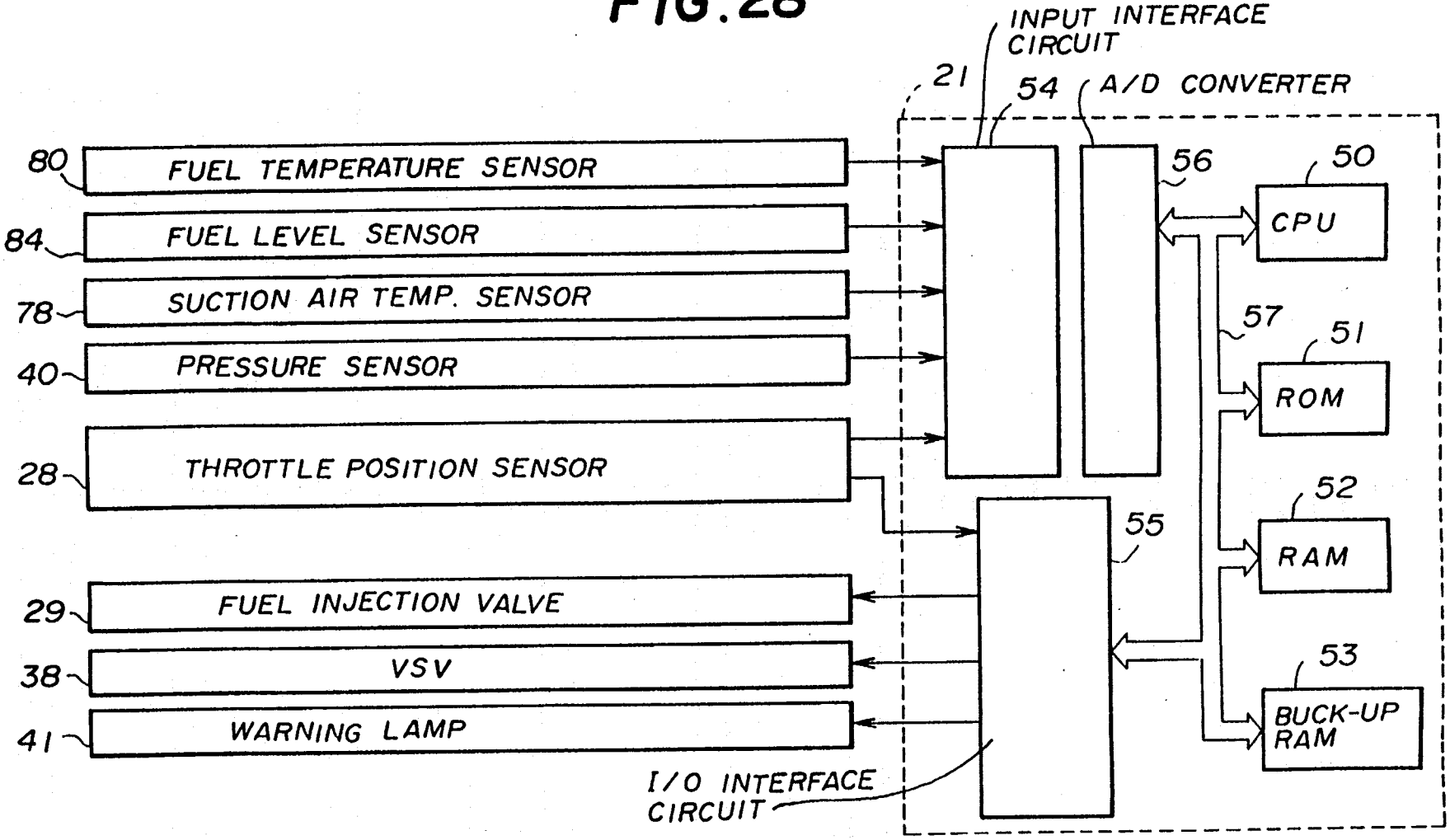
FIG. 28 is a block diagram of the hardware structure of the fourth embodiment of the present invention.

FIG. 28 shows the hardware structure of the microcomputer 21. As shown in FIG. 28, the microcomputer 21 used in the fourth embodiment of the present invention is configured as shown in FIG. 3.

A description will be given of the operation of the second embodiment of the present invention. When the engine is started by turning the starter switch 43 ON, fuel in the sub tank **71*b* of the fuel tank 3O is fed to the pressure regulator 75 via the pipe 74. The pressure regulator 75 regulates the pressure of the fuel at a fixed level, and supplies the regulated fuel to the fuel injection valve 29, which injects the fuel into the intake pipe 24 for a fuel injection time specified by the microcomputer 21. Fuel which is not used is fed back to the sub tank 71*b* via the fuel returning pipe 77**.

Fuel vapor occurring in the fuel tank 30 passes through the vapor passage 32 and reaches the valve 78 since the bypass control valve 62 is opened. When the pressure in the fuel tank 30 is less than the set pressure (250 mmAq, for example) of the valve 78, the check ball **78*a* is located at the position shown in FIG. 13 due to the function of the spring 78*b*, so that the vapor passage 32 is disconnected from the canister 33. Hence, the fuel vapor cannot be transferred to the canister 33**.

For example, when the engine is started in the cold state thereof, the in-tank pressure is approximately equal to the atmospheric pressure, and the volume of fuel decreases due to a fuel injection carried out immediately after the engine is started. Hence, the in-tank pressure decreases and becomes a negative pressure. Thereafter, the temperature of the engine gradually increases and the quantity of fuel vapor increases. Hence, the in-tank pressure increases towards the positive-pressure area, and becomes equal to the set pressure by the valve 78.

When the in-tank pressure becomes equal to or higher than the set pressure, the check ball 78a in the valve 78 is moved against the spring force of the spring 78b. Hence, the fuel vapor from the fuel tank is allowed to pass through the valve 78 and reach the canister 33. The fuel vapor adheres to the active carbon 33c, in the canister 33. When the fuel vapor leaves the canister 33, the in-tank pressure decreases. When the in-tank pressure becomes equal to or lower than the set pressure by the valve 78a, the valve 78 is closed again.

As described above, when there is no fuel leakage in the vapor passage 32 or the fuel tank 30, fuel vapor in the tank 30 passes through the valve 78 and adheres to the active carbon 33c, in the canister 33. Immediately after the engine is started, the purge control condition is not satisfied because the purge control valve 38 is closed. The purge control condition defines a condition that makes it possible to minimize deterioration of drivability and exhaust emission even if the air-fuel ratio deviates due to purging. For example, the purge control condition required that 1) the engine coolant temperature is equal to or higher than a predetermined temperature, 2) the quantity of intake air is equal to or greater than a predetermined quantity during a feedback control in which fuel injection is controlled so as to become equal to a target air-fuel ratio, and 3) a fuel cutting operation is not performed. The microcomputer 21 supervises the purge control condition.

When the microcomputer 21 decides that the purge control condition is satisfied, the microcomputer 21 opens the purge control valve 38. Due to the negative pressure in the intake pipe 24, the atmosphere is introduced into the canister 33 via the atmosphere aperture 34 thereof, and the fuel is removed from the active carbon 33c. Then, the fuel vapor is sucked into the intake pipe 24 via the purge passage 37 and the purge control valve 38. The active carbon 33c, in the canister 33 is refreshed due to the removing of the fuel vapor. Hence, the quantity of fuel vapor from the fuel tank 30 gradually increases.

Figure 29:
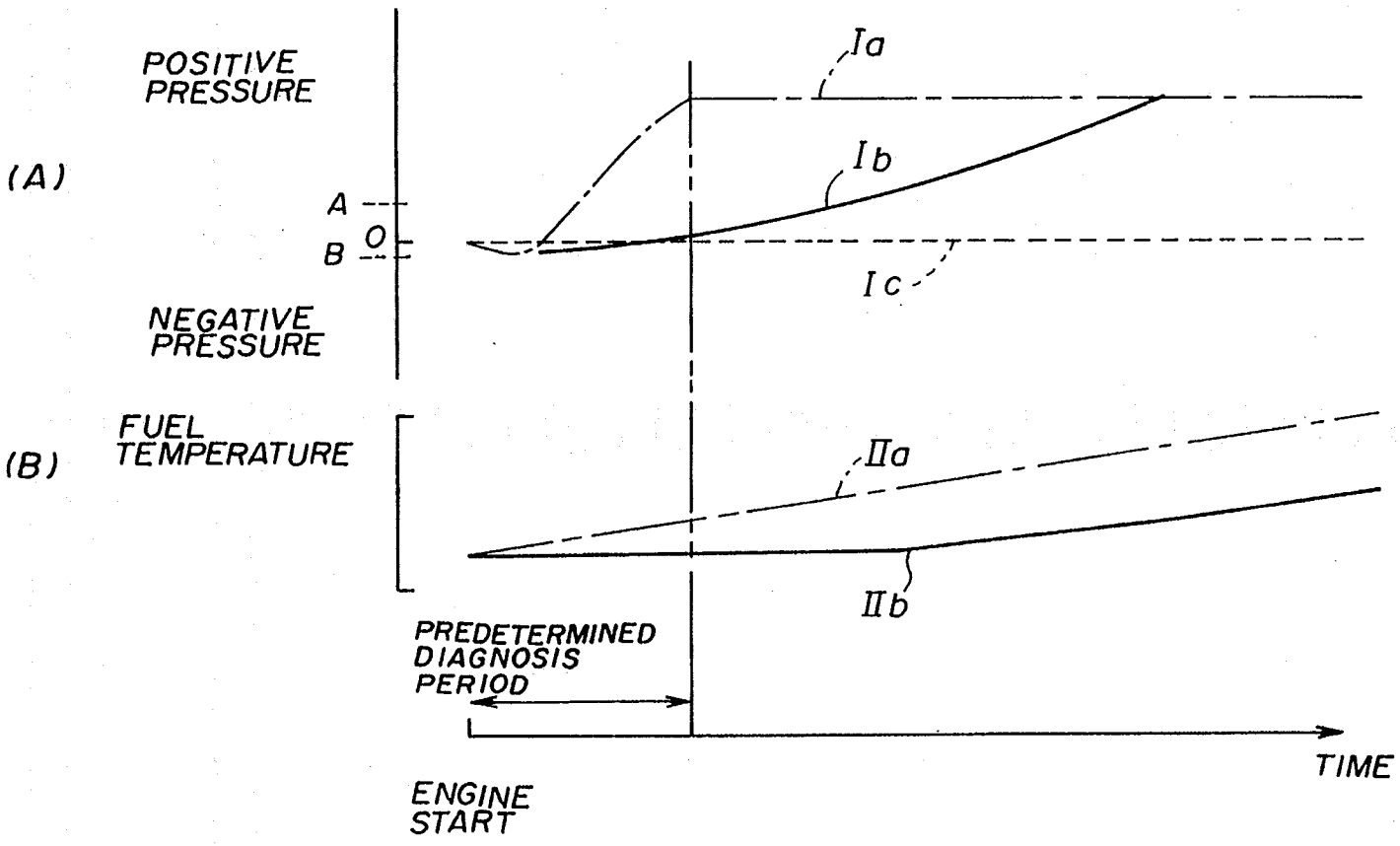
FIG. 29 is a time chart of the operation of the fourth embodiment of the present invention.

When the fuel level is low, the fuel temperature increases rapidly, as indicated by a one dot chained line IIa in (B) of FIG. 29. When the fuel level is high, the fuel temperature increases slowly, as indicated by a solid line IIb in (B) of FIG. 29. As the increasing rate of the fuel temperature increases, a larger amount of fuel vapor occurs. In the case where the fuel level is low even when there is no fuel leakage, the in-tank pressure increases rapidly, as indicated by a one-dot chained line Ia in (A) of FIG. 29. In the case where the fuel level is high even when there is no fuel leakage, the in-tank pressure increases slowly, as indicated by a solid line Ib in (A) of FIG. 29. In case where there is fuel leakage, the in-tank pressure is approximately equal to the atmospheric pressure, as indicated by a broken line Ic in (A) of FIG. 29.

Figure 30:
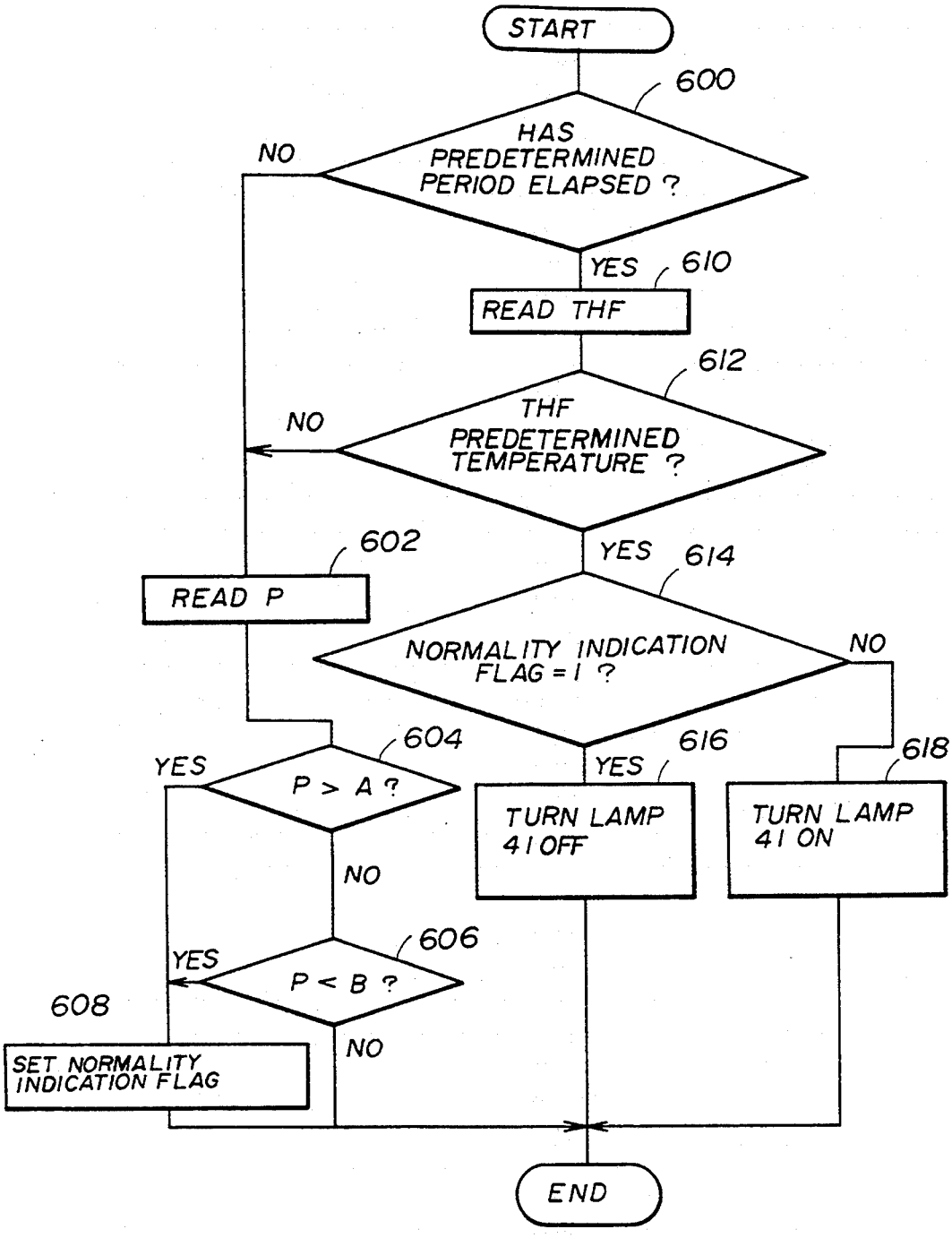
FIG. 30 is a flowchart of the operation of the fourth embodiment of the present invention.

A description will now be given of a diagnosing operation on the evaporative fuel purge system according to the fourth embodiment of the present invention. FIG. 30 is a flowchart of a diagnosing routine according to the fourth embodiment of the present invention. The routine shown in FIG. 30 is carried out every 64 msec, for example.

In step 600, the CPU 50 determines whether or not a predetermined period (equal to, for example 5–10 minutes) has elapses after the engine is started. When the determination result is NO, the CPU 50 reads the in-tank pressure P from the detection signal from the pressure sensor 40 in step 602. In step 604, the CPU 50 determines whether or not the in-tank pressure P is higher than a leakage decision value A. When the determination result is NO, the CPU 50 determines whether or not the in-tank pressure P is higher than a leakage decision value B. As shown in (A) of FIG. 29, the leakage decision value A is a positive pressure slightly higher than the atmospheric pressure, and the leakage decision pressure B is a negative pressure slightly lower than the atmospheric pressure.

When $P>A$ or $P<B$, the CPU 50 decides that the evaporative fuel purge system is normally operating, and sets the normality indication flag to "1" in step 608. Then, the CPU 50 ends execution of the routine shown in FIG. 30. When it is determined that $B \leqq P \leqq A$, the CPU 50 decides that there may be a failure in the evaporative fuel purge system, and ends execution of the routine.

When it is determined, in step 600, that the predetermined period has elapsed after the engine is started, the CPU 50 reads a fuel temperature THF from the detection signal from the fuel temperature sensor 80 in step 610. Then, the CPU 50 determines, in step 612, whether or not the fuel temperature THF is higher than a predetermined fuel temperature. The predetermined temperature is equal to, for example, 35° C. above which a large quantity of fuel vapor will occur. When the result of the step-612 determination is NO, CPU 50 decides that there is a small quantity of fuel vapor, and executes step 602. When the fuel temperature THF is higher than the predetermined fuel temperature, the CPU 50 decides that a sufficient quantity of fuel vapor has occurred, and determines, in step 614, whether or not the normality indication flag is active. When the determination result is YES, the CPU 50 turns the warning lamp 41 OFF in step 616. When the result of the step-614 determination is NO, the CPU 50 turns the warning lamp 41 ON in step 618.

According to the fourth embodiment of the present invention, in case where the fuel temperature is lower than the predetermined fuel temperature and a small quantity of fuel vapor occurs when the predetermined diagnosing period has elapsed after the engine is started, the diagnosing period is extended, and the diagnosing operation continues after the predetermined diagnosing period, as shown in the solid line Ib shown in (A) of FIG. 29.

Figure 31:
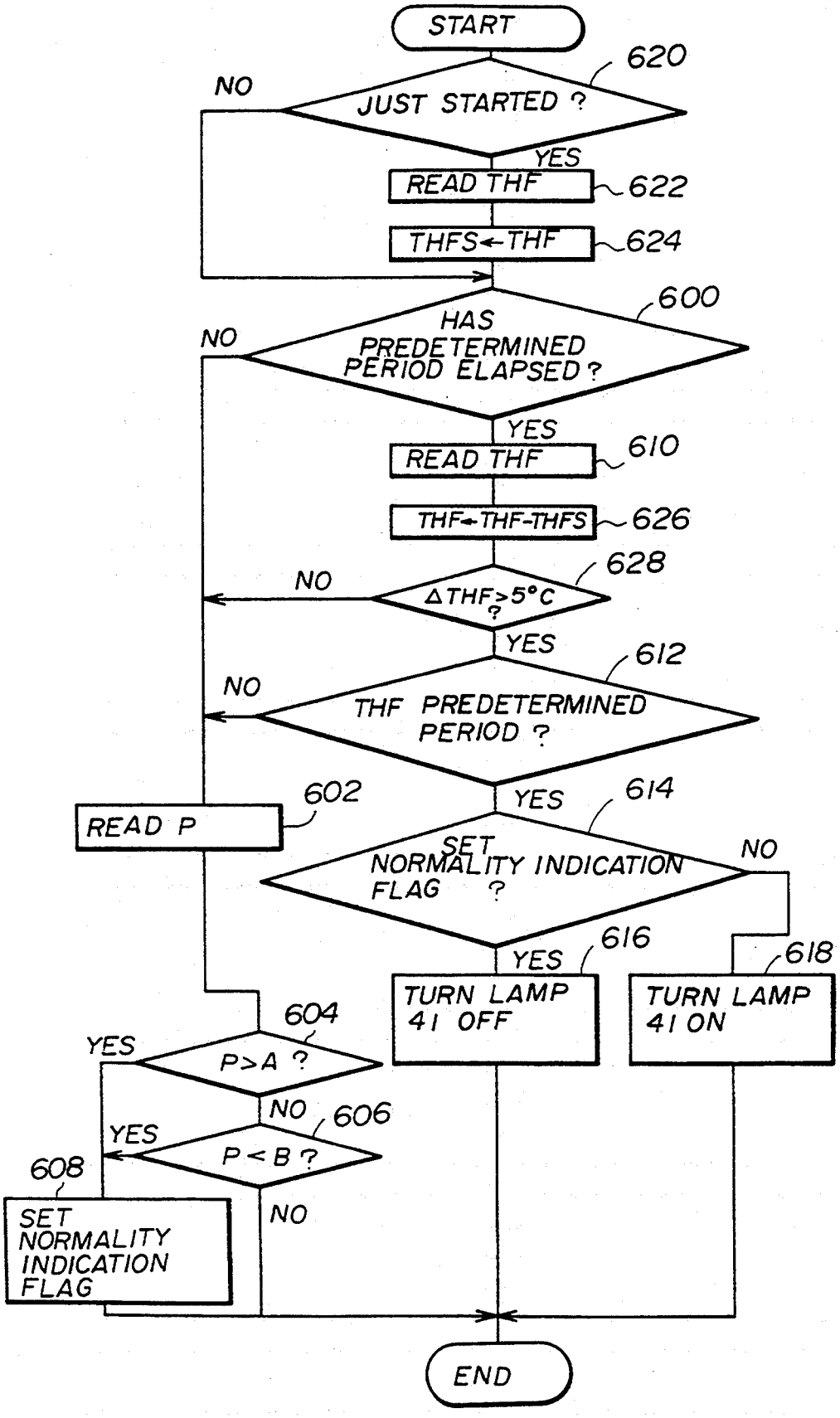
FIG. 31 is a flowchart of a first variation of the operation shown in FIG. 30.

FIG. 31 is a flowchart of a variation of the routine shown in FIG. 30. In FIG. 31, steps that are the same as steps shown in FIG. 30 are given the same reference numbers. In step 620, the CPU 50 determines whether or not the starter switch 43 is turned ON. When the determination result is YES, the CPU 50 reads the fuel temperature THF in step 622, and writes the read fuel temperature THF into an engine starting fuel temperature variable THFS in step 624. The CPU 50 reads the fuel temperature THF in step 610, and calculates the difference delta-THF between the THF and the THFS in step 626. In step 628, the CPU 50 determines whether or not the fuel temperature difference delta-THF is higher than 5° C. When delta-THF $\leqq$5° C., the CPU 50 executes step 602 intended to extend the diagnosing period. When the result of the step 628-determination is YES, the CPU 50 determines whether or not the fuel temperature, THF is higher than the aforementioned predetermined fuel temperature in step 612. The predetermined fuel temperature used in step 612 may be lower than 35° C. because there is somewhat fuel temperature.

Figure 32:
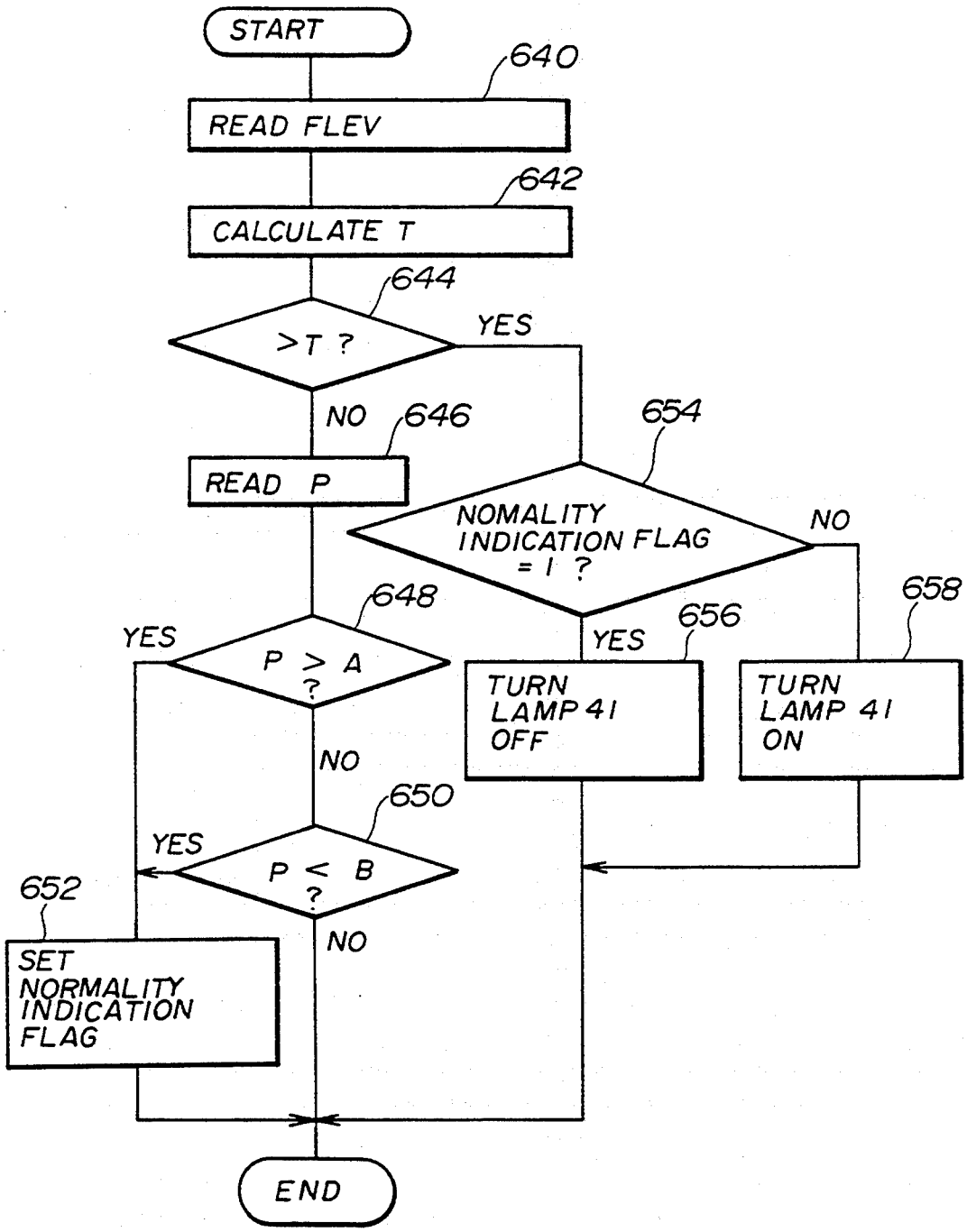
FIG. 32 is a flowchart of a second variation of the operation shown in FIG.
Figure 33:
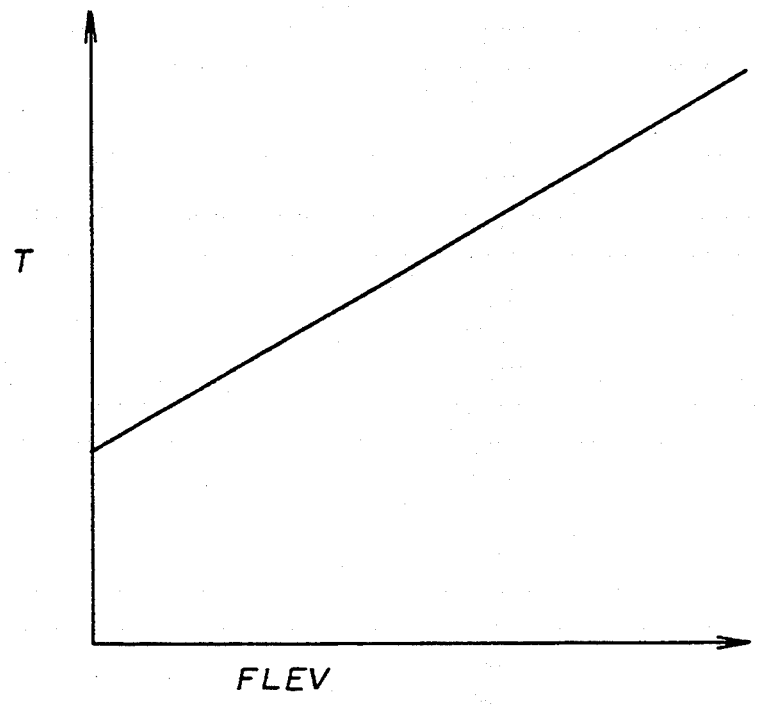
FIG. 33 is a graph showing parameters of a table used to generate a leakage decision value.

FIG. 32 is a flowchart of a second variation of the fourth embodiment of the present invention. A routine shown in FIG. 32 is executed every 64 msec, for example. In step 640, the CPU 50 reads the fuel level FLEV from the detection signal of the fuel level sensor 82 (FIG. 27). In step 642, the CPU 50 obtains the diagnosing period T by using a table defining a graph of FIG. 33. The higher the fuel level, the fuel temperature increases more slowly. Hence, a longer diagnosing period is needed as the fuel level is higher.

In step 644, the CPU 50 determines the passage time after the engine is started exceeds the diagnosing period T. When the result of the above step is NO, the CPU 50 reads the in-tank pressure P in step 646. In step 648, the CPU 50 determines whether or not the in-tank pressure is higher than the aforementioned predetermined value A. When the result of this step is NO, the CPU 50 determines, in step 650, whether or not the in-tank pressure is lower than the aforementioned leakage decision value B. When the result of the step-648 determination or the step 650-determination is YES, in step 652 the CPU 50 sets the normality indication flag to "1" (that is, this flag is activated).

When the result of the step-644 determination is YES, the CPU 50 determines whether or not the normality indication flag is active, in step 654. When the determination result is YES, the warning lamp 41 is turned OFF. When the result of step 654 is NO, the warning lamp is turned ON. As can be seen from the above, the second variation is intended to extend the diagnosing period as there is a larger quantity of fuel in the fuel tank 30 in order to prevent an erroneous diagnosis decision.

Figure 34:
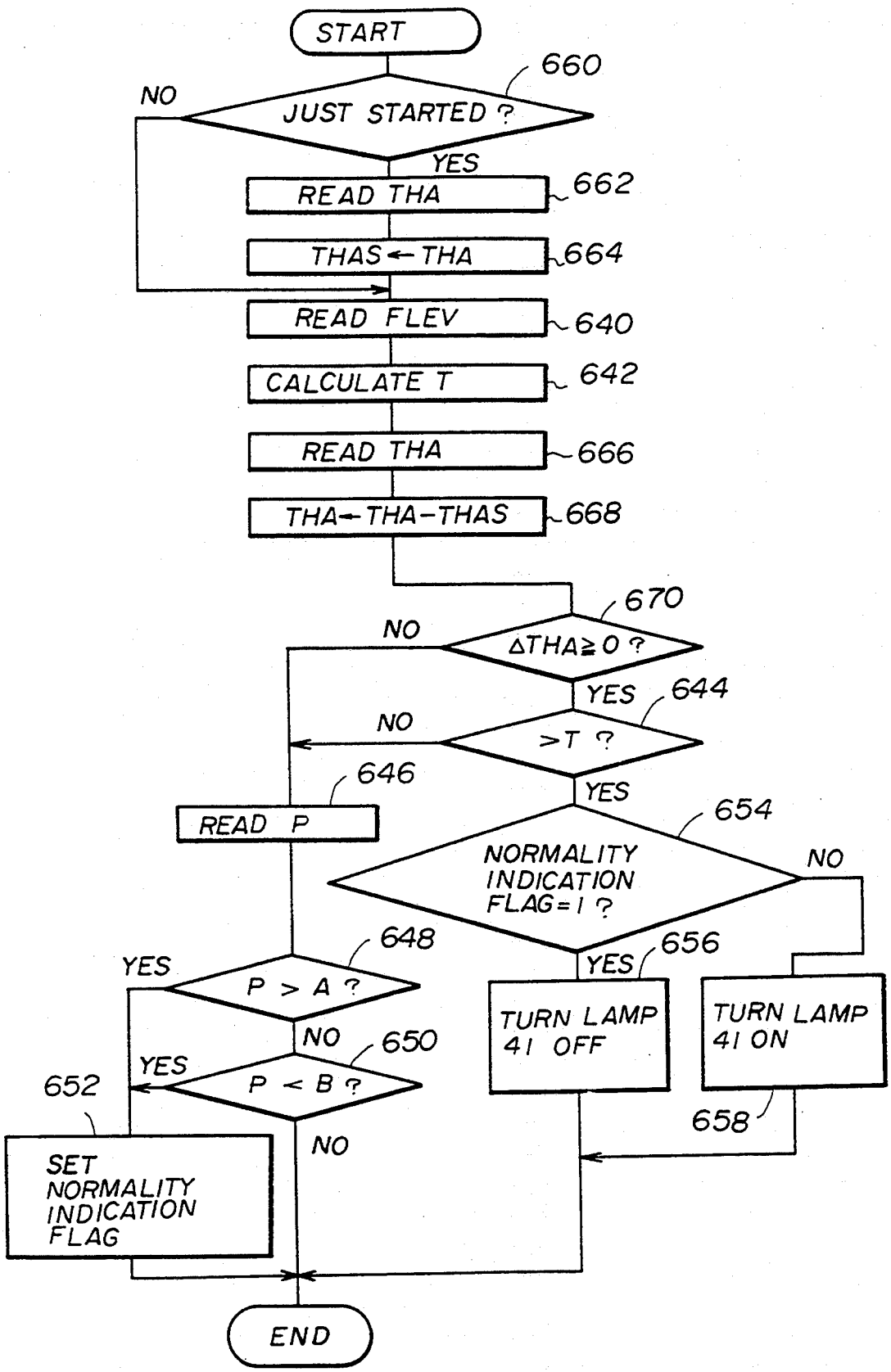
FIG. 34 is a flowchart of a variation of the operation shown in FIG. 32.

FIG. 34 shows a variation of the procedure, shown in FIG. 32. In FIG. 34, steps that are the same as steps shown in FIG. 32 are given the same reference numbers. The CPU 50 determines whether or not the stater switch 43 is turned ON in step 660, and reads an intake air temperature THA from the detection signal of the intake air sensor 78 (FIG. 27) in step 662. In step 664, the CPU 50 writes the read intake air temperature THA into an engine starting intake air temperature variable 664, and executes step 640. When it is determined, in step 660, that the engine has been started, the CPU 50 directly executes step 640. After the diagnosing period T is obtained from the fuel level FLEV in steps 640 and 642, the CPU 50 reads the intake air temperature THA in step 666, and calculates a difference delta-THA between the read intake air temperature THA and the engine starting intake air temperature THAS in step 668. In step 670, the CPU 50 discerns whether or not the intake air temperature difference delta-THA is equal or higher than 0. When the determination result is NO, the CPU 50 proceeds to step 646 in order to extend the diagnosing period T. When the result of the step-670 determination is YES, the CPU 50 executes 644. It can be seen from the above that the variation shown in FIG. 34 is made taking into account the fuel temperature does not easily increase when the intake air temperature is low.

A description will now be given of a fifth embodiment of the present invention. The fifth embodiment of the present invention is made taking into account variation in the space capacity of the fuel tank (which corresponds to a vapor volume). As the space capacity of the fuel tank increases (the fuel level decreases), it takes a longer time to reach a predetermined negative pressure for an identical flow rate. When the diagnosing operation is carried out in the state in which the system is set at the predetermined negative pressure and is maintained thereat, variation in the negative pressure greatly depend on the space value even for an identical leakage area. More particularly, as the space area of the fuel tank increases, variation in the negative pressure decrease. The above phenomenon causes an erroneous diagnosis decision.

Figure 35:
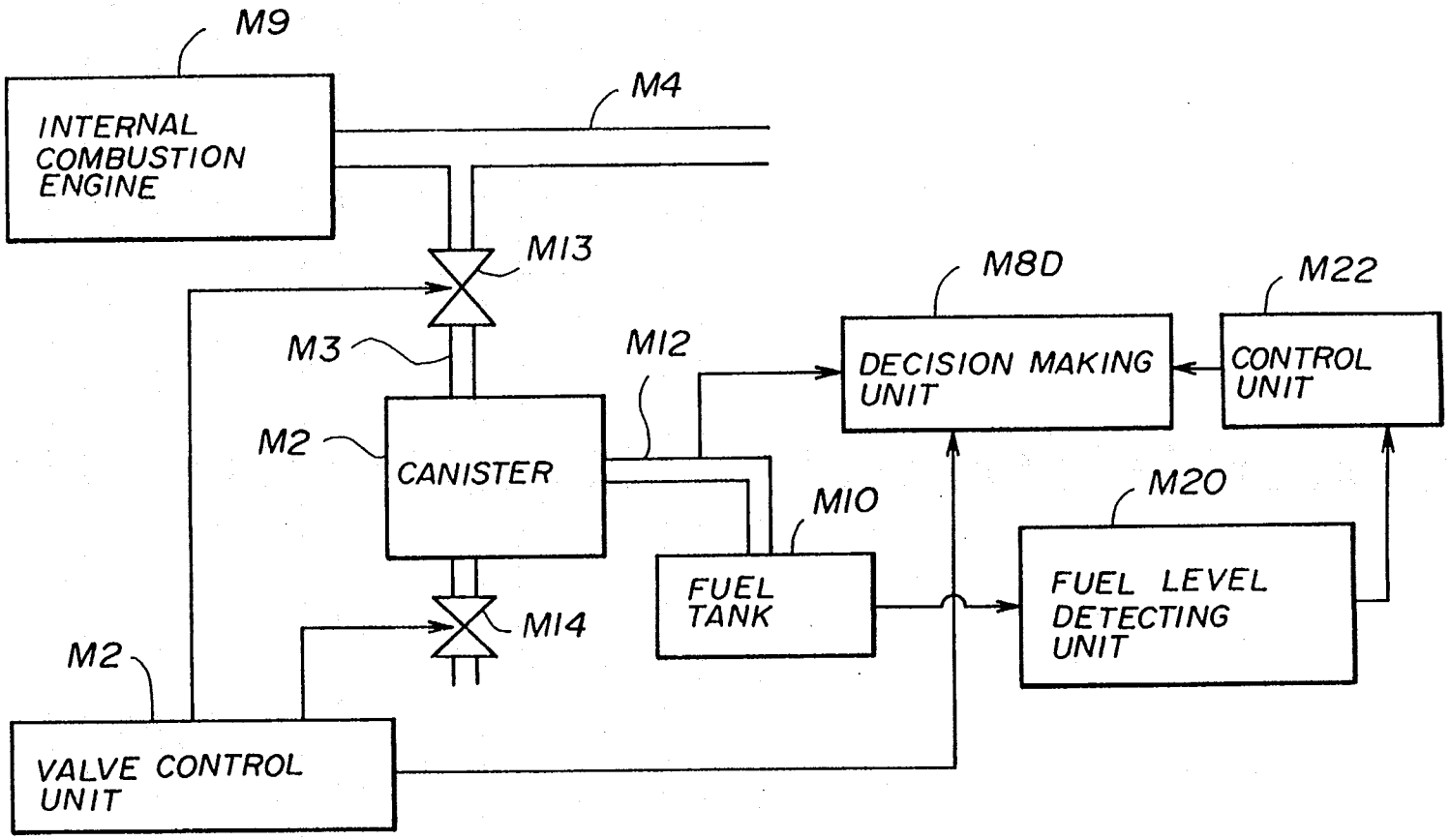
FIG. 35 is a block diagram of an overview of a fifth embodiment of the present invention.

FIG. 35 is a block diagram illustrating an overview of-the fifth embodiment of the present invention. In FIG. 35, parts that are the same as parts shown in the previously described figures are given the same reference numbers. A fuel level detecting unit M20 detects the level of fuel in the fuel tank M10. A valve control unit M21 closes the second control valve M14 and simultaneously opens the first control valve M13. Further, the valve control unit M21 opends the first control valve M13 in order to apply a negative pressure in the intake air passage M4 to the fuel tank M10 via the purge passage M3, the canister M2 and the vapor passage M12. After the pressure in the evaporative fuel purge system becomes a predetermined value, the valve control unit M21 closes the first control valve M13. A decision making unit M8D calculates the rate of variation in the pressure in the system for a predetermined period after the first and second control valves M13 and M14 are closed, and compares the rate of variation with a leakage decision value. Then, the decision making unit M8D determines whether or not a failure has occurred in the evaporative fuel purge system. A control unit 20 controls the decision making operation of the unit M8D on the basis of the fuel level detected by the fuel level detecting unit M20.

Figure 36:
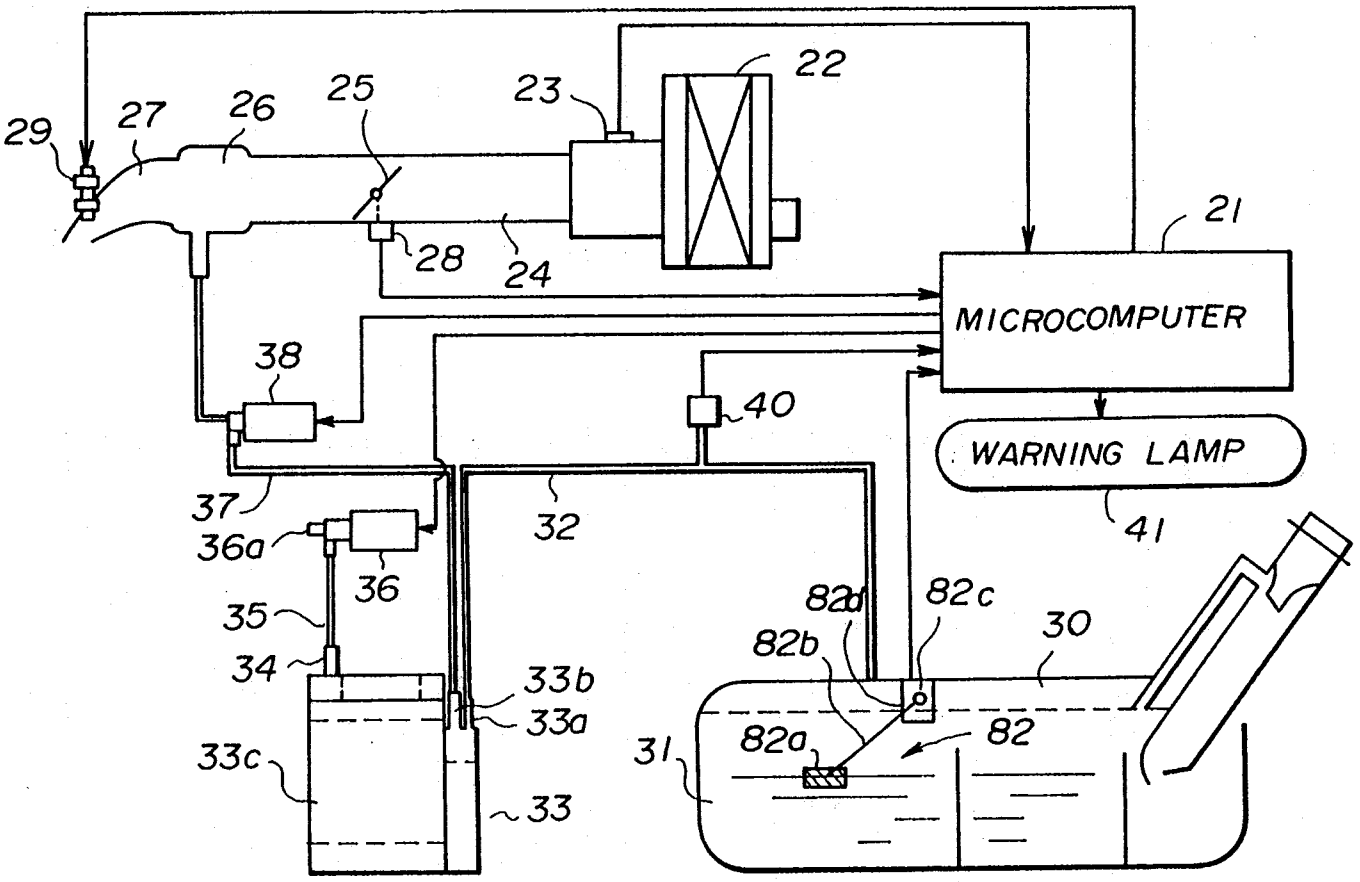

FIG. 36 shows the system structure of the fifth embodiment of the present invention. In FIG. 36, parts that are the same as parts shown in the previously described figures are given the same reference numbers. The fuel level sensor 82 provided in the fuel tank 30 comprises a floating member **82*a*, rod member 82*b* and a potentiometer 82d. The floating member 82*a* floats on the fuel level. The rod member 82*b* has one end fastened to the floating member 82*a*, and another end supported at a supporting point 82*c* so that the rod member 82*a* can rotate about the supporting point 82*c*. The potentiometer 82*d* generates an electric signal dependent on the turning angle of the rod member 82*c*. The floating member 82*a* and the rod member 82*c*** move in accordance with the fuel level.

Figure 37:
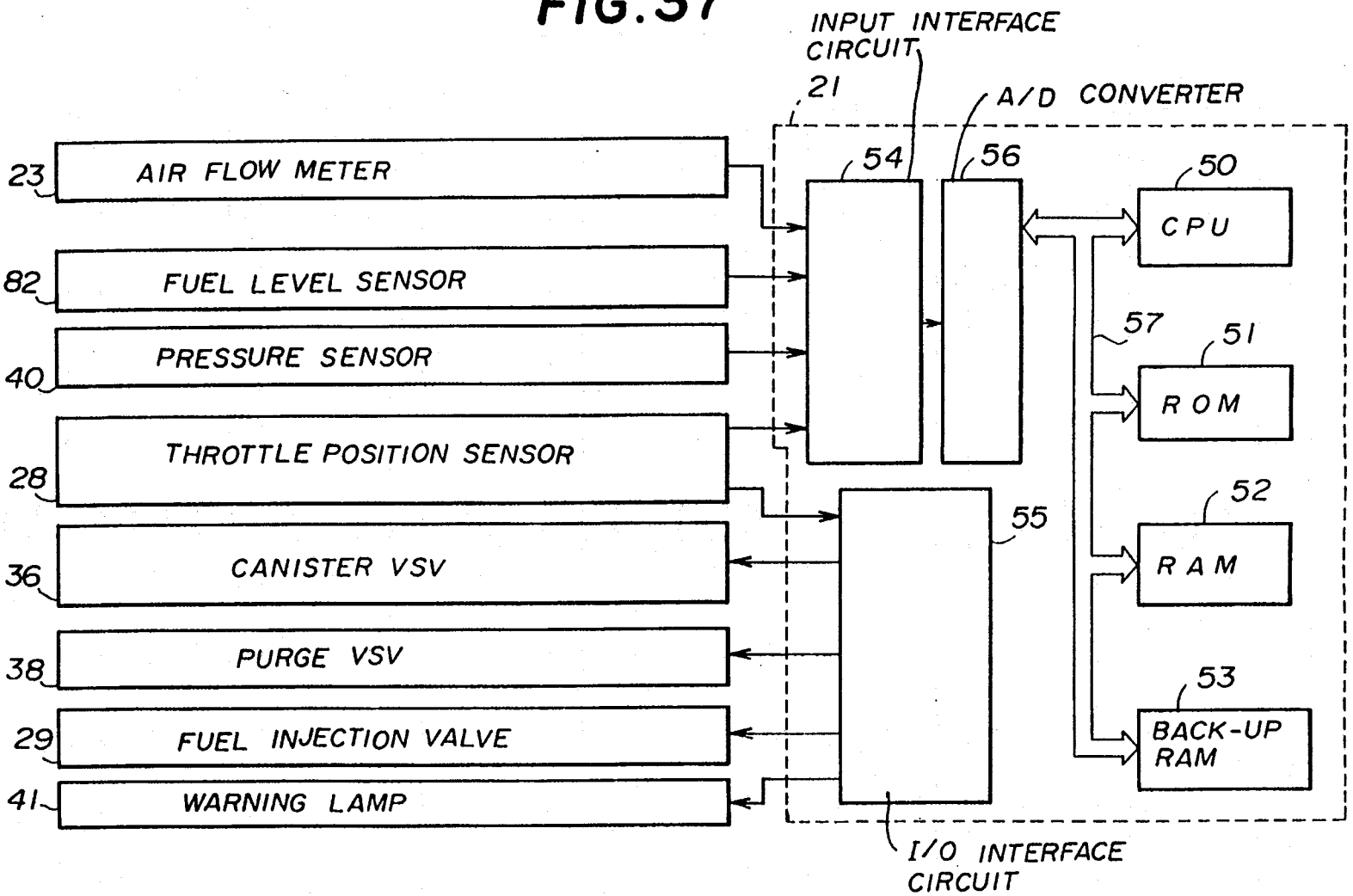
FIG. 37 is a block diagram of the hardware structure of the fifth embodiment of the present invention.

FIG. 37 is a block diagram of the hardware structure of the fifth embodiment of the present invention. In FIG. 37, parts that are the same as parts shown in the previously described figures are given the same reference numbers.

Figure 38A:
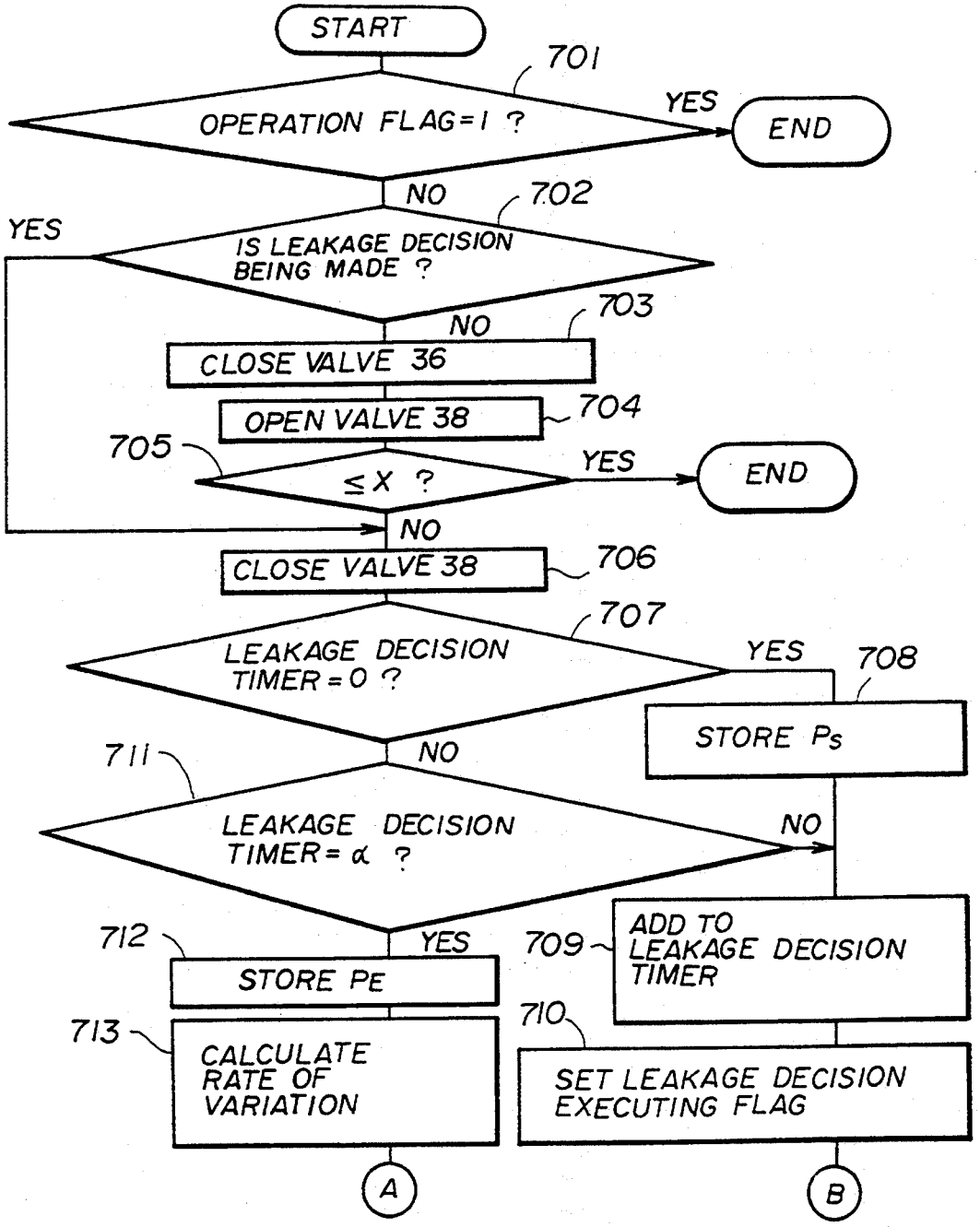
FIGS. 38A and 38B are flowcharts of the operation of the fifth embodiment of the present invention.
Figure 38B:
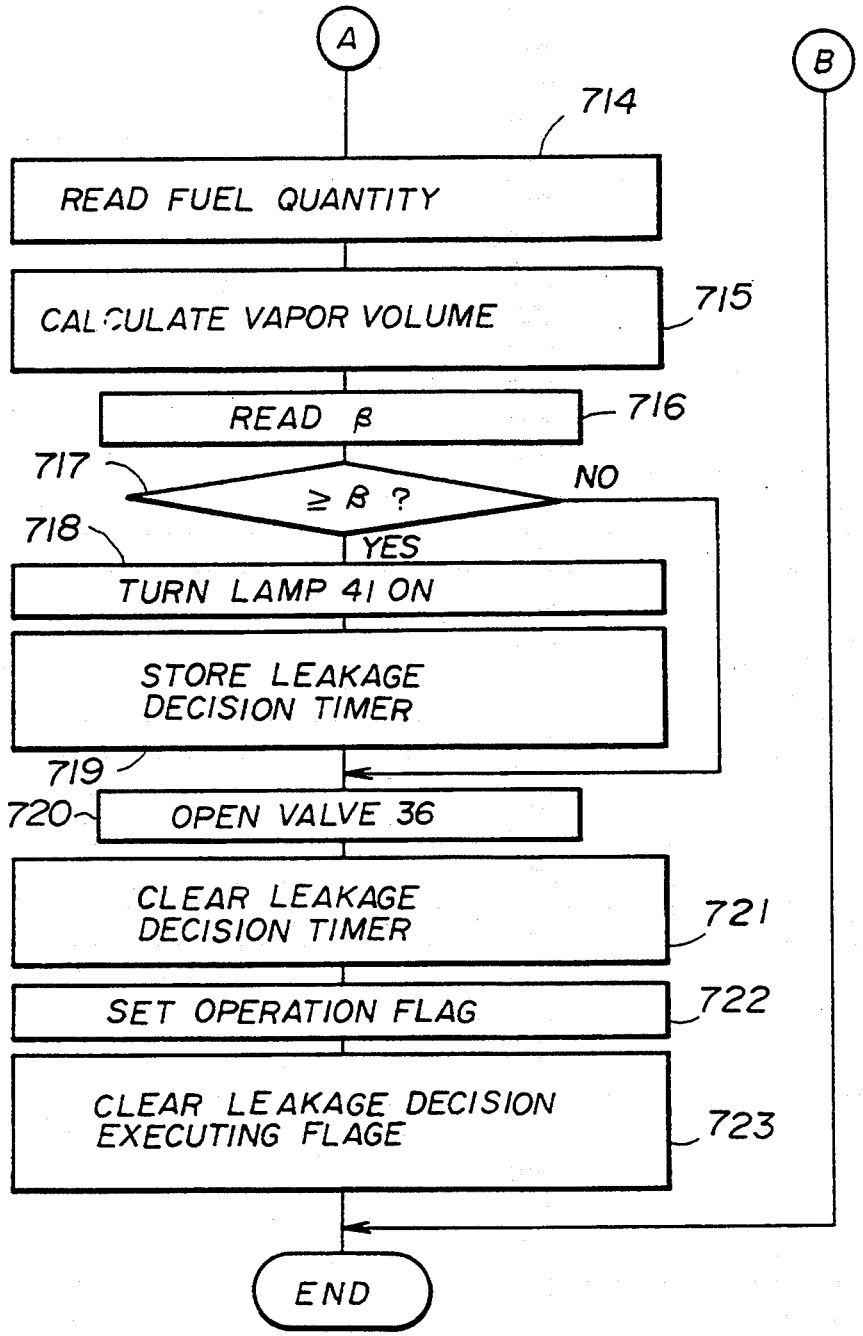

FIGS. 38A and 38B are flowcharts of the operation of the fifth embodiment of the present invention. In step 701, the CPU 50 determines whether or not the operation flag is equal to "1". When the, routine shown in FIGS. 38A and 38B is executed for the first time after the engine is started, the operatic, n flag is reset to "0". In step 702, the CPU 50 determines whether or not the leakage decision executing flag is active ("1"). The leakage decision executing flag is reset to "0" by the initial routine executed after the engine is started. The CPU 50 opens the valve 36 (FIG. 36) in step 703, and opens the purge control valve 38 in step 704. Thereby, the in-tank pressure quickly increases towards the negative-pressure area.

In step 705, the CPU 50 determines whether or not the in-tank pressure is equal to or lower tan the predetermined value X (Pa). When the result of the step-705 is YES, the negative pressure in the intake air passage is being introduced into the evaporative fuel purge system. The steps 701–705 are repeatedly performed until the result of the step-705 determination becomes NO. The CPU 50 closes the purge control valve 38 in step 706.

Figure 39A:
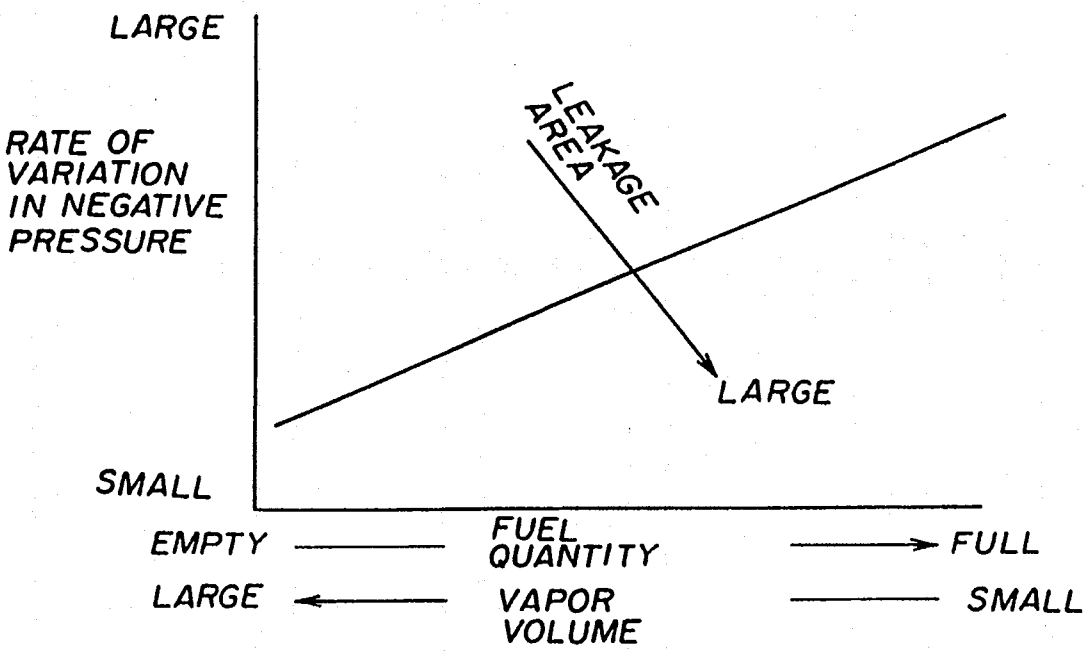
FIGS. 39A and 39B are graphs showing a relationship between a negative-pressure variation rate and the quantity of fuel.

As shown in FIG. 39A, the rate of variation in the negative pressure in the evaporative fuel purge system including the vapor passage 32, the purge passage 37 and the fuel tank 30 increases as a large amount of fuel exists in the fuel tank 30 (in other words, as the vapor volume in the fuel tank 30 decreases). Hence, the time necessary to open the purge control valve 38 in step 706 after closing it in step 704 decreases as the vapor volume decreases. Further, as shown in FIG. 39A, the rate of variation in the negative pressure decreases as a fuel leakage area increases. This is because air enters into the system via the leakage area and does not prevent an increase in the negative pressure.

Figure 39B:
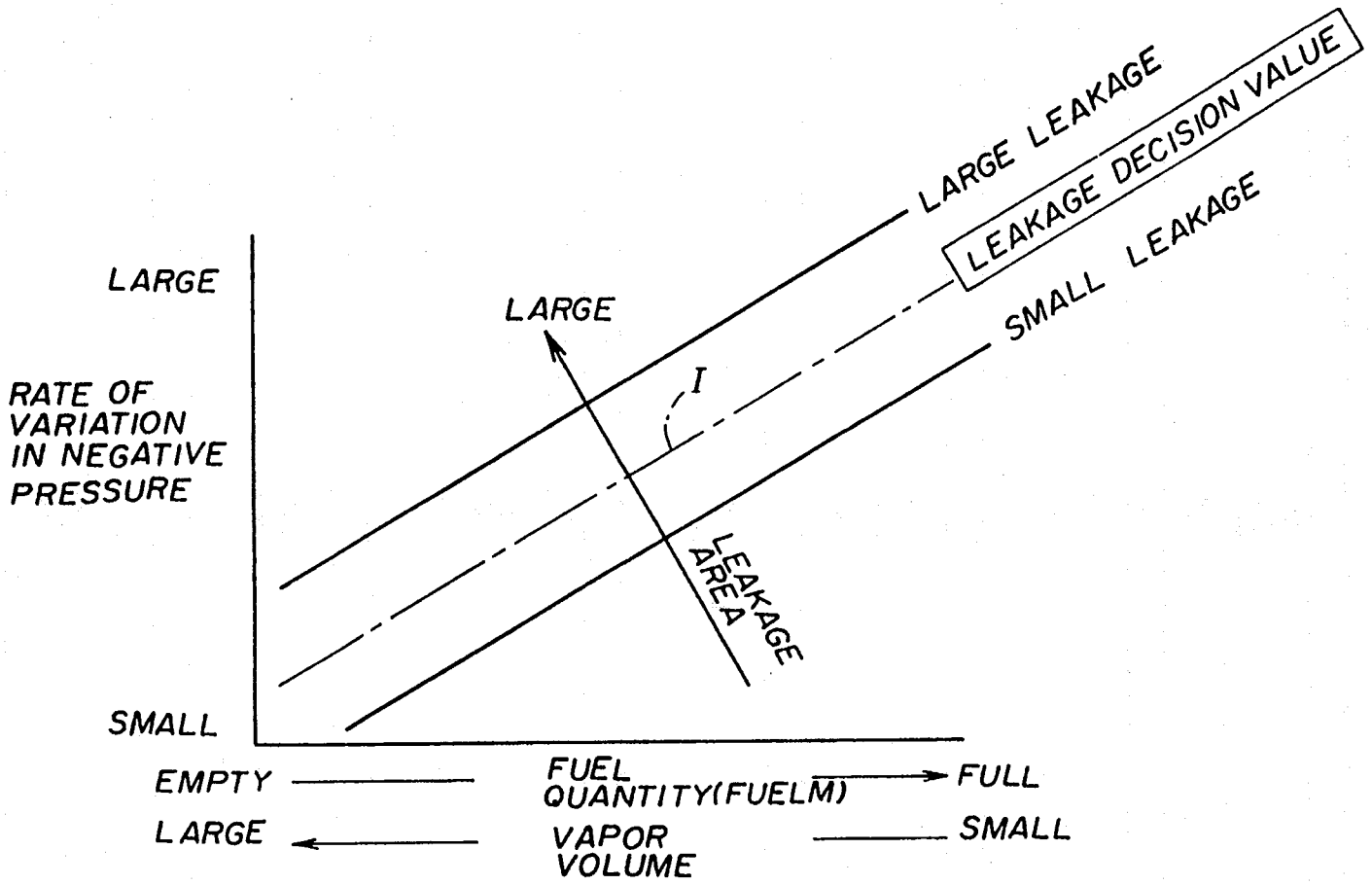

When the purge control valve 38 is closed in step 706, the evaporative fuel purge system between the purge passage 37 and the fuel tank 30 is closed, and the initial set pressure X (Pa) is held in the closed purge system. In the case there is no leakage and no fuel vapor, the initial set pressure X (Pa) does not change. In case where is fuel leakage, as shown in FIG. 39B the rate of variation in the negative pressure increases as a larger quantity of fuel exists in the fuel tank 30. For an identical quantity of fuel, the rate of variation in the negative-pressure increases as the leakage area increases, as shown in FIG. 39B.

With the above in mind, it is necessary to change the leakage decision value to be compared with the rate of variation of the negative pressure in accordance with the quantity of fuel (fuel level) in order to detect fuel leakage. A table having a characteristic indicated by a one-dot chained line I shown in FIG. 39B is stored in the backup RAM 53 beforehand, and is referred to as will be described later.

In step 707, the CPU 50 determines whether or not the leakage decision timer indicates "0". Since the leakage decision timer is cleared by the aforementioned initial routine, the result of the step-707 determination is affirmative when the step-707 determination is carried out for the first time. Then the CPU 50 executes step 708, in which the current detection value of the pressure sensor 40 is written, as a diagnosis starting pressure value $P_S$, into the RAM 52.

The CPU 50 adds a predetermined value to the value of the leakage decision timer in step 709, and sets the leakage decision executing flag to "1" in step 710. Thereafter, the CPU 50 ends execution of the routine shown in FIGS. 38A and 38B. When the routine is activated again, it is determined, in step 702, that the leakage decision operation is being executed. Thus, the CPU 50 jumps steps 703–705, and proceeds to step 707 via step 706.

Since it is determined, in step 707, that the leakage decision timer does not indicate "0", the CPU 50 decides, in step 711, that the value of the leakage decision timer reaches a value corresponding to a diagnosing period (leakage decision period) $\alpha$. When the result of the above determination is NO, the CPU 50 ends execution of the routine via the steps 709 and 710.

In the above-mentioned manner, the steps 701, 7012, 706, 707, 711, 709 and 710 are repeatedly performed every 65 ms. When the value of the leakage, decision timer reaches the leakage decision period $\alpha$, the detection value of the pressure sensor 40 obtained at that time is written into the RAM 52, as a diagnosis end pressure value $P_E$ in step 712. In step 713, the CPU 50 calculates the rate of variation in the pressure by using the following expression:

$$(P_S-P_E)/\alpha$$

where the pressure values $P_S$ and $P_E$ are read from the RAM 52.

In step 714, the CPU 50 reads the quantity of fuel from the detection signal of the fuel level sensor 82. In step 715, the CPU 50 calculates the vapor volume from the read quantity of fuel. In step 716, the CPU 50 accesses the table stored in the backup RAM 53 with the vapor volume obtained in step 715, and reads a corresponding leakage decision value $\beta$.

In step 717, the CPU 50 determines whether or not the rate of variation in the negative pressure calculated in step 713 is equal to or greater than the leakage decision value $\beta$ obtained in step 716. When the determination result is YES, the CPU 50 concludes that there is a large leakage since a large variation in the negative pressure is observed. Hence, the CPU 50 turns the warning lamp 41 ON in step 718 in order to inform the driver of the occurrence, of a failure in the evaporative fuel purge system. At this time, the CPU 50 writes the aforementioned leakage failure code into the backup RAM 53 in step 719. The leakage failure code is read from the RAM 53 during a repairing operation, and the maintenance person is informed of a failure in the evaporative fuel purge system. When it is determined, in step 717, that the rate of variation is less than the leakage decision value $\beta$, the CPU 50 executes step 720.

In step 720, the CPU 50 sends the canister atmosphere aperture valve 36 the control signal which opens the valve 36. When the valve 36 is normal, tile valve 36 is opened, and the atmosphere is introduced into the evaporative fuel purge system from the atmosphere introducing inlet 36*a* via the canister atmosphere aperture 36.

The CPU 50 clears the leakage decision timer in step 721, and sets the operation flag to "1" in step 721. Further, the CPU 50 clears the leakage decision executing flag to "0" in step 723, and ends execution of the routine shown in FIGS. 38A and 38B. Thereafter, the operation flag indicates "1" when the routine shown in FIGS. 38A and 38B is activated. Hence, the operation flag is maintained at "1" until the engine is started again.

Figure 40:
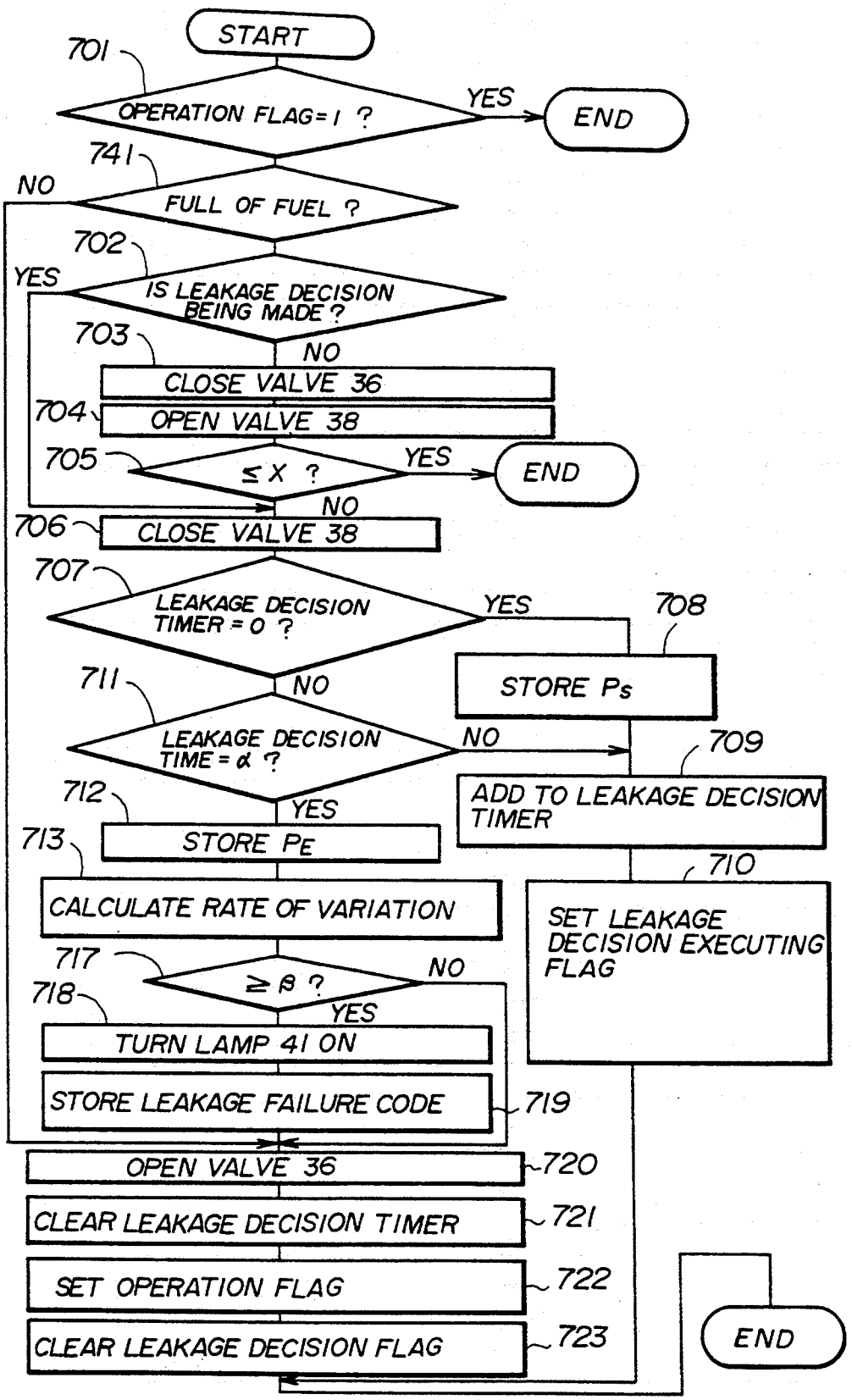
FIG. 40 is a flowchart showing a first variation of the fifth embodiment of the present invention.

A description will now be given, with reference to FIG. 40, of a first variation of the fifth embodiment of the present invention. In FIG. 40, steps that are the same as steps shown in FIGS. 38A and 38B are given the same reference numbers. When it is determined, in step 701, that the operation flag is not equal to "1" in step 741 the CPU 50 refers to the detection signal of the fuel level sensor 82, and determines whether or not the fuel tank 30 is full of fuel. When it is determined that the fuel tank 30 is full of fuel, the diagnosing operation including the, steps 702–713 and steps 717–719 is carried out. When it is determined, in step 741, that the fuel tank 30 is not full of fuel, the CPU 50 opens the valve 36 in step 720 without executing the diagnosing operation.

According to the first variation shown in FIG. 40, the diagnosing operation is carried out only when it is determined that the fuel tank 30 is full of fuel. Hence, the aforementioned table can be omitted. It will be noted that it is determined that the fuel tank is full of fuel when the fuel level in the fuel tank 30 is located at the position indicated by a broken line shown in FIG. 36. In this state, the vapor volume is the smallest, and the negative pressure can be completely introduced into the system in a short time. In addition, when the fuel tank 30 is full of fuel, the greatest rate of variation in the negative pressure can be obtained for an identical leakage area, as shown in FIG. 39B. Hence, it is possible to precisely calculate the rate of variation in the negative pressure. The diagnostic result obtained when the fuel tank 30 is not full of fuel is less reliable than that obtained when the fuel tank 30 is full of fuel.

Figure 41:
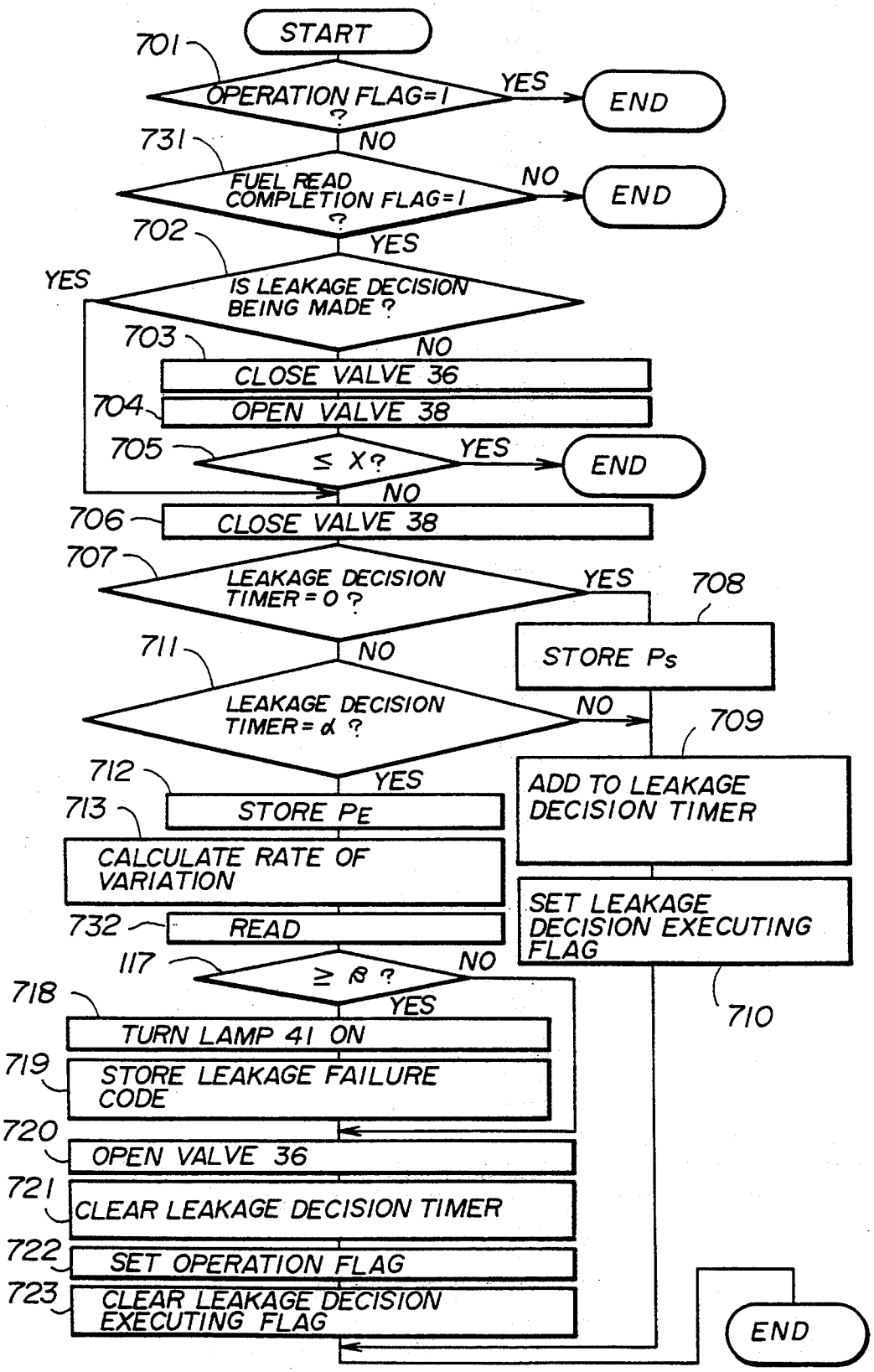
FIG. 41 is a flowchart showing a second variation of the fifth embodiment of the present invention.

A second variation of the, fifth embodiment will now be described with reference to FIG. 41, in which steps that are the same as steps shown in FIGS. 38A, 38B and 40 are given the same reference numbers. The second variation is made taking into account the fact that the fuel level sensor 82 shown in FIG. 32 is of a float type and does not indicate a correct fuel level when the fuel surface is wavy due to the road condition and driving condition (acceleration or deceleration).

In step 731, the CPU 50 determines whether or not a fuel read completion flag is equal to "1". The fuel read completion flag is reset to "0" by the initial routine executed when the engine is started, and is set to "1" only when the quantity of fuel is stored in the RAM52, as will be described later with reference to FIGS. 42, 43, 44, and 45B. The routine shown in FIG. 41 ends when the read has not yet been read.

When the quantity of fuel is read (this is stored in a variable FUELM) and the fuel read completion flag indicates "1", the aforementioned diagnosing routine starting from step 702. However, in the second variation shown in FIG. 41, after the rate of variation in the negative pressure is calculated in step 713, the table having the characteristic I indicated by the one-dot chained line shown in FIG. 39B is referred to with the fuel quantity FUELM (step 732) in order to obtain the corresponding leakage decision value $\beta$.

Figure 42:
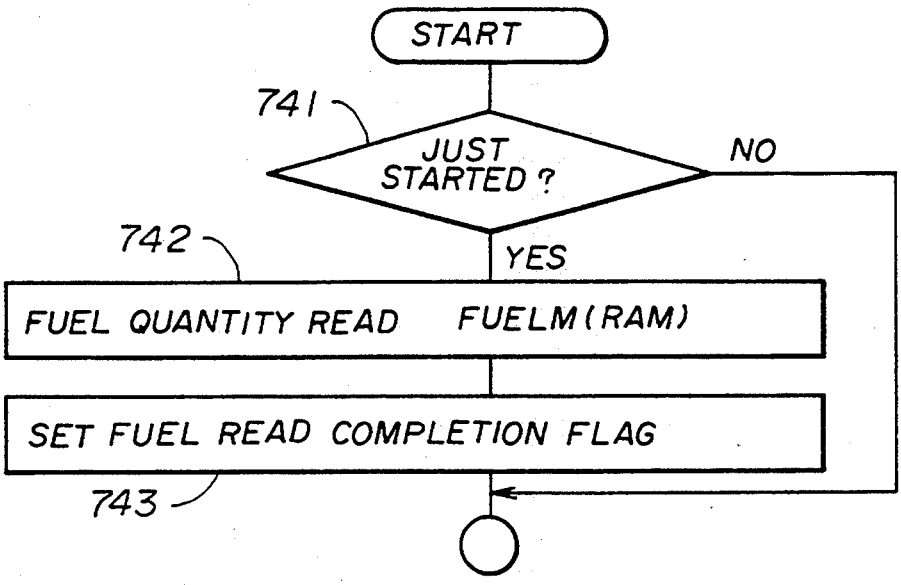
FIGS. 42, 43, 44, 45A and 45B are flowcharts of processes for calculating the quantity of fuel in a fuel tank.

A description will now be given of control routines for calculating the quantity of fuel. FIG. 42 shows a first control routine for calculating the quantity of fuel. The CPU 50 determines whether or not the engine has just been started in step 741 by, for example, discerning whether or not a predetermined time has elapsed after the starter is turned ON. When the determination result is YES, the CPU 50 reads the quantity of fuel from the detection signal of the fuel level sensor 82, and writes the read quantity of fuel into the variable FUELM in step 742. In step 743, the CPU 50 sets the fuel read completion flag to "1".

Figure 43:
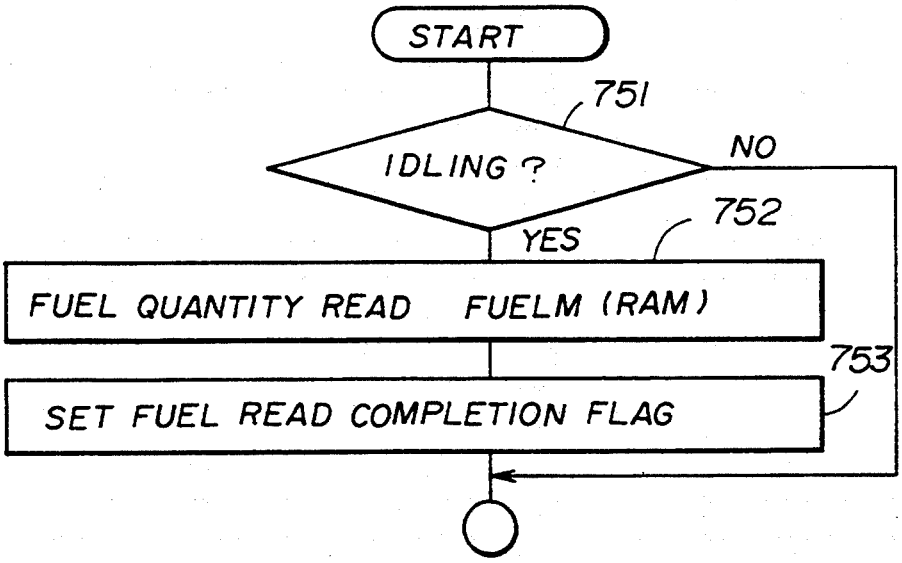

FIG. 43 shows a second control routine for calculating the quantity of fuel. The second control routine updates the quantity of fuel each time an idle decision is performed. In step 751, the CPU 50 determines whether or not the engine is idling by referring to the output signal of the throttle position sensor 28 and determining whether or not the throttle valve 25 is fully closed. When the result of the step 751-determination is YES, the CPU 50 executes steps 752 and 753 which are respectively the same as the steps 742 and 743 shown in FIG. 42.

Figure 44:
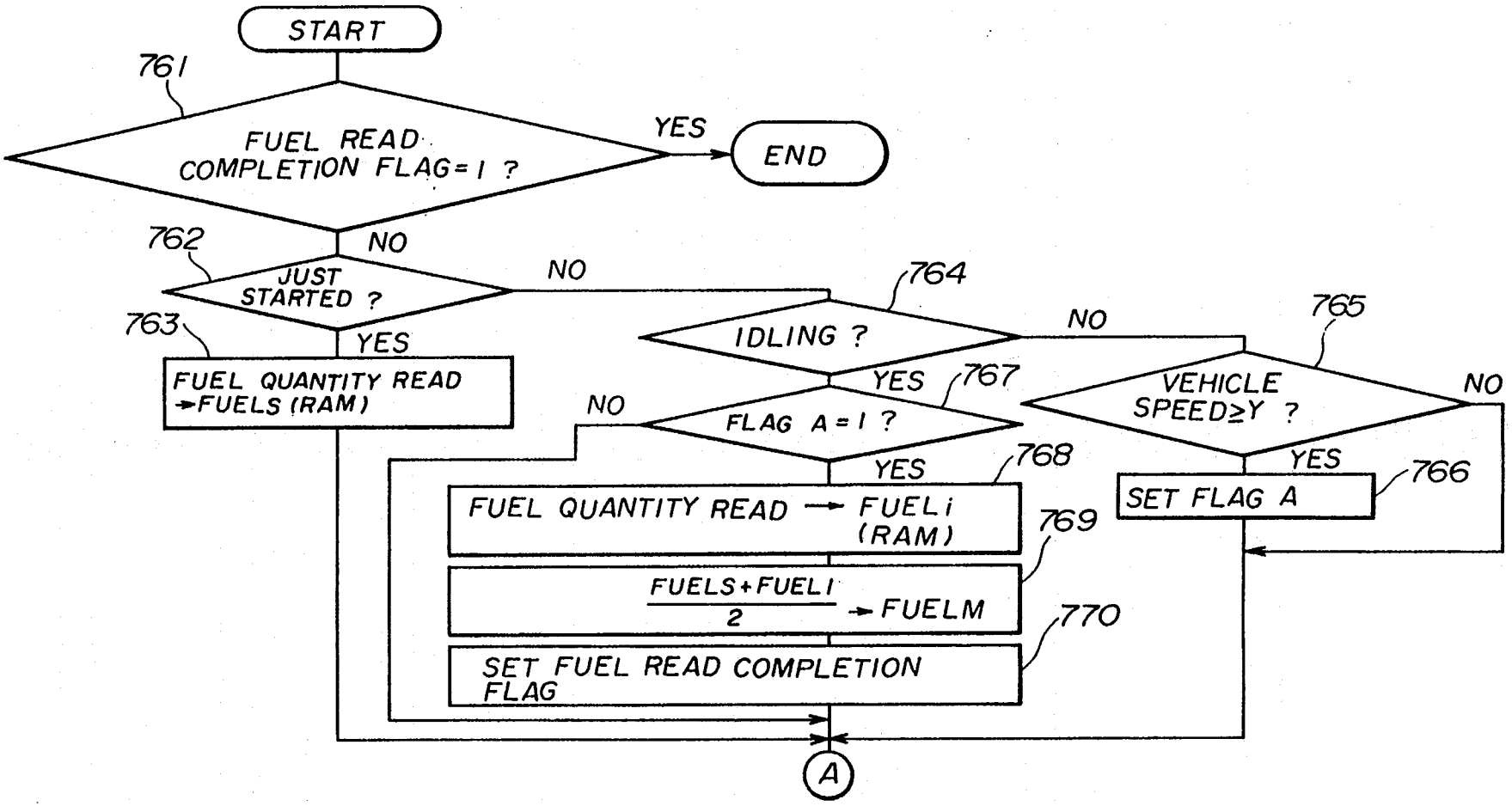

FIG. 44 is a flowchart of a third control routine for calculating the quantity of fuel. The third control routine takes into account the fact that the fuel level is inclined, for example, when the vehicle is parted on a slope. In the third control routine, the average of the fuel quantity obtained immediately after the engine is started and the fuel quantity obtained in the idling state.

In step 761, the CPU 50 determines whether or not the fuel read completion flag is equal to "1". The fuel read completion flag is equal to "0" until it is set to "1" in step 770. When this flag is equal to "1", the routine shown in FIG. 44 is not executed. This is because the quantity of fuel is read one time for the diagnosing operation. In step 762, the CPU 50 determines whether or not the engine has just been started. When the result Of step 782 is YES, the CPU 50 reads the quantity of fuel from the detection signal of the fuel level sensor 82, and writes it into the variable FUELS in step 763. The variable FUELS is stored in the RAM 52.

When it is determined that the engine has not just been started, the CPU 50 determines whether or not the engine is idling. When the determination result is NO, the CPU 50 determines, in step 765, whether or not the vehicle speed is equal to Y (km/h) by referring to the detection signal of a speed sensor (not shown). When the result of the step-765 determination is YES, the CPU 50 sets a flag to "1" in step 766, and the routine shown in FIG. 44. When it is determined, in step 765, that the vehicle speed is less than the Y, the CPU 50 ends execution of the routine shown in FIG. 44.

When it is determined, in step 764, that the engine is idling, the CPU 50 determines whether or not the flag A is equal to "1" in step 767. When the determination result is NO, the CPU 50 ends execution of the routine. When it is determined that A=1, the CPU decides that the vehicle was traveling before the idling state, and reads the quantity of fuel in the fuel tank 30 to write it into a variable FUELi instep 768. In step 769, the CPU 50 calculates the average of the quantity of fuel FUELS stored in step 763 and the quantity of fuel FUELi stored in step 768, and writes the average quantity of fuel into a variable FUELM. In step 770, the CPU 50 sets the fuel read completion flag to "1".

Figure 45A:
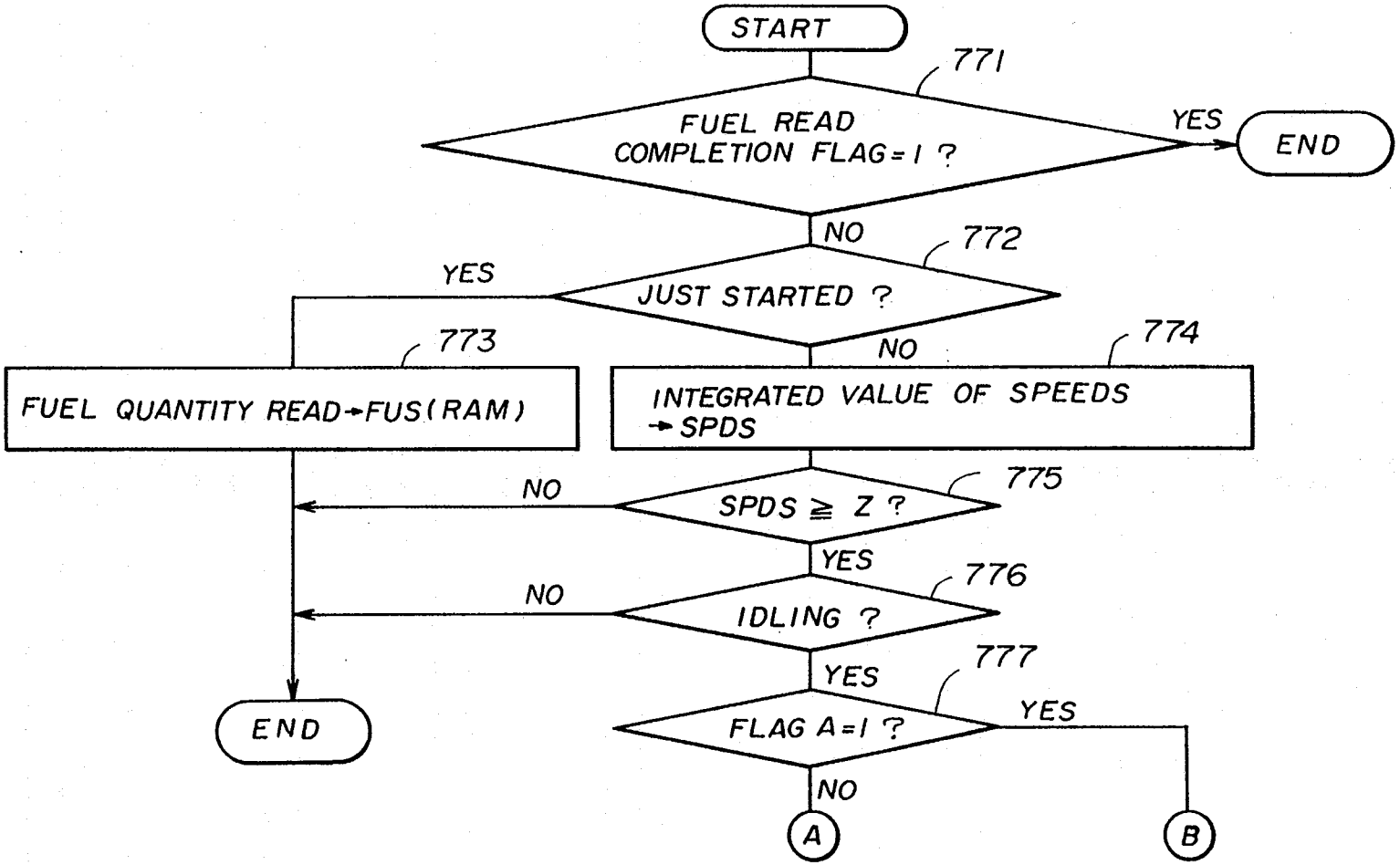
Figure 45B:
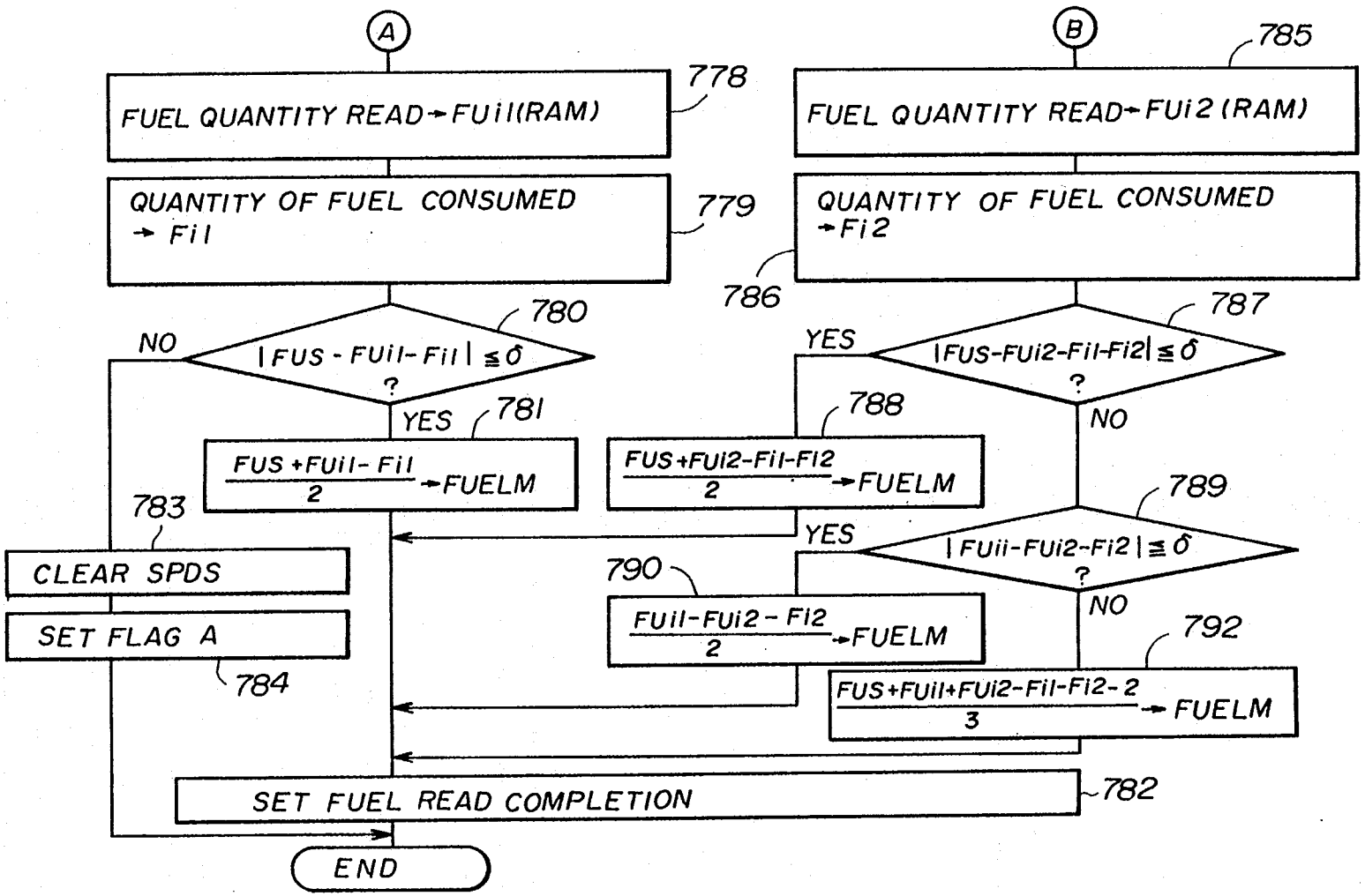

FIGS. 45A and 45B show a fourth control routine for calculating the quantity of fuel in the fuel tank 30. The fourth control routine corrects the quantity of fuel on the basis of the quantity of fuel consumed. For this purpose, the fourth control routine uses the quantity of fuel obtained immediately after the engine is started, as well as the quantity (quantities) of fuel obtained in the first (and second) idling state (states).

In FIG. 45A, the CPU 50 determines whether or not the fuel read completion flag is equal to "1". When the determination result is YES, the CPU 50 ends execution of the routine shown in FIG. 45A. When the determination result is NO, the CPU 50 determines whether or not the engine has just been started. When the result of the step-773 determination is YES, the CPU 50 reads the quantity of fuel in the fuel tank 30 and writes it into a parameter FUS, which is stored in the RAM 52. Then, the CPU 50 ends execution of the routine shown in FIG. 45A.

When the result of the step-772 determination is NO, the CPU 50 adds the vehicle speed to the sum of the previously obtained speeds, and writes the integrated value of the vehicle speeds into a parameter SPDS in step 774. In step 775, the CPU 50 determines the integrated value of the vehicle speeds is equal to or greater than a predetermined threshold value Z. When the determination result is NO, the CPU 50 decides that the traveling distance is not sufficient, and ends the routine. When it is determined that SPDS≧Z, the CPU 50 decides that the vehicle was traveling in the past, and determines, in step 776, whether or not the engine is idling by referring to the detection signal of the throttle position sensor 28.

When it is determined that the engine is idling, the CPU 50 determines whether or not the flag A is equal to "1" in step 777. The flag A indicates "1" in the case where the vehicle travels in the past, and is reset to "0" by the initial routine. When step 777 is executed for the first time after the engine is started, the result of step 777 is NO. When the result of step 777 is NO, the CPU 50 reads the quantity of fuel in the fuel tank 30 in the first idling state, and writes it into a variable FUi1 stored in the RAM 52 in step 778.

Figure 46:
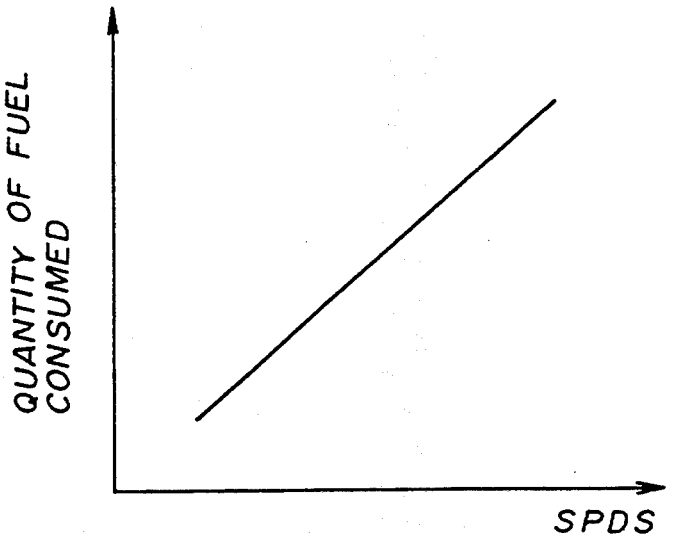
FIG. 46 is a graph of a characteristic referred to in the process shown in FIG. 45B.

The backup RAM 53 stores a two-dimensional table describing the relationship between the integrated value SPDS of the vehicle speeds and the quantity of fuel consumed shown in FIG. 46. In step 779, the CPU 50 accesses the two-dimensional table with the integrated value SPDS of the vehicle speeds, and obtains the fuel consumption quantity corresponding to the SPDS. In step 780, the CPU 50 determines whether or not |FUS−FUi1−Fi1| is equal to or less than a tolerable difference $\sigma$. The absolute value |FUS−FUi1| between the fuel quantity FUS obtained immediately after the engine is started and the fuel quantity FUi1 obtained in the first idling state must be identical to or close to the quantity of fuel consumed if the quantity of fuel can be correctly detected. When the result of the step-780 determination is YES, the CPU 50 decides that the quantity of fuel in the fuel tank 30 can be correctly detected, and calculates an objective fuel quantity FUELM using the following expression in step 781:

$$(FUS+FUi1-Fi1)/2.$$

The objective fuel quantity FUELM is the average of the difference between the FUS and Fi1 and the fuel quantity FUi1 in the first idling state. After storing the objective fuel quantity FUELM in the RAM 52, the CPU 50 sets the fuel read completion flag to "1" in step 782, and ends the routine.

When it is determined, in step 780, that |FUS−FUi1−Fi1| is greater than the tolerable difference $\sigma$, the CPU 50 decides that the condition for detecting the fuel quantity is not normal, and clears the integrated value of the vehicle speeds in step 783. Then, the CPU 50 sets the flag A to "1" in step 784, and ends the routine.

When the steps 771, 772, 774 and 775 are executed and it is determined, in step 776, when the engine is idling, the CPU 50 executes step. 785 via step 777. In step 785, the CPU 50 reads the quantity of fuel in the fuel tank 30 in the second idling state, and writes it into the variable FUi2, which is stored in the RAM 52. In step 786, the CPU 50 refers to the aforementioned two-dimensional table with the integrated value of the vehicle speeds, and obtains a fuel consumption quantity Fi2 corresponding to the integrated vehicle speed value between the decision making in the first idling state and the decision making in the second idling state. In step 787, the CPU 50 determines whether or not the following is satisfied:

$$|FUS-FUi2-Fi1-Fi2| \leqq \sigma \quad (1).$$

The absolute value of the difference |FUS−FUi2| must be approximately equal to the fuel consumption quantity (Fi1+Fi2) until the decision making in the second idling state after the engine is started. In this case, the above condition (1) is satisfied. In step 788, the CPU 50 calculates the average of the fuel quantity (FUS−Fi1−Fi2) and the fuel quantity obtained in the second idling state, and writes it into the variable FUELM, which is stored in the RAM 52. Then, the CPU 50 executes step 782.

When it is determined that the condition (1) is not satisfied, the CPU 50 executes step 789 in which it is determined whether or not the following condition is satisfied:

$$|FUi1-Fui2| \leqq \sigma \quad (2)$$

It will be noted that the condition (1) will not be satisfied in case where the fuel quantity FUS is erroneous, for example, when the vehicle is parked on a slope. If the quantity of fuel in the fuel tank 30 can be correctly detected, the difference between the fuel quantity in the first idling state and the fuel quantity FUi2 in the second idling state will be approximately equal to the quantity Fi2 of fuel consumed during the period between the first and second idling states.

When the condition (2) is satisfied, the CPU 50 calculates the average of the value obtained by subtracting the fuel consumption quantity Fi2 from the quantity of fuel FUi1 in the first idling state, and the quantity of fuel FUi2 in the second idling state, and writes the average into the variable FUELM in step 792. Then, the fuel read completion flag is set to "1" in step 782. When it is determined that the condition (2) is not satisfied, the CPU 50 calculates the following expression in step 792:

$$(FUS+FUi1+FUi2-Fi1-Fi2\times 2)/3.$$

The above expression converts the fuel quantities FUS, FUi1 and FUi2 into an average value in the second idling state. The calculation result of the above expression is written into the objective fuel quantity FUELM, which is stored in the RAM 52 in step 792. Then, the CPU 50 executes step 782.

It can be seen from the above that the fourth control routine is capable of accurately calculating the quantity of fuel in the fuel tank 30.

Figure 47:
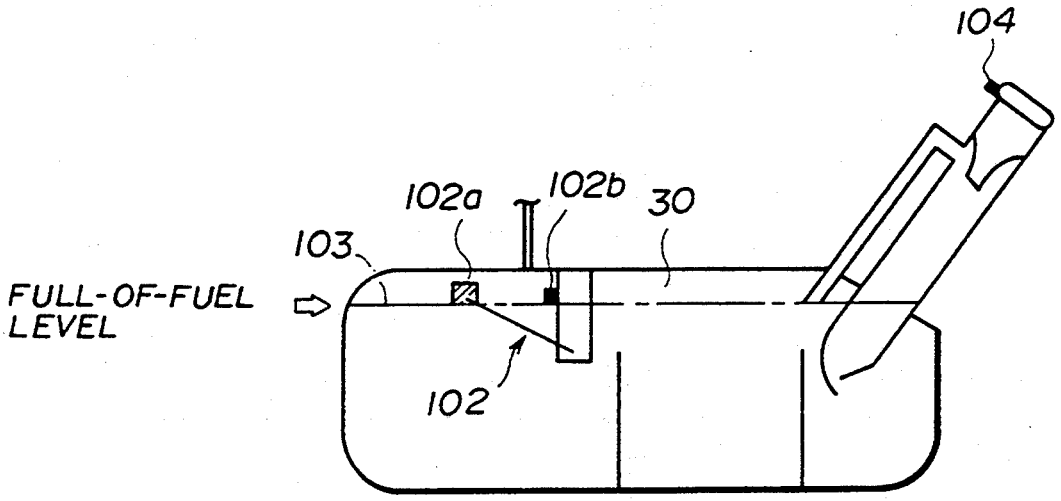
FIG. 47 is diagram illustrating a modification variation of the fifth embodiment of the present invention.

The fuel level sensor 82 can be replaced by a fuel level sensor 102 shown in FIG. 47. The fuel level sensor 102 comprises a floating member 102*a*, a level sensor 102*b*, and a potentiometer. The fuel level sensor 102*b* is positioned at a full level 103, and detects whether or not the fuel tank 30 is full of fuel. A fuel cap switch 104 is turned OFF when a fuel cap is opened to supply the fuel tank 30 with fuel, and is ON with the fuel cap closed. The detection signal of the fuel cap switch 104 is sent to the microcomputer 21.

Figure 48A:
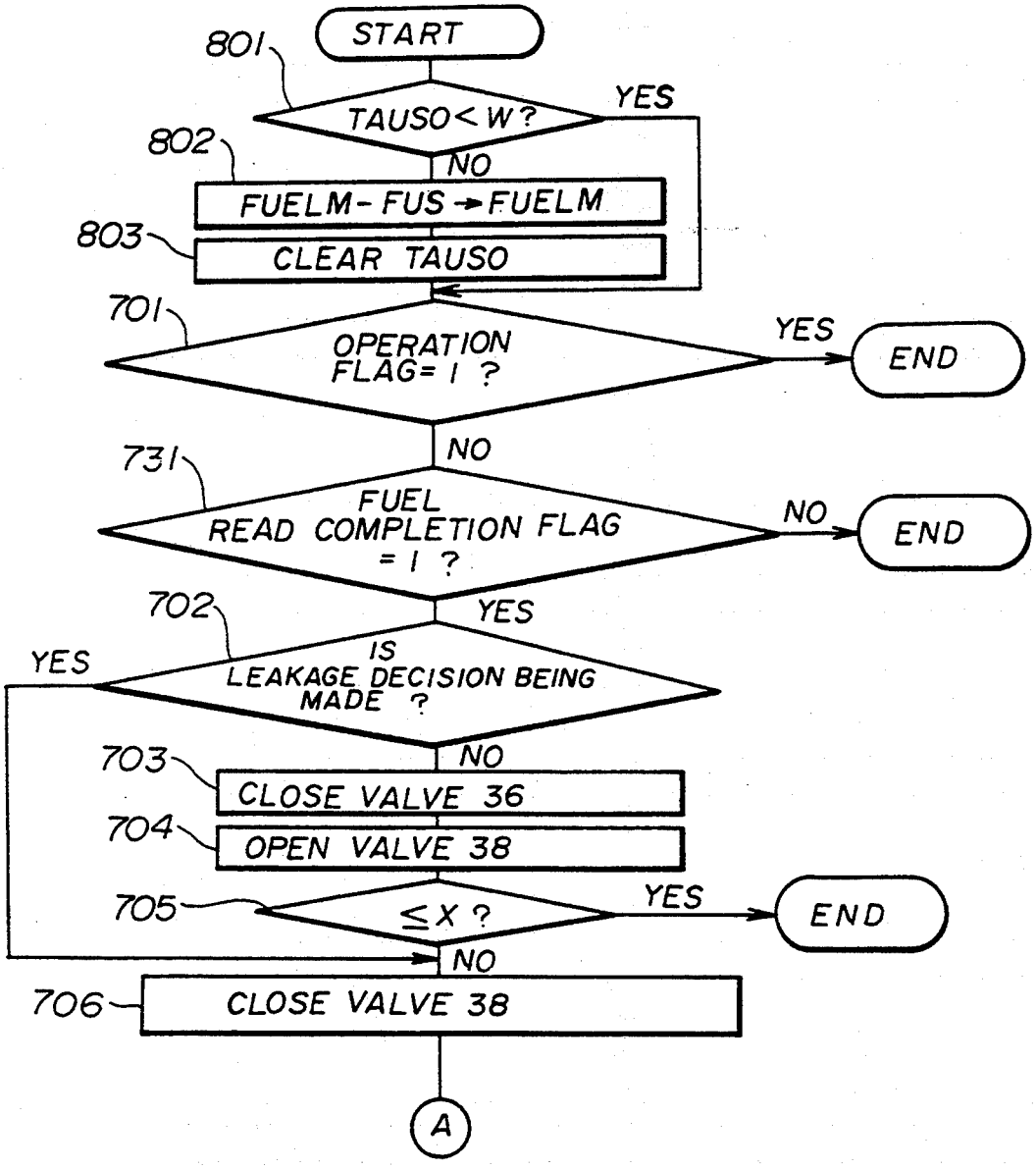
FIG. 48A and 48B are flowcharts of a third variation of the fifth embodiment of the present invention.
Figure 48B:
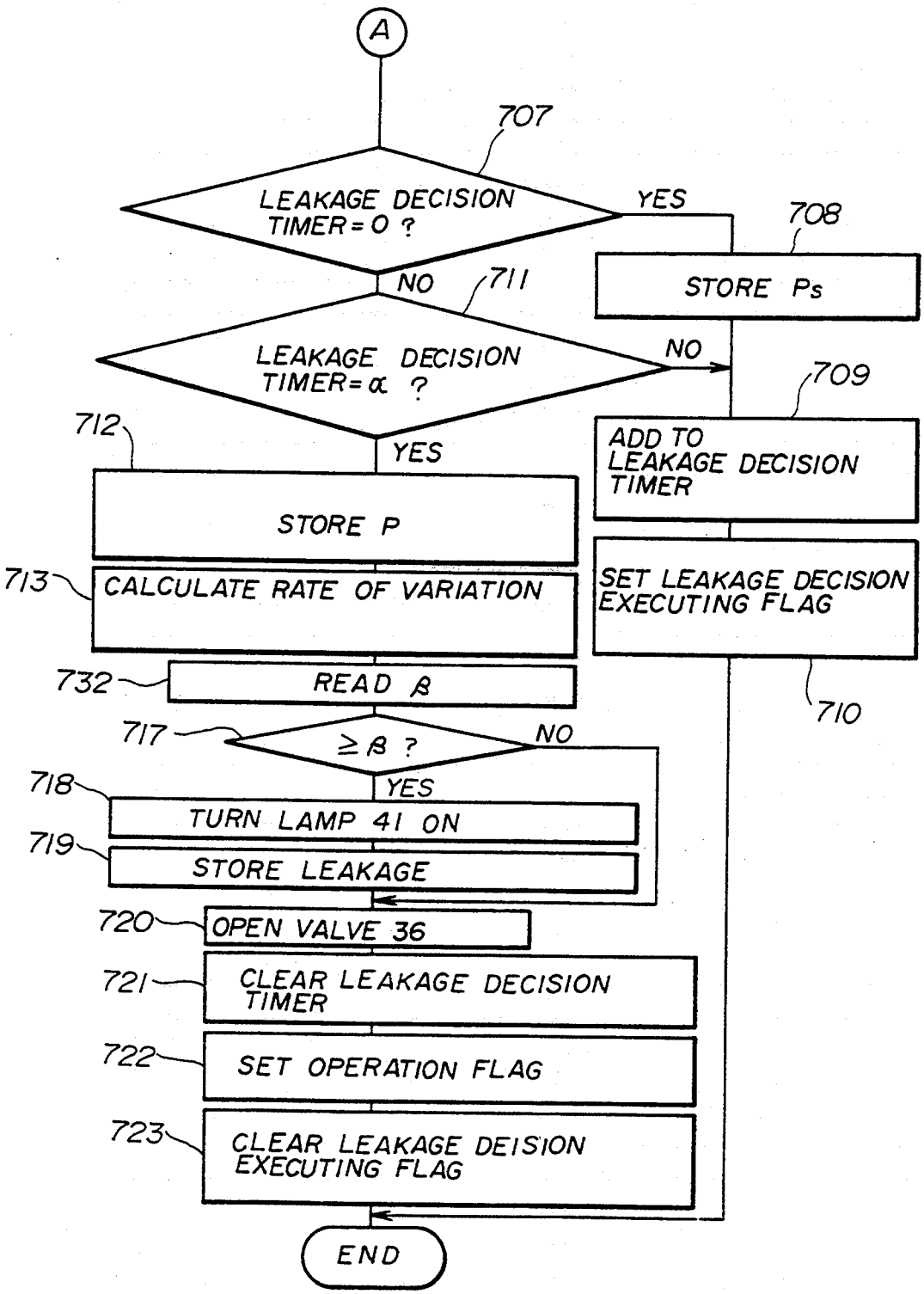

FIGS. 48A and 48B are flowcharts of a third variation of the fifth embodiment of the present invention. In FIGS. 48A and 48B, steps that are the same as steps shown in the previously described figures are given the same reference numbers. The routine shown in FIGS. 48A and 48B is executed, for example, every 65 msec. In step 801, the CPU 50 determines whether or not a fuel injection period integrating value TAUSO is less than an integration reference value W. The fuel injection period integrating value TAUSO is obtained every fuel injection timing in accordance with a process shown in FIG. 50.

When it is determined, in step 801, that TAUSO≧W, the CPU 50 updates the fuel quantity FUELM by subtracting the fuel consumption quantity FUS from the fuel quantity FUELM in step 802. The fuel consumption (injection) quantity FUS (unit l) is a fixed value obtained by the following formula:

$$FUS = W \times INJ \times m \quad (3)$$

where W is the above-mentioned integration reference value (unit ms), INJ denotes a flow characteristic (unit cc/min) of the fuel injection valve 29, and m is the number of cylinders of the engine.

The CPU 50 clears the fuel injection period integrating value TAUSO, and executes the diagnosing process starting from step 701. When it is determined, in step 801, that TAUSO<W, the CPU 50 directly executes step 701 without executing the steps 802 and 803. According to the third variation shown in FIGS. 48A and 488, the initial value of the fuel quantity FUELM is the quantity of fuel of which the fuel tank 30 is full, and the fuel consumption quantity FUS corresponding to the integration reference value W is subtracted from the FUELM each time the injection period integrating value TAUSO reaches the integration reference value W (steps 801–803).

Figure 49:
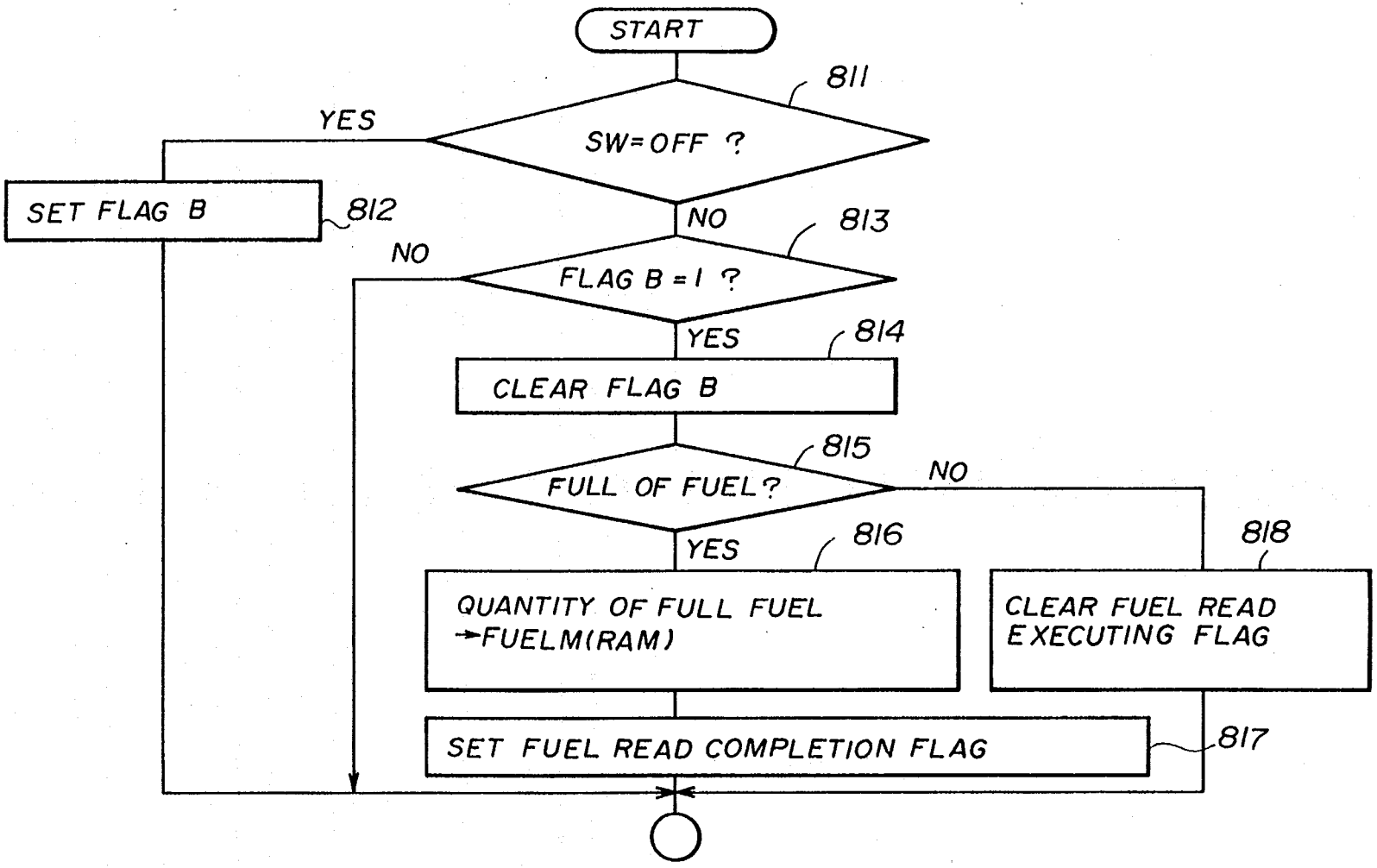
FIG. 49 is a flowchart of a process for calculating the quantity of fuel in the fuel tank.

FIG. 49 is a fuel quantity calculating routine applied to the third variation shown in FIGS. 48A and 48B. In the case where it is determined, on the basis of the position of the floating member 102*a* or the detection signal of the level sensor 102*b*, whether or not the fuel tank 30 is full of fuel, an erroneous decision result may be obtained. For example, when the fuel surface is wavy due to traveling of the vehicle, it may be determined that the fuel tank 30 is full of fuel irrespective of the fact that the tank 30 is not full. Hence, it is desirable that the fuel quantity detecting operation should be carried out in the state in which the vehicle is stationary on the flat road immediately after fuel is supplied. For this purpose, it may be possible to detect the timing at which the fuel cap switch 104 is switched from OFF to ON.

However, in some cases, fuel may be supplied so that the tank 30 is full. In this case, the initial value of the fuel quantity FUELM includes error. With the above in mind, the routine shown in FIG. 49 is intended to conclude that the fuel tank 30 is full of fuel on the basis of the detection :signals of both the fuel level sensor 102 and the fuel cap switch 104. Only when the detection signals from the sensor 102 and the switch 104 respectively indicate that the tank 30 is full, the operation flag is set to "1" in step 817 shown in FIG. 49. The engine is turned OFF when fuel is supplied. Normally, the engine is equipped with a circuit which turns ON the microcomputer 21 when the fuel cap switch 104 is switched from ON to OFF.

In step 811, the CPU 50 determines whether or not the fuel cap switch 104 is OFF. When the fuel cap switch 104 is OFF, the CPU 50 sets flag B to "1" in step 812, and ends execution of the routine. When the fuel cap switch 104 is ON, the CPU 50 determines whether or not the flag B indicates "1" in step 813. The flag B is reset to "0" by the initial routine executed immediately after the engine is started, or step 814. When it is determined that the flag B is not equal to −1", the CPU 50 decides that the fuel cap switch 104 is ON, and ends execution of the routine.

When it is determined, in step 813, that the flag B is equal to "1", that is, when it is determined that the fuel cap switch 104 switches from OFF to ON, the CPU 50 decides that supply of fuel is completed, and clears the flag B in step 814. In step 815, the CPU 50 determines that the fuel tank 30 is full of fuel. When the determination result is YES, in step 816 the CPU 50 writes the fuel quantity obtained at this time into the fuel quantity variable FUELM, which is stored in the RAM 52. In step 817, the CPU 50 sets the fuel read completion flag to "1". Hence, the fuel quantity variable FUELM is stored inn the backup RAM 53 so that it is available even after the starter switch 43 is turned OFF.

When it is determined, in step 815, that the fuel tank 30 is not full of fuel, the CPU 50 decides that fuel is not supplied so that the tank 30 becomes full, and clears the fuel read completion flag in step 818. Then, the CPU 50 ends execution of the routine. As described above, the fuel read completion flag is set to "1" only when fuel has just been supplied and it is determined that the tank 30 is full.

Figure 50:
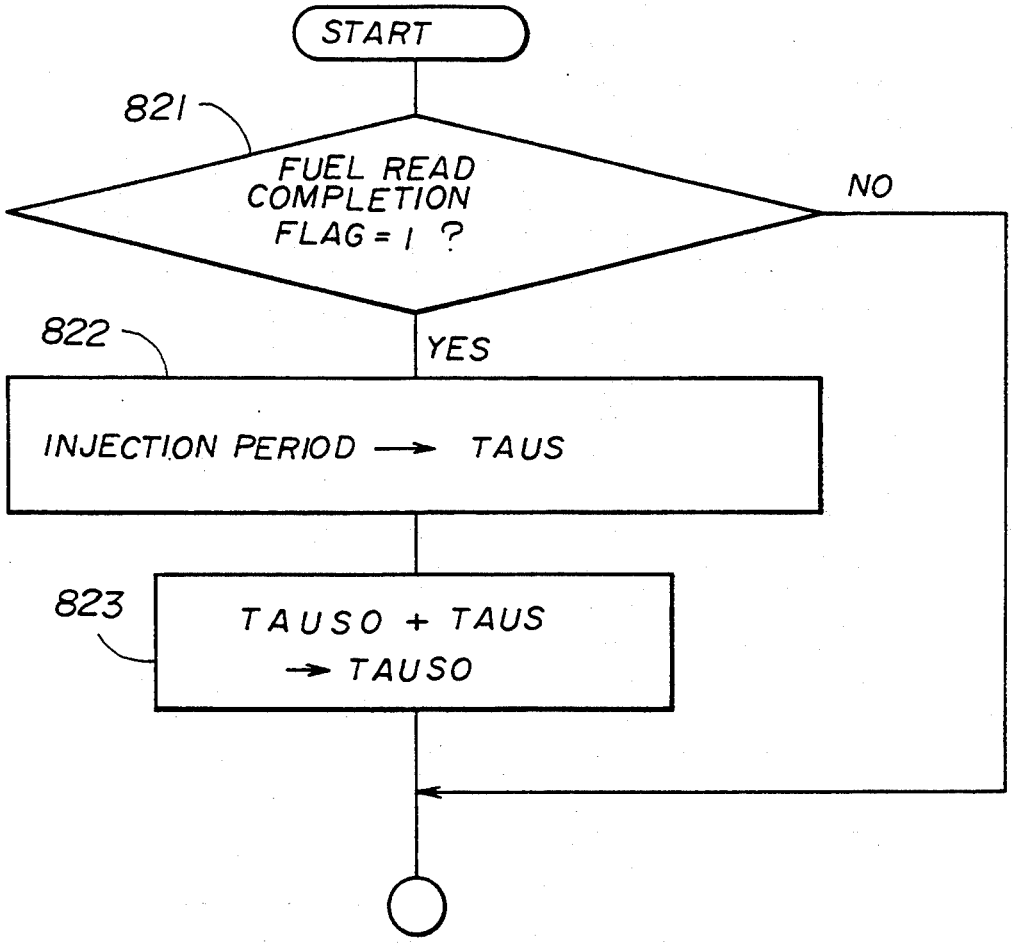
FIG. 50 is a flowchart of a process for calculating a fuel injection period integration value.

A description will now be given, with reference to FIG. 50, of a routine for calculating the fuel injection period integration value TAUSO used in the flowchart of FIGS. 48A and 488. In step 50, the CPU 50 determines whether or not the fuel read completion flag is equal to "1". When it is determined that the flag is not equal to "1", the CPU 50 decides that fuel is not supplied so that the tank 30 becomes full, and ends execution of the routine shown in FIG. 50. When it is determined that the fuel read completion flag is equal to "1", in step 822 the CPU 50 writes the injection period TAU calculated by the fuel injection period calculating routine into the variable TAUS. In step 823, the CPU 50 adds the value of the variable TAU to the variable of the injection period integration value TAUSO, and ends execution of the routine.

The injection period TAU can be calculated by, for example, using (TP×FAF×F) where TP denotes a basic injection period, which is calculated from the engine speed and the quantity of intake air (magnitude of the intake air pipe 24) so that a mixture of air and fuel injected has a target air-fuel ratio. The FAF denotes an air-to-fuel feedback correction coefficient, which is varied so that the air-fuel ratio is equal to the target air-fuel ratio on the basis of the concentration of oxygen in exhaust gas. F denotes various correction coefficients based on the temperature of intake air and the temperature of the coolant, and is equal to 1.0 or close thereto immediately before the engine has been warmed up.

Other variations of the fifth embodiment of the present invention can be made. For example, it is possible to perform the diagnosing operation when the quantity of fuel in the tank 30 is equal to a predetermined level other than the full level. It is also possible to inhibit execution of the diagnosing operation when the fuel level becomes equal to or lower than a predetermined fuel level other than the full level. The purging of fuel vapor can be performed in the vicinity of the throttle valve 25.

A description will be given of a sixth embodiment of the present invention. The sixth embodiment is intended to execute the diagnosing operation taking into account the following matter. When the vehicle is traveling at a speed of 90 km/h on a 5% slope, the vehicle moves an attitude distance of 75 m per minute. Since a variation in the atmosphere is 1333 Pa per 100 m, a pressure variation of 998 Pa occurs per minute for the attitude difference 75 m. If a hole having a diameter of 0.4 mm occurs inn the vapor passage, a pressure variation of approximately 638 Pa takes place per minute. When the atmospheric pressure varies in the state in which the diagnosing operation is performed on the basis of the difference between the pressure in the closed evaporative fuel purge system and the atmospheric pressure, an error occurs in the above difference the pressure in the closed system is not affected by the atmospheric pressure. Hence, an erroneous decision may be made. The sixth embodiment of the present invention is intended to eliminate the above problem.

Figure 51:
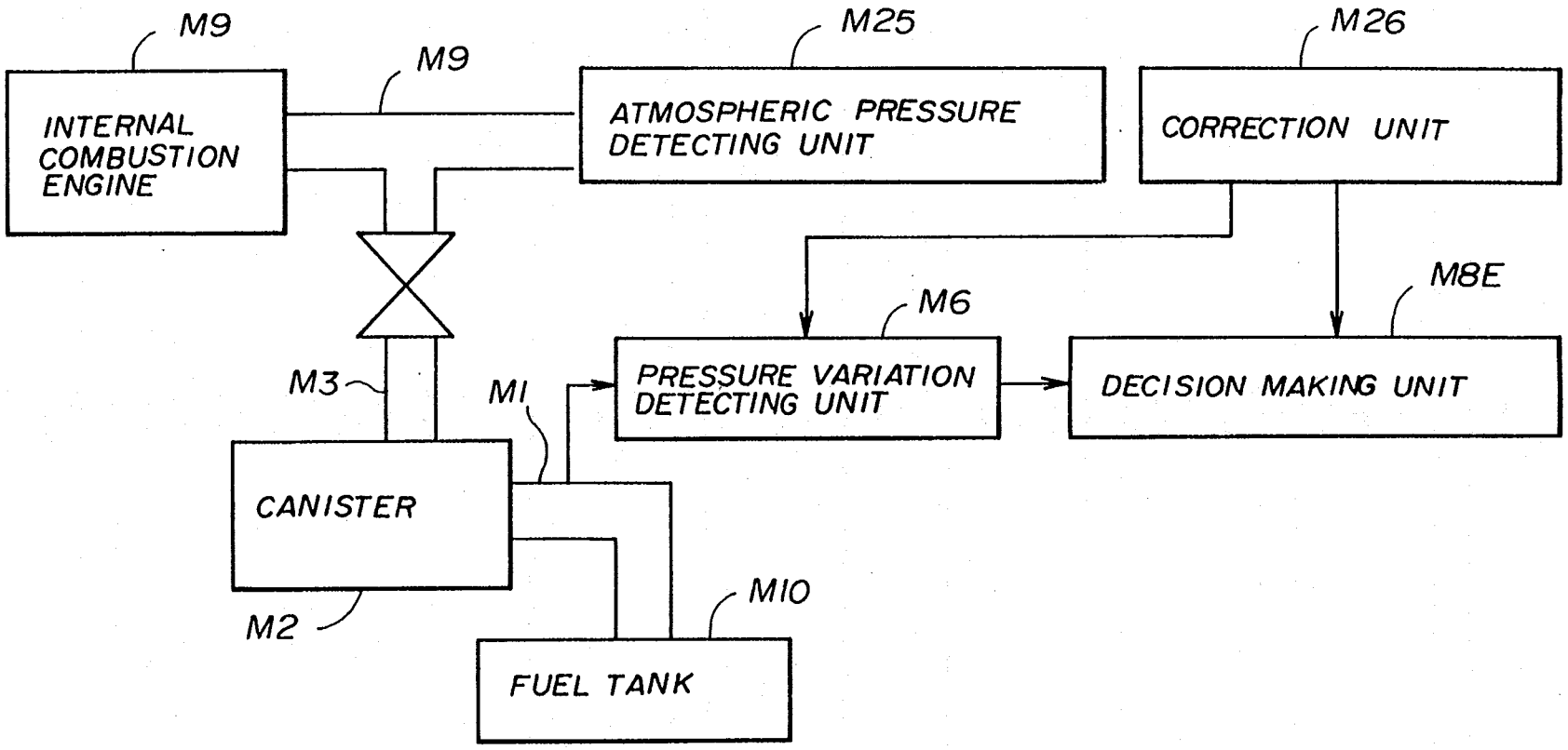
FIG. 51 is a block diagram of an overview of a sixth embodiment of the present invention.

FIG. 51 shows an overview of the sixth embodiment of the present invention. In FIG. 51, parts that are the same as parts shown in the previously described figures are given the same reference numbers. In FIG. 51, the evaporative fuel purge system is maintained in the closed state during the time when the diagnosing operation is being performed. The pressure detecting unit M6 detects the pressure in the evaporative fuel purge system maintained in the closed state. A decision making unit M8E makes a decision as to whether or not a failure has occurred in the system by comparing a variation in the pressure detected by the pressure detecting unit M6 with a predetermined leakage decision value. An atmospheric pressure detecting unit M25 detects the atmospheric pressure. A correction unit M26 corrects the detection signal of the pressure detecting unit M6 and the predetermined leakage decision value used in the decision making unit M8E on the basis of the atmospheric pressure detected by the atmospheric pressure detecting unit M25.

Figure 52:
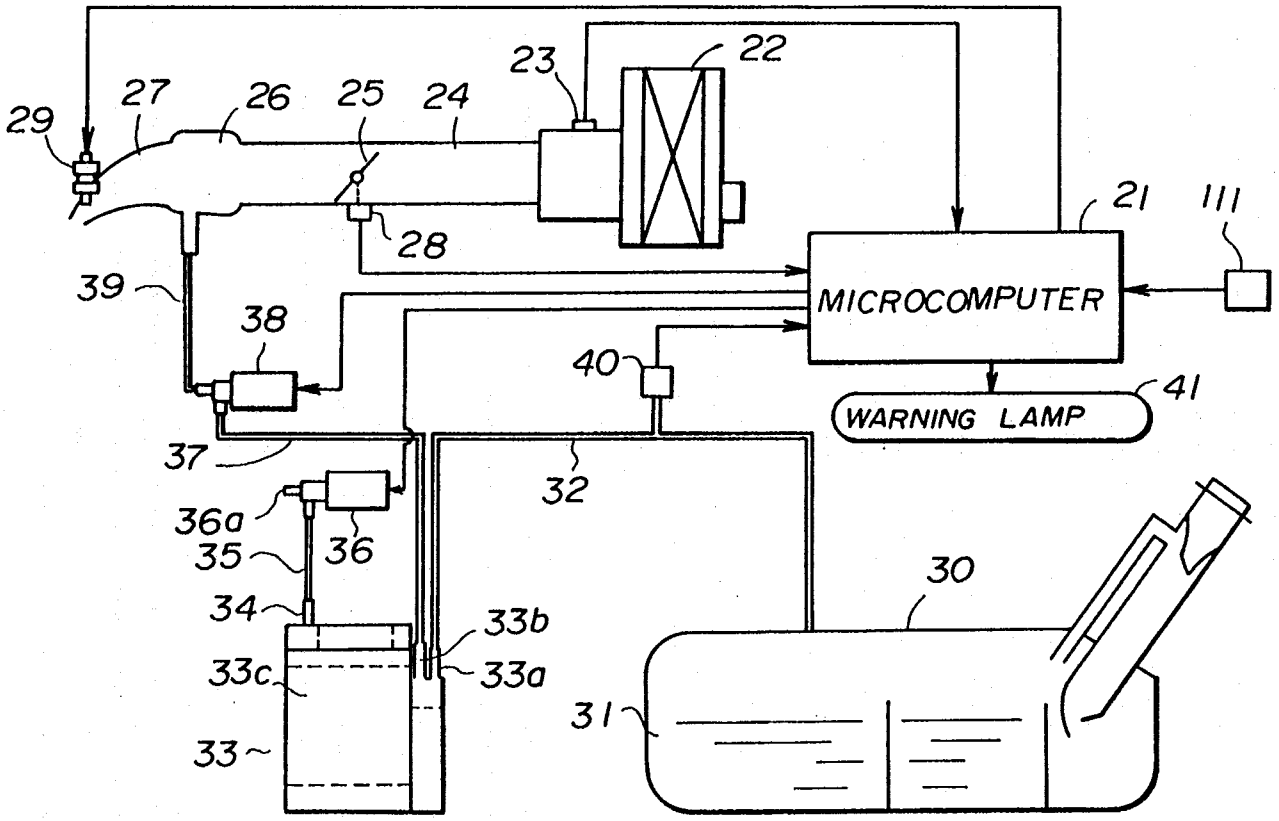
FIG. 52 is a diagram of the system structure of the sixth embodiment of the present invention.
Figure 53:
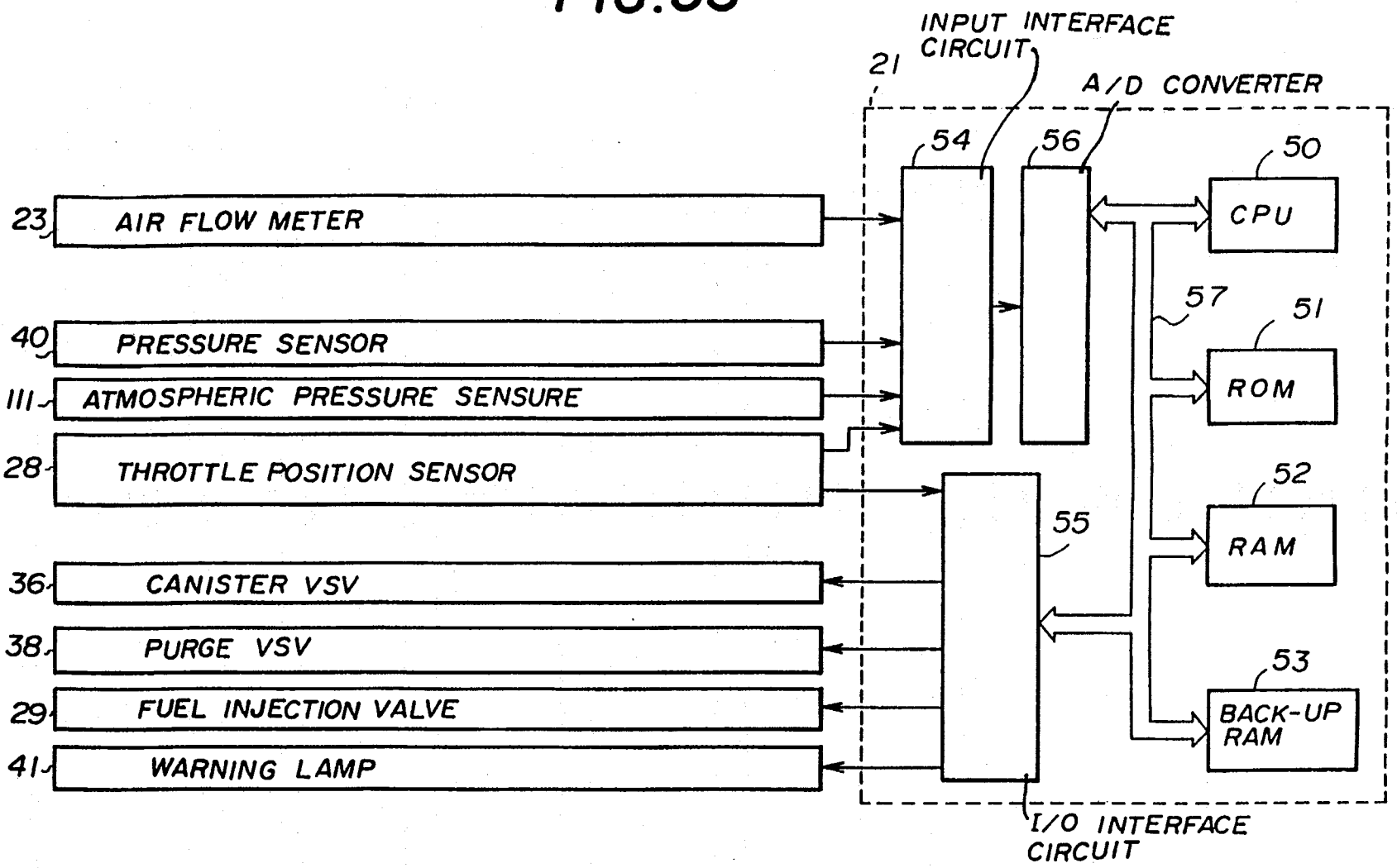
FIG. 53 is a block diagram of the hardware structure of the sixth embodiment of the present invention.

FIG. 52 shows the system structure of the sixth embodiment of the present invention. In FIG. 52, parts that are the same as parts shown in the previously described figures are given the same reference numbers. An atmospheric pressure sensor 111 is connected to the microcomputer 2.1. FIG. 53 shows the system structure of the sixth embodiment of the present invention. In FIG. 53, parts that are the same as parts shown in the previously described figures are given the same reference numbers. The atmospheric pressure sensor 111 is connected to the input interface circuit 54.

Figure 54A:
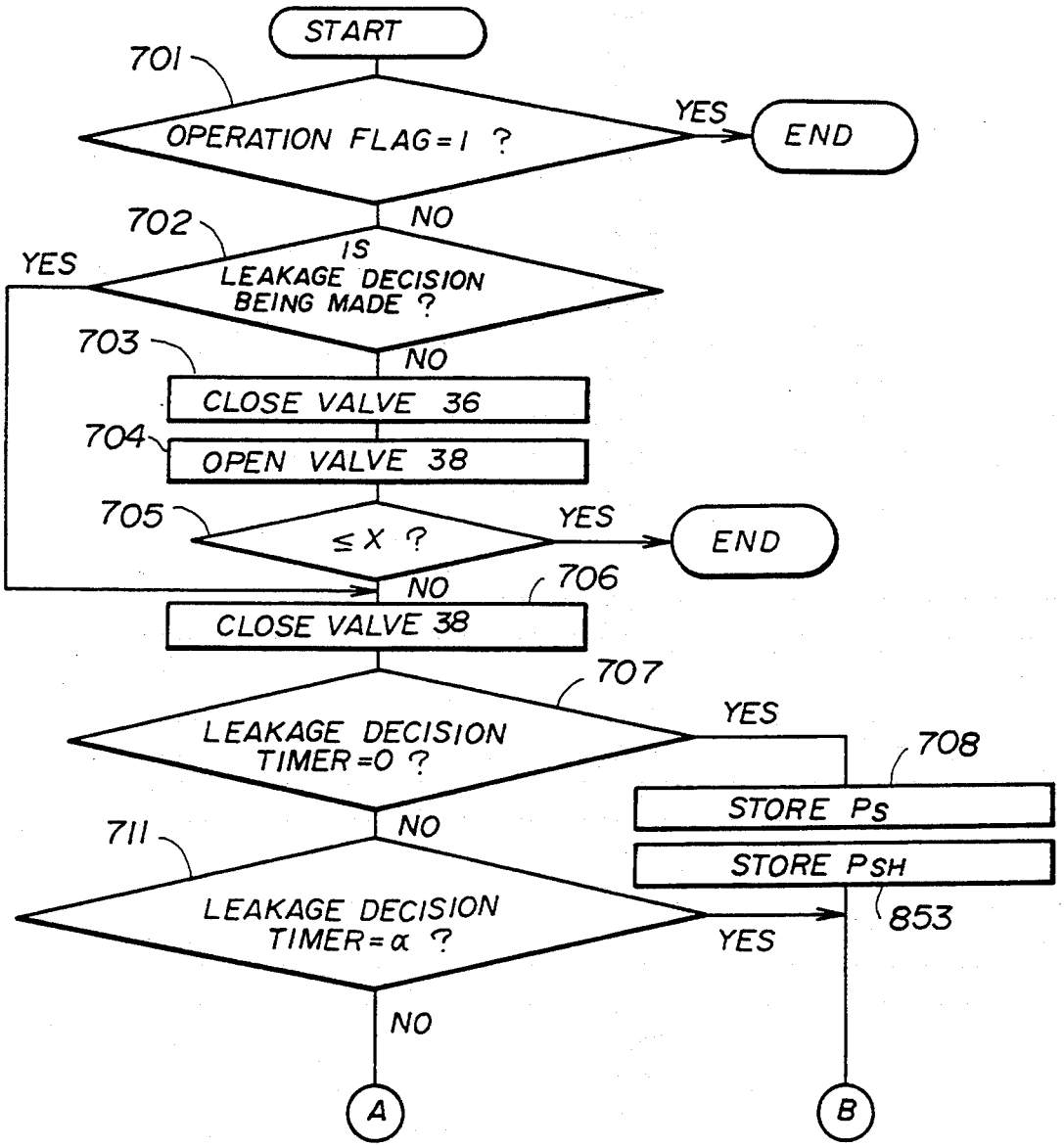
FIGS. 54A and 54B are flowchart of the operation of the sixth embodiment of the present invention.
Figure 54B:
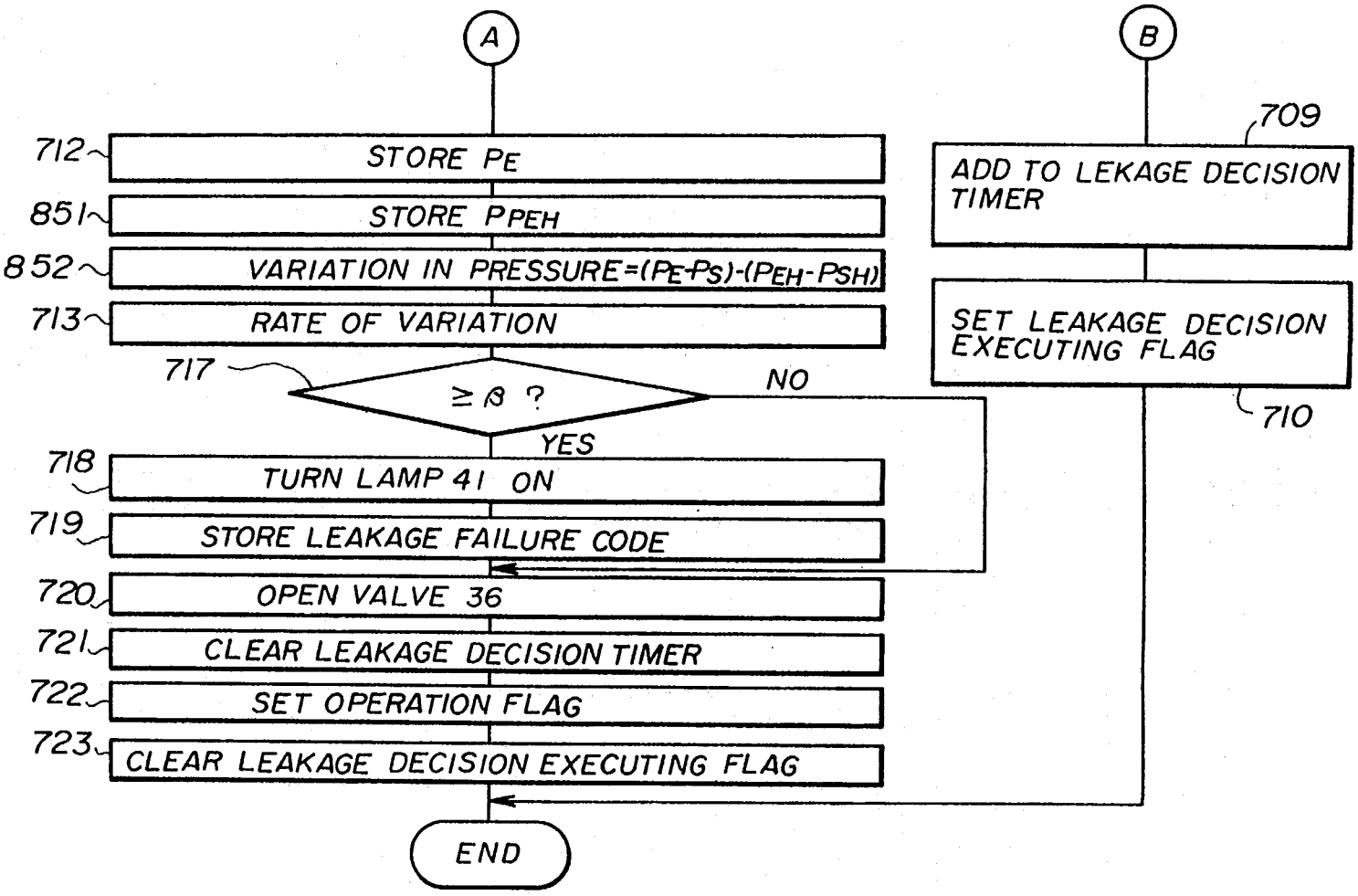

FIGS. 54A and 54B are flowcharts of a diagnosing routine according to the sixth embodiment of the present invention. The routine shown in FIGS. 5.4A and 54B is executed every 65 msec. In FIGS. 54A and 54B, steps that are the same as steps shown in FIGS. 38A and 38B are given the same reference numbers. After it is determined, in step 707, that the leakage decision timer is equal to 0 and executes step 708, in step 853 the CPU 50 reads the atmospheric pressure from the detection signal from the atmospheric pressure sensor 111, and writes it into a diagnosis starting atmospheric pressure variable $P_{SH}$ stored in the RAM 52. After executing step 712, in step 851 the CPU 50 reads the atmospheric pressure from the detection signal of the atmospheric pressure sensor 111, and writes it into a diagnosis end atmospheric pressure variable $P_{EH}$ stored in the RAM 52. In step 852, the CPU 50 calculates a variation in the pressure by using the following expression:

$$(P_E-P_S)-(P_{EH}-P_{SH}).$$

The influence of variation in the atmospheric pressure has been eliminated from the variation in the pressure in the fuel tank 30. In step 713, the rate of variation in the pressure in the fuel tank 30 is calculated by dividing the variation in the pressure by a seconds.

Figure 55:
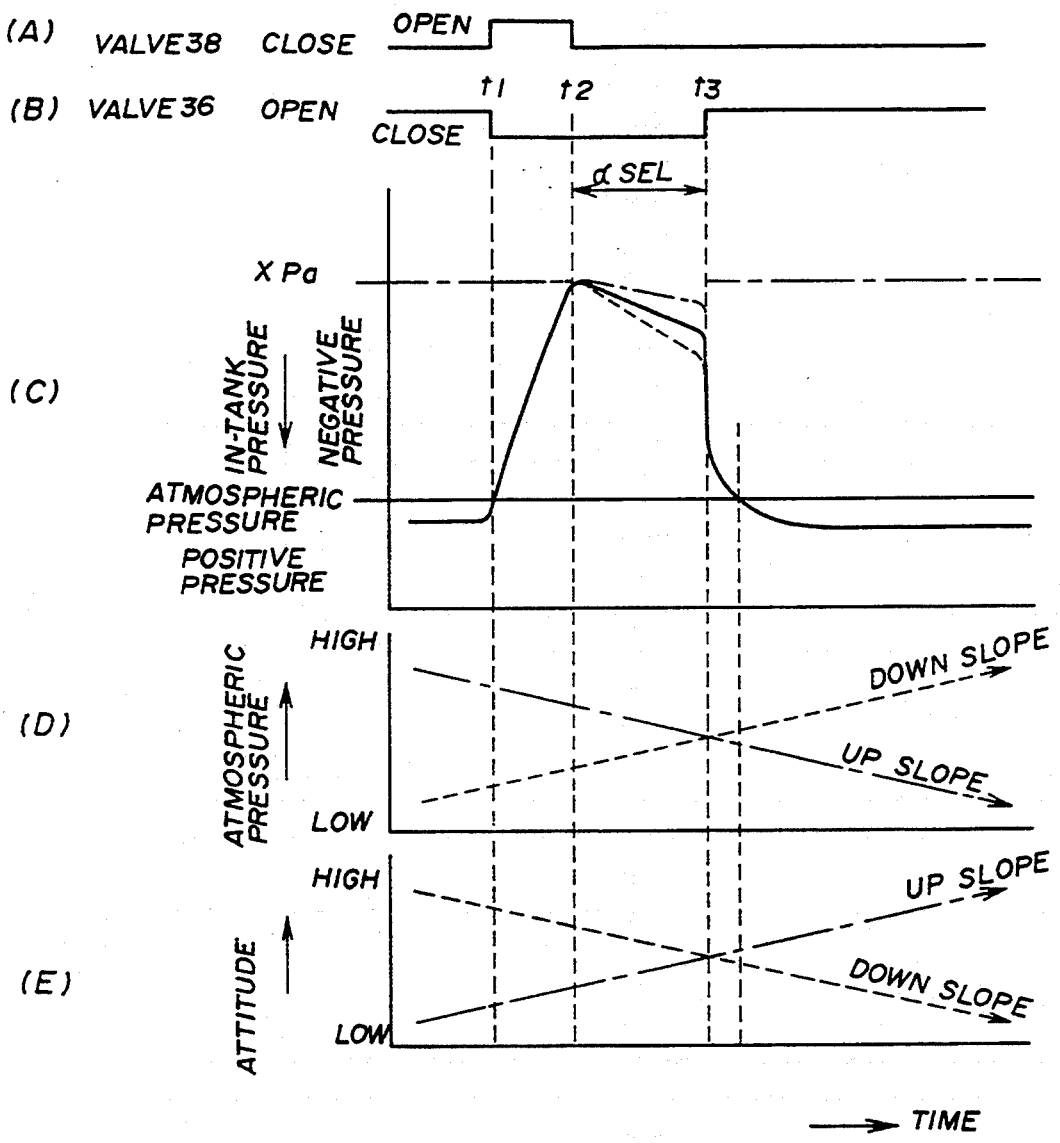
FIG. 55 is a time chart illustrating the operation of the sixth embodiment of the present invention.

FIG. 55 is a graph showing the operation of the sixth embodiment of the present invention. In FIG. 55, (A), (B) and (C) respectively correspond to (A), (B) and (C) of FIG. 5. The solid line in (C) of FIG. 55 indicates a variation in the in-tank pressure observed in the state in which there is no variation in the atmospheric pressure. When the vehicle is traveling on a down slope as indicated by the broken line in (E) of FIG. 55, the atmospheric pressure increases, as indicated by the broken line in (D) of FIG. 55. In this case, the in-tank pressure detected by the pressure sensor 40 greatly increases towards the atmospheric pressure between the times $t_2$ and $t_3$, as indicated by the broken line in (C) of FIG. 55. When the vehicle is traveling on an up slope, as indicated by the one-dot chained line shown in (E) of FIG. 55, the atmospheric pressure decreases as indicated by the one-dot chained line in (D) of FIG. 55. In this case, the in-tank pressure detected by the pressure sensor 40 does not greatly increase towards t:he atmospheric pressure between the times $t_2$ and $t_3$, as indicated by the one-dot chained line shown in (C) of FIG. 55.

However, according to the sixth embodiment of the present invention, the variation in the pressure is obtained (step 852) by subtracting the variation in the atmospheric pressure ($P_{EH}-P_{SH}$) from the variation in the in-tank pressure ($P_E-P_S$), and is used to obtain the rate of variation in the in-tank pressure. Hence, it is possible to obtain the rate of variation in the in-tank pressure shown by the solid line in (C) of FIG. 55 irrespective of whether the vehicle is traveling on a down or up slope. Hence, it is possible to correctly determine whether or not leakage has occurred in the evaporative fuel purge system.

A variation of the sixth embodiment of the present invention will now be described with reference to FIG. 56, wherein parts which are the same as parts shown in the previously described figures are given the same reference numbers. The variation shown in FIG. 56 uses the check valve 78 provided in the vapor passage 32. When the engine does not operate, the fuel tank 30 is released to the atmosphere via the vapor passage 32, the check valve 78, the vapor passage **32*a*, the canister 33 and the atmosphere aperture 34. When the engine is started, fuel is fed from the tank 30** by the pump, and the vapor volume increases while the in-tank pressure decreases to a negative pressure. Thereafter, the fuel is returned to the fuel tank and the fuel temperature increases. Hence, fuel vapor increases and the in-tank pressure increases to a positive pressure.

Figure 56:
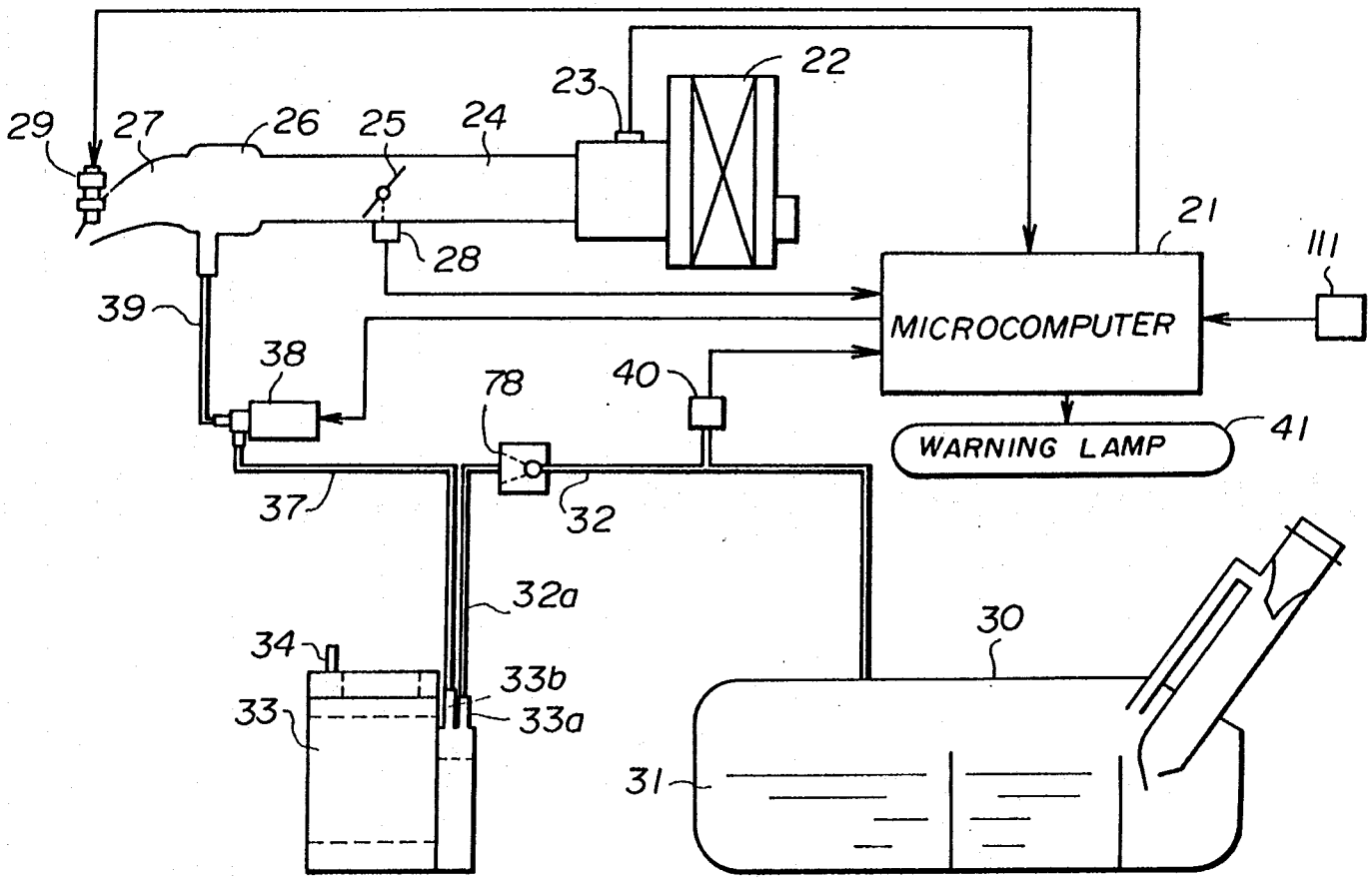
FIG. 56 is a block diagram of a variation of the sixth embodiment of the present invention.
Figure 57:
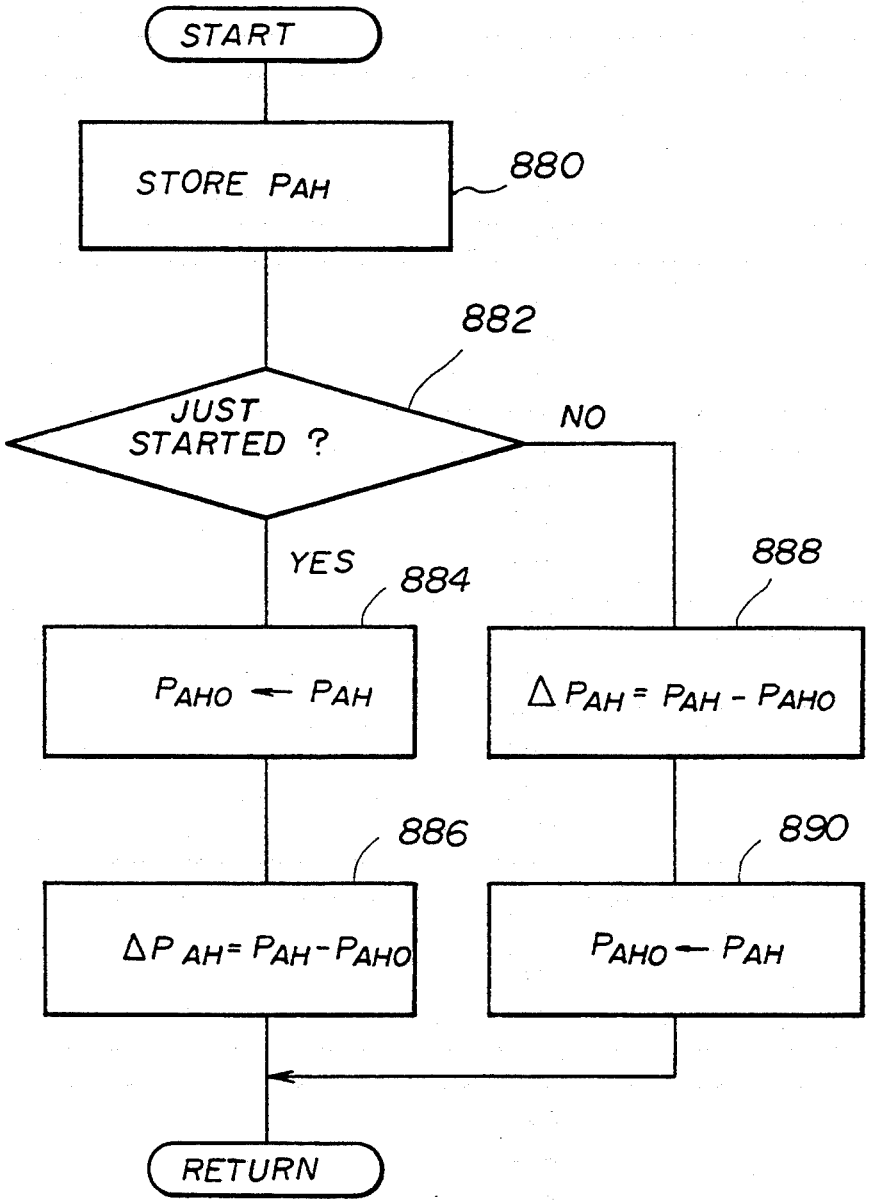
FIGS. 57 and 58 are diagrams of the operation of the sixth embodiment of the present invention.

FIG. 57 is a flowchart of an atmospheric pressure read routine of the variation shown in FIG. 56. The routine shown in FIG. 57 is executed, for example, every 1 minute. In step 880, the CPU 50 reads the atmospheric pressure from the detection signal of the atmospheric pressure sensor 111, and writes it into a variable $P_{AH}$, which is stored in the RAM 52. In step 882, the CPU 50 determines whether or not the engine has just been started by referring to the signal from the starter switch 43. When the result of step 882 is YES, in step 884 the CPU 50 inserts the value of the variable $P_{AH}$ into a previous atmospheric pressure variable $P_{AHO}$, which is stored in the RAM 52. In step 886, the CPU 50 subtracts the previous atmospheric pressure $P_{AHO}$, from the atmospheric pressure $P_{AH}$ to obtain an atmospheric pressure variation delta-$P_{AH}$.

When it is determined, in step 882, that the engine has not just been started, the CPU 50 subtracts the previous atmospheric pressure $P_{AHO}$ from the atmospheric pressure $P_{AH}$ to obtain the atmospheric pressure variable delta-$P_{AH}$. In step 890, the CPU 50 inserts the atmospheric pressure $P_{AH}$ into the previous atmospheric pressure variable $V_{AHO}$.

Figure 58:
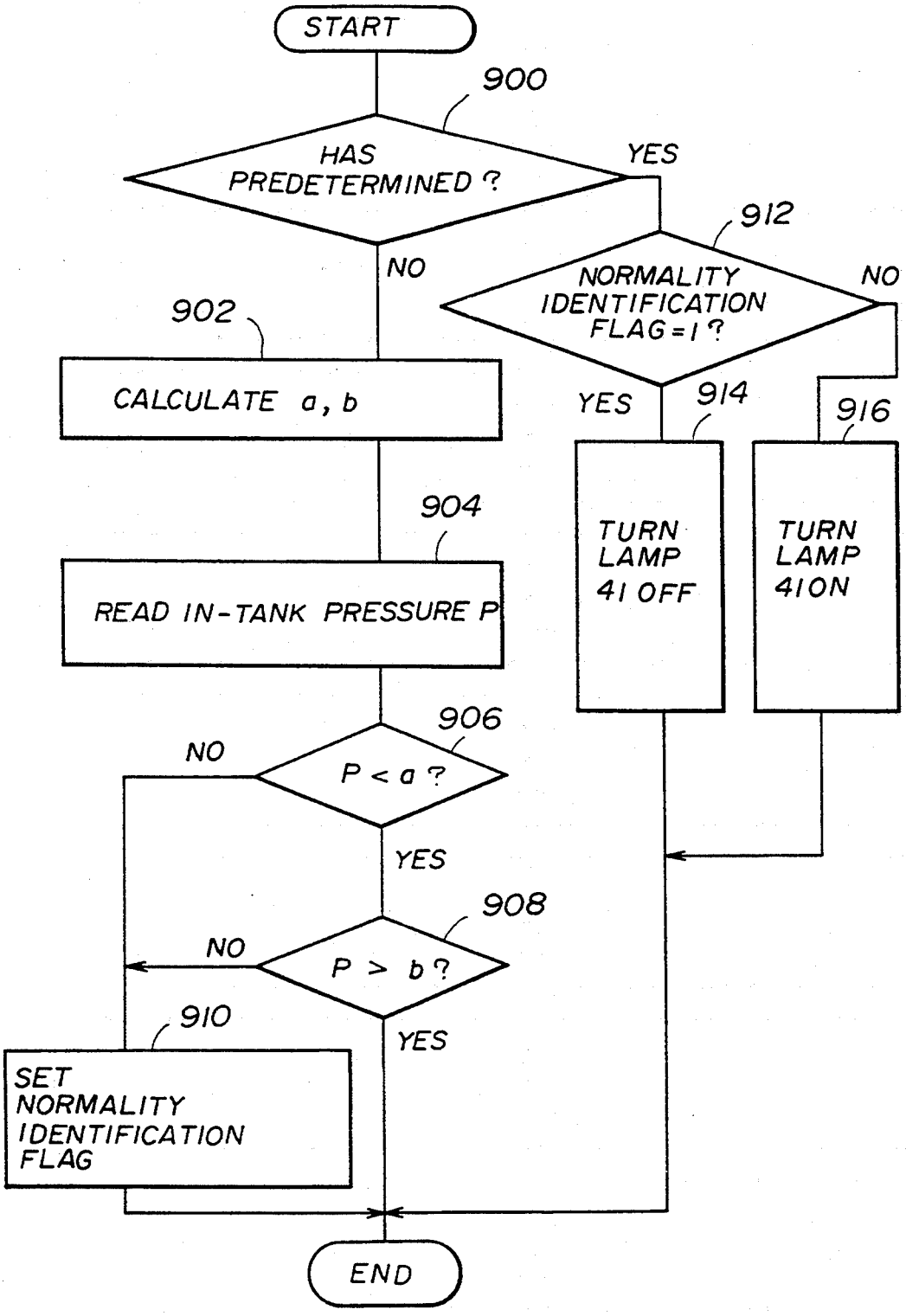

A routine shown in FIG. 58 is a part of the main routine executed every 65 msec. In step 900, the CPU 50 whether or not a predetermined time has elapsed after the engine is started. The predetermined time is, for example, 10 minutes. When the result of step 900 is NO, the CPU 50 executes step 902 in which leakage decision values and are obtained by accessing tables defining graphs of FIGS. 59A and 598 by the atmospheric pressure variation delta-$P_{AH}$. The leakage decision value a is used to decide that the evaporative fuel purge system is normal when the in-tank pressure becomes equal to or higher than the leakage decision value a. The leakage decision value b is used to decide that the system is normal when the in-tank pressure becomes equal to or lower than the leakage decision value b.

Figure 59A:
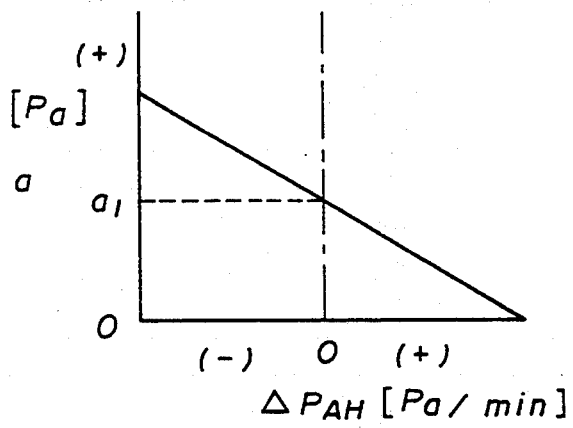
FIGS. 59A, 59B, 60, 61 and 62 are graphs illustrating the operation of the sixth embodiment of the present invention.
Figure 59B:
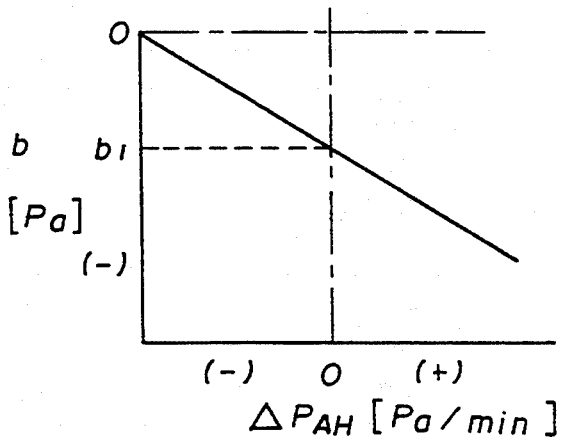

FIG. 59A shows that the positive leakage decision value a decreases as the atmospheric pressure variation delta-$P_{AH}$ increases, that is, the rate of increase in the atmospheric pressure increases. FIG. 59B shows that the negative leakage decision value b decreases as the atmospheric pressure variation delta-$P_{AH}$ increases.

In step 904, the CPU 50 reads the in-tank pressure P from the detection signal from the pressure sensor 40, and compares the in-tank pressure P with the leakage decision values a and b in steps 906 and 908. When the result of either step 906 or 908 is NO, the CPU 50 sets the normality indication flag to "1" in step 910, and ends execution of the routine.

When it is determined, in step 900, that the predetermined time has elapsed after the engine is started, the CPU 50 determines whether or not the normality indication flag is equal to "1" in step 912. When the result of step 912 is YES, the CPU 50 turns the warning lamp 41 ON in step 914. When the result of step 912 is NO, the CPU turns the warning lamp 41 OFF in step 916.

Figure 60:
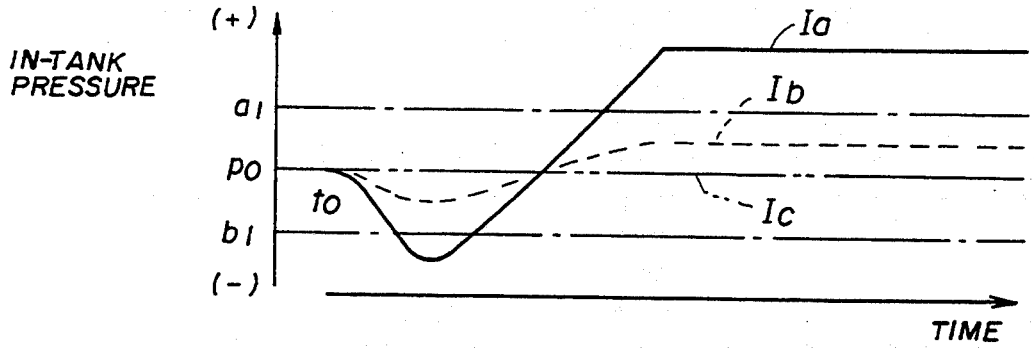
Figure 61:
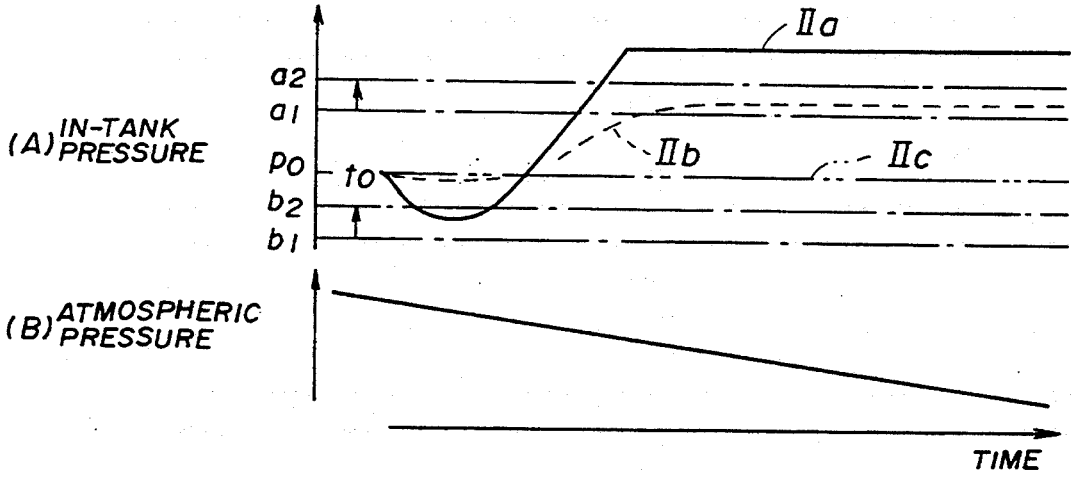

With the atmospheric pressure variation delta-Pa equal to zero, the leakage decision values a and b are respectively $a_1$ and $b_1$. When there is no leakage in the fuel tank 30 and the vapor passage 32, the in-tank pressure P decreases after time $t_0$ at which the engine is started, as indicated by the solid line I*a* in FIG. 80. After the in-tank pressure P becomes less than the leakage decision value $b_1$, it starts to increase and then exceeds the leakage decision value $a_1$. Hence, the normality indication flag is set to "1", and the warning lamp 41 is continuously OFF. If there is a small leakage area, the in-tank pressure will fluctuate between the leakage decision values $a_1$ and $b_1$, as indicated by the broken line Ib in FIG. 60, and the normality indication flag is not set to "1". Hence, the warning lamp 41 is turned ON. If there is a large leakage area, the in-tank pressure P little deviates from the pressure $P_O$, as shown by the two-dot chained line Ic. Hence, the normality indication flag is not set to "1", and the warning lamp 41 is turned ON.

Figure 81:
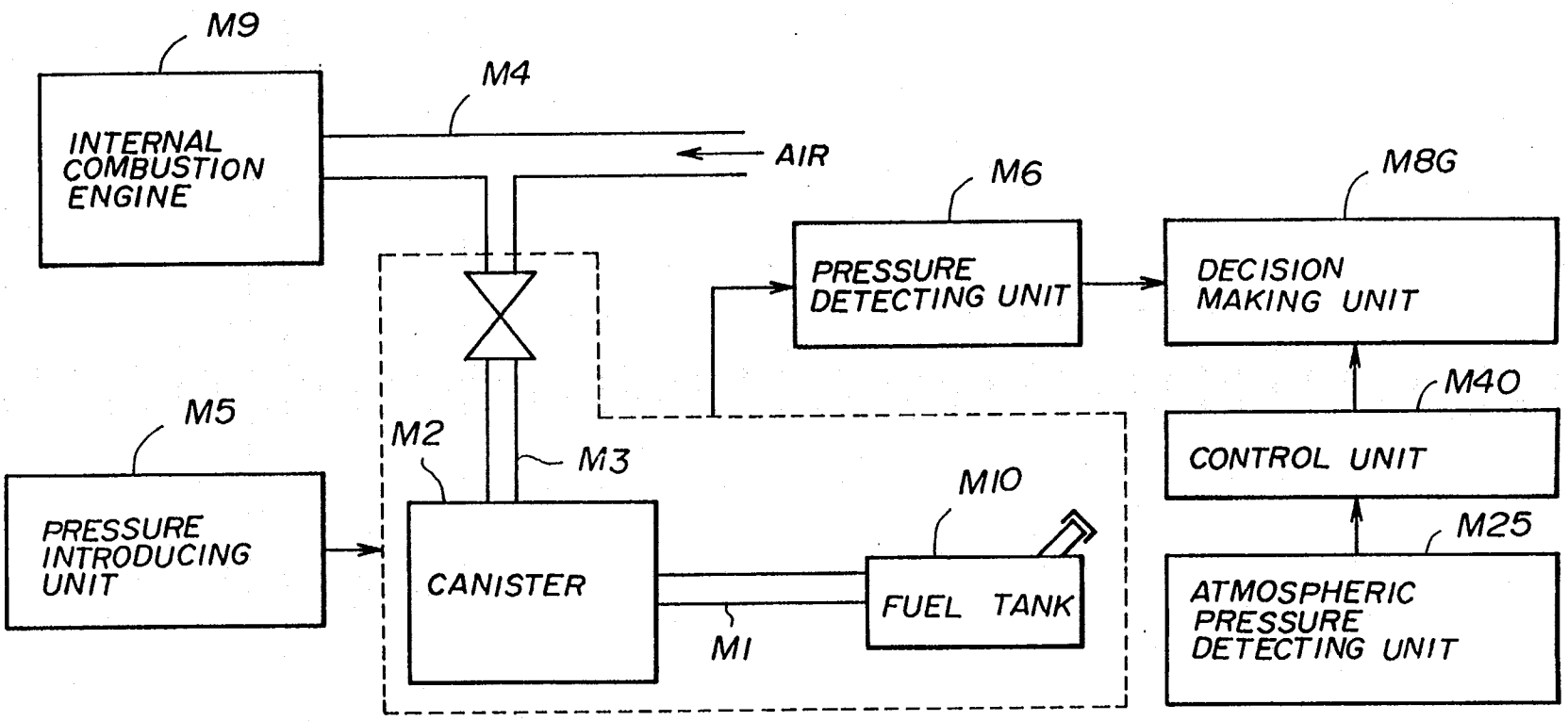
FIG. 81 is a block diagram of an overview of an eighth embodiment of the present invention.

If the atmospheric pressure variation delta-Pa is negative as shown in (B) of FIG. 81, the leakage decision values a and b are respectively $a_2$ and $b_2$, as shown in (A) of FIG. 81. When there is no leakage in the fuel tank 30 and the vapor passage 32, the in-tank pressure P decreases after the engine is started (time $t_0$) as shown in (A) of FIG. 81, and falls into the range between $b_1$ and $b_2$. Then, the, in-tank pressure P starts to increase and exceeds the leakage decision value $a_2$. Hence, the normality indication flag is not set to "1" and the warning lamp 41 continues to be ON. If there is a small leakage area in the fuel tank 30, the in-tank pressure P exceeds the leakage decision value $a_1$ and fluctuates between $a_2$ and $b_2$, as indicated by the broken line IIb in (A) of FIG. 81. Hence, the normality indication flag is not set to "1" and the warning lamp 41 is turned ON. If there is a large leakage area in the fuel tank 30, the in-tank pressure little deviates from the pressure $P_0$ as shown by the two-dot chained line IIc. Hence, the normality indication flag is not set to "1", and the warning lamp. 41 is turned ON.

Figure 62:
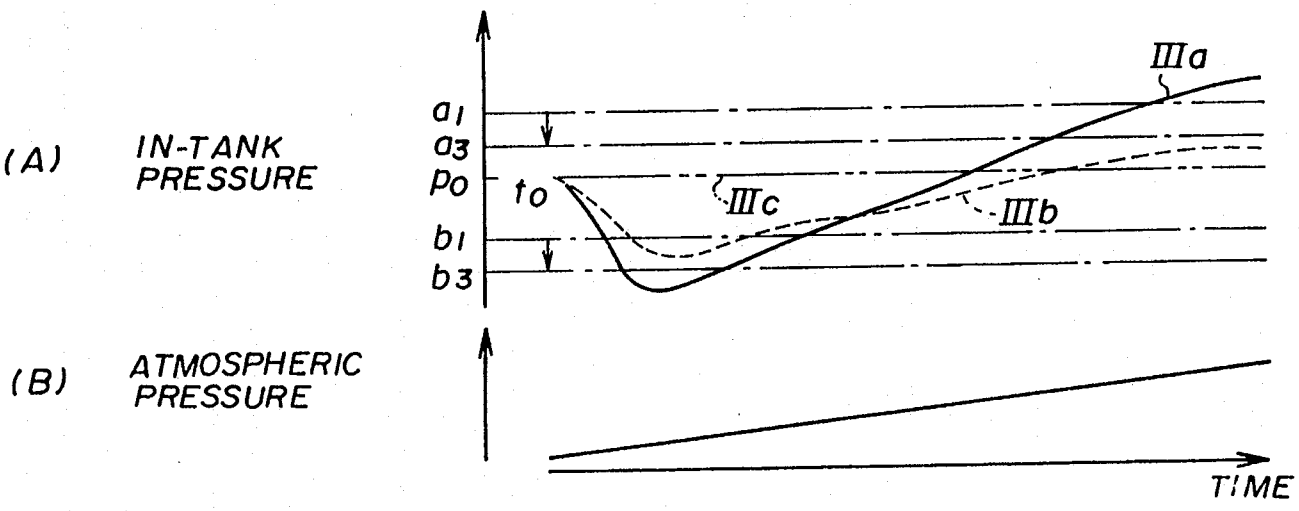
Figure 63:
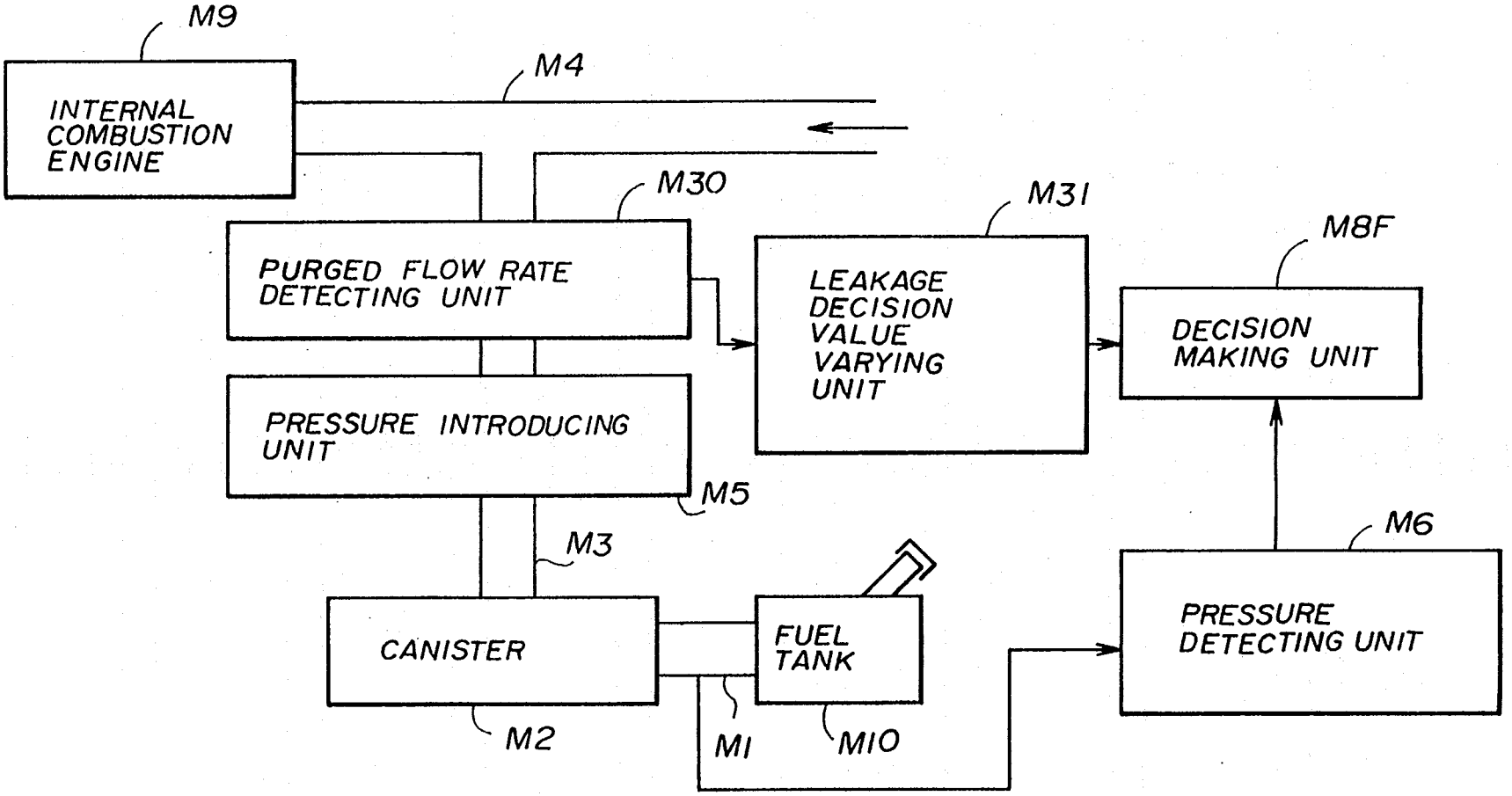
FIG. 63 is a block diagram of an overview of a seventh embodiment of the present invention.

When the atmospheric pressure variation delta-Pa is positive as shown in (B) of FIG. 62, the leakage decision values a and b are respectively $a_3$ and $b_3$ lower than the leakage decision values $a_1$ and $b_1$. When there is no leakage in the fuel tank 30 and the vapor passage 32, the in-tank pressure P decreases after the engine is started (time $t_0$), as indicated by the solid line IIIa in (A) of FIG. 62, and becomes lower than the leakage decision value $b_3$. Then, the, in-tank pressure P starts to increase and exceeds the leakage decision value $a_3$. Hence, the normality indication flag is set to "1" and the warning lamp 41 is continuously OFF. If there is a small leakage area in the fuel tank 30, the in-tank pressure P becomes lower than the leakage decision value $a_1$, and fluctuates in the range between $a_3$ and $b_3$, as shown in the broken line IIIb in (A) of FIG. 62. Hence, the normality indication flag is not set to "1", and the warning lamp 41 is turned ON. If there is a large leakage area in the fuel tank 30, the in-tank pressure delta-P little deviates from the pressure $P_0$, as shown by the two-dot chained line. Hence, the normality indication flag is not set to "1", and the warning lamp 41 is turned ON.

In the above-described manner, the leakage decision values a and b are varied in accordance with the variation delta-$P_{AH}$, and it is possible to make an erroneous decision such that the evaporative fuel purge system is normal irrespective of the occurrence of a small leakage area fin the system.

It is possible to omit step 890 and obtain a variation delta-$P_{AH}$ in the atmospheric pressure with respect to the atmospheric pressure obtained when the engine is started to calculate the leakage decision values a and b. It is also possible to apply the sixth embodiment to a structure which calculates the difference between the minimum in-tank pressure and the maximum in-tank pressure for a predetermined period after the engine is started. In this case, the minimum and maximum in-tank pressure values are corrected by variation in the atmospheric pressure.

A description will now be given of a seventh embodiment of the present invention. The seventh embodiment of the present invention is intended to consider the quantity of purge flow in order to control a predetermined leakage decision value to be compared with a variation in the pressure in the system and to control the period during which the negative pressure is introduced in the system.

Figure 83:
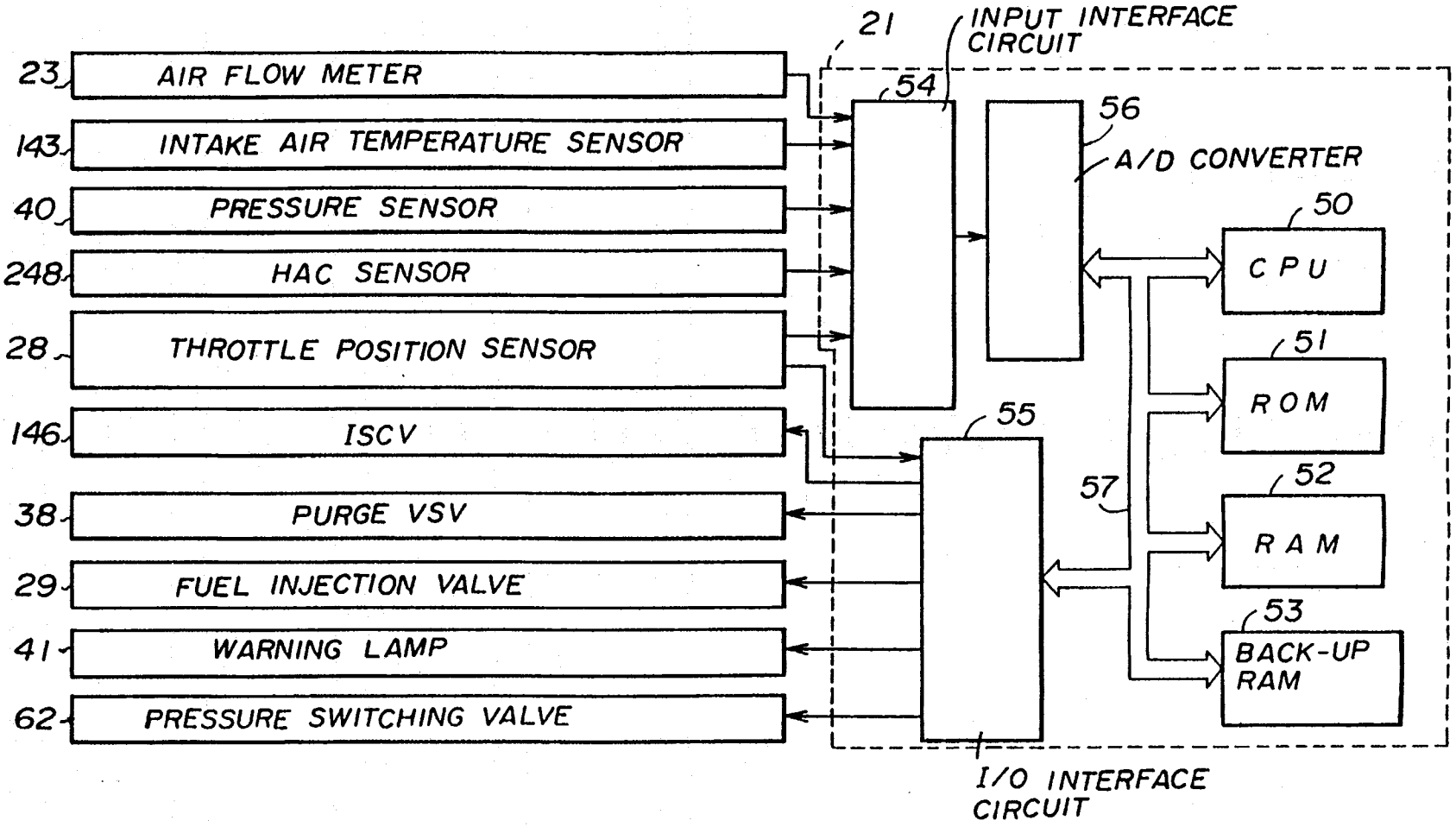
FIG. 83 is a block diagram of the hardware structure of the eighth embodiment of the present invention.

FIG. 83 shows an overview of the seventh embodiment of the present invention. In FIG. 83, parts that are the same as parts shown in the previously described figures are given the same reference numbers. A purged flow rate detecting unit M30 detects the flow rate of purged fuel flowing in the purge passage M3. A decision making unit M8F obtains the rate of variation in the negative pressure introduced in the evaporative fuel purge system on the basis of the detection signal of the pressure detecting unit M6, and compares the rate of variation in the pressure with a predetermined leakage decision value in order to determine whether or not a failure has occurred in the evaporative fuel purge system. A leakage decision value varying unit M31 varies the above leakage decision value used in the decision making unit M8F in accordance with the flow rate of purged fuel.

Figure 64:
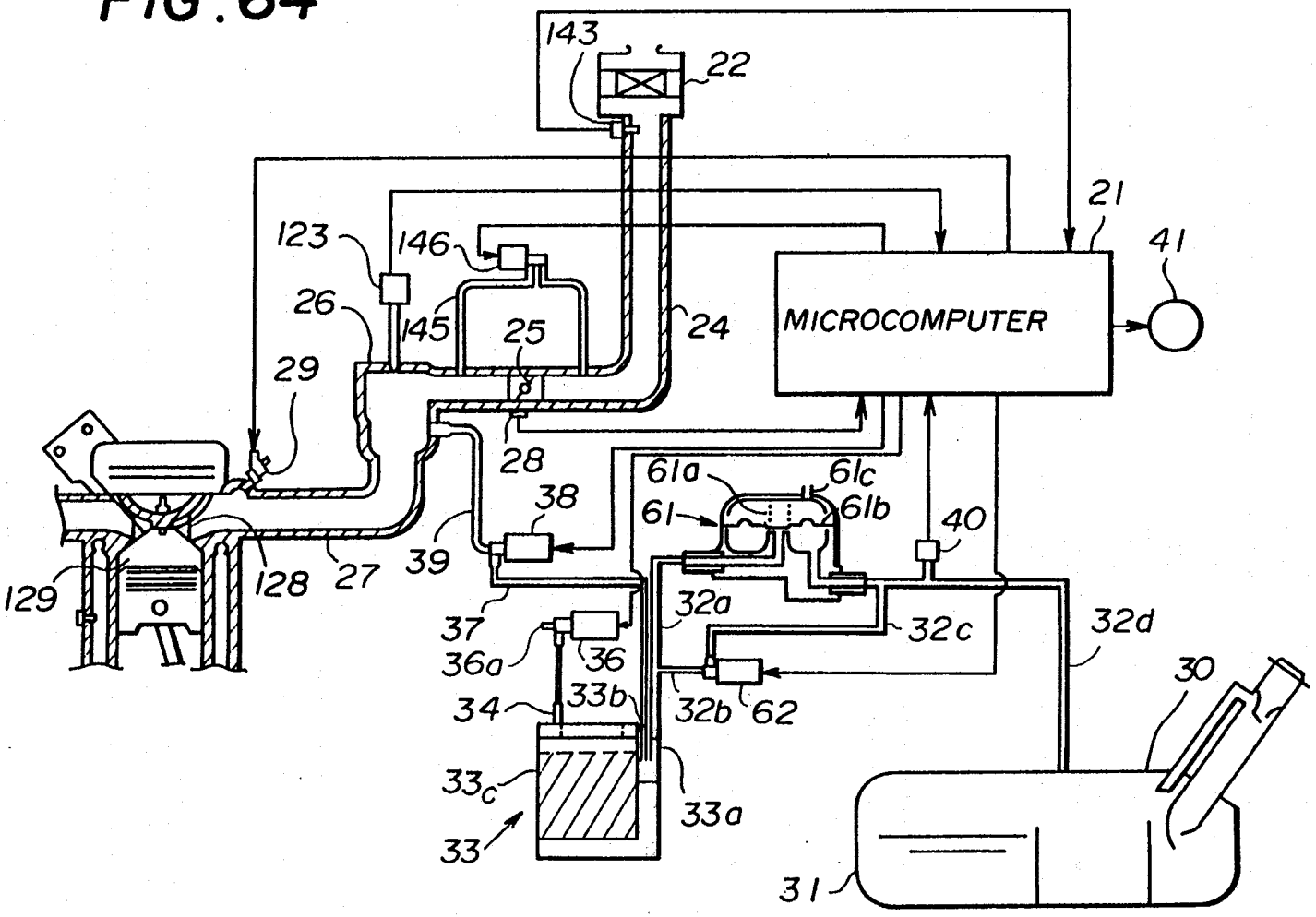
FIG. 64 is a diagram of the seventh embodiment of the present invention.

FIG. 64 illustrates the system structure of the seventh embodiment of the present invention. In FIG. 64, parts that are the same as parts shown in the previously described figures are given the same reference numbers. A pressure sensor 123 that detects the pressure in the intake air pipe 24 is fastened to the surge tank 26. A detection signal of the pressure sensor 123 is sent to the microcomputer 21. An intake air temperature sensor 143 is provided in the vicinity of the air cleaner 22, and sends a detection signal indicating the temperature of intake air in the pipe, 24 to the microcomputer 21. A bypass passage 145 is provided so that it bypasses the throttle valve 25 and connects the upstream side of the intake air passage, 24 and the surge tank 26. An idle speed control valve (ISCV) 146 that controls the flow rate of air flowing in the bypass passage 145 is provided in the bypass passage 145. An intake air valve 128 is provided for each cylinder. A reference number 129 indicates a combustion chamber. The flow rate of purged fuel will be detected, as will be described later.

Figure 65:
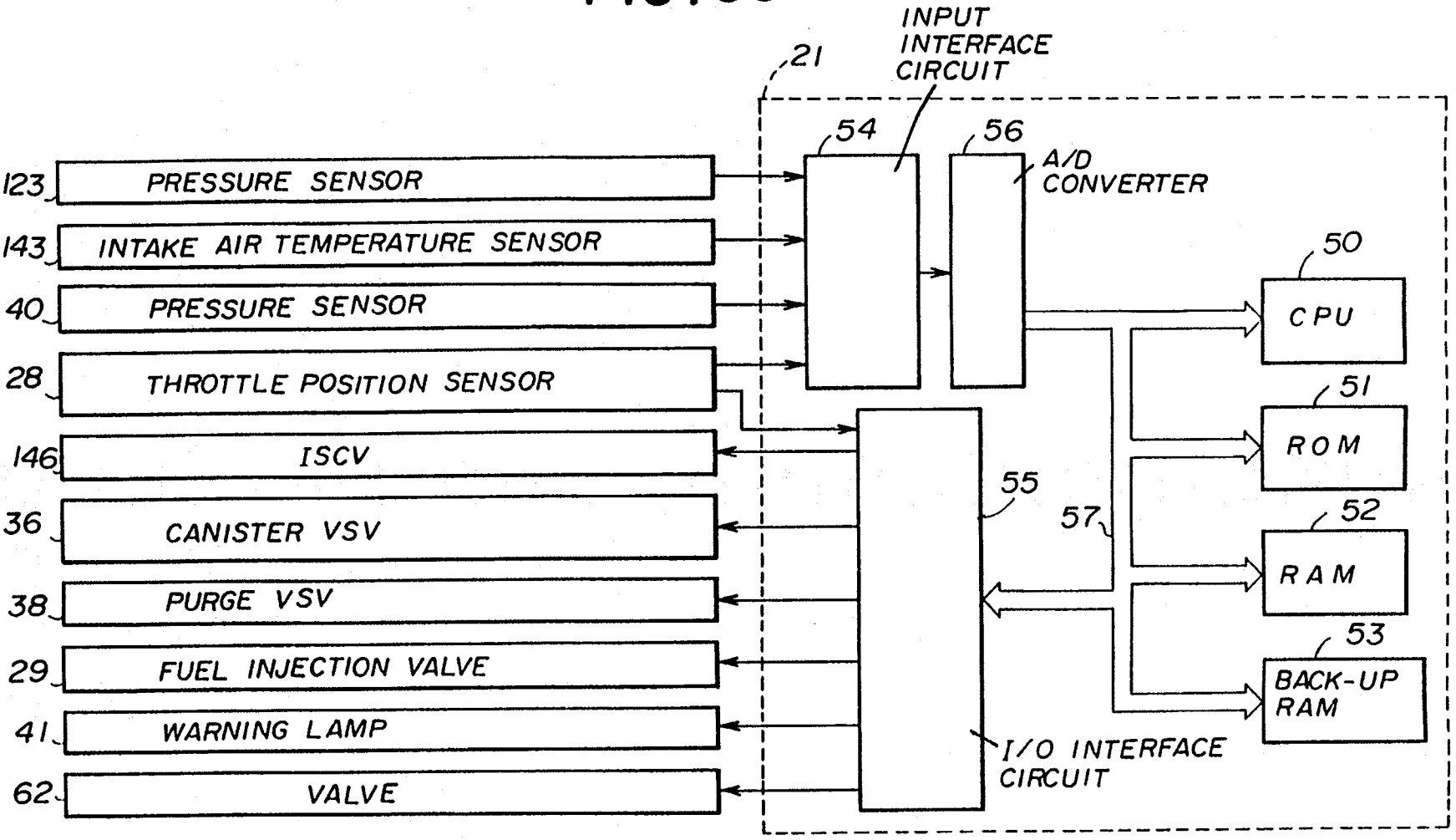
FIG. 65 is a block diagram of the hardware structure of the seventh embodiment of the present invention.

FIG. 65 shows the hardware structure of the seventh embodiment of the present invention. In FIG. 65, parts that are the same as parts shown in the previously described figures are given the same reference numbers.

The basic operation of the seventh embodiment of the present invention is the same as the operation of the first variation of the first embodiment shown, in FIG. 6, and hence a description thereof will be omitted here.

A description will now be given of a process for detecting the flow rate of purged fuel (that is, the operation of the purged flow rate detecting unit M 30). The purged flow rate is the rate of purged fuel flowing from the purge passage 37 to the purge passage 39 via the purge control valve 38. More particularly, the purged flow rate depends on the cross section of a passage portion of the purge control valve 38 and the difference between the pressure in the purge passage 37 and the pressure in the purge passage 39. The cross section of the passage portion of the purge control valve 38 can be defined as a flow rate characteristic when a pressure difference is applied to the valve 38. The pressure difference corresponds to the difference between the negative pressure in the intake air pipe 24 and the atmospheric pressure, and is substantially based on only the negative pressure in the intake air pipe 24.

Figure 66:
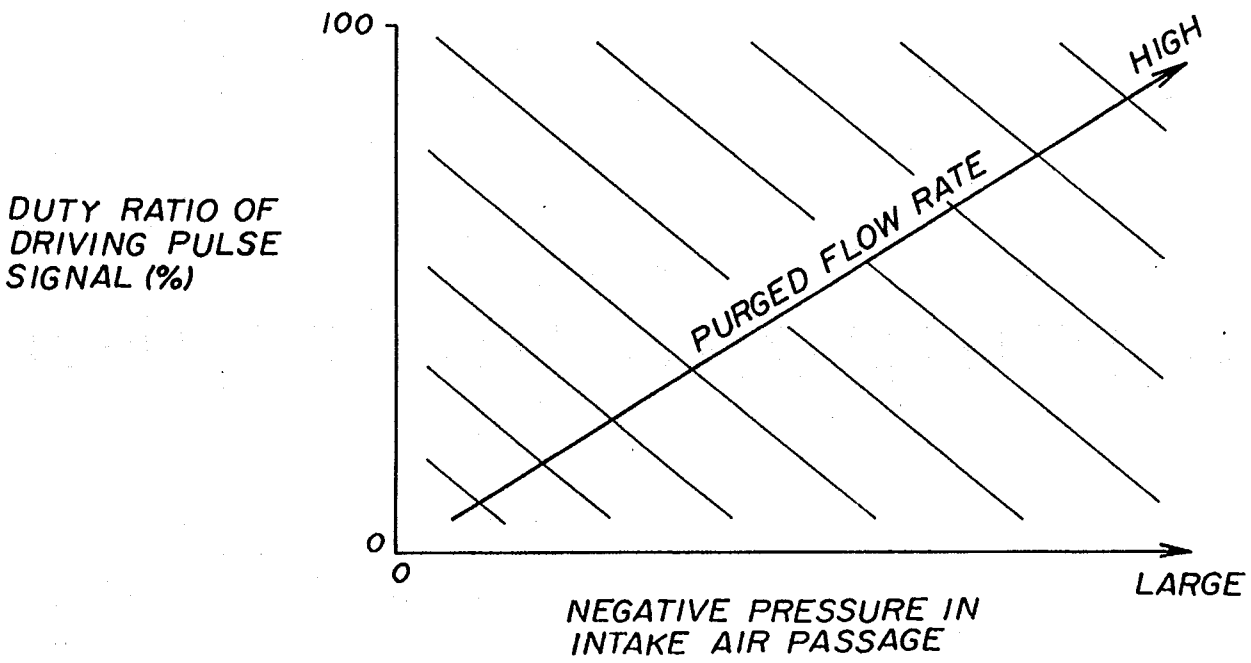
FIG. 66 is a graph showing the relationship between the duty ratio of a driving pulse signal applied to a purge control valve and a negative pressure in an intake air passage.

In a duty ratio control type in which the purge control valve 38 is alternately turned ON and OFF in response to the duty ratio of a driving pulse signal applied to the purge control valve 38 from the microcomputer 21, the purged flow rate is based on the negative pressure in the intake air pipe 24 and the duty ratio of the above driving pulse signal, as shown in FIG. 66, which shows that the purged flow rate increases as the duty ratio of the driving pulse signal increases for a fixed negative pressure in the intake air passage 24. FIG. 66 also shows that the purged flow rate increases as the negative pressure in the intake air pipe 24 increases for a fixed duty ratio.

In an ON/OFF control type in which the purge control valve 38 is fully opened or closed, the purged flow rate simply increases in proportion to the negative pressure in the intake air pipe 24.

Figure 67:
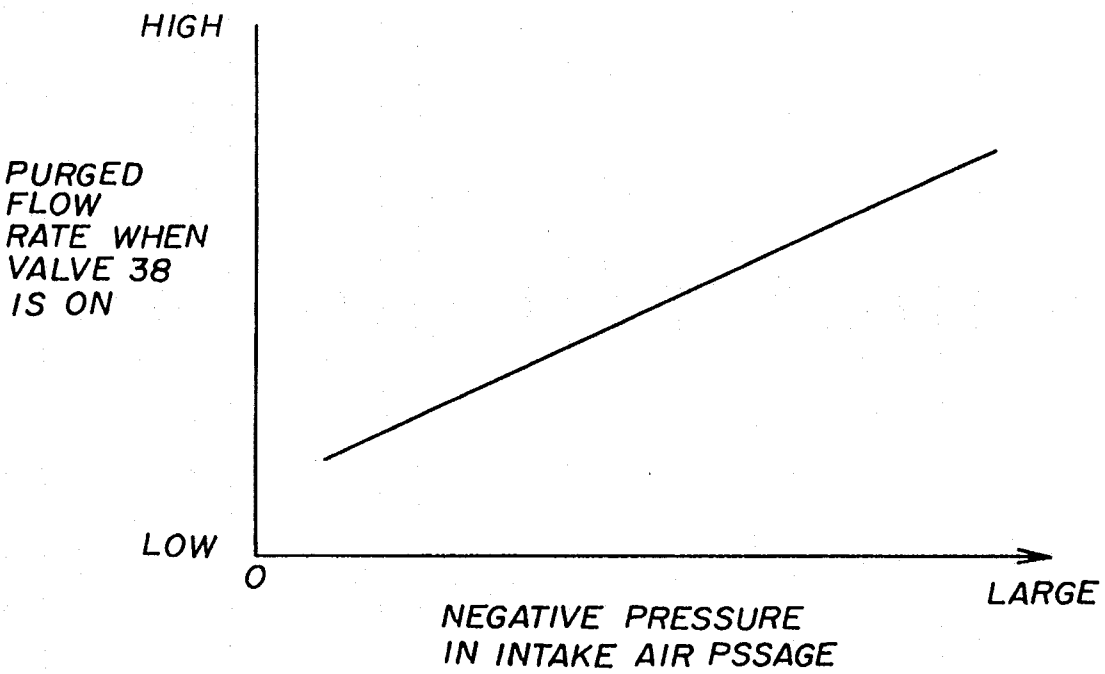
FIG. 67 is a graph showing the relationship between an ON/OFF signal applied to the purge control valve and a negative pressure in the intake air passage.

Hence, it is possible to infer the purged flow rate from the negative pressure in the intake air pipe 24 by referring to the characteristic shown in FIG. 66 or FIG. 67. The seventh embodiment of the present invention employs the duty ratio control type of the purge control valve 38. As the driving pulse signal applied to the purge control valve 38 stepwise increases as indicated by a line I shown in (A) of FIG. 68, the purged flow rate does not immediately follows this increase (rise) in the driving pulse signal, and responds to the increase with a delay of time, as shown in (B) of FIG. 68. The above holds true for use of the ON/OFF control type of the purge control valve 38. The delay in the response to change in the driving pulse signal applied to the valve 38 arises from the resistances of pipes or passages and the volume of the canister 33 as well as ventilation resistance.

Figure 68:
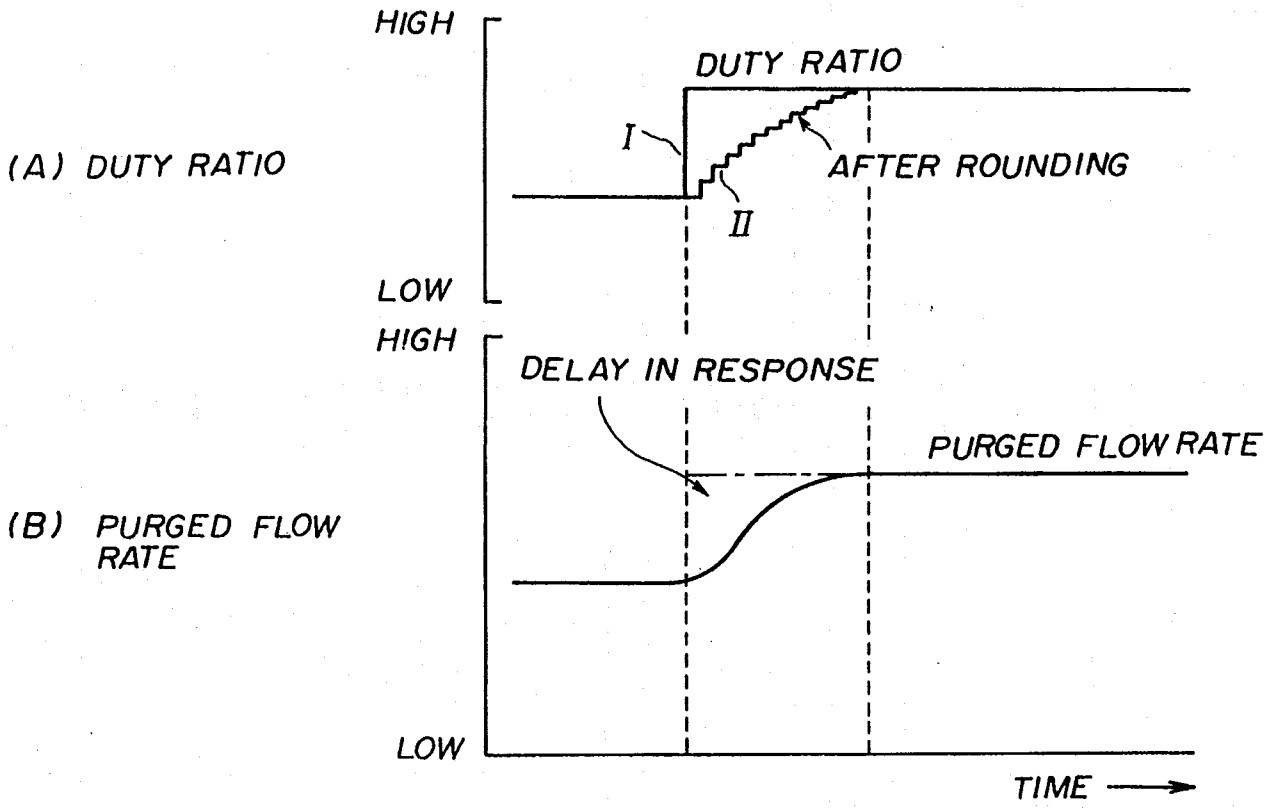
FIG. 68 is a graph showing the relationship between the duty ratio of the driving pulse signal and the purged flow rate.

As shown in (A) of FIG. 68, a change in the negative pressure in the intake air pipe 24 responds to the change of the driving pulse signal. With the above in mind, a process for calculating the purged flow rate according to the seventh embodiment of the present invention (will be described later with reference to FIG. 69) employs a rounding process in which a change in the driving pulse signal is rounded or controlled so as to correspond to an actual change in the purged flow rate, as indicated in a curve II in (A) of FIG. 68. Further, a change in the negative pressure in the intake air pipe 24 is also rounded so as to correspond to an actual change therein.

Figure 69:
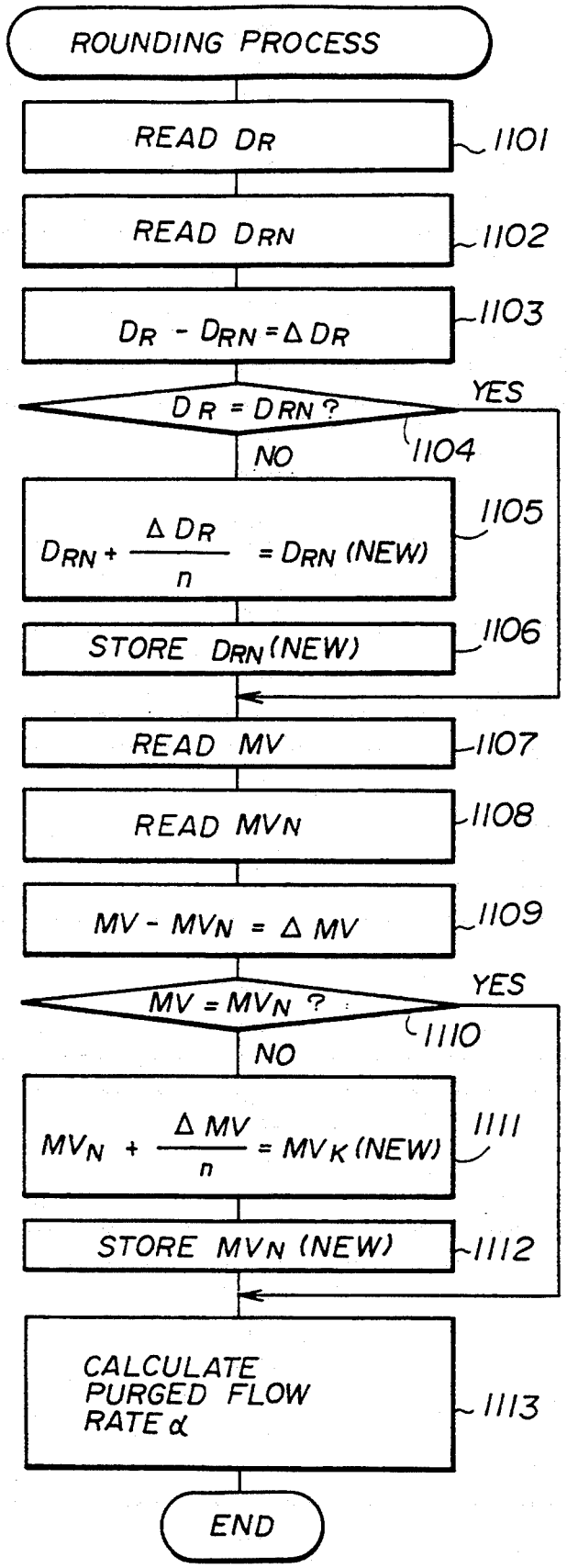
FIG. 69 is a flowchart of the operation of the seventh embodiment of the present invention.

FIG. 69 is a flowchart of the process for calculating the purged flow rate according to the seventh embodiment of the present invention. The process is executed for each predetermined period, under control of the microcomputer 21, as a sub-routine of a diagnosing process which will be described in detail later.

In step 1101, the CPU 21 (FIG. 65) reads the current duty ratio $D_R$ of the driving pulse signal applied to the purge control valve 38. Hereinafter, the above duty ratio will also be referred to as a purge VSV duty ratio. In step 1102, the CPU 50 reads a rounded purge VSV duty ratio $D_{RN}$ obtained by the previous execution of the routine shown in FIG. 69. In step 1103, the CPU 50 calculates a duty ratio variation by calculating the difference between $D_R$ and $D_{RN}$ $(D_R - D_{RN})$ In step 1104, the CPU 50 ,determines whether or not the current purge VSV duty ratio $D_R$ is equal to the previous purge VSV duty ratio $D_{RN}$. When the result of step 1104 is NO, the CPU 50 executes a rounding process in steps 1105 and 1106. In step 1105, the CPU 50 calculates a rounded version $D_{RN}$(NEW) of the purge VSV duty ratio $D_{RN}$ by using the following equation:

$$D_{RN} + (\text{delta-}D_R/n) = D_{RN}(\text{NEW}) \quad (4)$$

where n is a constant equal to, for example, "4", "16" or "32". In step 1106, the CPU 50 writes the rounded purge VSV duty ratio $D_{RN}$(NEW) into the RAM 52.

In step 1107, the CPU 50 reads the current negative pressure in the intake air pipe 24 from the detection signal of the pressure sensor 123 (FIG. 64). In step 1108, the CPU reads a negative pressure $MV_N$ obtained by the previous execution of the routine shown in FIG. 69.

In step 1109, the CPU 50 calculates a negative-pressure variation delta-MV by subtracting the previously rounded negative pressure $MV_N$ from the current negative-pressure MV. In step 1110, the CPU 50 determines whether or not the previously rounded negative pressure $MV_N$ is equal to the current negative pressure MV. The CPU 50 proceeds to step 1113 when the result of step 1110 is YES, and to step 1111 when the result of step 1110 is NO.

The CPU 50 executes a rounding process for the negative pressure MV in steps 1111 and 1112. In step 1111, the CPU 50 calculates a rounded version $MV_N$(NEW) of the negative pressure MV by using the following equation:

$$MV_N + (\text{delta-}MV/n) = MV_N(\text{NEW}) \quad (5).$$

In step 1112, the CPU 50 writes the rounded negative pressure version $MV_N$(NEW) in the RAM 52. In step 11.13, the CPU 50 refers to a table describing the characteristic shown in FIG. 66, and accesses the table with the rounded purge VSV duty ratio $D_{RN}$(NEW) obtained in step 1105 and the rounded negative pressure $MV_N$(NEW) obtained in step 1113. In this manner, a corresponding purged flow rate a can be obtained from the table.

Figure 70:
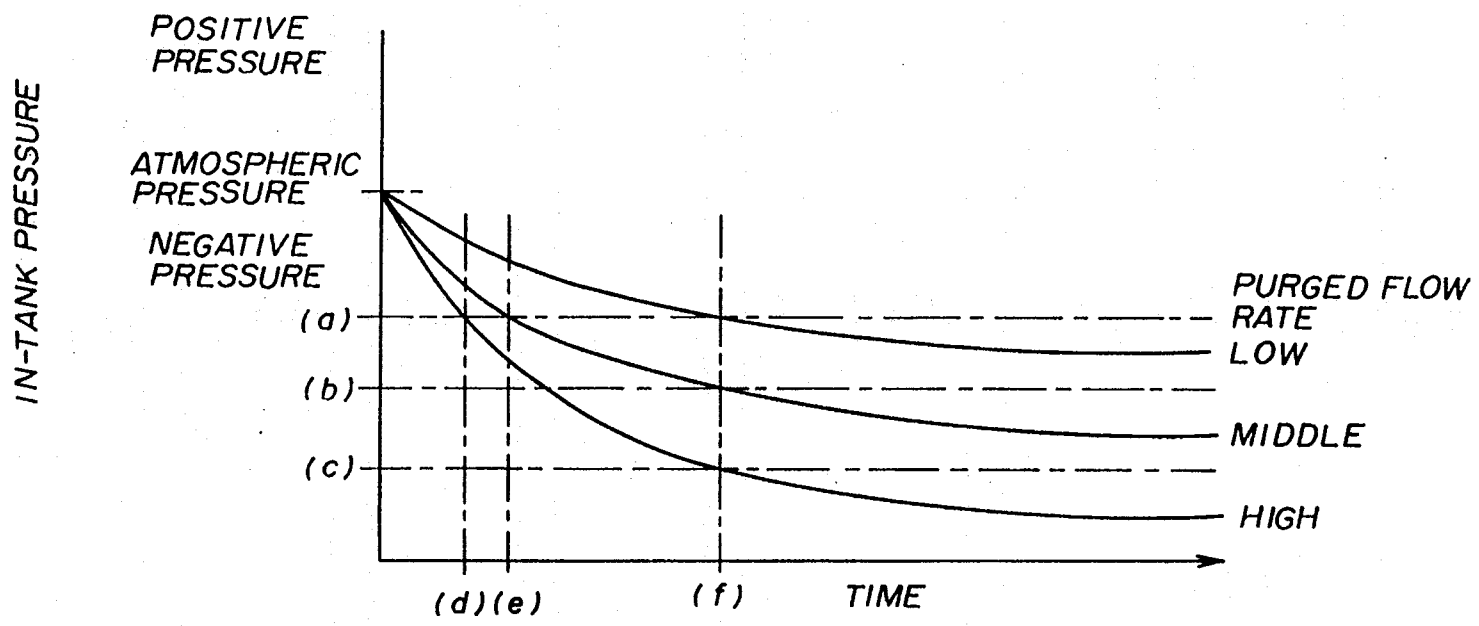
FIG. 70 is a graph showing the relationship between the in-tank pressure and the purged flow rate.

A description will now be given of a diagnosing process using the purged flow rate $\alpha$ obtained according to the process shown in FIG. 69. In the seventh embodiment, a negative pressure is applied to the fuel tank 30. At this time, the negative pressure in the fuel tank 30 changes with time, as shown in FIG. 70. More particularly, the characteristics shown in FIG. 70 are obtained in a condition such that the purging operation in the canister 33 is being executed in the state in which the atmosphere aperture 33*d* of the canister 33 is open and that a negative pressure in the purge passages 37 and 39 resulting from passage resistance of the canister 33 is applied to the fuel tank 30 of the evaporative fuel purge system having no leakage (a first variation of the seventh embodiment shown in FIG. 72 which will be described later). In this case, since the pressure generated by the passage resistance of the canister 33 is applied to the fuel tank 30, the negative in-tank pressure increases after application of the negative pressure is started, as shown in FIG. 70. Then, the in-tank pressure is settled at the negative pressure corresponding to the passage resistance of the canister 33.

However, a change in the purged flow rate changes the negative pressure in the fuel tank 30 even for an identical passage resistance of the canister 33. As shown in FIG. 70, the maximum value of the negative pressure decreases as the purged flow rate decreases.

Figure 71:
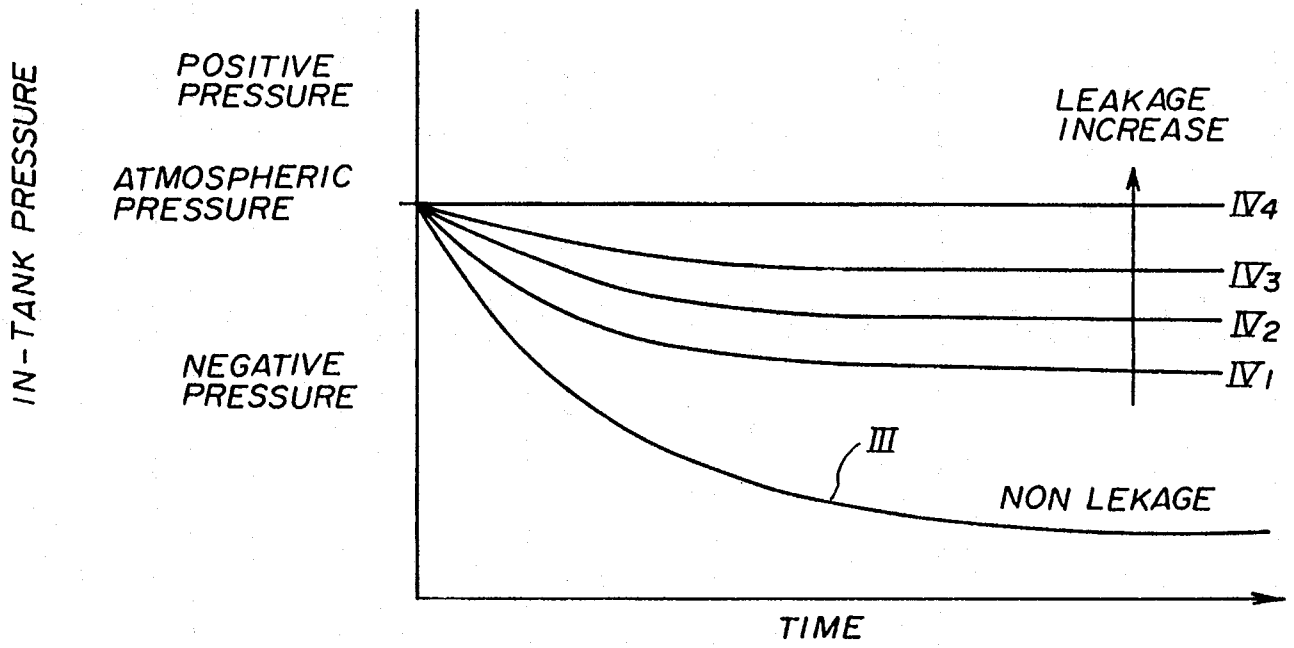
FIG. 71 is a graph showing the relationship between the in-tank pressure and leakage in the purge system of the seventh embodiment of the present invention.

The negative in-tank pressure changes with time as a leakage area occurring in the evaporative fuel purge system increases, as shown in FIG. 71. When there is no leakage, the largest in-tank pressure can be obtained, as indicated by a curve III shown in FIG. 71. In the case where there is a leakage area, the maximum negative in-tank pressure obtained in this state is smaller than that for the case where there is no leakage. Further, as the leakage area increases, the maximum negative in-tank pressure decreases towards the atmospheric pressure, as indicated by curves IV1, IV2 and IV3. When the leakage area exceeds a given diameter, the in-tank pressure is equal to the atmospheric pressure.

Hence, for a given purged flow rate, it is possible to determine whether or not there is a leakage area by using, as the leakage decision value, a pressure level slightly closer to the atmospheric pressure than the negative pressure level obtained when there is no leakage. However, as shown in FIG. 70, the maximum negative pressure in the fuel tank 30 is changed due to a variation in the purged flow rate. If the negative in-tank pressure is simply compared witch the fixed leakage decision value, it is possible to distinguish a small negative in-tank pressure (close to the atmospheric pressure) due to a small purged flow rate from a small negative in-tank pressure due to a leakage area. Hence, an erroneous decision as to whether or not a failure has occurred in the evaporative fuel purge system may be made.

With the above in mind, the seventh embodiment of the present invention controls the parameter values used for diagnosis on the basis of the purged flow rate. The system structure shown in FIG. 64 changes, on the basis of the purged flow rate, the leakage decision value of the negative in-tank pressure, as indicated by (a), (b) and (c) shown in FIG. 70. It is also possible to change the period for introducing the negative pressure in the system on the basis of the purged flow rate.

The seventh embodiment of the present invention is not limited to the system structure shown in FIG. 64, and several variations can be made.

Figure 72:
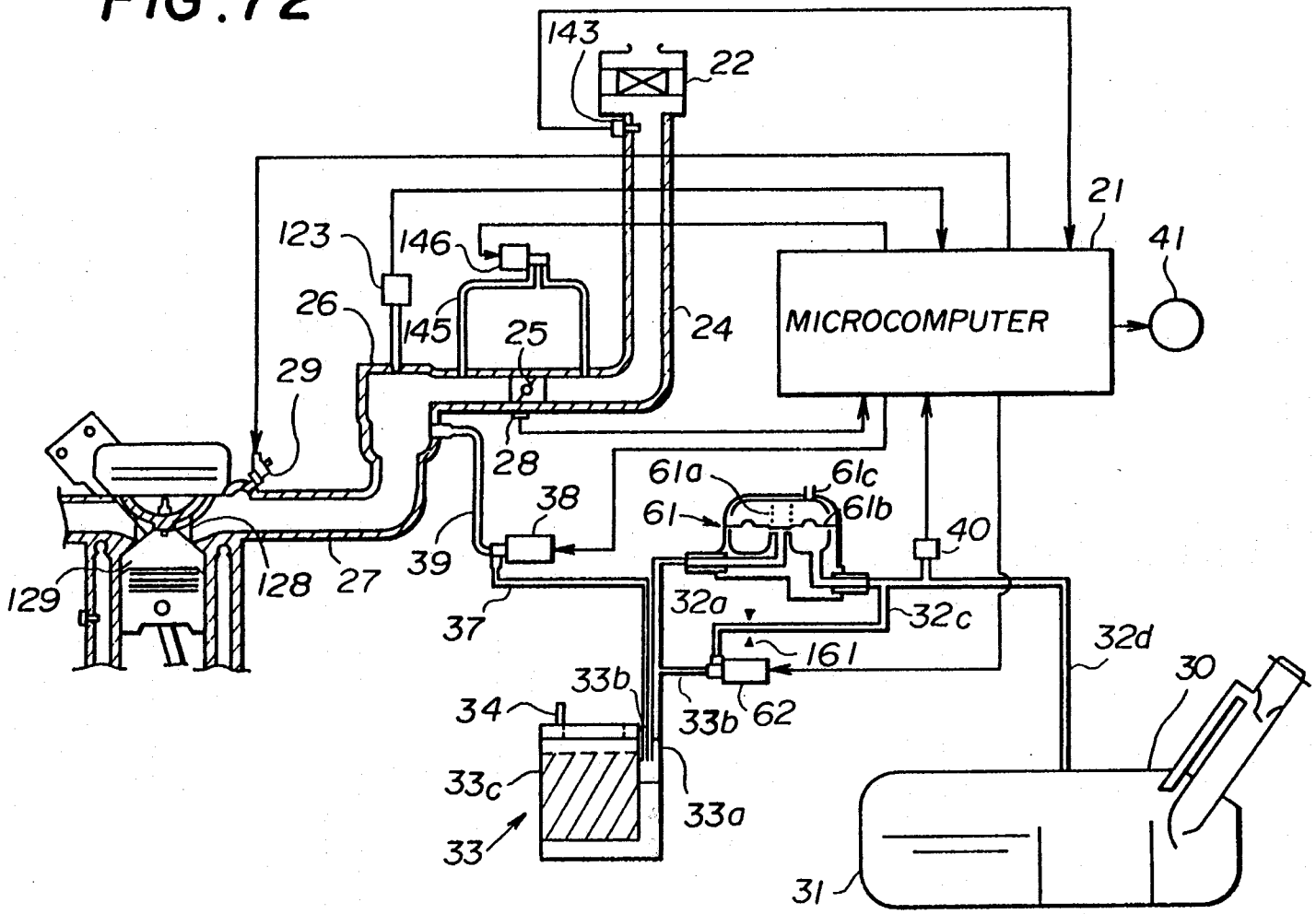
FIG. 72 is a diagram of the system structure of a first variation of the seventh embodiment of the present invention.

FIG. 72 shows a first variation of the seventh embodiment of the present invention. In FIG. 72, parts that are the same as parts shown in the previously described figures are given the same reference numbers. The system structure of the first variation shown in FIG. 72 does not use the valve 36 connected to the atmosphere aperture 34 of the canister 33, and provides the vapor passage 32*c* with an orifice 161. During the diagnosing operation, both the in-tank pressure switching valve 62 and the purge control valve are kept open, and the negative pressure caused by t]he orifice is applied to the fuel tank 31 while bypassing the valve 61.

Figure 73:
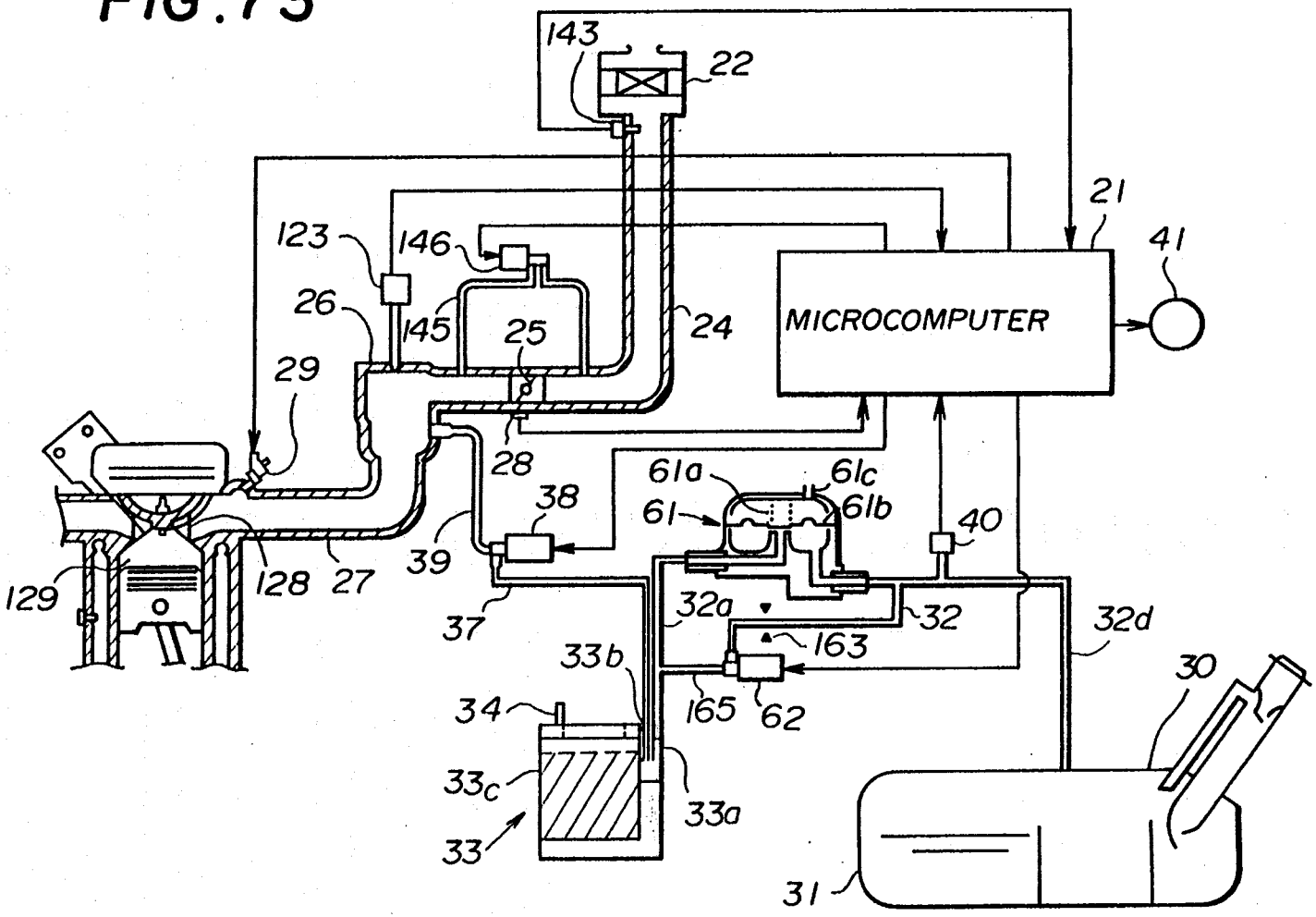
FIG. 73 is a diagram of the system structure of a second variation of the seventh embodiment of the present invention.

FIG. 73 shows a second variation of the seventh embodiment of the present invention. In FIG. 73, parts that are the same as parts shown in the previously described figures are given the same reference numbers. In the system structure shown in FIG. 73, the valve 36 is not used, and the vapor passage 32*c* is connected to the purge passage 37 via the in-tank pressure switching valve 62 and a bypass passage 165 so that the canister 33 is bypassed. Further, an orifice 163 is provided in the halfway of the vapor passage 32*c*.

While the fuel vapor purging operation is being carried out, the in-tank pressure switching valve 62 is maintained in the closed .state, so that the vapor passage 32*c* is separated from the purge passage 37. The in-tank pressure in the fuel tank 30 is set to the set pressure by the valve 62. Fuel vapor generated in the fuel tank 30 is made to adhere to the active carbon 33*c* in the canister 33. During the diagnosing operation, the switching valve 62 is maintained in the open state, and the vapor passage 32*c* is connected to the purge passage 37 via the bypass passage 165. Hence, when the purge control valve 38 is open, the negative pressure in the surge tank 26 is applied to the fuel tank 30 via the purge passage 39, the purge control valve 38, the purge passage 37, the bypass passage 165, the in-tank pressure switching valve 62, the orifice 163, and the vapor passages 32*c* and 32*d*.

Since the orifice 16S has a considerably small diameter, a large passage resistance is generated. There is formed a substantially stationary system on the upstream side of the orifice 163 close to the fuel tank 30.

When there is no leakage in the vapor passages 32*c* and 32*d* on the upstream side of the orifice 163, a negative pressure is introduced into the upstream side of the orifice 163. If there is leakage in the vapor passage 32*c* or 32*c*, a negative pressure is not applied to the upstream side of the orifice 163. Hence, it is possible to increase precision of detection of the pressure sensor 40.

Figure 74:
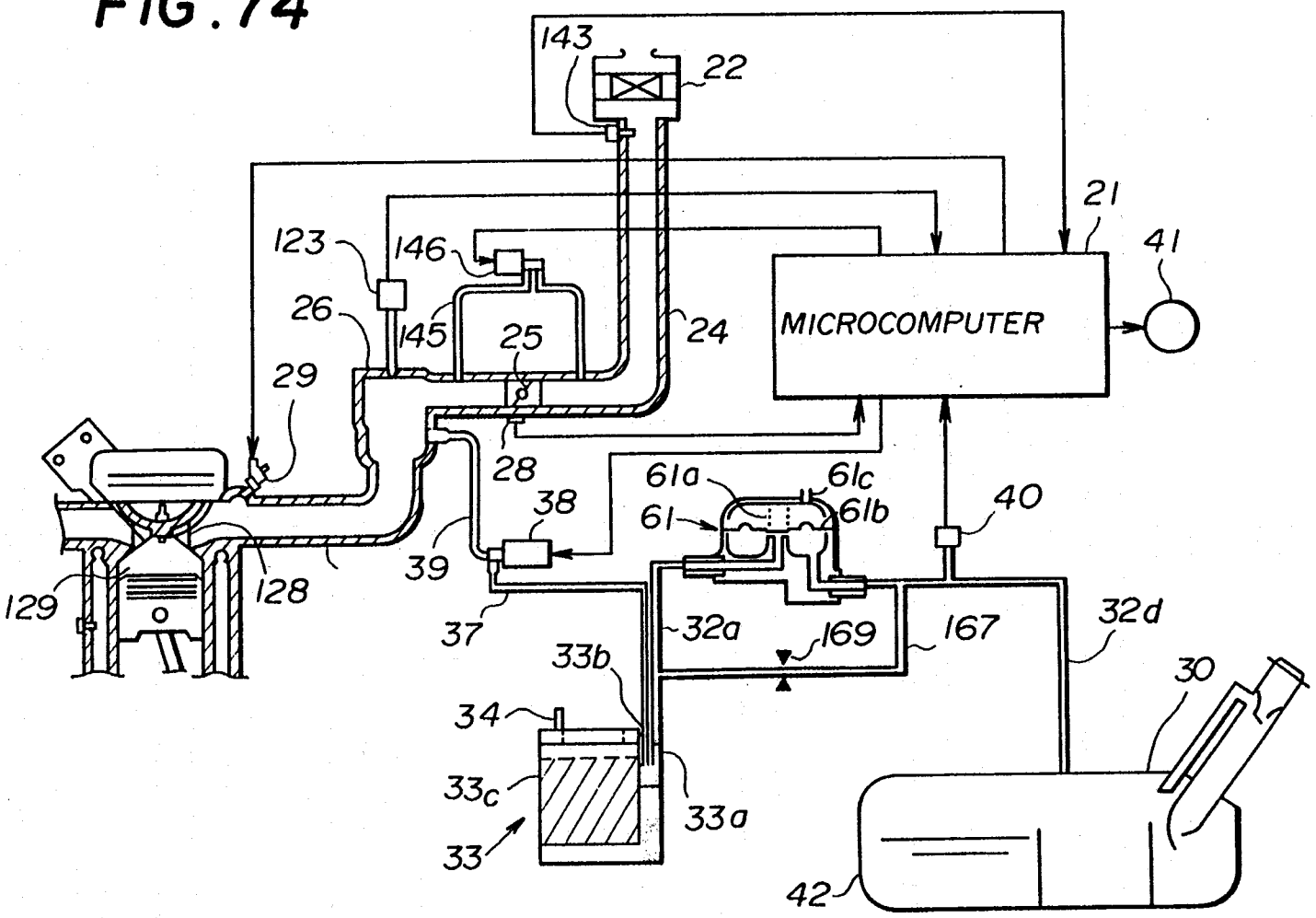
FIG. 74 is a diagram of the system structure of a third variation of the seventh embodiment of the present invention.

FIG. 74 shows a third variation of the seventh embodiment of the present invention. In FIG. 74, parts that are the same as parts shown in the previously described figures are given the same reference numbers. In the system structure shown in FIG. 74, the valves 36 and 62 shown in FIG. 64 are not used, and a bypass passage 67 is provided so as to connect the upstream side of the valve 61 to the downstream side thereof. Further, an orifice 169 is provided in the halfway of the bypass passage 167. The basic concept of the third variation is the same as that of the first variation shown in FIG. 72. However, each time the purge control valve 38 is opened, the negative pressure in the surge tank 26 is applied to the fuel tank 30 via the purge passage 39, the purge control valve 38, the purge passage 37, the canister 33, the bypass passage 167, the orifice 169 and the vapor passage 32*d*.

A description will now be given of a diagnosing process according to the seventh embodiment of the present invention. Different diagnosing processes are used for the different system structures shown in FIGS. 64, 72, 73 and 74. In the system structure shown in FIG. 64, a negative pressure is introduced into the evaporative fuel purge system when the diagnosing operation is carried out, and is held in the closed system for a predetermined period. A diagnosis decision is made by referring to a variation in the negative pressure obtained for the predetermined period. In the system structures shown in FIGS. 72 and 73, the in-tank pressure switching valve 62 and the purge control valve 38 are maintained in the open state for a predetermined period, and a variation in the negative pressure introduced in the evaporative fuel purge system is measured from the detection signal of the pressure sensor 40. When the variation obtained is equal to or greater than a leakage decision variation, it is determined that the evaporative fuel purge system is normally operating. In the system structure shown in FIG. 74, the purge control valve 38 is kept open during a predetermined period, and a variation in the negative pressure introduced into the system is measured.

Figure 75:
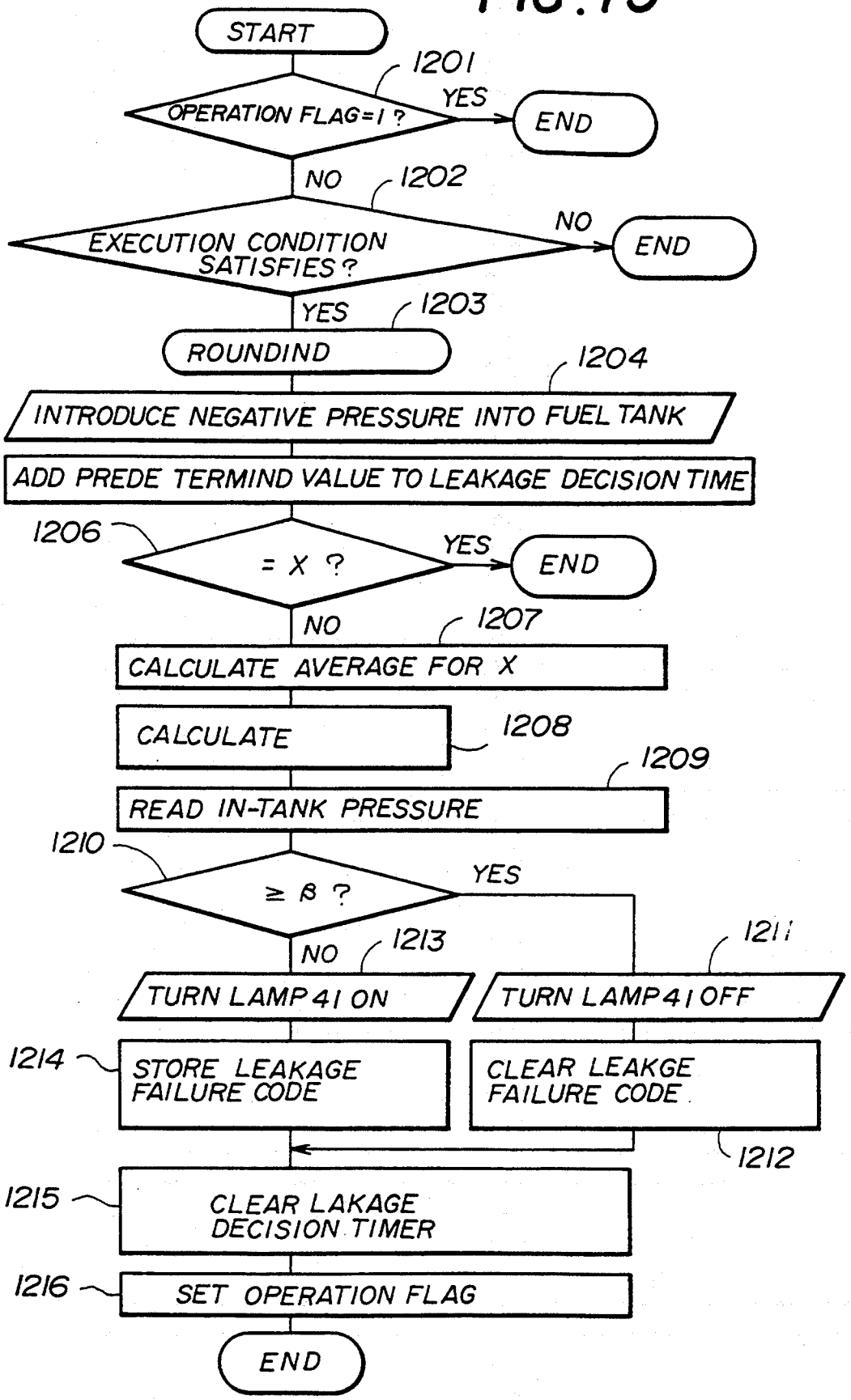
FIG. 75 is a flowchart of the operation of the seventh embodiment of the present invention.
Figure 76:
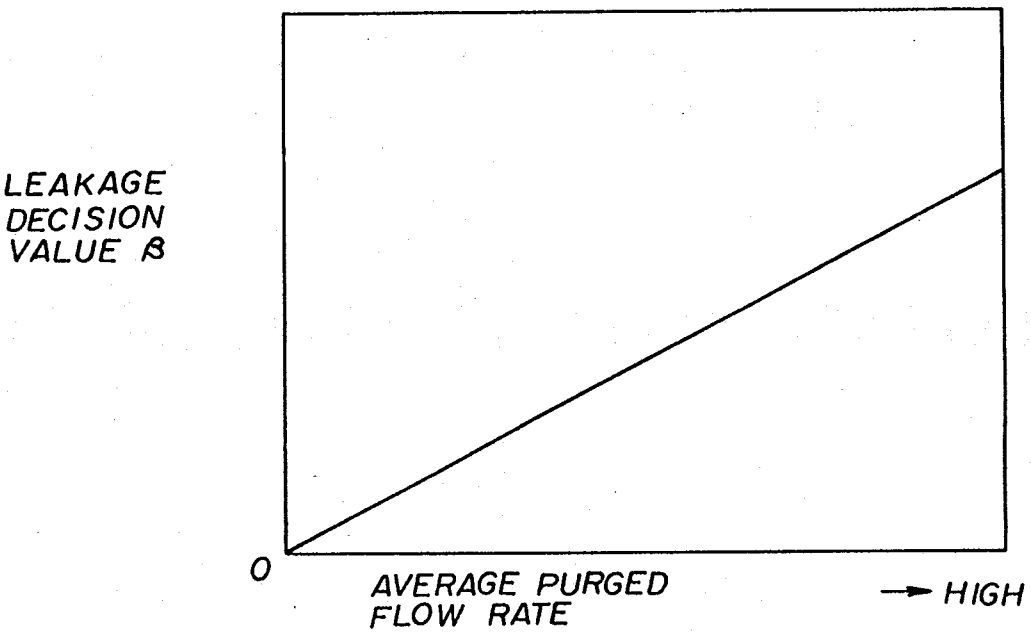
FIG. 76 is a graph showing the relationship between the leakage decision value and the average purged flow rate used in the flowchart of FIG. 75.

By way of example, the diagnosing operation of the system structures shown in FIGS. 72–74 will now be described with reference to FIG. 75, which illustrates a diagnosing routine executed, for example, every 65 msec. In step 1201, the CPU 50 determines whether or not the operation flag is equal to "1". When step 1201 is executed for the first time after the engine is started, the operation flag is equal to "0". In step 1202, the CPU 50 determines whether or not a diagnosis execution condition is satisfied. For example, it is determined whether or not purging of the canister 33 has been completed. When the result of step 1202 is NO, the CPU 50 ends execution of the routine shown in FIG. 75. When the result of step 1202 is YES, the CPU executes step 1203, in which the aforementioned rounding processes are executed to thereby obtain the purged flow rate $\alpha$.

Figure 78:
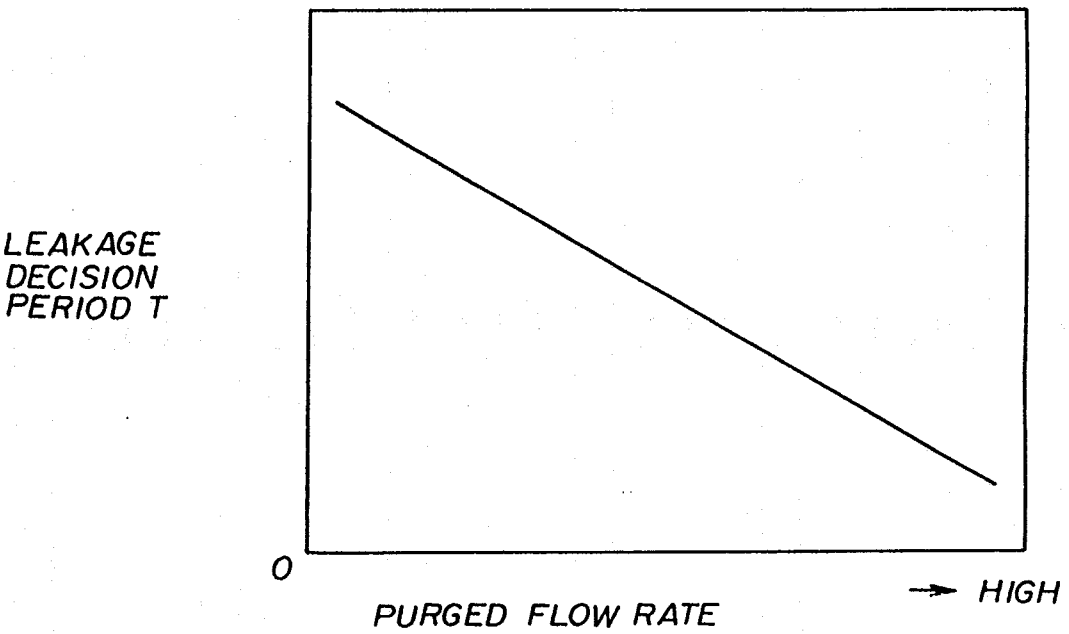
FIG. 78 is a graph showing the relationship between a leakage decision period and the purged flow rate used in the first variation shown in FIG. 77.

In step 1204, the CPU 50 opens the in-tank switching valve 82 and the purge control valve 38 in order to introduce a negative pressure in the intake air pipe 24 into the purge system. In step 1205, the CPU 50 adds a predetermined value to the value of the leakage decision timer. In step 1206, the CPU 50 determines whether or not the value of the leakage decision timer is equal to a predetermined value X (seconds). When the result of step 1208 is NO, the CPU 50 ends execution of the routine shown in FIG. 75. When the result of step 1208 is NO, the CPU executes step 1207 in which step the average of the purged flow rates obtained for the X seconds. In step 1209, the CPU 50 accesses the table describing a characteristic shown in FIG. 78 with the average purged flow rate. Thereby, a corresponding leakage decision value $\beta$ is obtained. In FIG. 78, as the average purged flow rate increases, the leakage decision value $\beta$ increases. As has been described previously, the maximum negative pressure applied to the fuel tank 30 changes on the basis of the purged flow rate, and hence the leakage decision value should be changed on the basis of the actual purged flow rate.

In step 1209, the CPU 50 reads the substantial in-tank pressure from the detection signal of the pressure sensor 40. In step 1210, the CPU 50 determines whether or not the negative in-tank pressure obtained in step 1209 is equal to or higher than the leakage decision value $\beta$ obtained in step 1208. When the result step 1208 is YES, the CPU 50 decides that the there is no leakage in the evaporative fuel purge system, and turns the warning lamp 41 OFF in step 1211. Then, the CPU 50 clears the aforementioned leakage failure code in step 1212.

When it is determined, in step 1210, that the negative in-tank pressure is lower than the leakage decision value $\beta$, the CPU 50 turns the warning lamp 41 ON in step 1213, and stores the leakage failure code in the backup RAM 53. The CPU 50 clears the leakage decision timer in step 1215, and sets the operation flag to "1" in step 1216. The routine shown in FIG. 75 is not executed until the engine is started again.

Figure 77:
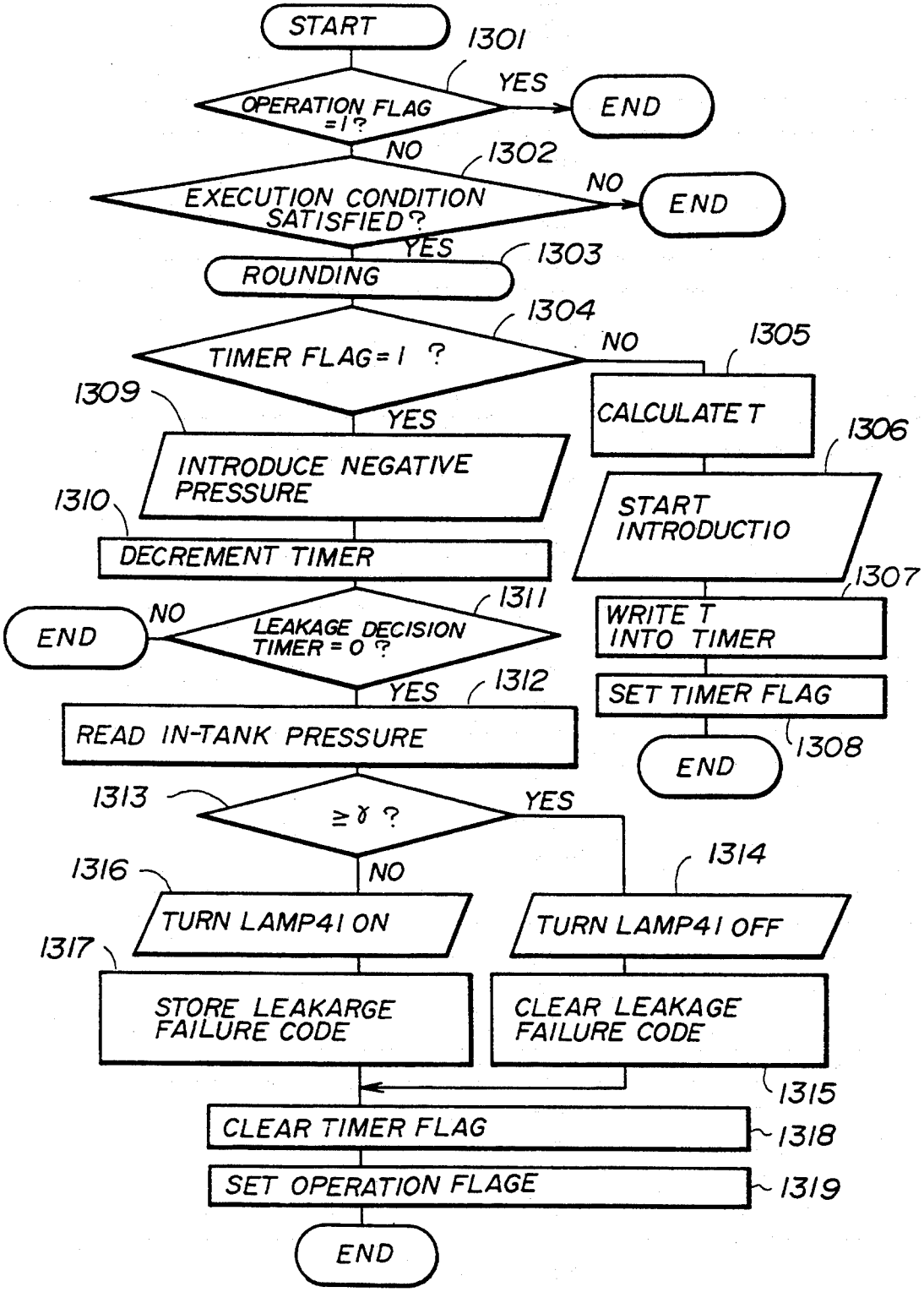
FIG. 77 is a flowchart of a first variation of the operation shown in FIG. 75.

FIG. 77 is a variation of the diagnosing process of the seventh embodiment of the present invention. The routine shown in FIG. 77 is executed, for example, every 65 msec. Steps 1301–1303 shown in FIG. 77 are the same as the steps 1201–1203 shown in FIG. 75. In step 1304, the CPU 50 determines whether or not a timer flag is equal to "1". When it is determined that the timer flag is equal to "0", the CPU 50 executes step 1305. When it is determined that the timer flag is equal to "1", the CPU 50 executes step 1309. The timer flag is cleared by the initial routine executed when the engine is started. When the routine shown in FIG. 77 is executed for the first time after the engine is started, the result of step 1304 is NO, and the CPU 50 calculates the diagnosing period (leakage decision period) T by assessing the table defining a characteristic shown in FIG. 78 with the purged flow rate obtained in step 1303. In the characteristic shown in FIG. 78, the diagnosing period T decreases as the purged flow rate increases. This is because that, as shown in FIG. 70, the negative-pressure introducing time it takes the in-tank pressure to reach the predetermined in-tank pressure increases as the purged flow rate decreases.

After executing step 1305, the CPU 50 opens the valves 62 and 38 in order to introduce the negative pressure in the intake air pipe 24 into the evaporative fuel purge system in step 1306. In step 1307, the CPU 50 inserts the diagnosing period T into the leakage decision timer. After setting the timer flag to "1" in step 1308, the CPU 50 ends execution of the routine shown in FIG. 77.

When the routine shown in FIG. 77 is executed after 65 msec, step 1304 is executed in which it is determined that the timer flag is equal to "1". In step 1309, the CPU 50 continues to introduce the negative pressure in the intake air pipe 24 into the, system, and subtracts a predetermined value from the, value of the leakage decision timer in step 1310. In step 1311, the CPU 50 determines whether or not the value of the leakage decision timer is equal to "0". After application of the negative pressure is continuously carried out for the diagnosing period T, it is determined, in step 1311, that the leakage decision timer is equal to "0". In step 1312, the CPU 50 reads the in-tank pressure observed at that time by referring to the detection signal of the pressure sensor 40. In step 1312, the CPU 50 determines whether or not the in-tank pressure is equal to or higher than a predetermined leakage decision value $\tau$ (in the negative-pressure area).

When the in-tank pressure is equal to or higher than the predetermined leakage decision value $\tau$, the CPU 50 turns the warning lamp 41 ON in step 1316, and writes the leakage failure code into the backup RAM 53 in step 1317. When it is determined, in step 1313, that the in-tank pressure is less than the predetermined leakage decision value $\tau$, the CPU 50 turns the warning lamp 41 OFF in step 1314, and clears leakage failure code in the backup RAM 1315. The CPU 50 clears the timer flag in step 1318, and sets the operation flag to "1" in step 1319.

As has been described above, the negative-pressure introducing period or the leakage decision value is varied on the basis of the purged flow rate, and hence the decision on diagnosis can be made with the optimal relationship between the in-tank pressure and the leakage decision value even when the maximum negative-pressure applied to the fuel tank 30 varies.

FIG. 79 shows a second variation of the diagnosing process. In FIG. 79, steps that are the same as steps shown in the previously described figures are given the same reference numbers. After executing the rounding process in step 1203, the CPU 50 determines, in step 1401, whether or not the purged flow rate is equal to or greater than a predetermined value Y that makes it possible to make the decision on diagnosis with the fixed leakage decision value $\tau$. When the result of step 1401 is NO, the CPU 50 decides that reliable diagnosing cannot be performed, and clears the leakage decision timer in step 1402. In subsequent step 1403, the CPU 50 closes the in-tank pressure switching valve 62.

Since the leakage decision timer is cleared by the initial routine, the CPU 50 executes step 1405 when step 1404 is executed for the first time after the engine is started. In step 1405, the CPU 50 determines whether or not the in-tank pressure is equal to or higher than a predetermined value $P_0$ (equal to the atmospheric pressure or a pressure higher than the atmospheric pressure). When the result of step 1405 is NO, the CPU 50 does not diagnose the evaporative fuel purge system. When the result of step 1405 is YES, the CPU 50 opens the valves 62 and 38 in order to introduce the negative pressure into the fuel tank 30 in step 1204.

In the initial state before the negative pressure is not applied to the fuel tank 30, the pressure in the fuel tank 30 is approximately equal to the atmospheric pressure. When the predetermined period X (seconds) has elapsed after the negative pressure is applied to the fuel tank 30, the optimal leakage decision value $\tau$ is compared with the in-tank pressure (steps 1408 and 1313). When the purged flow rate becomes less than Y before the time X elapses after introduction of the negative pressure into the fuel tank 30, the leakage decision timer is cleared in steps 1401 and 1402. In this case, when the purged flow rate returns to Y or over, the negative pressure is introduced for the X seconds from the state in which a negative pressure somewhat remains in the fuel tank 30. Hence, the leakage decision value $\tau$ does not become the optimal value.

In step 1405, the CPU 50 decides that the negative pressure does not remain in the fuel tank 30, and executes the diagnosing process starting from step 1204. Hence, when the purged flow rate becomes less than Y before the elapse of X seconds from the negative pressure is introduced in the fuel tank 30, the CPU 50 waits for recovery of the in-tank pressure to the original pressure. Thereafter, the diagnosing process is restarted.

After the negative pressure is introduced into the fuel tank 30 in step 1204, the CPU 50 adds the predetermined value to the value of the leakage decision timer in step 1205, and determines whether or not the predetermined time X has elapsed from the negative pressure is introduced in step 1406. In step 1407, the CPU 50 reads the in-tank pressure from the detection signal of the pressure sensor 40 after X seconds. In step 1408, the CPU 50 determines whether or not the in-tank pressure is equal to or higher than the fixed leakage decision value $\tau$.

According to the second variation shown in FIG. 79, the leakage decision is made by referring to only the purged flow rate and the negative-pressure introducing period by using the fixed leakage decision value $\tau$.

Figure 80:
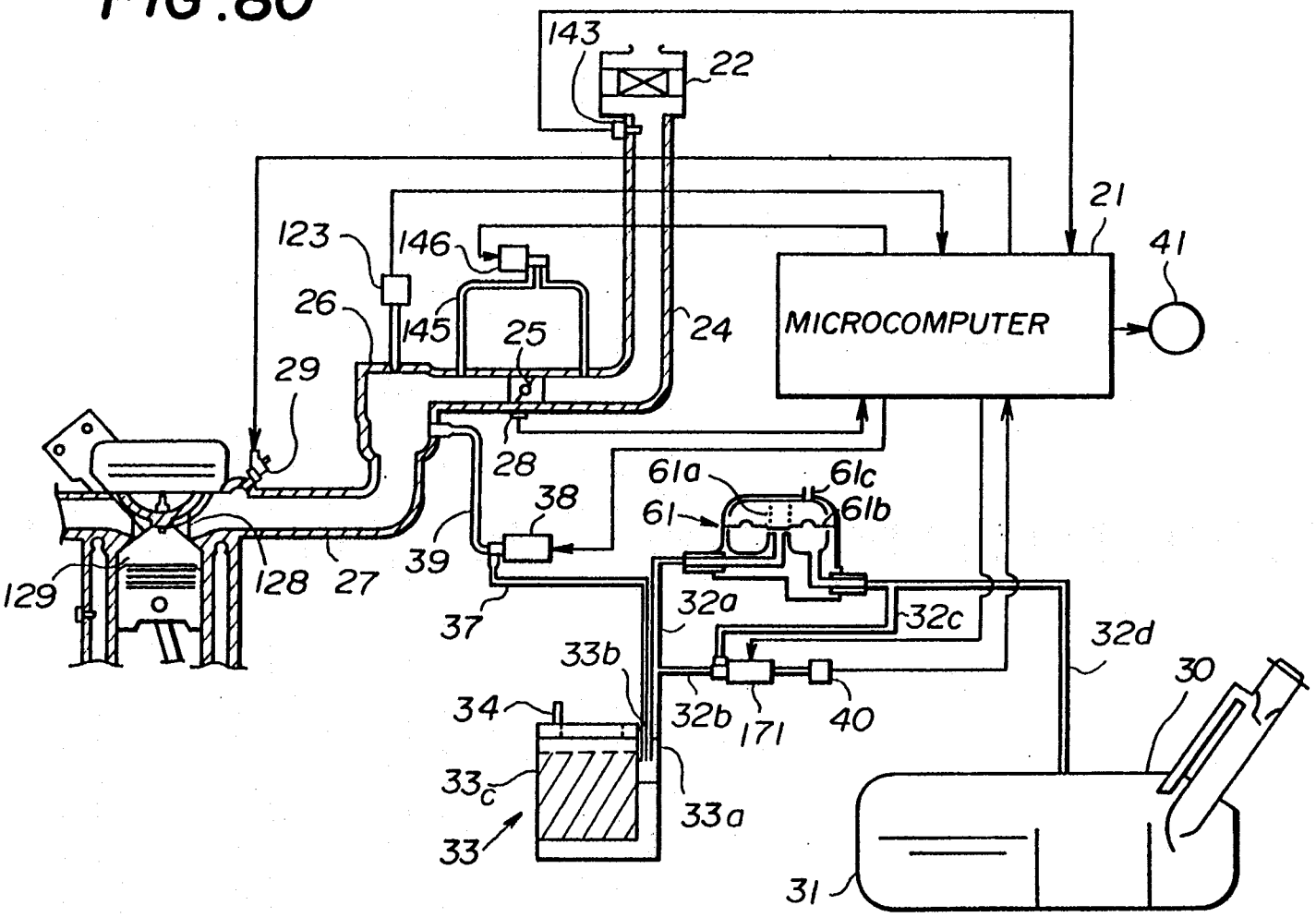
FIG. 80 is a diagram showing the system structure of a variation of the system structure shown in FIG. 74.

Alternatively, it is possible to introduce, the negative pressure up to the in-tank pressure switching valve 62, not up to the fuel tank 30. Such a system is illustrated in FIG. 80, in which parts that are the same as parts shown in the previously described figures are given the same reference numbers. In lieu of the valve 62, a three-directional valve 171 is provided. The pressure sensor 40 is connected to the three-directional valve 171. The three-directional valve 171 selectively connects the pressure sensor 40 and the vapor introducing port **33*a* of the canister 33 to each other, or connects the pressure sensor 40 and the vapor passage 32*c* under control of the microcomputer 21. The purge control valve 38 is opened, and the CPU 50 compares a predetermined leakage decision value with the detection signal of the pressure sensor 40 in the state where the pressure sensor 40 is connected to the vapor introducing port 33*a* of the canister via the three-directional valve 171. When the negative pressure detected by the pressure sensor 40** is greater than the predetermined leakage decision value in the negative-pressure area, it is determined that the evaporative fuel purge system is normal. In other cases, it is determined that the system is abnormal.

A description will now be given of an eighth embodiment of the present invention. FIG. 81 shows an overview of the eighth embodiment of the present invention. In FIG. 81, parts that are the same as parts shown in the previously described figures are given the same reference numbers. The eighth embodiment of the present invention is a modification of the seventh embodiment of the present invention, taking into account information concerning the atmospheric pressure. For example, it is determined whether or not the diagnosing process should be carried out on the basis of the atmospheric pressure detected by an atmospheric pressure detecting means. Alternatively, the atmospheric pressure detected by the atmospheric detecting means is used to control the leakage decision value used to determine whether or not a failure has occurred in the evaporative fuel purge system.

Referring to FIG. 81, a control unit M40 inputs information indicating the actual atmospheric pressure detected by the atmospheric pressure detecting unit M25, and controls the predetermined leakage decision value to be compared, in a decision making unit M8G, with the pressure in the evaporative fuel purge system indicated by the block depicted by the broken line on the basis of the detected atmospheric pressure. Alternatively, the control unit M40 corrects the pressure level detected by the pressure detecting unit M6 on the basis of the detected atmospheric pressure. Further, the control unit M40 inhibits the decision making unit M8G from making the decision when the detected atmospheric pressure. Hence, it is possible to accurately diagnosis the evaporative fuel purge system.

Figure 82:
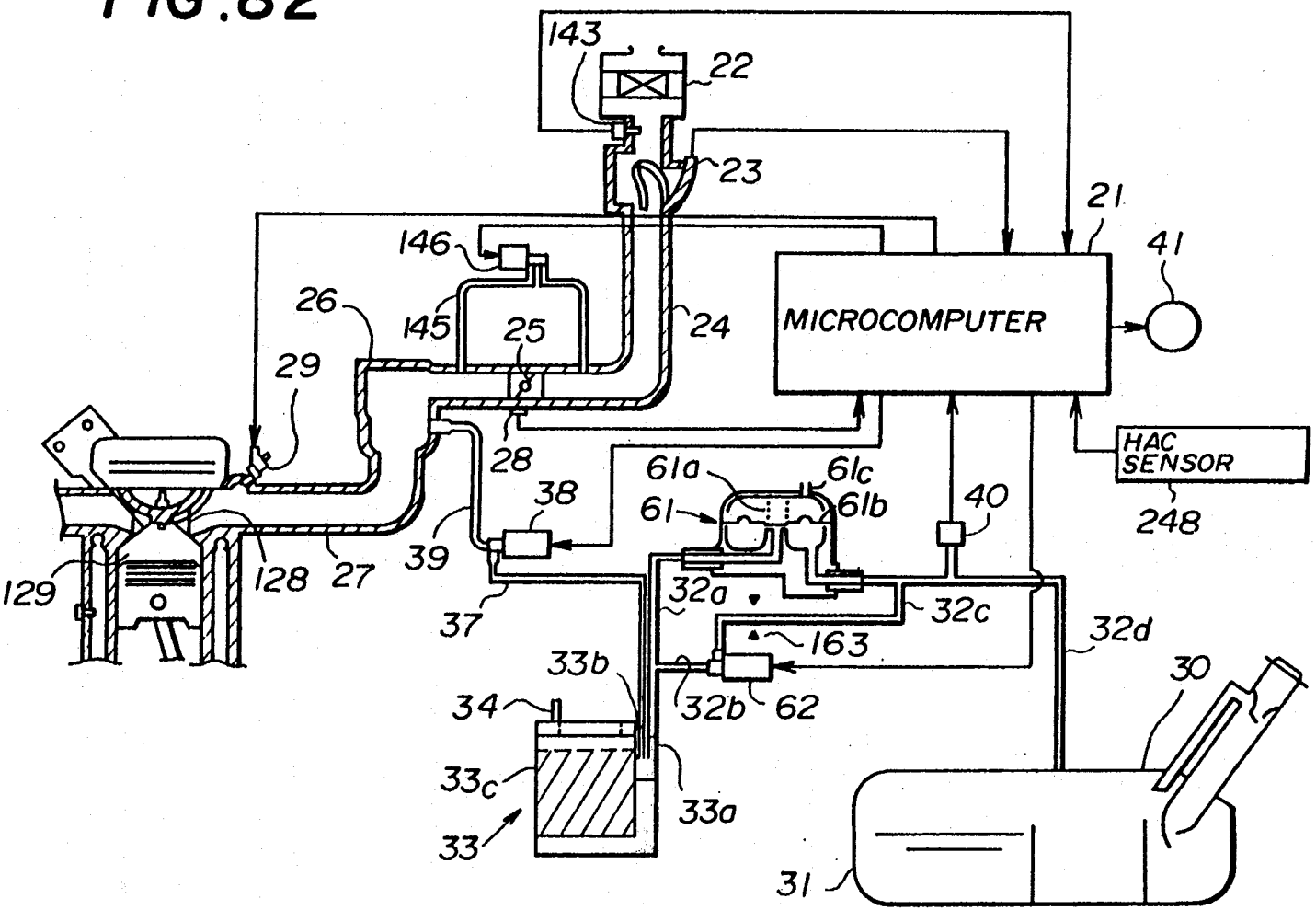
FIG. 82 is a diagram of the system structure of the eighth embodiment of the present invention.

FIG. 82 shows the system structure of the eighth embodiment of the present invention. In FIG. 83, parts that are the same as parts shown in the previously described figures are given the same reference numbers. An atmospheric pressure sensor 111 of an attitude compensation type is connected to the microcomputer 21. This type of the sensor 111 generates a detection signal indicative of the atmospheric pressure (absolute pressure). FIG. 83 shows the hardware structure of the eighth embodiment of the present invention.

Figure 84:
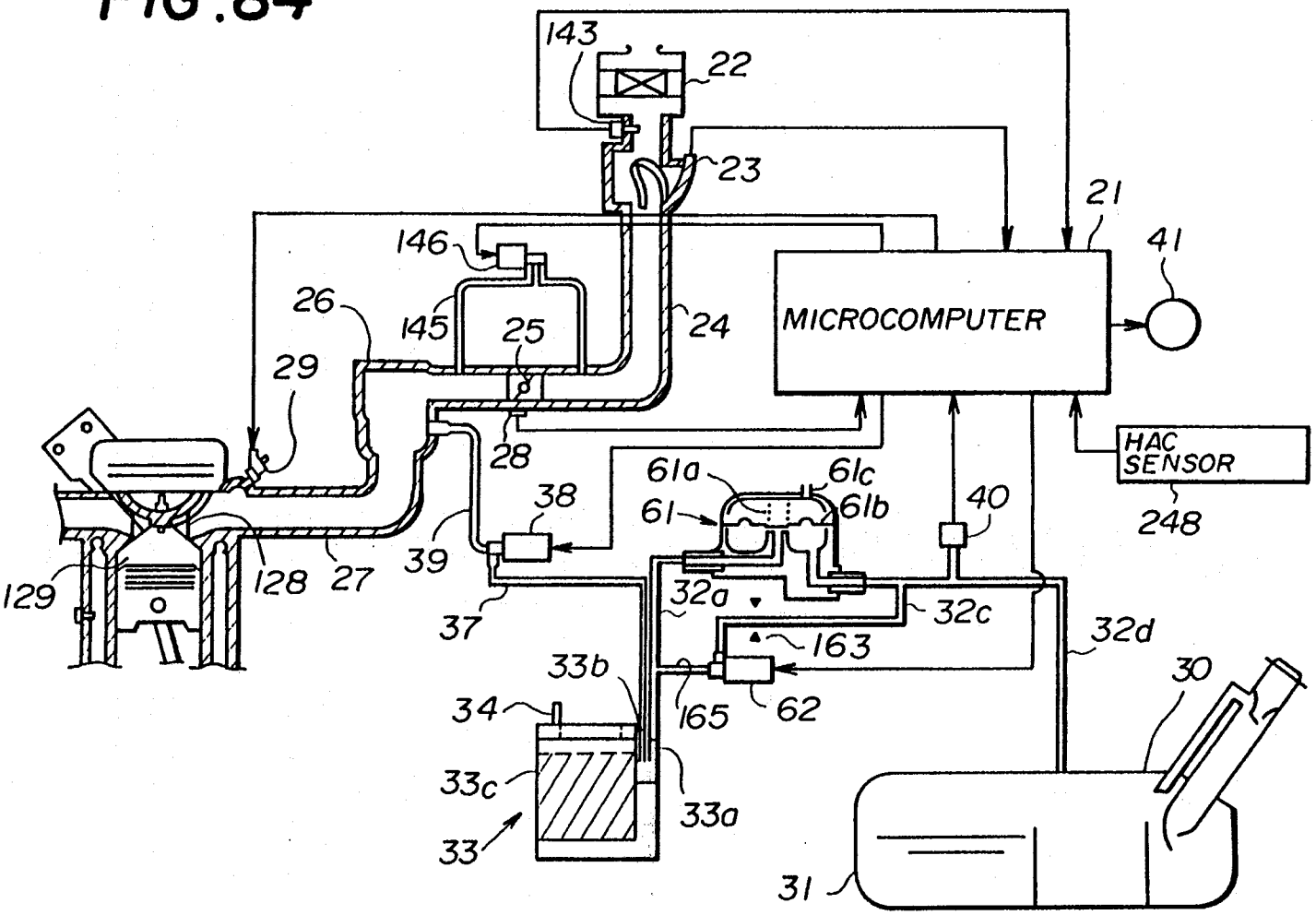
FIG. 84 is a block diagram of a variation of the eighth embodiment of the present invention.

FIG. 84 shows a variation of the eighth embodiment of the present invention. In FIG. 84, parts that are the same as parts shown in the previously described figures are given the same reference numbers. The system structure shown in FIG. 84 is the same as that shown in FIG. 73 except for the atmospheric pressure sensor 248.

Figure 85:
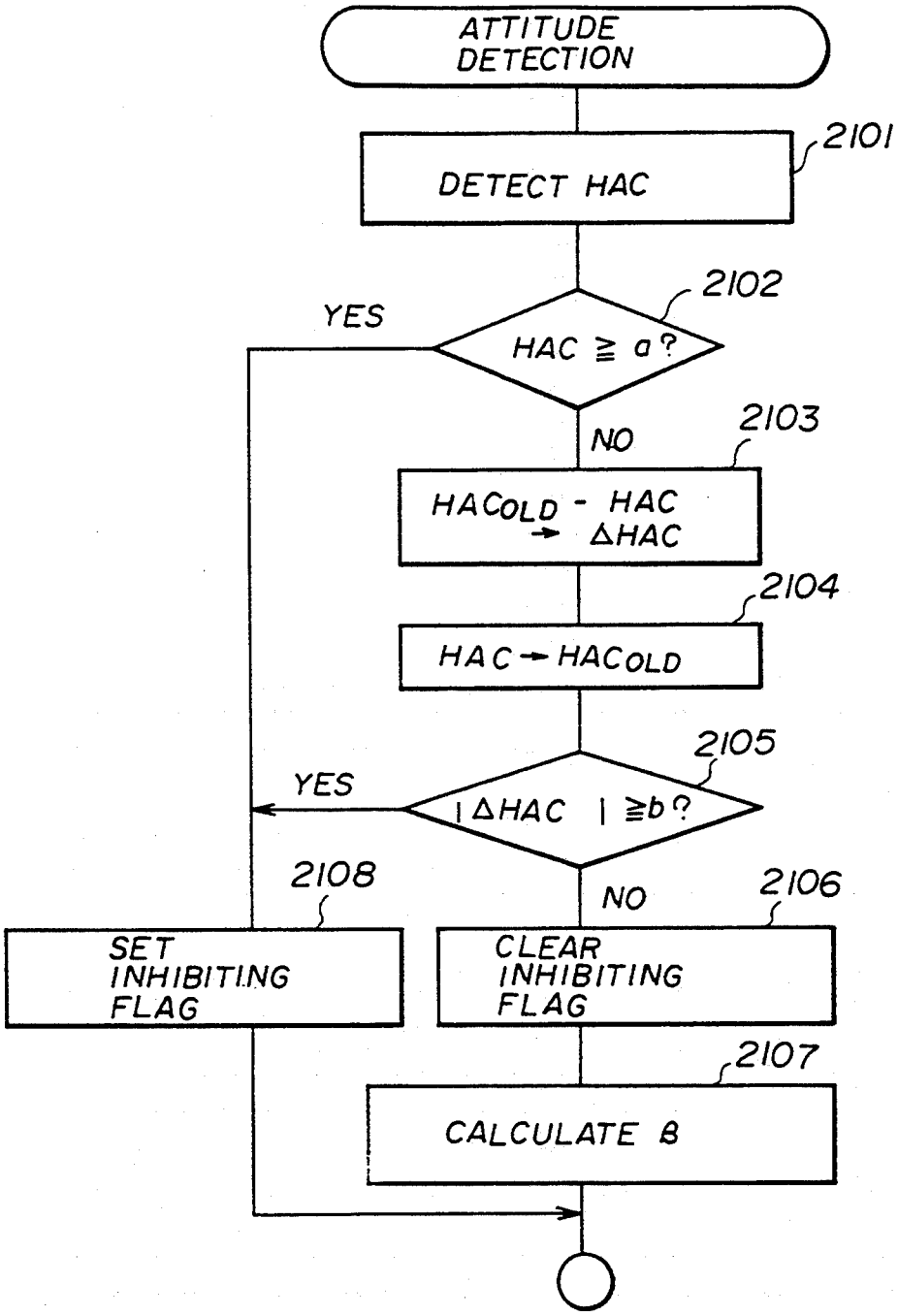

A description will now be given of a diagnosing process according to the eighth embodiment of the present invention. The diagnosing process includes a high attitude detection routine shown in FIG. 85, and a leakage detection routine shown in FIG. 86. The routine shown in FIG. 85 is executed, for example, every one second. In step 2101, the CPU 50 calculates the current attitude of the vehicle from the detection signal of the atmospheric pressure sensor 248, and stores it into the RAM 52. A pressure of 1 atmospheric pressure is shut in the atmospheric pressure sensor 248, and a variation in the atmospheric pressure can be observed by referring to the difference between the current atmospheric pressure and 1 atmospheric pressure. Hence, the attitude can be inferred from variation in the atmospheric pressure.

In step 2102, the CPU 50 determines whether or not the current attitude obtained in step 2101 is higher than a predetermined value a. When the result of step 2101 is YES, the negative pressure in the intake air pipe 24 is equal to or less than a predetermined leakage decision value, and the maximum negative pressure applied to the fuel tank 30 is toe, small to diagnosis the evaporative fuel purge system with high reliability. In this case, the CPU 50 sets a high-attitude operation inhibiting flag to "1" in step 2108, and ends execution of the routine shown in FIG. 85. When it is determined, in step, 2102, that the current attitude is less than the predetermined leakage decision value a, the CPU 50 decides that an enough negative pressure to diagnosis the evaporative fuel purge system can be obtained, and executes step 2103. In this step, the CPU 50 subtracts the output value $HAC_{OLD}$ of the atmospheric pressure sensor 248 (the previous attitude) obtained by the immediately prior execution of the routine from the current output value HAC thereof (the current attitude). The difference indicates a variation in the attitude (variation in the atmospheric pressure) delta-HAC.

The CPU 50 writes the current attitude HAC into the parameter $HAC_{OLD}$ in step 2104, and determines, in subsequent step 2105, whether or not the absolute value of the attitude variation delta-HAC is equal to or greater than a predetermined leakage decision value b. When the result of step 2105 is YES, the CPU 50 executes step 2108 for the same reason as described above. When the result of step 2105 is NO, the CPU 50 decides that the variation in the negative pressure is stable and the reliable diagnosis process can be performed, and clears the high-attitude operation inhibiting flag in step 2106. In subsequent step 2107, the CPU 50 accesses a table defining a characteristic as shown in FIG. 87 with the calculated attitude (atmospheric pressure) HAC, so that a corresponding leakage decision value $\beta$ can be obtained.

Figure 87:
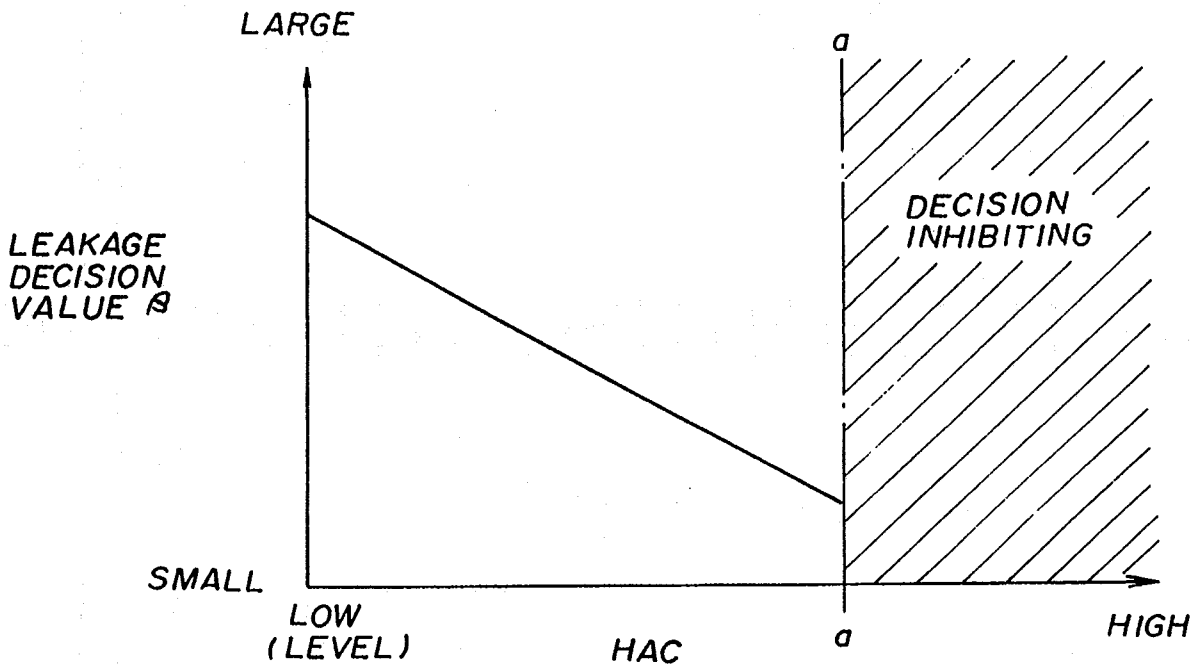
FIG. 87 is a graph showing the relationship between the leakage decision value and the attitude used in the eighth embodiment of the present invention.

As shown in FIG. 87, the negative in-tank pressure decreases and the maximum negative pressure applied to the fuel tank 30 decreases as the attitude HAC increases (in other words, the atmospheric pressure decreases). Hence, the leakage decision value $\beta$ decreases as the attitude HAC increases. When it is determined, in step 2101, that the attitude HAC is equal to or higher than a, the leakage decision value 62 is not calculated.

A description will now be given of the leakage decision process with reference to FIG. 86. In step 2201, the CPU 50 determines whether or not the operation flag is equal to "1". When the result of step 2201 is NO, the CPU 50 determines, in step 2202, whether or not the high-attitude operation inhibiting flag is equal to "1". This flag is set to "1" only by step 2108 shown in FIG. 85, and is cleared only by step 2106. When the high-attitude operation inhibiting flag is equal to "1" the CPU 50 determines, in step 2203, whether or not the negative-pressure introduction flag is equal to "1". Since this flag is cleared by the initial routine executed when the engine is started, the result of step 2204 is NO when the routine is executed for the first time after the engine is started.

The CPU 50 calculates the purged flow rate in step 2204, and determines, in step 2205, whether or not the purged flow rate is equal to or higher than a predetermined leakage decision level Y. The purged flow rate can be obtained in the aforementioned manner. When the result of step 2205 is NO, the CPU 50 decides that an enough purged flow rate to detect whether or not leakage has occurred in the evaporative fuel purge system, and closes the purge control valve 38 and the in-tank pressure switching valve 62. When the result of step 2205 is YES, the CPU 50 closes the purge control valve 38 and the in-tank pressure switching valve 62 in step 2207, and sets the negative-pressure introduction flag to "1" in step 2208.

In step 2209, the CPU 50 adds the predetermined value to the value of the leakage decision timer. In step 2210, the CPU 50 determines whether or not the value of the leakage decision timer is equal to or greater than the predetermined period of time X (seconds). When the result of step 2210 is YES, the CPU 50 ends execution of the routine shown in FIG. 86. When the result of step 2201 is NO, the CPU 50 reads the negative in-tank pressure from the detection signal of the pressure sensor 40 in step 2211. In step 2212, the CPU 50 determines whether or not the in-tank pressure is equal to or higher than the predetermined leakage decision value $\beta$. When the result of step 2212 is YES, the CPU 50 decides that the evaporative fuel purge system is normal, and turns the warning lamp 41 ON in step 2213. Subsequently, the CPU 50 clears the leakage failure code in the backup RAM 53 in step 2214, and executes step 2217. When the result of step 2212 is NO, the CPU 50 turns the warning lamp 41 ON in step 2215, and stores the leakage failure code in the backup RAM 53. The CPU 50 clears the leakage decision timer and the negative-pressure introduction flag in step 2217, and sets the operation flag to "1" in step 2218.

Figure 88:
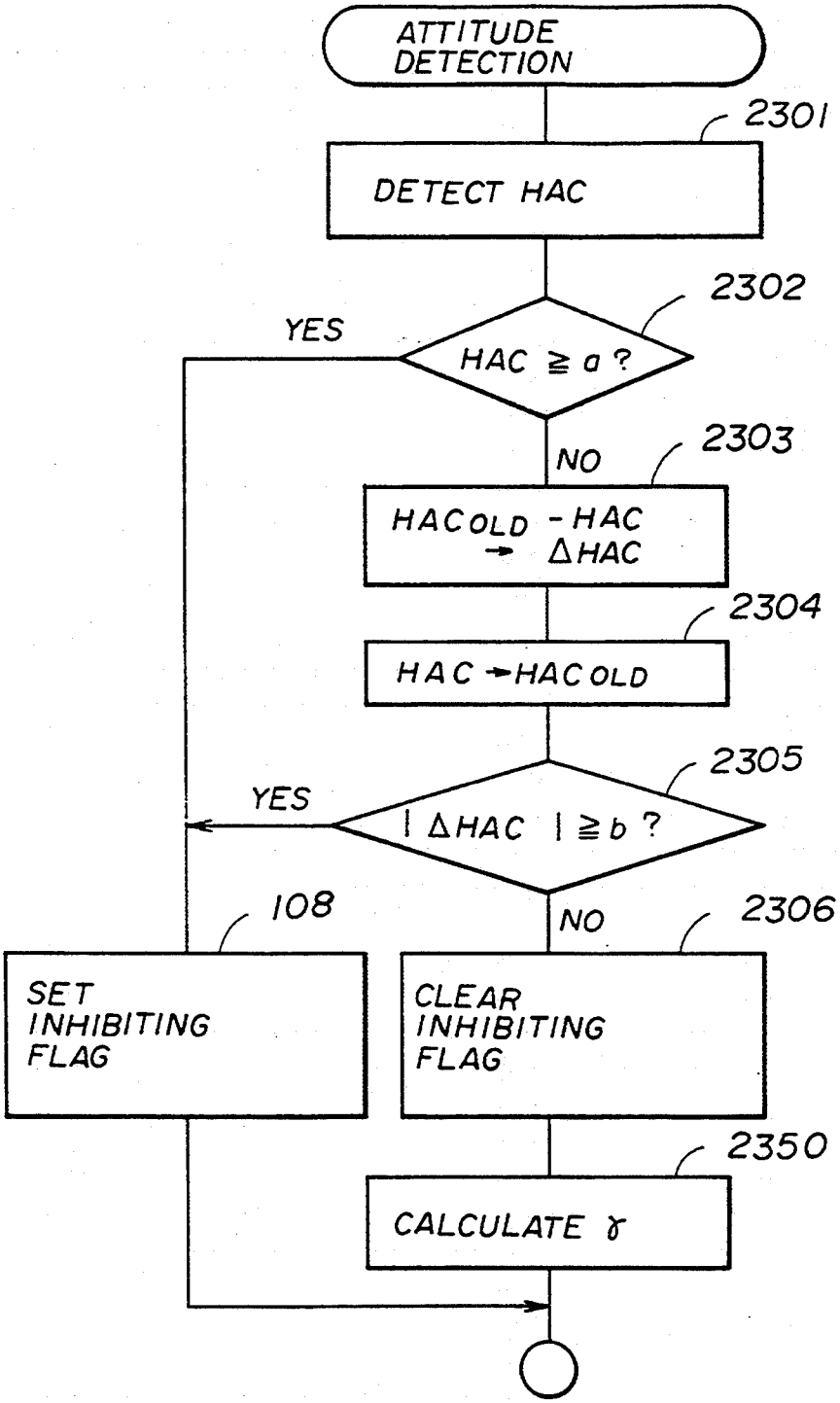
FIG. 88 is a flowchart of a variation of the process shown in FIG. 85.
Figure 89:
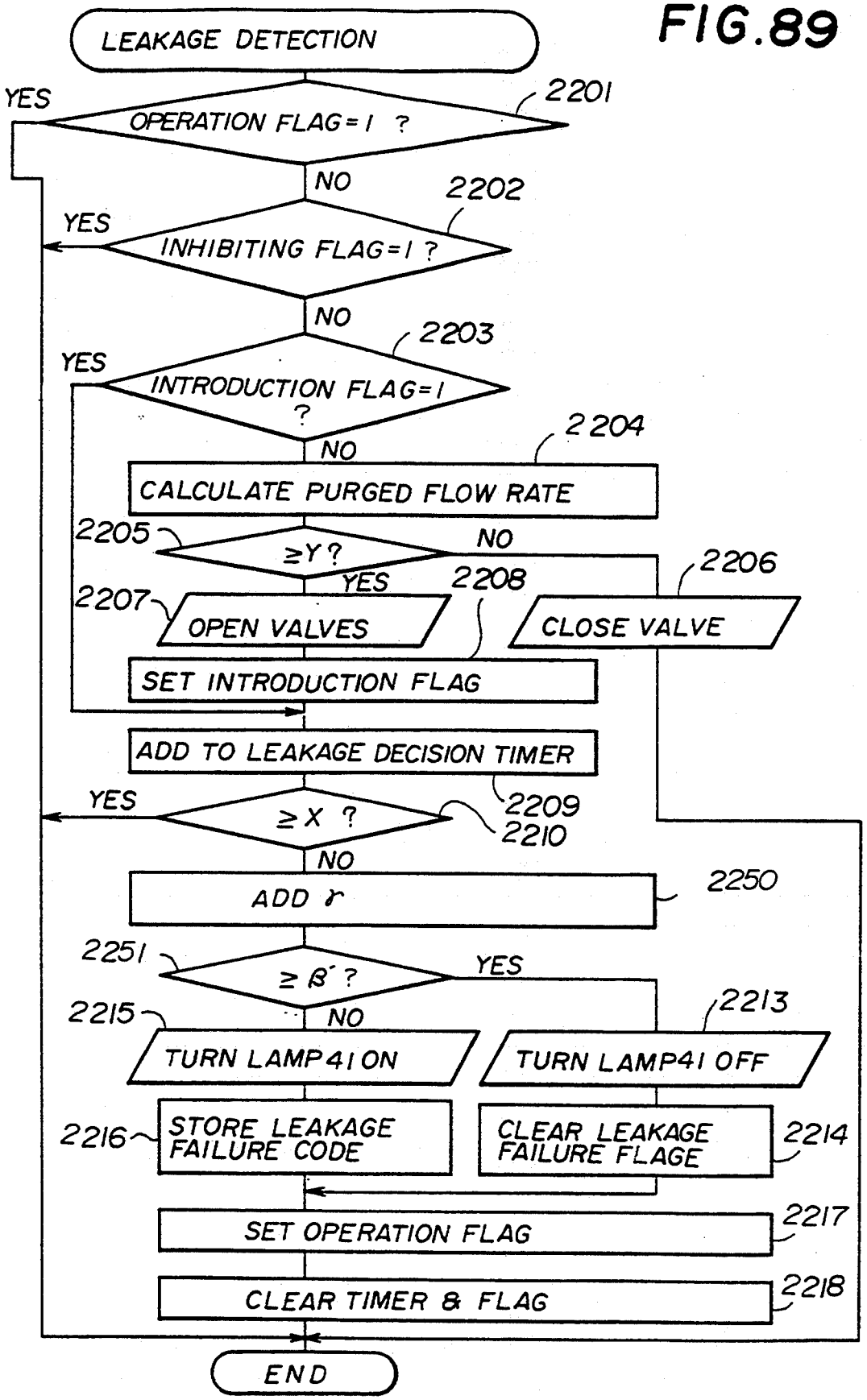
FIG. 89 is a flowchart of a variation of the process shown in FIG. 86.

A variation of the diagnosing routine of the eighth embodiment of the present invention will now be described. The variation includes an attitude detecting routine shown in FIG. 88, and a leakage detecting routine shown in FIG. 89. In FIG. 88, steps that are the same as steps shown in FIG. 85 are given the same reference numbers. In FIG. 89, steps that are the same as steps shown in FIG. 86 are given the same reference numbers.

Figure 90:
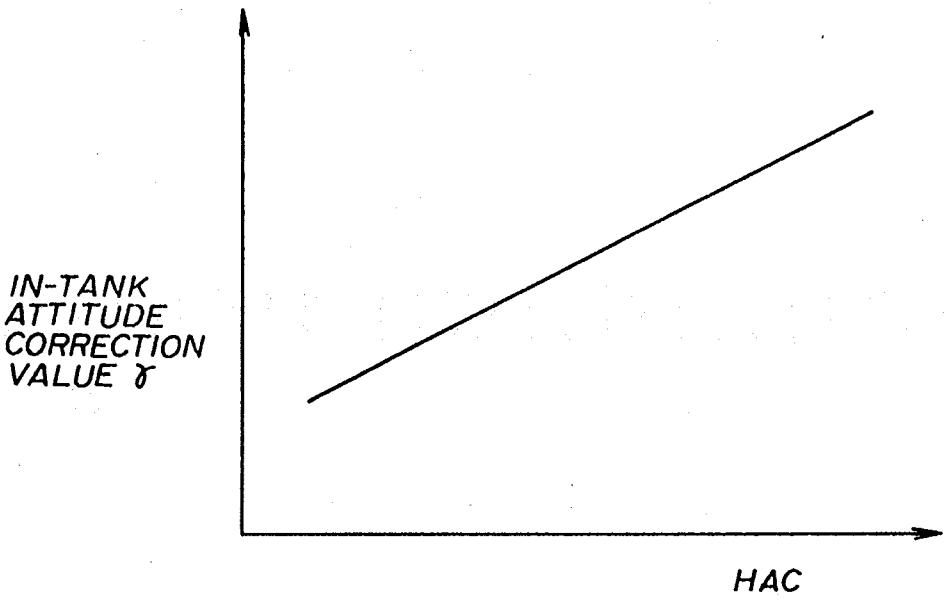
FIG. 90 is a graph showing the relationship between an in-tank pressure attitude correction value and the attitude.

Referring to FIG. 88, after executing step, 2306, the CPU 50 calculates an in-tank pressure attitude correction value $\tau$ by referring to a table describing a characteristic shown in FIG. 90. As shown in FIG. 90, the in-tank pressure correction value $\tau$ increases as the attitude HAC increases.

Referring to FIG. 89, when it is determined, in step 2210, that the time X (seconds) has elapsed after application of the negative pressure is started, the CPU 50 executes step 2250 in which the CPU 50 reads the negative in-tank pressure from the detection signal of the pressure sensor 40, and adds the correction value $\tau$ to the read in-tank pressure. In step 2251, the CPU 50 determines whether or not the corrected in-tank pressure obtained in step 2250 is equal to or higher than a fixed leakage decision value $\beta'$. When it is determined that the negative in-tank pressure is greater than the leakage decision value $\beta'$ (that is, the negative in-tank pressure has a negative pressure higher than the leakage decision value $\beta'$, the CPU 50 executes step 2213. When it is determined the negative in-tank pressure is less than the leakage decision value $\beta'$, the CPU 50 executes step 2215.

A description will now be given of a ninth embodiment of the-present invention. The ninth embodiment of the present invention is intended to eliminate the influence of a tolerable error in the flow rate of the purge control valve 38, loss of pressure caused in the canister 33, and age deterioration.

Figure 91:
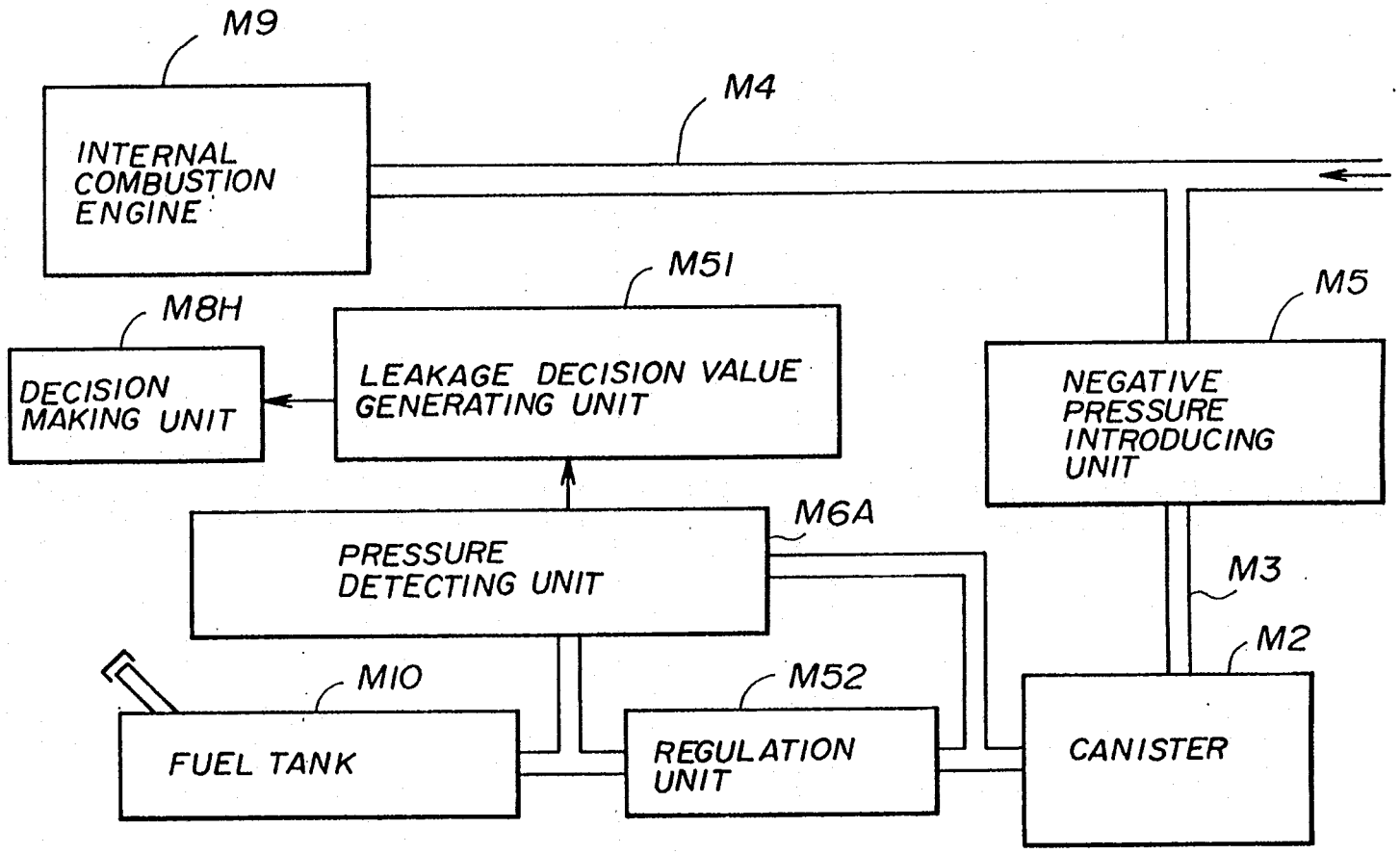
FIG. 91 is a block diagram of an overview of a ninth embodiment of the present invention.
Figure 92:
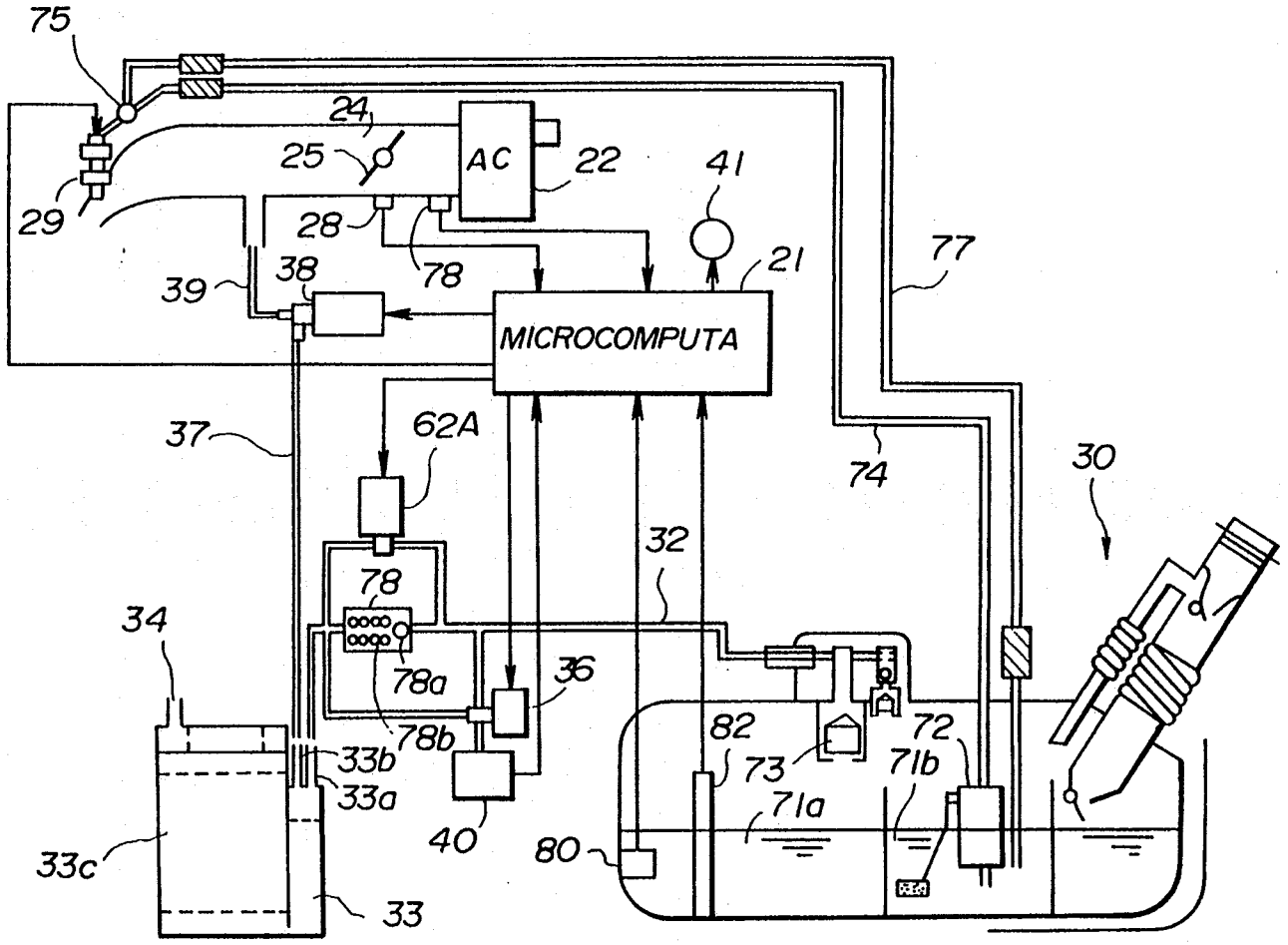
FIG. 92 is a diagram of the system structure of the ninth embodiment of the present invention.

FIG. 91 is a diagram showing an overview the ninth embodiment of the present invention. In FIG. 91, parts that are the same as parts shown in the previously described figures are given the same reference numbers. A regulation unit M52 regulates the vapor passage M1 between the fuel tank M10 and the canister M2. A pressure detecting unit M6A detects the pressure in a system between the fuel tank M10 and the regulation unit M52, and the pressure in a system between the regulation unit M52 and the canister M2. A leakage decision value generating unit M51 generates a leakage decision value of pressure used to determine whether or not a failure has occurred in the evaporative fuel purge system on the basis of the pressure in the system between the regulation unit M52 and the canister M2 in the state the regulation unit M52 disconnects the fuel tank M10 from the canister FIG. 92 shows the system structure of the ninth embodiment of the present invention. In FIG. 92, parts that are the same as parts shown in the previously described figures are given the same reference numbers. A three-directional valve 346 connects the vapor passage on the side of the fuel tank 30 to the pressure sensor 40 when it is turned ON under control of the microcomputer 21, and connects the vapor passage on the side of the canister 33 to the pressure sensor 40 when it is turned OFF. The pressure sensor. 40 is a deformation gate, which detects a deformation of a silicon wafer by means of a bridge circuit, and measures the difference between the pressure in the vapor passage and the atmospheric pressure.

Figure 93:
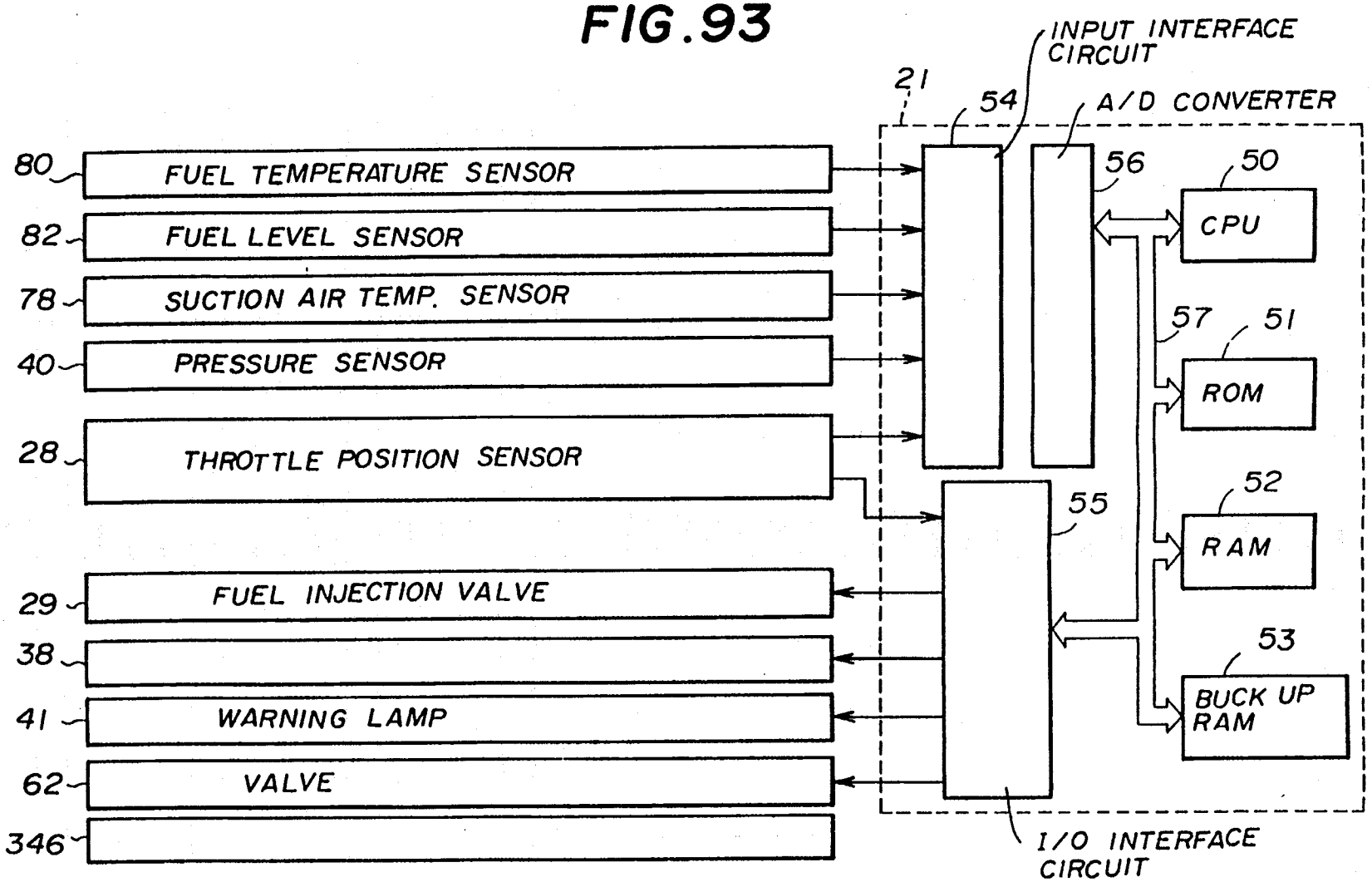
FIG. 93 is a block diagram of the hardware structure of the ninth embodiment of the present invention.

FIG. 93 shows the hardware structure of the ninth embodiment of the present invention. In Fig, 93, parts that are the same as parts shown in the previously described figures are given the same reference numbers.

When the engine is started by turning the starter switch 43 ON, fuel in the sub tank **71*b* of the fuel tank 30 is fed to the pressure regulator 75 via the pipe 74. The pressure regulator 75 regulates the pressure of the fuel at a fixed level, and supplies the regulated fuel to the fuel injection valve 29, which injects the fuel into the intake pipe 24 for a fuel injection time specified by the microcomputer 21. Fuel which is not used is fed back to the sub tank 71*b* via the fuel returning pipe 77**.

Fuel vapor occurring in the fuel tank 30 passes through the vapor passage 32 and reaches the valve 78 since the bypass control valve 78 is opened. When the pressure in the fuel tank 30 is less than the set pressure (250 mmAq, for example) of the valve 78, the check ball **78*a* is located at the position shown in FIG. 13 due to the function of the spring 78*b*, so that the vapor passage 32 is disconnected from the canister 33. Hence, the fuel vapor cannot be transferred to the canister 33**.

For example, when the engine is started in the cold state thereof, the in-tank pressure is approximately equal to the atmospheric pressure, and the volume of fuel decreases due to a fuel injection carried out immediately after the engine is started. Hence, the in-tank pressure decreases and becomes a negative pressure. Thereafter, the temperature of the engine gradually increases and the quantity of fuel vapor increases. Hence, the in-tank pressure increases towards the positive-pressure area, and becomes equal to the set pressure by the valve 78.

When the in-tank pressure becomes equal to or higher than the set pressure, the check ball **78*a* in the valve 78 is moved against the spring force of the spring 78*b*. Hence, the fuel vapor from the fuel tank 30 is allowed to pass through the valve 78 and reach the canister 33. The fuel vapor adheres to the active carbon 33*c*, in the canister 33. When the fuel vapor leaves the canister 33, the in-tank pressure decreases. When the in-tank pressure becomes equal to or lower than the set pressure by the valve 78*a*, the valve 78** is closed again.

As described above, when there is no fuel leakage in the vapor passage 32 or the fuel tank 30, fuel vapor in the tank 30 passes through the valve 78 and adheres to the active carbon **33*c*, in the canister 33. Immediately after the engine is started, the purge control condition is not satisfied because the purge control valve 38 is closed. The purge control condition defines a condition that makes it possible to minimize deterioration of drivability and exhaust emission even if the air-fuel ratio deviates due to purging. For example, the purge control condition required that 1) the engine coolant temperature is equal to or higher than a predetermined temperature, 2) the quantity of intake air is equal to or greater than a predetermined quantity during a feedback control in which fuel injection is controlled so as to become equal to a target air-fuel ratio, and 3) a fuel cutting operation is not performed. The microcomputer 21** supervises the purge control condition.

When the microcomputer 21 makes a decision that the purge control condition is satisfied, the microcomputer 21 opens the purge control valve 38. Due to the negative pressure in the intake pipe 24, the atmosphere is introduced into the canister 33 via the atmosphere aperture 34 thereof, and the fuel is removed from the active carbon 33c. Then, the fuel vapor is sucked into the intake pipe 24 via the purge passage 37 and the purge control valve 38. The active carbon 33c, in the canister 33 is refreshed due to the removing of the fuel vapor. Hence, the quantity of fuel vapor from the fuel tank 30 gradually increases.

Figure 94:
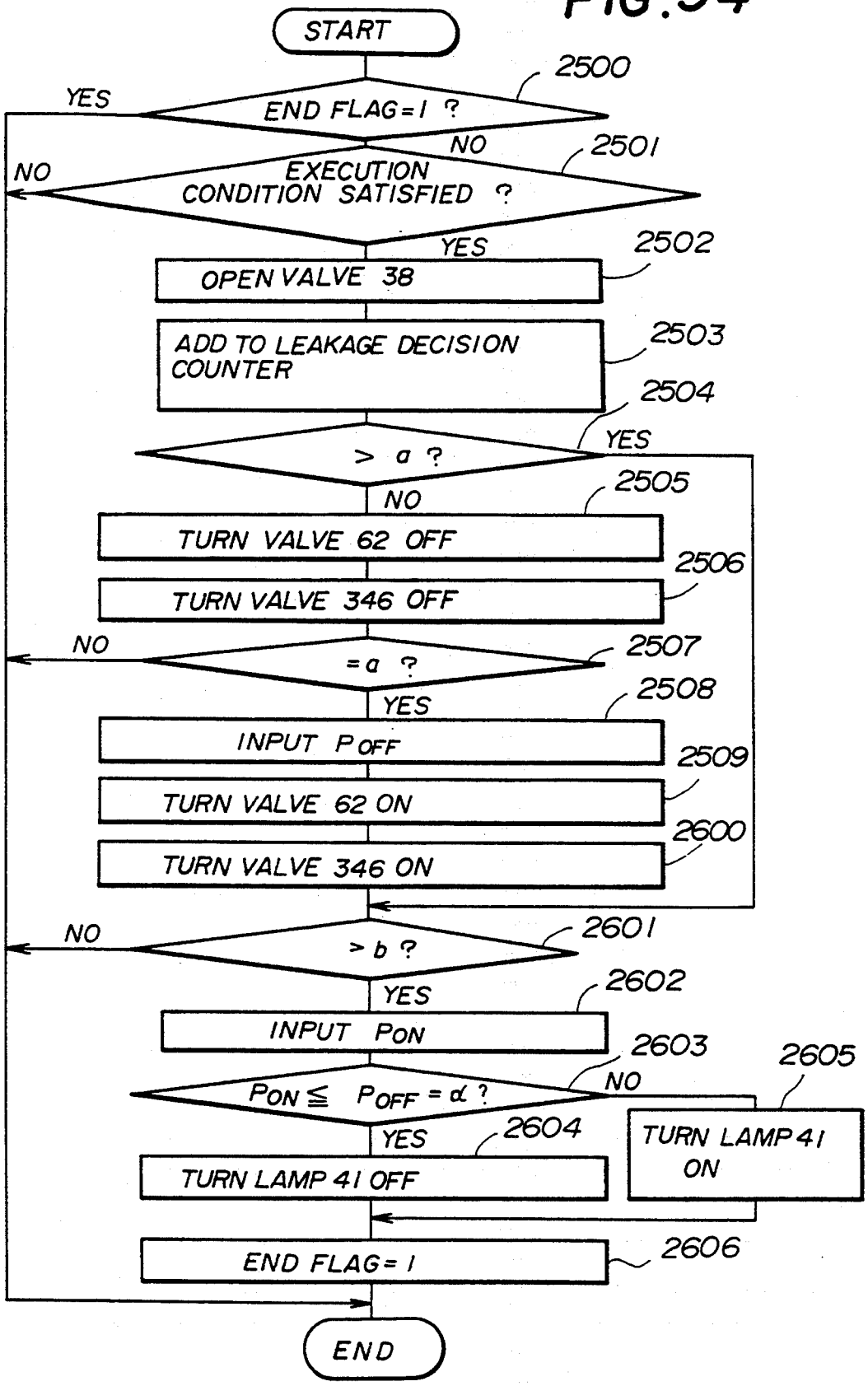
FIG. 94 is a flowchart of the operation of the ninth embodiment of the present invention.

A diagnosing process of the ninth embodiment of the present invention will be described with reference to FIG. 94. In step 2500, the CPU 50 determines whether not the aforementioned diagnosis end flag is equal to "1". When the result of step 2500 is YES, the CPU 50 ends execution of the routine. When the result of step 2500 is NO, the CPU 50 determines whether or not the aforementioned purge control condition is satisfied. When the result of step 2501 is NO, the CPU 50 ends execution of the routine. When the result of step 2501 is YES, the CPU 50 opens the purge control valve 38 in step 2502, and adds a predetermined counter value (equal to, for example, 1) to the leakage decision counter in step 2503. In step 2504, the CPU 50 determines whether or not the value of the decision counter is greater than a predetermined leakage decision period a (seconds). When the counter value is less than the leakage decision period a, the CPU 50 closes the bypass control valve 62 in step 2505, and turns the three-directional valve 346 OFF in step 2506.

In step 2507, the CPU 50 determines whether or not the value of the decision counter is equal to a. The period a corresponds to the time it takes the engine to stably operate. When the result of this step is NO, the CPU 50 ends execution of the routine. When the result of step 2507 is affirmative, the CPU 50 reads the negative purge pressure $P_{OFF}$ from the detection signal of the pressure sensor 40, and turns the bypass control valve 62 ON in step 2509. In subsequent step 2600, the CPU 50 turns the three-directional valve 346 ON. In step 2601, the CPU 50 determines whether or not the counter value of the decision counter is greater than a predetermined counter value b (seconds). The counter value b is used to obtain the time (b−a) necessary for diagnosing. When the result of step 2601 is NO, the CPU 50 ends execution of the routine. When the result of step 2601 is YES, the CPU 50 reads the in-tank pressure $P_{ON}$ from the detection signal of the pressure sensor 40 in step 2602.

In step 2603, the CPU 50 determines whether or not $P_{ON} \leqq (P_{OFF}+\alpha)$ where $(P_{OFF}+\alpha)$ serves as the leakage decision value based on the negative purge pressure measured by means of the purge control valve 38 and the canister 33. That is, the leakage decision value $(P_{OFF}+\alpha)$ includes the influence of the tolerable error in the flow rate of the purge control valve 38, loss of pressure caused in the canister 33, and age deterioration. When the result of step 2603 is NO, the CPU 50 executes step 2605 in which the warning lamp 41 is turned ON. When the result of step 2603 is YES, the CPU 50 executes step 2604 in which the warning lamp 41 is turned OFF. In step 2606, the CPU 50 sets the end flag to "1".

Figure 95:
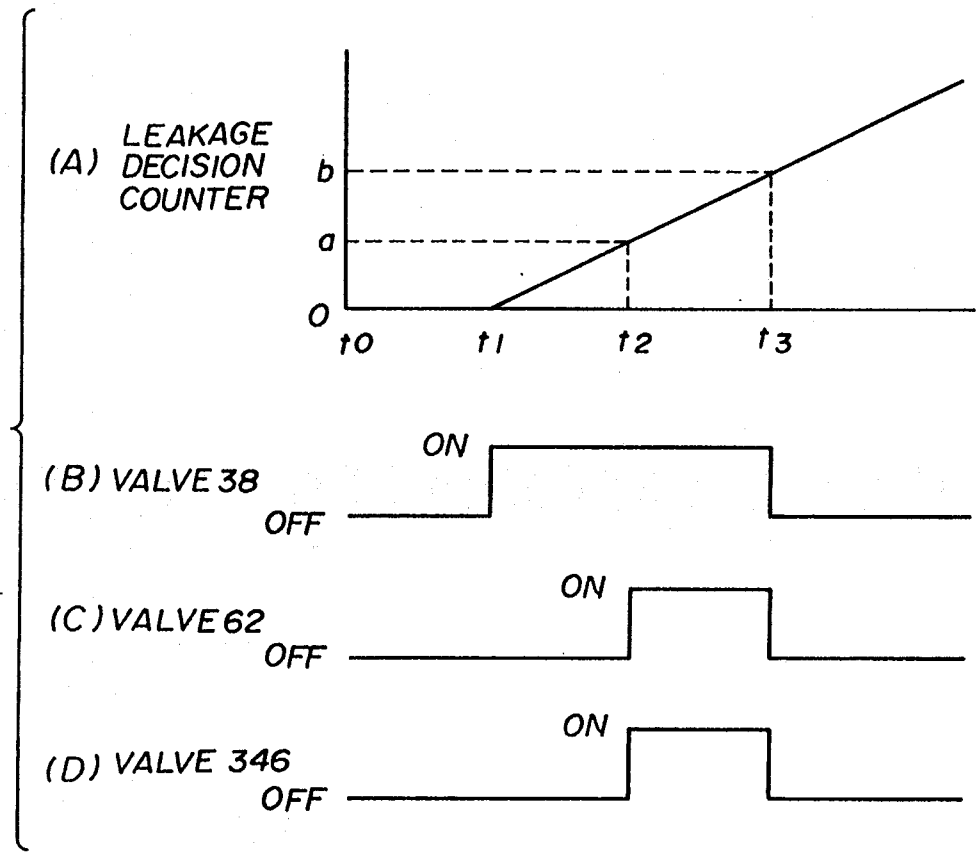
FIG. 95 is a time chart of the operation of the ninth embodiment of the present invention.

FIG. 95 is a timing chart of the diagnosing operation of the ninth embodiment of the present invention. After the engine is started at time $t_0$, and the purge control condition is satisfied, the value of the decision counter increases, as (A) of FIG. 95, and the purge control valve 38 is closed. The bypass control valve 62 and the three-directional valve 346 are kept OFF until the counter value reaches the leakage decision value a. Hence, the pressure sensor 40 is connected to the vapor passage on the side of the canister 33. When the value of the decision counter exceeds the leakage decision value a at time $t_2$, the bypass control valve 62 and the three-directional switching valve 346 are turned ON. Thereby, the pressure sensor 40 is connected to the vapor passage on the side of the fuel tank 30. When the value of the decision counter exceeds the leakage decision value b at time $t_3$, the diagnosis decision is made.

It is possible to multiply the negative purge pressure $P_{OFF}$ by a predetermined coefficient $\beta$ in lieu of addition of the predetermined value a to the negative purge pressure $P_{OFF}$.

Figure 96:
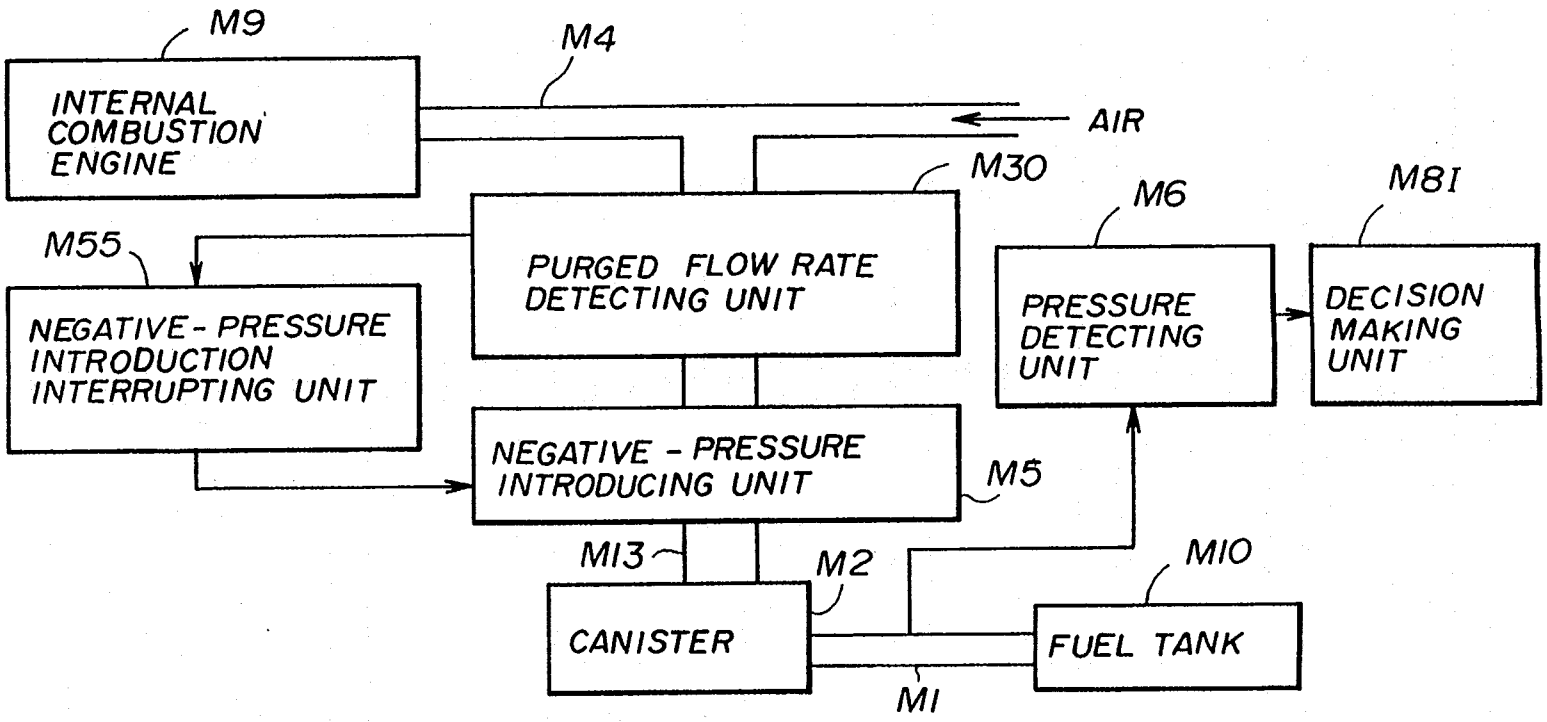
FIG. 96 is a block diagram of an overview of a tenth embodiment of the present invention.

A description will now be given of a tenth embodiment of the present invention. FIG. 96 illustrates an overview of the tenth embodiment of the present invention. In FIG. 96, parts that are the same as parts shown in the previously described figures are given the same reference numbers. A negative-pressure introduction interrupting unit M55 compares the purged flow rate with a predetermined leakage decision value. When the purged flow rate is less than the predetermined leakage decision value, the negative-pressure introduction interrupting unit M55 inhibits the pressure introducing unit M5 from introducing the negative pressure in the intake air passage M4 into the evaporative fuel purge system. The tenth embodiment is capable of preventing an erroneous diagnosis decision resulting from fluctuation in the purge flow rate while the negative pressure in the intake air passage M4 is being applied to the purge system.

The system structure of the tenth embodiment of the present invention is, for example, the same as shown in FIG. 72 or FIG. 73. The hardware structure of the tenth embodiment is, for example, the same as shown in FIG. 65.

Figure 97:
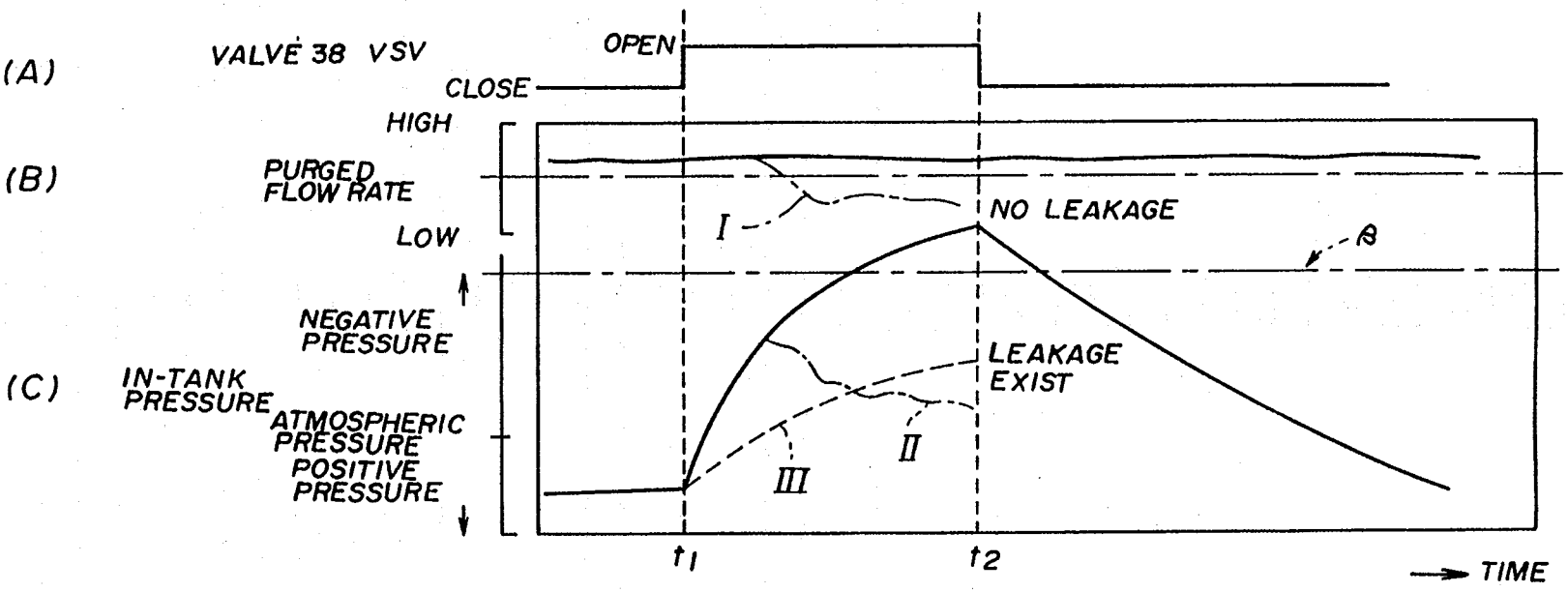
FIG. 97 is a time chart of the operation of the tenth embodiment of the present invention.

FIG. 97 shows the relationship between the purged flow rate and the in-tank pressure. The graph of FIG. 97 is obtained under the condition that the atmosphere aperture 34 is maintained in the open state and the purging by means of the canister 33 is being executed. Under the above condition, FIG. 97-(A) shows the state of the purge control valve 38, FIG. 97-(B) shows a change in the purged flow rate, and FIG. 97-(C) shows a variation in the in-tank pressure in the fuel tank 30. While the purge control valve 38 is maintained in the open state between time $t_1$ and time $t_2$, the negative pressure in the intake air pipe 24 is introduced at a purged flow rate equal to or higher than a given rate as indicated by the solid line in (B) of FIG. 97, a negative pressure caused due to the passage resistance of the canister 33 is applied to the fuel tank 30, and the negative pressure increases from the time $t_1$, as indicated by the solid line in (C) of FIG. 97. Then, the in-tank pressure is settled at the negative pressure based on the passage resistance of the canister 33 (which is a negative value greater than the leakage decision value $\beta$).

However, for an identical passage resistance of the canister 33, the negative in-tank pressure varies as indicated by one-dot chained line II in (C) of FIG. 97, as the purged flow rate changes as indicated by the one-dot chained line I shown in (B) thereof. The maximum negative pressure decreases as the purge flow rate decreases. For an identical purged flow rate, provided that there is a leakage area in the purge system, the maximum in-tank pressure assumes a value closer to the atmospheric pressure than the leakage decision value $\beta$, as indicated by the broken line II in (C) of FIG. 97. The maximum negative pressure applied to the fuel tank 30 decreases as the size of the leakage area increases. When the leakage area has a size equal to or greater than a size, the in-tank pressure is equal to the atmospheric pressure and does not change.

Hence, even when there is no leakage, the original purged flow rate becomes lower than the rate obtained at the starting time of introduction of the negative pressure as indicated by the one-dot chained line in (B) of FIG. 97, the in-tank pressure does not exceed the leakage decision value $\beta$ as indicated by the two-dot chained line II in (C) of FIG. 97. Hence, the in-tank pressure observed at time $t_2$ cannot be distinguished from an in-tank pressure (indicated by the broken line III in (C) of FIG. 97) observed when there is a leakage area in the system.

With the above in mind, according to the tenth embodiment of the present invention, the negative-pressure introducing period is varied, and the time counting operation is stopped when the purged flow rate becomes lower than the predetermined leakage decision value. The in-tank pressure observed at that time is stored in the RAM 52. When the purge flow rate becomes equal to or higher than a reference purge flow rate and the in-tank pressure recovers to the stored in-tank pressure, the time counting operation is restarted. In this manner, erroneous diagnosis decision making can be prevented.

Figure 98A:
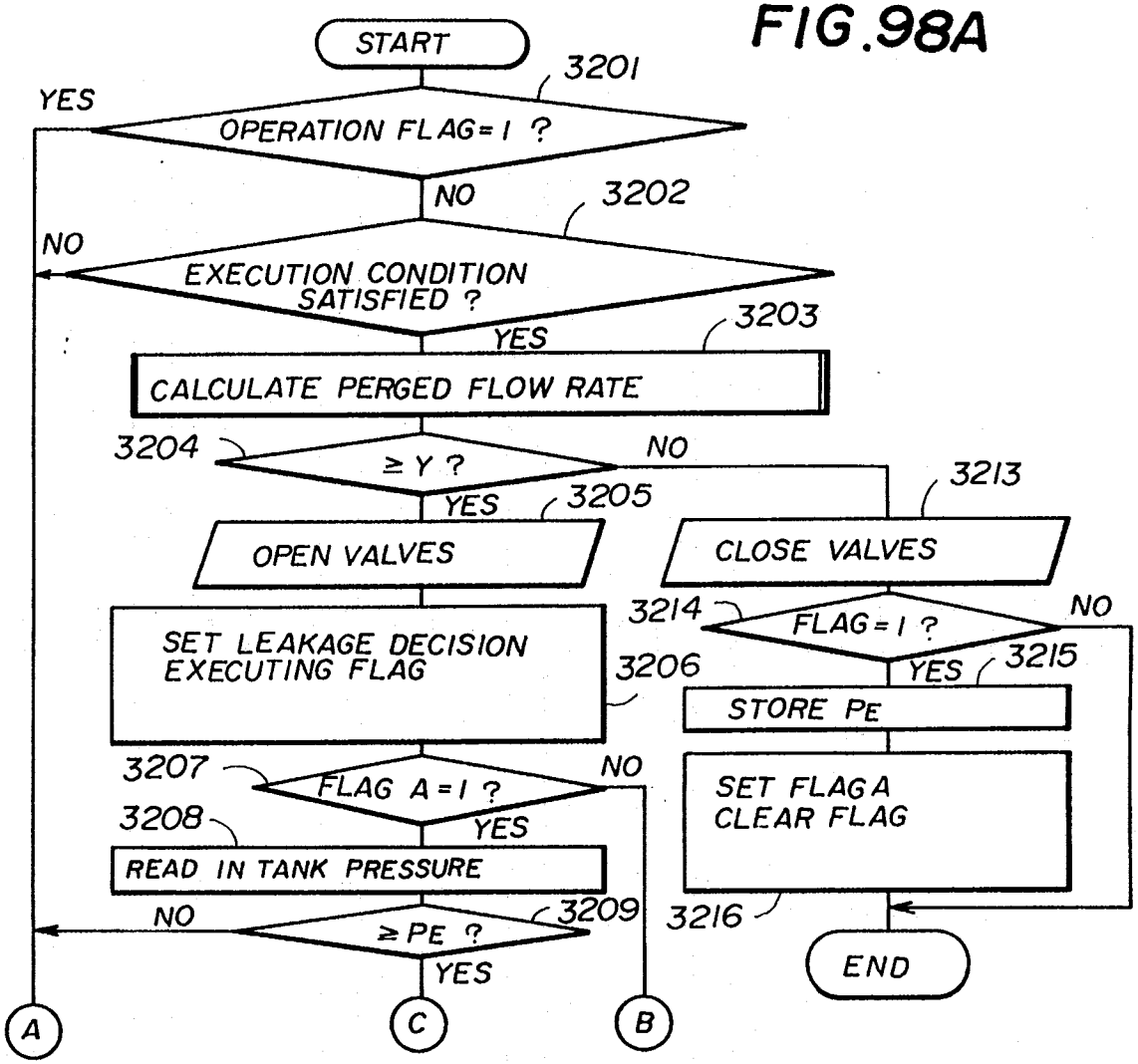
FIGS. 98A and 98B are flowchart of the operation of the tenth embodiment of the present invention.
Figure 98B:
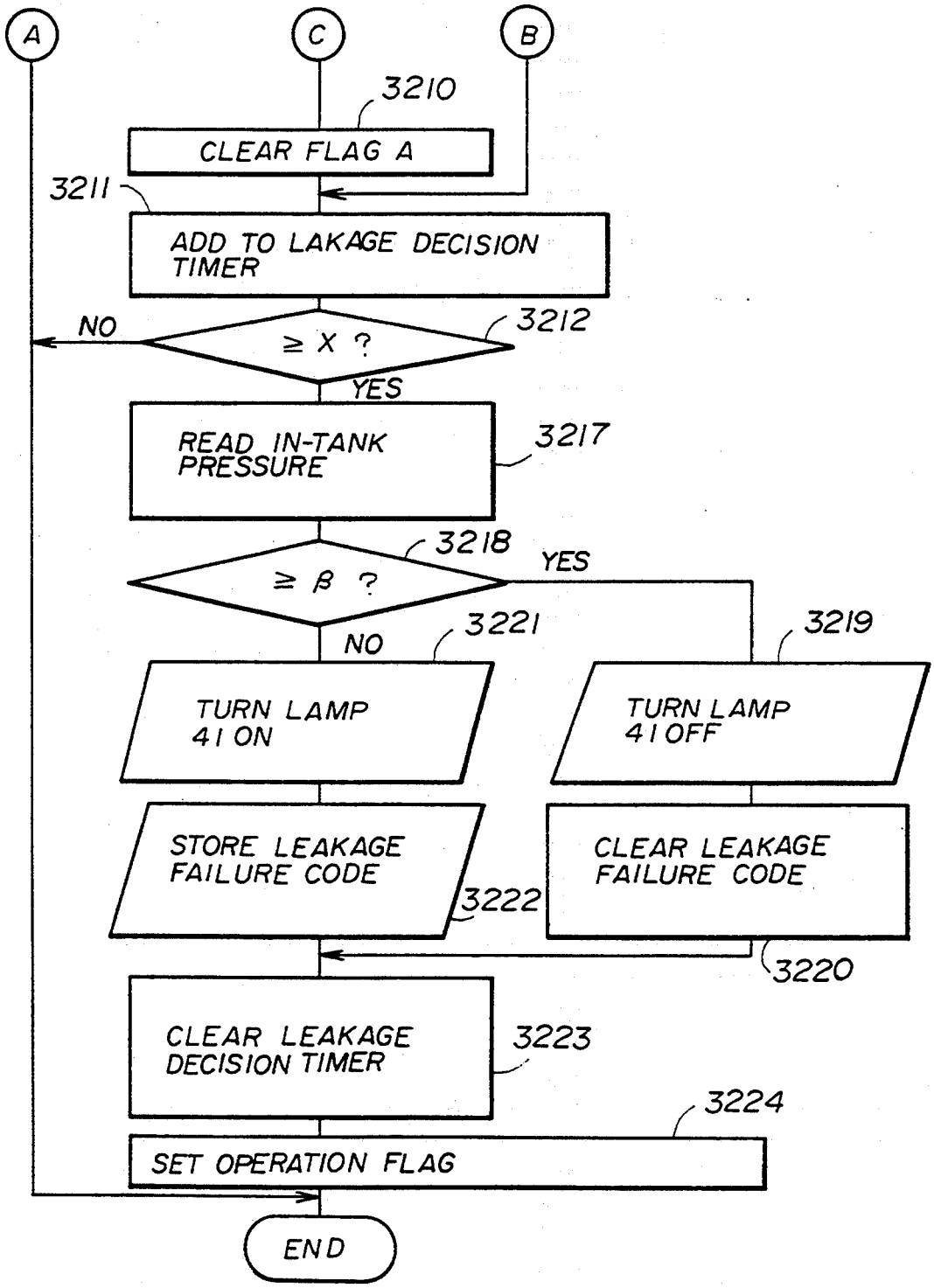

Referring to FIGS. 98A and 98B, the CPU 50 determines whether or not the operation flag is equal to "1" in step 3201. In step 3202, the CPU 50 determines whether or not the diagnosis executing condition is satisfied by, for example, discerning whether or not the purging by means of the canister 33 has been completed. When the result of step 3202 is YES, the CPU 50 obtains the purged flow rate a by the aforementioned rounding process. In step 3204, the CPU 50 determines whether or not the purged flow rate a is equal to or higher than a predetermined threshold value Y making it possible to obtain an in-tank pressure which can be used for diagnosing with the given fixed value $\beta$. When it is determined that $\alpha \geqq Y$, the CPU 50 opens the purge control valve 38 to thereby introduce the negative pressure into the fuel tank 30 via the canister 33. During the diagnosing process, the in-tank switching valve 62 is maintained in the closed state.

After setting the leakage decision executing flag to "1" in step 3206, the CPU 50 determines whether or not flag A is equal to "1" in step 3207. The flag A indicates whether or not the negative-pressure introducing process is paused, and is reset to "0" by the initial routine. When the routine shown in FIGS. 98A and 98B is executed for the first time after the engine is started, the flag A is equal to "0", and the CPU 50 executes step 3211 in which a predetermined value is added to the value of the leakage decision timer. In step 3212, the CPU 50 determines whether or not the value of the leakage decision timer is equal to or greater than a predetermined negative-pressure introducing period X (seconds). When the result of this step is NO, the CPU 50 ends execution of the routine.

When the diagnosis execution condition is satisfied at time $t_1$ and the purged flow rate continues to be equal to or higher than the reference purged flow rate Y until $time_2$ (the period between $t_1$ and $t_2$ is shorter than the X seconds), steps 3201–3212 are repeatedly carried out every 65 msec. Hence the counter value of the leakage decision timer increases by a predetermined value, as shown in (A) of FIG. 99. Further, the purge control valve 38 is opened as shown in (B) of FIG. 99, and the negative in-tank pressure increases as shown in (D) of FIG. 99. Further, the leakage decision executing flag is equal to "1" as shown in (E) of FIG. 99, and the flag A is equal to "0" as shown in (F) of FIG. 99.

Figure 99:
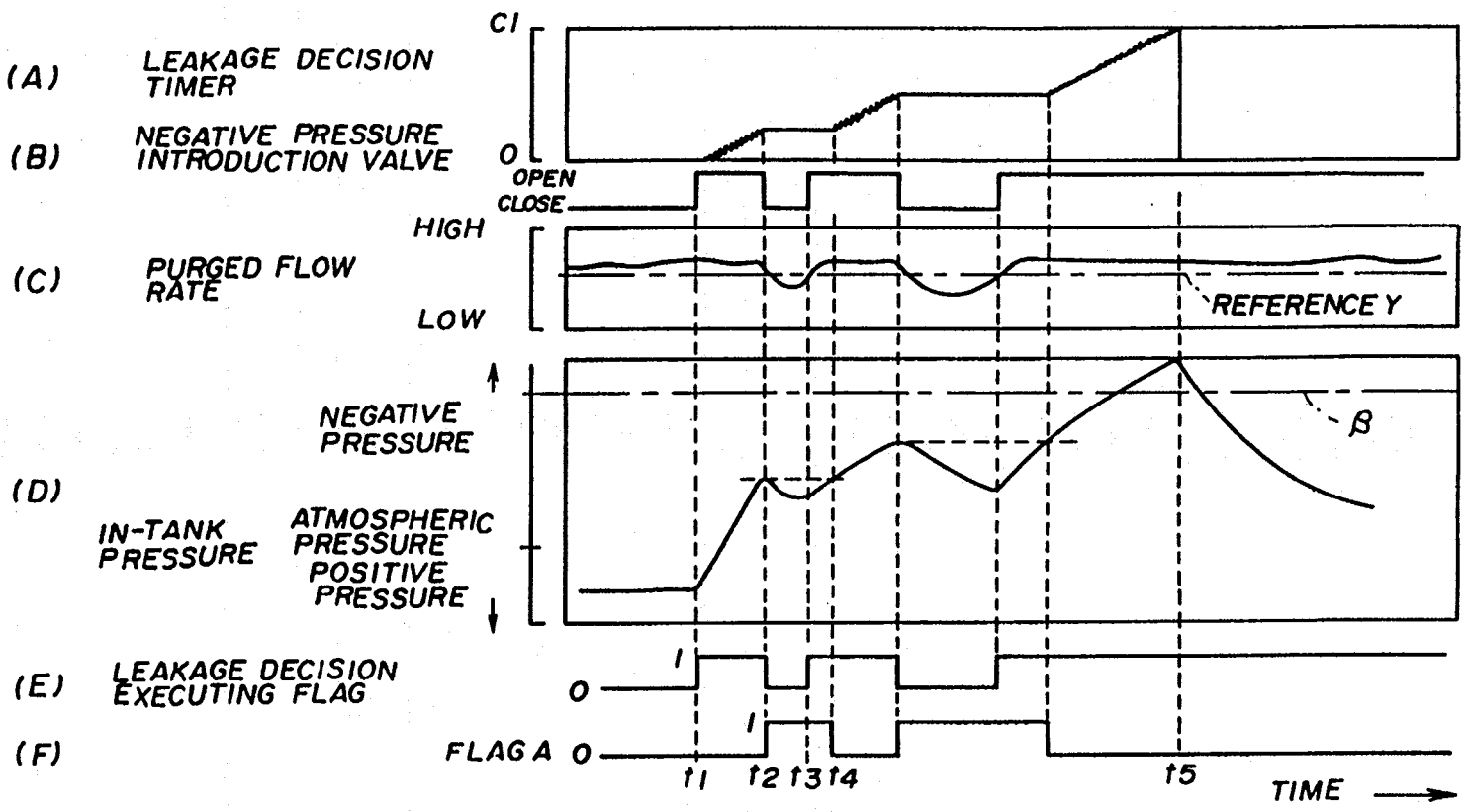
FIG. 99 is a time chart of the operation of the tenth embodiment of the present invention. DESCRIPTION OF THE PREFERRED EMBODIMENTS

If the purged flow rate becomes less than the reference purge flow rate Y at time $t_2$, as shown in (C) of FIG. 99, the CPU 50 executes step 3213 after executing step 3204, and closes the purge control valve 38. Thereby, the introduction of the negative pressure into the fuel tank 30 is stopped, and the negative pressure obtained at that time is shut in the purge system. In step 3214, the CPU 50 determines whether or not the leakage decision flag is equal to "1". When the result of this step is NO, the CPU 50 ends execution of this routine. When the result of step 3214 is YES, the CPU 50 reads, from the output signal of the pressure sensor 40, the in-tank pressure obtained when the introduction of the negative pressure is stopped, and writes into the parameter $P_E$ in step, 3215. In step 3216, the CPU 50 sets the flag A to "1", and clears the leakage decision executing flag.

Thereafter, steps 3201–3204, 3213 and 3214 are repeatedly carried out until the purged flow rate becomes equal to or higher than the reference purge flow rate Y at time $t_3$, as shown in (C) of FIG. 99, and hence the counting operation of the leakage decision timer is not performed. When the purged flow rate becomes equal to or higher than the reference value Y, the CPU 50 restarts to introduce the negative pressure into the fuel tank 50 in step 3205 after executing steps 3201–3204, and decides that the flag A is equal to "1" in step 207 via step 3206. In step 3208, the. CPU 50 reads the in-tank pressure observed at time $t_3$, and determines whether or not the read in-tank pressure is equal to or higher than the in-tank pressure $P_E$ obtained when the introduction of the negative pressure is interrupted in step 3213.

The negative in-tank pressure increases so that it becomes away from the atmospheric pressure after time $t_3$. In most cases, it is determined that the in-tank pressure observed at time $t_3$ is lower than $P_E$, and the CPU 50 ends execution of the routine. When the result of step 3209 is YES, the CPU 50 clears the flag A in step 3210, and adds the predetermined value to the value of the leakage decision timer in step 3211. In step 3212, the CPU 50 determines whether or not the value of the leakage decision timer is equal to or greater than the predetermined X seconds. Hence, the counting operation of the leakage timer is restarted at time $t_4$, as shown in (A) of FIG. 99, and the in-tank pressure increases after time $t_3$ in response to introduction of the negative pressure, as shown in (D) of FIG. 99.

When it is determined, in step 3212, that the value of the leakage decision timer is equal to C1 corresponding to the X seconds, the CPU 50 reads the in-tank pressure in step 3217, and determines, in step 3218, whether or not the in-tank pressure is equal to or greater than the fixed leakage decision value $\beta$. As shown in (D) of FIG. 99, the in-tank pressure is equal to or greater than the fixed value $\beta$ at time $t_5$. In this case, the CPU 50 decides that there is no leakage in the purge system, and turns the warning lamp 41 0N in step 3219, and clears the leakage failure code in the backup RAM 53 in step 3220. When the result of step 3218 is NO, the CPU 50 turns the warning lamp 41 OFF in step 3221, and stores the leakage failure code in the backup RAM 53 in step 3222. The CPU 50 clears the leakage decision timer in step 3223, and sets the operation flag to "1" in step 3224.

It is possible to keep the valve 62 closed and introduce the negative pressure into the vapor passage on the side of the canister 33 rather than applying the negative pressure to the fuel tank 30. In this case, the aforementioned three-directional valve can be used in lieu of the valve 62, as has been previously described.

The present invention is not limited to the specifically disclosed embodiments and variations, and other variations and modifications may be made without departing from the scope of the present invention.

What is claimed is:

1. A diagnostic apparatus for an evaporative fuel purge system having a canister receiving fuel from a fuel tank via a vapor passage, the fuel being supplied to an intake air passage of an internal combustion engine via a purge passage from the canister, said diagnostic apparatus comprising:

pressure detecting means for detecting a pressure in the evaporative fuel purge system, the pressure detecting means including a first means for detecting the pressure in the evaporative fuel purge system in a state in which the fuel tank is coupled to the evaporative fuel purge system, wherein the first means includes a third means for detecting the pressure in the evaporative fuel purge system by detecting an in-tank pressure in the fuel tank in a state in which the fuel tank is disconnected from the canister;

decision making means coupled to said pressure detecting means for determining whether or not a failure has occurred in the evaporative fuel purge system on the basis of a relationship between the pressure detected by said pressure detecting means and a decision value; and correction means coupled to said decision making means for correcting said relationship on the basis of a value of a parameter having an influence on the pressure detected by said pressure detecting means, the correction means including a second means for detecting an amount of fuel vapor in the fuel evaporative purge system, the detected amount of fuel vapor corresponding to said parameter, wherein the second means comprises a fourth means for detecting a temperature of the fuel in the fuel tank, wherein the temperature of the fuel corresponds to the amount of fuel vapor in the fuel evaporative purge system.

2. A diagnostic apparatus for an evaporative fuel purge system having a canister receiving fuel from a fuel tank via a vapor passage, the fuel being supplied to an intake air passage of an internal combustion engine via a purge passage from the canister, said diagnostic apparatus comprising:

pressure detecting means for detecting a pressure in the evaporative fuel purge system, wherein said pressure detecting means comprises first means for detecting the pressure in the evaporative fuel purge system for a predetermined period after a negative pressure in the intake air passage is introduced into the evaporative fuel purge system;

decision making means coupled to said pressure detecting means for determining whether or not a failure has occurred in the evaporative fuel purge system on the basis of a relationship between the pressure detected by said pressure detecting means and a decision value; and correction means coupled to said decision making means for correcting said relationship on the basis of a value of a parameter having an influence on the pressure detected by said pressure detecting means, wherein said correction means comprises second means for detecting a degree of introduction of the negative pressure into the evaporative fuel purge system, wherein the third means comprises a third means for detecting a passage resistance of the canister, corresponding to the degree of introduction of the negative pressure.

3. The diagnostic apparatus as claimed in claim 2, wherein said decision making means comprises fifth means for determining whether or not a variation in the pressure detected by the pressure detecting means is equal to or less than the decision value and for deciding that a failure has occurred in the evaporative fuel purge system when it is determined that the variation in the pressure detected by the pressure detecting means is equal to or less than the decision value.

4. A diagnostic apparatus for an evaporative fuel purge system having a canister receiving fuel from a fuel tank via a vapor passage, the fuel being supplied to an intake air passage of an internal combustion engine via a purge passage from the canister, said diagnostic apparatus comprising:

pressure detecting means for detecting a pressure in the evaporative fuel purge system, the pressure detecting means including a first means for detecting the pressure in the evaporative fuel purge system in a state in which the fuel tank is coupled to the evaporative fuel purge system;

decision making means coupled to said pressure detecting means for determining whether or not a failure has occurred in the evaporative fuel purge system on the basis of a relationship between the pressure detected by said pressure detecting means and a decision value; and control means coupled to the decision making means for inhibiting said decision making means from performing a decision making operation when a parameter having an influence on the pressure detected by said pressure detecting means has a predetermined threshold value, the control means including a second means for detecting an amount of fuel vapor in the fuel evaporative purge system, the detected amount of fuel vapor corresponding to said parameter, wherein the second means comprises a third means for detecting sloshing of the fuel in the fuel tank, wherein the detected sloshing of the fuel corresponds to the amount of fuel vapor in the fuel evaporative purge system.

5. A diagnostic apparatus for an evaporative fuel purge system having a canister receiving fuel from a fuel tank via a vapor passage, the fuel being supplied to an intake air passage of an internal combustion engine via a purge passage from the canister, said diagnostic apparatus comprising:

pressure detecting means for detecting a pressure in the evaporative fuel purge system, wherein said pressure detecting means comprises first means for detecting the pressure in the evaporative fuel purge system for a predetermined period after a negative pressure in the intake air passage is introduced into the evaporative fuel purge system;

decision making means coupled to said pressure detecting means for determining whether or not a failure has occurred in the evaporative fuel purge system on the basis of a relationship between the pressure detected by said pressure detecting means and a decision value; and control means coupled to the decision making means for inhibiting said decision making means from performing a decision making operation when a parameter having an influence on the pressure detected by said pressure detecting means has a predetermined threshold value, said control means including a second means for detecting a degree of introduction of the negative pressure into the evaporative fuel purge system, wherein said second means comprises a third means for detecting a passage resistance of the canister, the passage resistance of the canister corresponding to the degree of introduction of the negative pressure.

6. A diagnostic apparatus for an evaporative fuel purge system having a canister receiving fuel from a fuel tank via a vapor passage, the fuel being supplied to an intake air passage of an internal combustion engine via a purge passage from the canister, said diagnostic apparatus comprising:

pressure detecting means for detecting a pressure in the evaporative fuel purge system, the pressure detecting means including a first means for detecting the pressure in the evaporative fuel purge system in a state in which the fuel tank is coupled to the evaporative fuel purge system, wherein the first means includes a third means for detecting the pressure in the fuel evaporative purge system by detecting an in-tank pressure in the fuel tank in a state in which the fuel tank is disconnected from the canister;

decision making means coupled to said pressure detecting means for determining, when a predetermined diagnosing period has elapsed from a predetermined time, whether a failure has occurred in the evaporative fuel purge system on the basis of a relationship between the pressure detected by said pressure detecting means and a decision value; and correction means coupled to the decision making means for correcting said predetermined diagnosing period on the basis of a value of a parameter having an influence on the pressure detected by said pressure detecting means, said correction, means including a second means for detecting an amount of fuel vapor in the fuel evaporative purge system, the amount of fuel vapor corresponding to said second parameter, wherein said second means includes a fourth means for detecting a temperature of the fuel in the fuel tank, the temperature of the fuel in the fuel tank corresponding to the amount of fuel vapor in the fuel evaporative purge system.

7. A diagnostic apparatus for an evaporative fuel purge system having a canister receiving fuel from a fuel tank via a vapor passage, the fuel being supplied to an intake air passage of an internal combustion engine via a purge passage from the canister, said diagnostic apparatus comprising:

pressure detecting means for detecting a pressure in the evaporative fuel purge system, wherein said pressure detecting means comprises first means for detecting the pressure in the evaporative fuel purge system for a predetermined period after a negative pressure in the intake air passage is introduced into the evaporative fuel purge system;

decision making means coupled to said pressure detecting means for determining, when a predetermined diagnosing period has elapsed from a predetermined time, whether a failure has occurred in the evaporative fuel purge system on the basis of a relationship between the pressure detected by said pressure detecting means and a decision value; and correction means coupled to the decision making means for correcting said predetermined diagnosing period on the basis of a value of a parameter having an influence on the pressure detected by said pressure detecting means, wherein said correction means comprises second means for detecting a degree of introduction of the negative pressure into the evaporative fuel purge system and wherein said second means comprises a third means for detecting a passage resistance of the canister corresponding to the degree of introduction of the negative pressure.

8. The evaporative fuel purge system as claimed in claim 7, wherein said second means comprises third means for detecting a passage resistance of the canister, the passage resistance of the canister corresponding to the degree of introduction of the negative pressure.

9. A diagnostic apparatus for an evaporative fuel purge system having a canister receiving fuel from a fuel tank via a vapor passage, the fuel being supplied to an intake air passage of an internal combustion engine via a purge passage from the canister, said diagnostic apparatus comprising:

pressure detecting means for detecting a pressure in the evaporative fuel purge system, wherein said pressure detecting means comprises first means for detecting the pressure in the evaporative fuel purge system for a predetermined period after a negative pressure in the intake air passage is introduced into the evaporative fuel purge system;

detection making means coupled to make pressure detecting means for determining, when a predetermined diagnosing period has elapsed from a predetermined time, whether a failure has occurred in the evaporation fuel purge system on the basis of a relationship between the pressure detected by said pressure detecting means and a decision value; and correction means coupled to the decision making means for correcting said predetermined diagnosing period on the basis of a value of a parameter having an influence on the pressure detected by said pressure detecting means, wherein said correction means comprises second means for detecting a degree of introduction of the negative pressure into the evaporative fuel purge system, said second means comprising a third means for detecting an atmospheric pressure corresponding to the degree of introduction of the negative pressure and a fourth means for detecting a purged flow rate of fuel passing through the purge passage, the purged flow rate corresponding to the degree of introduction of the negative pressure; and wherein the diagnostic apparatus further comprises control means coupled to said decision making means for inhibiting said decision making means from performing a decision making operation when the purged flow rate of the fuel is equal to or less than a predetermined threshold value.

10. The diagnostic apparatus as claimed in claim 7, wherein said decision making means comprises third means for determining whether or not an increase in the pressure in the evaporative fuel purge system reaches the decision value for said predetermined period after the negative pressure in the intake air passage is introduced into the evaporative fuel purge system and for deciding that a failure has occurred in the evaporative fuel purge system when it is determined that the variation in the pressure does not reach the decision value.

11. The diagnostic apparatus as claimed in claim 6, wherein said decision making means comprises fifth means for determining whether or not a variation in the pressure detected by the pressure detecting means is equal to or less than the decision value and for deciding that a failure has occurred in the evaporative fuel purge system when it is determined that the variation in the pressure detected by the pressure detecting means is equal to or less than the decision value.

* * * * *

UNITED STATES PATENT AND TRADEMARK OFFICE

CERTIFICATE OF CORRECTION

PATENT NO. : 5,425,344

DATED : June 20, 1995

INVENTOR(S) : Takayuki OTSUKA et al.

It is certified that error appears in the above-indentified patent and that said Letters Patent is hereby corrected as shown below:

In the Drawings: Please change Fig. 73 as follows:

FIG. 73

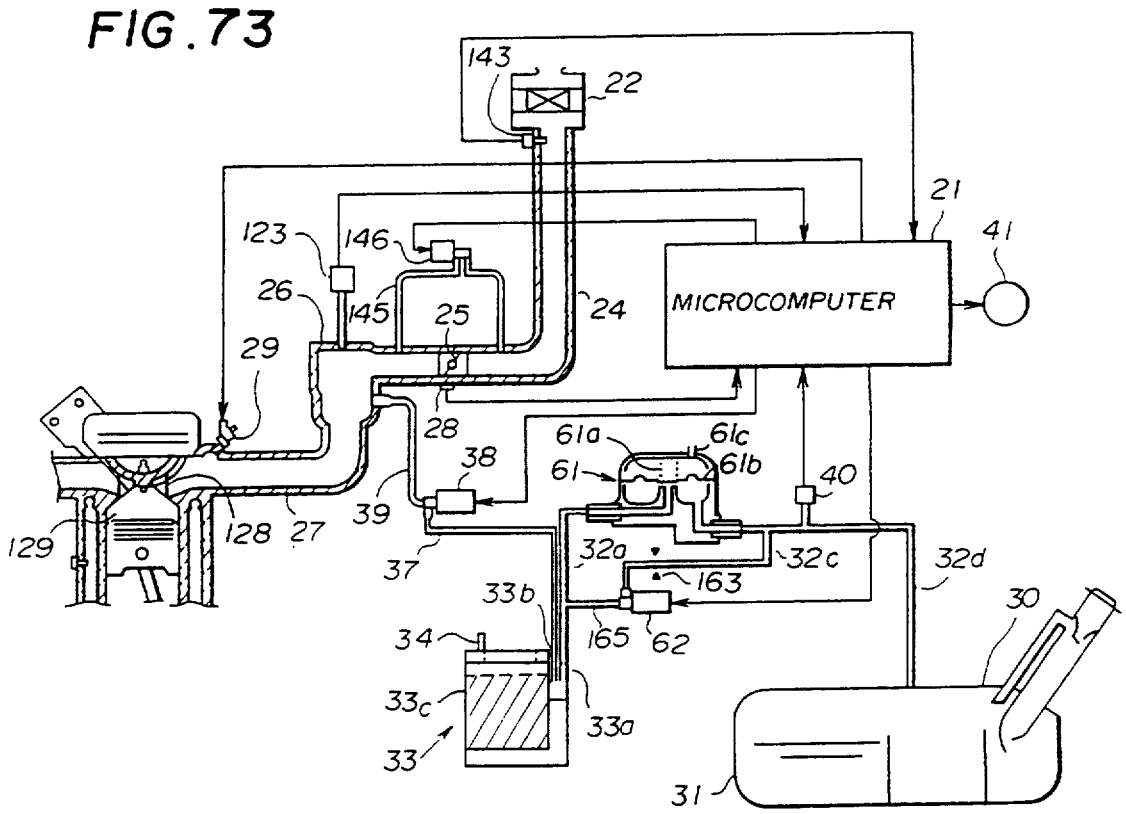

UNITED STATES PATENT AND TRADEMARK OFFICE

CERTIFICATE OF CORRECTION

PATENT NO. : 5,425,344

DATED : June 20, 1995

INVENTOR(S) : Takayuki OTSUKA et al.

It is certified that error appears in the above-indentified patent and that said Letters Patent is hereby corrected as shown below:

| Column | Line | |
|---|---|---|
| 1 | 12 | Change "absorbent" to --adsorbent--. |
| 1 | 20 | Change "absorbent" to --adsorbent--. |
| 1 | 35 | Before "engine" delete ",". |
| 3 | 56 | After "FIG." insert --30;--. |
| 3 | 63 | Change "38" to --36--. |
| 4 | 28 | Change "flowchart" to --flowcharts--. |
| 5 | 52 | Change "flowchart" to --flowcharts--. |
| 5 | 55-56 | After "invention." leave one line and center subheating in column, then leave one further blank line. |
| 6 | 47-48 | Delete "The intake pipe 24, the surge tank 26 and the intake manifold 27". |

UNITED STATES PATENT AND TRADEMARK OFFICE

CERTIFICATE OF CORRECTION

PATENT NO. : 5,425,344

DATED : June 20, 1995

INVENTOR(S) : Takayuki OTSUKA et al.

It is certified that error appears in the above-indentified patent and that said Letters Patent is hereby corrected as shown below:

| Column | Line | |
|---|---|---|
| 6 | 50 | After "angle" delete ",". |
| 6 | 51 | Change "value" to --valve--. |
| 6 | 58 | After "the" delete ",". |
| 6 | 60 | After "canister" insert --33--. |
| 6 | 63 | Change "absorbent" to --adsorbent--. |
| 7 | 5 | Change "value" to --valve--. |
| 7 | 14 | Change "in the halfway of" to --located in--. |
| 8 | 68 | Change "3.8" to --38--. |
| 11 | 47 | Change "performs" to --perform--. |
| 11 | 50 | Before "may" delete "which". |
| 11 | 68 | Change "Vapor" to --vapor--. |
| 12 | 5 | After "21" start new paragraph. |

UNITED STATES PATENT AND TRADEMARK OFFICE

CERTIFICATE OF CORRECTION

PATENT NO. : 5,425,344

DATED June 20, 1995

INVENTOR(S) : Takayuki OTSUKA et al.

It is certified that error appears in the above-indentified patent and that said Letters Patent is hereby corrected as shown below:

| Column | Line | |
|---|---|---|
| 12 | 17 | Change "510" to --50--. |
| 12 | 43 | After "time" change "a" to --α--. |
| 12 | 45 | After "indicated" continue paragraph. |
| 12 | 52 | Change "D" to --β--. |
| 12 | 56 | Change "D" to --β--. |
| 13 | 53 | After "the" (first occurrence) delete "," |
| 15 | 59 | Change "a" to --α--. |
| 16 | 6 | Change "a" to --α--. |
| 16 | 22 | Change "84" to --64--. |
| 16 | 39 | Change "82" to --62--. |
| 16 | 40 | Change "438" to --436--. |

UNITED STATES PATENT AND TRADEMARK OFFICE

CERTIFICATE OF CORRECTION

PATENT NO. : 5,425,344

DATED : June 20, 1995

INVENTOR(S) : Takayuki OTSUKA et al.

It is certified that error appears in the above-indentified patent and that said Letters Patent is hereby corrected as shown below:

| Column | Line | |
|---|---|---|
| 16 | 45 | Change "18" to --16--. |
| 16 | 53 | Change "18" to --16--. |
| 16 | 59 | Change "D" to --β--. |
| 16 | 62 | Change "448" to --446--. |
| 16 | 63 | Change "α D" to --β--. |
| 17 | 11 | After "value" insert --of--. |
| 17 | 21 | Change "1B" to --18--. |
| 17 | 24 | Change "1B" to --18--. |
| 17 | 29 | Change "462" to --460--. |
| 17 | 32 | Change "488" to --466--. |
| 19 | 15 | Delete "by injection decreases". |

UNITED STATES PATENT AND TRADEMARK OFFICE

CERTIFICATE OF CORRECTION

PATENT NO. : 5,425,344

DATED : June 20, 1995

INVENTOR(S) : Takayuki OTSUKA et al.

It is certified that error appears in the above-indentified patent and that said Letters Patent is hereby corrected as shown below:

| Column | Line | |
|---|---|---|
| 19 | 46 | Change "vale" to --valve--. |
| 19 | 49 | After "M10." do not start new paragraph. |
| 20 | 4 | Delete "when". |
| 20 | 62 | Before "lower" insert --or--. |
| 21 | 5 | Before "step" insert --in--. |
| 21 | 28 | Change "When" to --With--. |
| 21 | 30 | Change "580" to --560--. |
| 21 | 31 | Change "580" to --560--." |
| 22 | 7 | After "50" insert --initiates--. |
| 23 | 47 | Change "0N" to --ON--. |
| 23 | 65 | Change "active "1" and" to --active "1",--. |

UNITED STATES PATENT AND TRADEMARK OFFICE

CERTIFICATE OF CORRECTION

PATENT NO. : 5,425,344

DATED : June 20, 1995

INVENTOR(S) : Takayuki OTSUKA et al.

It is certified that error appears in the above-indentified patent and that said Letters Patent is hereby corrected as shown below:

| Column | Line | |
|---|---|---|
| 24 | 43 | Change "3O" to --30--. |
| 25 | 6 | After "tank" insert --30--. |
| 25 | 8 | After "33c" delete ",". |
| 25 | 16 | After "33c" delete ",". |
| 25 | 68 | Change "elapses" to "elapsed". |
| 27 | 2-3 | Delete "because there is somewhat fuel temperature". |
| 27 | 14 | After "determines" insert --whether--. |
| 28 | 6 | Change "depend" to --depends--. |
| 28 | 9 | Change "crease" to --creases--. |
| 28 | 19 | Change "opends" to --opens--. |
| 28 | 62 | Change "operatic, n" to --operation--. |
| 29 | 4 | Change "tan" to --than--. |

UNITED STATES PATENT AND TRADEMARK OFFICE

CERTIFICATE OF CORRECTION

PATENT NO. : 5,425,344

DATED : June 20, 1995

INVENTOR(S) : Takayuki OTSUKA et al.

It is certified that error appears in the above-indentified patent and that said Letters Patent is hereby corrected as shown below:

| Column | Line | |
|---|---|---|
| 30 | 3 | Change "7012" to --702--. |
| 31 | 40 | Change "standing" to --starts--. |
| 32 | 18 | Change "Of step 782" to --of step 762--. |
| 32 | 30 | After "FIG. 44" insert --ends--. |
| 32 | 40 | Change "instep" to --in step--. |
| 35 | 24 | Change "488" to --48B--. |
| 35 | 68 | Change "-1"," to --"1",--. |
| 36 | 14 | Change "inn" to --in--. |
| 37 | 5 | Change "inn" to --in--. |
| 37 | 11 | Change "difference" to --because--. |
| 37 | 40 | Change "2.1" to --21--. |

UNITED STATES PATENT AND TRADEMARK OFFICE

CERTIFICATE OF CORRECTION

PATENT NO. : 5,425,344

DATED : June 20, 1995

INVENTOR(S) : Takayuki OTSUKA et al.

It is certified that error appears in the above-indentified patent and that said Letters Patent is hereby corrected as shown below:

| Column | Line | |
|---|---|---|
| 37 | 48 | Change "5.4A" to --54A--. |
| 38 | 3 | Before "seconds" change "a" to --α--. |
| 38 | 22 | Change "t:he" to --the--. |
| 38 | 45 | Change "released" to --open--. |
| 39 | 11 | After "CPU 50" insert --determines--. |
| 39 | 17 | Change "598" to --59B--. |
| 39 | 50 | Change "80" to --60--. |
| 39 | 61 | Change "$P_o$," to --$P_o$,--. |
| 39 | 65 | Change "81" to --61--. |
| 39 | 67 | Change "81" to --61--. |
| 40 | 2 | Change "81" to --61--. |

UNITED STATES PATENT AND TRADEMARK OFFICE

CERTIFICATE OF CORRECTION

PATENT NO. : 5,425,344

DATED : June 20, 1995

INVENTOR(S) : Takayuki OTSUKA et al.

It is certified that error appears in the above-indentified patent and that said Letters Patent is hereby corrected as shown below:

| Column | Line | |
|---|---|---|
| 40 | 10 | Change "81" to --61--. |
| 40 | 44 | Change "fin" to --in--. |
| 42 | 15 | Change "follows" to --follow--. |
| 42 | 51 | Change "$_{(DR}$-$D_{RN}$)" to --($D_R$-$D_{RN}$)--. |
| 43 | 19 | Change "11.13" to --1113--. |
| 43 | 24 | Change "a" to --$\alpha$--. |
| 44 | 6 | Change "witch" to --with--. |
| 44 | 51 | Before "state" delete ".". |
| 45 | 5 | Change "32*c*" to --32*d*--. |
| 45 | 66 | Change "82" to --62--. |
| 46 | 5 | Change "1208" to --1206--; change "NO" to --YES--. |

UNITED STATES PATENT AND TRADEMARK OFFICE

CERTIFICATE OF CORRECTION

PATENT NO. : 5,425,344

DATED : June 20, 1995

INVENTOR(S) : Takayuki OTSUKA et al.

It is certified that error appears in the above-indentified patent and that said Letters Patent is hereby corrected as shown below:

| Column | Line | |
|---|---|---|
| 46 | 7 | Change "1208" to --1206--. |
| 46 | 8 | Before "obtained" insert --is--. |
| 46 | 10 | Change "78" to --76--. |
| 46 | 12 | Change "78" to --76--. |
| 46 | 24 | After "result" insert --of--. |
| 47 | 5 | After "system" delete ",. |
| 47 | 6 | After "the" delete ",". |
| 48 | 12 | Before "negative" insert --time that--. |
| 48 | 20 | Before "negative" insert --time that--. |
| 48 | 67 | After "atmospheric" insert --pressure--. |
| 49 | 15 | Change "when" to --based on--. |
| 49 | 55 | Change "toe," to --too--. |

UNITED STATES PATENT AND TRADEMARK OFFICE

CERTIFICATE OF CORRECTION

PATENT NO. : 5,425,344

DATED : June 20, 1995

INVENTOR(S) : Takayuki OTSUKA et al.

It is certified that error appears in the above-indentified patent and that said Letters Patent is hereby corrected as shown below:

| Column | Line | |
|---|---|---|
| 49 | 61 | Change "an" to --a--. |
| 49 | 62 | Change "enough" to --sufficient--; change "diagnosis" to --diagnose--. |
| 50 | 26 | Change "is not calculated." to --is not calculated.--. |
| 50 | 47 | Change "an" to --a--. |
| 50 | 48 | Change "enough" to --sufficient--. |
| 50 | 49 | After "system" delete ",". |
| 50 | 52 | Change "closes" to --opens--. |
| 51 | 49 | After "overview" insert --of--. |
| 51 | 63 | Change "in the state" to --in which case--. |

UNITED STATES PATENT AND TRADEMARK OFFICE

CERTIFICATE OF CORRECTION

PATENT NO. : 5,425,344

DATED : June 20, 1995

INVENTOR(S) : Takayuki OTSUKA et al.

It is certified that error appears in the above-indentified patent and that said Letters Patent is hereby corrected as shown below:

| Column | Line | |
|---|---|---|
| 51 | 65 | After "canister" insert --M2--. |
| 54 | 22 | Change "value a" to --value --α --. |
| 55 | 47 | Change "rate a" to --rate α --. |
| 55 | 49 | Change "rate a" to --rate α --. |
| 56 | 51 | Change "becomes away" to --diverges--. |
| 57 | 6 | Change "0N" to --ON--. |
| 60 | 47 | Change "detection" to --decision--; change "make" to --said--. |

Signed and Sealed this

Third Day of September, 1996

*Attest:*

Bruce Lehman

BRUCE LEHMAN

*Attesting Officer*

*Commissioner of Patents and Trademarks*